US009084047B2

(12) United States Patent
O'Polka

(10) Patent No.: US 9,084,047 B2
(45) Date of Patent: Jul. 14, 2015

(54) PORTABLE SOUND SYSTEM

(71) Applicant: Richard O'Polka, Wauwatosa, WI (US)

(72) Inventor: Richard O'Polka, Wauwatosa, WI (US)

( * ) Notice: Subject to any disclaimer, the term of this patent is extended or adjusted under 35 U.S.C. 154(b) by 0 days.

(21) Appl. No.: 14/214,402

(22) Filed: Mar. 14, 2014

(65) Prior Publication Data

US 2014/0270320 A1 Sep. 18, 2014

Related U.S. Application Data

(60) Provisional application No. 61/852,248, filed on Mar. 15, 2013.

(51) Int. Cl.

| | |
|---|---|
| ***E04B 1/99*** | (2006.01) |
| ***H04R 5/02*** | (2006.01) |
| ***H04R 1/02*** | (2006.01) |
| ***H04R 1/32*** | (2006.01) |
| *E04B 1/00* | (2006.01) |
| *H04R 5/00* | (2006.01) |

(52) U.S. Cl.

CPC ..... *H04R 1/026* (2013.01); *H04R 1/323* (2013.01); *H04R 5/02* (2013.01)

(58) Field of Classification Search

CPC ..... E04B 1/99; E04B 1/82; E04B 1/74; E04B 1/343; H04R 5/02; H04R 1/34; H04R 1/32; H04R 1/20

USPC ..... 181/287, 30, 155; 381/303, 306, 334, 381/333, 301, 160, 388

See application file for complete search history.

(56) References Cited

U.S. PATENT DOCUMENTS

| | | | | | |
|---|---|---|---|---|---|
| 756,091 | A | | 3/1904 | Altick | |
| 1,120,858 | A | * | 12/1914 | Stallforth | 181/30 |
| 1,502,662 | A | | 7/1924 | Grady | |
| 1,502,666 | A | * | 7/1924 | Grady, Jr. | 181/141 |
| 1,640,908 | A | * | 8/1927 | Schucker | 181/136 |
| 1,675,102 | A | * | 6/1928 | Holland | 181/30 |
| 1,786,279 | A | | 12/1930 | Wolff | |
| 1,854,542 | A | * | 4/1932 | Cooke | 181/30 |
| 1,896,844 | A | | 2/1933 | Hanson | |
| 1,908,661 | A | | 5/1933 | Foltz | |
| D103,954 | S | | 4/1937 | Reynolds | |
| 2,228,024 | A | | 1/1941 | Abrahams | |
| 2,324,398 | A | | 7/1943 | Kahr | |

(Continued)

OTHER PUBLICATIONS

Hulsebos, Edo, "Auralization Using Wave Field Synthesis", pp. 1-70 of 206 total pages.

(Continued)

*Primary Examiner* — Edgardo San Martin
(74) *Attorney, Agent, or Firm* — Foley & Lardner LLP

(57) ABSTRACT

A system for enhancing sound provided by a pair of speakers relative to a listener includes a support structure, a first panel, and a second panel. The first panel is a material having a sound reflective surface and is disposed upright relative to the ground and the listener by the support structure. The first panel extends between a first area proximate a first speaker and a second area proximate the listener. The second panel is a material having a sound reflective surface and is disposed upright relative to the ground and the listener by the support structure. The second panel extends between a third area proximate a second speaker and a fourth area proximate the listener. The first panel and the second panel are shaped such that sound waves emitted laterally from the first speaker and the second speaker are reflected and focused toward the listener.

20 Claims, 23 Drawing Sheets

(56) References Cited

U.S. PATENT DOCUMENTS 2,385,279 A 9/1945 Hopkins
D147,386 S 8/1947 Thomas
2,612,232 A 9/1952 Zivadinovic
2,643,727 A 6/1953 Leon
2,701,025 A 2/1955 Kuhl
2,732,907 A 1/1956 Leon
2,784,779 A 3/1957 Knipfer et al.
2,804,933 A 9/1957 Godfrey
2,835,335 A 5/1958 Glassey
2,896,736 A 7/1959 Karlson
3,041,957 A 7/1962 Liptay
3,139,150 A 6/1964 Weil
3,232,370 A 2/1966 Jaffe
3,236,949 A 2/1966 Murray
3,382,947 A 5/1968 Biggs
3,416,991 A 12/1968 Yoshimura
3,435,909 A 4/1969 Wenger
3,517,468 A 6/1970 Woods
3,592,289 A 7/1971 Aysta et al.
3,618,698 A * 11/1971 McCabe et al. ..... 181/136
3,630,309 A 12/1971 Wenger et al.
3,665,105 A 5/1972 Chowning
3,697,692 A 10/1972 Hafler
D225,871 S 1/1973 Crannel
3,762,767 A 10/1973 Powell
3,765,504 A 10/1973 Itoh
3,817,396 A 6/1974 Markson
3,826,250 A 7/1974 Adams
3,866,712 A 2/1975 Carruthers
3,875,711 A 4/1975 Palmer
3,895,188 A * 7/1975 Ingraham ..... 381/160
3,964,571 A 6/1976 Snell
4,006,311 A 2/1977 Carlsson
4,042,778 A 8/1977 Clinton
4,047,337 A 9/1977 Bergstrom
4,094,379 A 6/1978 Steinberger
4,107,461 A 8/1978 Bose
4,118,599 A 10/1978 Mori
4,124,249 A 11/1978 Abbeloos
4,190,739 A 2/1980 Torffield
4,207,964 A 6/1980 Taguchi
4,211,142 A 7/1980 Conklin
4,218,583 A 8/1980 Poulo
4,218,585 A 8/1980 Carver
4,219,696 A 8/1980 Kogure
4,225,010 A 9/1980 Smith
4,227,047 A 10/1980 Horne
4,227,050 A 10/1980 Wilson
4,256,922 A 3/1981 Gorike
4,366,882 A 1/1983 Parker
4,392,019 A 7/1983 Halliday
4,410,063 A 10/1983 Yasue
4,421,200 A 12/1983 Ferralli
4,474,258 A 10/1984 Westlund
4,475,620 A 10/1984 Carlsson
4,489,432 A 12/1984 Polk
4,495,637 A 1/1985 Bruney
4,497,064 A 1/1985 Polk
4,524,451 A 6/1985 Watanabe
4,553,534 A 11/1985 Stiegler
4,605,093 A 8/1986 Karlen
D286,108 S 10/1986 Hanlon
4,657,149 A 4/1987 Masson
4,695,903 A * 9/1987 Serap et al. ..... 386/359
4,701,951 A 10/1987 Kash
4,750,586 A 6/1988 Lerner
4,759,520 A 7/1988 Levine
4,805,731 A 2/1989 Staley
4,817,149 A 3/1989 Myers
4,836,328 A 6/1989 Ferralli
4,844,198 A 7/1989 Ferralli
4,858,090 A 8/1989 Downs
4,862,502 A 8/1989 Griesinger
4,882,753 A 11/1989 Shivers
4,888,804 A 12/1989 Gefvert
4,907,671 A 3/1990 Wiley
D308,448 S 6/1990 Beaulieu
4,953,213 A 8/1990 Tasaki
4,997,056 A 3/1991 Riley
5,046,097 A 9/1991 Lowe
5,069,011 A 12/1991 Jenne
5,086,755 A 2/1992 Schmid-Eilber
5,086,871 A 2/1992 Barbe
5,095,506 A 3/1992 Kikuno
5,105,462 A 4/1992 Lowe
5,123,874 A 6/1992 White
5,143,055 A 9/1992 Eakin
5,168,129 A 12/1992 D'Antonio
5,189,265 A 2/1993 Tilkens
5,199,075 A 3/1993 Fosgate
5,216,209 A 6/1993 Holdaway
5,216,769 A 6/1993 Eakin
5,218,474 A 6/1993 Kirschner
5,220,608 A 6/1993 Pfister
5,227,591 A 7/1993 Tarklonen
5,250,763 A 10/1993 Brown
5,251,260 A 10/1993 Gates
5,268,539 A 12/1993 Ono
D343,396 S 1/1994 Yamashita et al.
5,307,415 A 4/1994 Fosgate
5,337,363 A 8/1994 Platt
5,345,512 A 9/1994 Lee
D353,946 S 1/1995 Fischer et al.
5,384,851 A 1/1995 Fujimori
5,402,502 A 3/1995 Boothroyd
5,404,406 A 4/1995 Fuchigami
5,525,766 A 6/1996 Atcheson et al.
5,530,211 A * 6/1996 Rogers et al. ..... 181/30
5,532,438 A 7/1996 Brown
5,569,888 A * 10/1996 Kamani et al. ..... 187/317
5,572,847 A 11/1996 Elmore
5,577,990 A 11/1996 Widjaja
5,596,644 A 1/1997 Abel
5,615,176 A 3/1997 LaCarrubba
5,631,661 A 5/1997 Sanchez
5,646,378 A 7/1997 Van Haaff
5,661,808 A 8/1997 Klayman
D385,044 S 10/1997 Johnson
5,757,927 A 5/1998 Gerzon
5,784,468 A 7/1998 Klayman
5,784,473 A * 7/1998 Ferren ..... 381/86
5,798,922 A 8/1998 Wood
5,809,150 A 9/1998 Eberbach
5,815,578 A * 9/1998 Foster et al. ..... 381/1
5,817,992 A 10/1998 D'Antonio
5,883,962 A 3/1999 Hawks
5,884,436 A 3/1999 Ebbitt
5,965,850 A 10/1999 Fraser
5,970,152 A 10/1999 Klayman
6,038,330 A 3/2000 Meucci
6,067,361 A 5/2000 Kohut
6,069,962 A 5/2000 Miller
6,078,669 A 6/2000 Maher
6,118,876 A 9/2000 Ruzicka
6,122,386 A 9/2000 Wiley
6,144,747 A 11/2000 Scofield
6,154,545 A 11/2000 Kohut
6,154,553 A 11/2000 Taylor
6,178,245 B1 1/2001 Starkey
6,229,899 B1 * 5/2001 Norris et al. ..... 381/77
6,234,446 B1 5/2001 Patterson
6,237,714 B1 5/2001 Lee
6,285,766 B1 9/2001 Kumamoto
6,343,132 B1 1/2002 Fukuhara
6,354,044 B1 * 3/2002 Lagace, Jr. ..... 52/79.5
D458,041 S 6/2002 Couture et al.
6,435,301 B1 8/2002 LaCarrubba
6,504,933 B1 1/2003 Chung
6,520,280 B2 * 2/2003 Moskowitz ..... 181/30
6,520,282 B1 2/2003 Hadzic
6,527,080 B2 * 3/2003 Davies et al. ..... 181/175
6,571,907 B2 6/2003 Jennings
6,603,862 B1 8/2003 Betts
6,625,289 B1 9/2003 Oliemuller

(56) References Cited

U.S. PATENT DOCUMENTS

| | | | | |
|---|---|---|---|---|
| 6,694,033 | B1 | 2/2004 | Rimell | |
| 6,820,718 | B2 | 11/2004 | LaCarrubba | |
| 6,842,524 | B1 | 1/2005 | Kobayashi | |
| 6,999,590 | B2 | 2/2006 | Chen | |
| 7,059,093 | B2 | 6/2006 | Akers | |
| D525,794 | S | 8/2006 | Ball et al. | |
| 7,090,047 | B1 | 8/2006 | Lee et al. | |
| D530,104 | S | 10/2006 | Saffell et al. | |
| D530,312 | S | 10/2006 | Schmieta et al. | |
| 7,174,229 | B1 | 2/2007 | Chen | |
| 7,184,562 | B2 | 2/2007 | Seki | |
| 7,187,777 | B1 | 3/2007 | Saffran | |
| 7,362,874 | B2 | 4/2008 | Lee | |
| 7,377,078 | B2 | 5/2008 | Golino et al. | |
| 7,418,108 | B2 | 8/2008 | Oser | |
| 7,515,719 | B2 | 4/2009 | Hooley | |
| 7,522,733 | B2 | 4/2009 | Kraemer | |
| 7,529,376 | B2 * | 5/2009 | Konagai | 381/97 |
| 7,565,951 | B1 | 7/2009 | Perdue | |
| 7,654,949 | B2 | 2/2010 | McNew | |
| 7,690,158 | B2 | 4/2010 | Kelly | |
| 7,760,895 | B1 | 7/2010 | Lehmann | |
| 7,766,122 | B2 | 8/2010 | Graber | |
| 7,783,069 | B1 | 8/2010 | Miller | |
| 7,801,313 | B2 | 9/2010 | Sako | |
| 7,918,312 | B2 | 4/2011 | Carlson | |
| 7,991,176 | B2 | 8/2011 | Kirkeby | |
| 8,000,486 | B2 | 8/2011 | Hildebrandt | |
| 8,050,434 | B1 | 11/2011 | Kato | |
| 8,069,946 | B1 | 12/2011 | Cruise | |
| 8,122,995 | B1 | 2/2012 | Riley | |
| 8,130,988 | B2 | 3/2012 | Sako | |
| 8,136,626 | B1 | 3/2012 | Aliev | |
| 8,155,323 | B2 | 4/2012 | Chabanne | |
| 8,155,370 | B2 * | 4/2012 | Hsu et al. | 381/387 |
| 8,162,099 | B2 * | 4/2012 | Nakaguro et al. | 181/175 |
| 8,189,828 | B2 | 5/2012 | Takumai | |
| 8,259,960 | B2 | 9/2012 | Goldfarb | |
| 8,578,657 | B2 * | 11/2013 | Colucci et al. | 52/2.16 |
| 8,845,016 | B2 * | 9/2014 | Domash | 297/184.15 |
| 2003/0041529 | A1 | 3/2003 | Grandin | |
| 2004/0136553 | A1 * | 7/2004 | Lee et al. | 381/307 |
| 2004/0247140 | A1 | 12/2004 | Norris et al. | |
| 2005/0175197 | A1 | 8/2005 | Melchior | |
| 2005/0284079 | A1 | 12/2005 | Giordano | |
| 2006/0060420 | A1 | 3/2006 | Freiheit | |
| 2006/0065476 | A1 | 3/2006 | Tasker | |
| 2006/0126877 | A1 | 6/2006 | Porschmann | |
| 2006/0153407 | A1 | 7/2006 | Keele et al. | |
| 2006/0222191 | A1 * | 10/2006 | Hung et al. | 381/307 |
| 2007/0036366 | A1 | 2/2007 | Konagai et al. | |
| 2007/0154019 | A1 | 7/2007 | Kim | |
| 2007/0267248 | A1 | 11/2007 | Gudim | |
| 2010/0053466 | A1 | 3/2010 | Naka et al. | |
| 2010/0119075 | A1 | 5/2010 | Xiang | |
| 2010/0290659 | A1 * | 11/2010 | Tagami et al. | 381/352 |

OTHER PUBLICATIONS

Hulsebos, Edo, "Auralization Using Wave Field Synthesis", pp. 71-111 of 206 total pages.

Hulsebos, Edo, "Auralization Using Wave Field Synthesis", pp. 112-160 of 206 total pages.

Hulsebos, Edo, "Auralization Using Wave Field Synthesis", pp. 160-206 of 206 total pages.

Blauert, Jens, "Binaural Hearing and Human Sound Localization", 44 pages.

Blauert, Jens, "Sound Localization", 54 pages.

Cardas, George, "Setting-Up Speakers in a Rectangular Room", 5 pages.

Choueiri, Edgar, "Pure Stereo: A Revolutionary Technology for Audiophile-Grade 3D Audio", 3D Audio & Applied Acoustics Lab, Princeton University, 15 pages.

Choueiri, Edgar, "Optimal Crosstalk Cancellation for Binaural Audio With Two Loudspeakers", 3D Audio & Applied Acoustics Lab, Princeton University, 24 pages.

D'Antonio, Peter & Cox, Trevor, "Technical Bulletin on the Application of Diffusion in Critical Listening Rooms", RPG Diffuser Systems, Inc., Jan. 2003, 9 pages.

Egan, M. David, "Architectural Acoustics Workbook", 244 pages.

Certainteed Corporation, "Noise Control for Buildings: Guidelines for Acoustical Problem Solving", 40 pages.

Feilding, Charles, Lectures 001-023, College of Santa Fe Auditory Theory, Santa Fe University of Arts and Design, 317 pages.

Furuya, Hiroshi et al., "Arrival Direction of Late Sound and Listener Envelopment", Applied Acoustics, 62 (2001) pp. 125-136.

Gardner, William G., "3-D Audio Using Loudspeakers", Sep. 1997, 153 pages.

Gerzon, Michael, "Surround-Sound Psychoacoustics", 6 pages.

Glasgal, Ralph, "Ambiophonics: The Synthesis of Concert Hall Sound in the Home", Ambiophonics, http://www.ambiophonics.org/papers/AES99NYC1095/AES99NYC1095_6.html, date accessed Apr. 2, 2014, 2 pages.

Glasgal, Ralph & Miller, Robin, "Ambiophonics: True-To-Life Sound Reproduction Using Recursive Ambiophonic Crosstalk Elimination", Ambiophonics, http://www.ambiophonics.org/Tutorials/RGRM-RACE_rev.html, date accessed Apr. 2, 2014, 6 pages.

Glasgal, Ralph, "360° Localization via 4.x-RACE Processing", Audio Engineering Society, Presented at the 123rd Convention Oct. 5-8, 2007, 11 pages.

Glasgal, Ralph, "Ambiophonics: Achieving Physiological Realism in Music Recording and Reproduction", Ambiophonics, http://www.ambiophonics.org/papers/AES111a.html, date accessed Apr. 2, 2014, 11 pages.

Glasgal, Ralph, "Improving 5.1 and Stereophonic Mastering/Monitoring by Using Ambiophonic Techniques", Ambiophonics, http://www.ambiophonics.org/papers/TonmeisterSymposium4.html, date accessed Apr. 2, 2014, 9 pages.

Farina, Angelo et al.,. "Ambiophonic Principles for the Recording and Reproduction of Surround Sound for Music", Ambiophonics, http://www.ambiophonics.org/Ambiophonic_Principles/Farina_et_al_1.htm, date accessed Apr. 2, 2014, 26 pages.

Greene, Robert E., "Directional Hearing: How to Listen to Stereo", Regonaudio, http://www.regonaudio.com/Directional%20Hearing%20How%20To%20Listen%20to%20Stereo.htm, date accessed Apr. 3, 2014, 19 pages.

Greene, Robert E., "The Great Divide: What Do You Really Want from Your Audio System—and How to Get It", Regoaudio, Address to the San Diego Music and Audio Guild Jul. 27, 2005, http://www.regonaudio.com/The%20GREAT%20Divide.html, date accessed Apr. 2, 2014, 17 pages.

Greisinger, David, "Envelopment and Small Room Acoustics", Sep. 21, 2000, 52 pages.

Griesinger, David, "General Overview of Spatial Impression, Envelopment, Localization, and Externalization", Lexicon, 15 pages.

Griesinger, David, "Griesingers Coincident Microphone Primer", Oct. 7, 1985, 28 pages.

Griesinger, David, "Objective Measures of Spaciousness and Envelopment" AES 16th International Conference on Spatial Sound Reproduction, 15 pages.

Griesinger, David, "Pitch, Timbre, Source Separation and the Myths of Sound Localization", David Griesinger Acoustics, 28 pages.

Griesinger, David, "Spaciousness and Envelopment in Musical Acoustics", 24 pages.

Griesinger, David, "Speaker Placement, Externalization, and Envelopment in Home Listening Rooms", Lexicon, 48 pages.

Griesinger, David, "Surround From Stereo" Lexicon, 101 pages.

Griesinger, David, "The Audibility of Direct Sound as a Key to Measuring the Clarity of Speech and Music", 13 pages.

Griesinger, David, "The Importance of the Direct to Reverberant Ratio in the Perception of Distance, Localization, Clarity, and Envelopment—or—Measuring Auditory Engagement—or—Near/Far", 71 pages.

Griesinger, David, "The Physics and Psycho-Acoustics of Surround Recording Part 2", 80 pages.

(56) References Cited

OTHER PUBLICATIONS

Griesinger, David, "The Physics and Psychophysics of Surround Recording", Lexicon, 82 pages.
Griesinger, David, "The Science of Surround", Lexicon, Sep. 27, 1999, 70 pages.
Griesinger, David, "Theory and Design of a Digital Audio Signal Processor for Home Use". J. Audio Eng. Soc., vol. 37, No. 1/2, Jan./Feb. 1989, 11 pages.
Griesinger, David, "The Theory and Practice of Perceptual Modeling—How to use Electronic Reverberation to Add Depth and Envelopment Without Reducing Clarity", Lexicon, 42 pages.
Hans, Jenny, "Cymatics: A Study of Wave Phenomena and Vibration", vol. 1 and 2, 2001, 135 pages.
Harley, Robert, "System Set-Up Secrets: Insider Techniques for Optimizing Your Stereo System", Excerpted and Adapted from "The Complete Guide to High-End Audio and Introductory Guide to High-Performance Audio Systems", 2008, 21 pages.
Harley, Robert, "The Critical Listener's Lexicon (TAS 207)", The Absolute Sound, http://www.theabsolutesound.com/articles/the-critical-listeners-lexicon-tas-207-1/, Dec. 6, 2010, date accessed Apr. 2, 2014, 8 pages.
Jot, Jean-Marc, "Real-Time Spatial Processing of Sounds for Music, Multimedia and Interactive Human-Computer Interfaces", Feb. 1997, 22 pages.
Linkwitz, Siegfried, "Hearing Spatial Detail in Stereo Recordings", 26th Tonmeistertagung—VDT International Convention, Nov. 2010, 19 pages.
Miller, Robert E., "What to Expect to Hear with Ambiophonics: Observations of an Audio Engineer That Anyone Can Appreciate" Ambionics, http://www.ambiophonics.org/Tutorials/Expect-ToHear_1.html, 2008, date accessed Apr. 2, 2014, 2 pages.
Norton, Thomas J., "Enough Room?", Stereophile, http://www.stereophile.com/reference/58#, Oct. 7, 1991, date accessed Apr. 3, 2014, 19 pages.
O'Callaghan, Casey, "The Locations of Sounds", 10 pages.
Richard, Gael et al., "Audio Coding and 3D Sound Simulation", 7 pages.
Mandel, Michael, "Speech and Audio Processing & Recognition, Lecture 8: Spatial Sound", Columbia University Dept. of Electrical Engineering, Mar. 27, 2008, 33 pages.
Tonger, Anders & Farina, Angelo, "Real-Time Partitioned Convolution for Ambiophonics Surround Sound", Ambiophonics, http://www.ambiophonics.org/files/TorgerMohonk1.html, date accessed Apr. 2, 2014, 2 pages.
Tonneson, Cindy & Steinmetz, Joe, "3D Sound Synthesis", 6 pages.
Verheijen, Edwin, "Sound Reproduction by Wave Field Systhesis", 1997, 189 pages.
Wikipedia, Various acoustical definitions, http://en.wikipedia.org, date accessed Apr. 3, 2014, 107 pages.
International Search Report and Written Opinion for International Application No. PCT/US2014/029595, dated Jul. 28, 2014, 10 pages.

* cited by examiner

Prior Art Listening Room
Showing Stereo Speaker Crosstalk
and Out-Of-Sync Room Reflections

Fig. 1E

Spectrum analysis at listener's location (19a), 52" from speakers using high-performance PLASTIC surfaced Embodiment system with Sound Shapers. Acoustic amplitude and directional sound are increased to listener by about 7 dB with Embodiment system plus another 3 dB with Sound Shapers for a substantial total increase of about 10 dB. 6 dB = double acoustic amplitude.

Spectrum analysis at listener's location (19a), 52" from speakers using high-performance PLASTIC surfaced system (No Sound Shapers). Acoustic amplitude and directional sound to listener are substantially increased by about 7 dB by system.

Spectrum analysis at listener's location (19a), 52" from speakers. NO EMBODIMENT SYSTEM PRESENT (CONTROL) - in open room. [Same equipment, setup, system volume level (pink noise), and same distance from the speakers, without Embodiment system.]

Spectrum analysis at 62" from speakers (just outside of back of Embodiment system - 10" away from listener's location). Sound is dramatically reduced outside of Embodiment system, shielded by the system's structure.

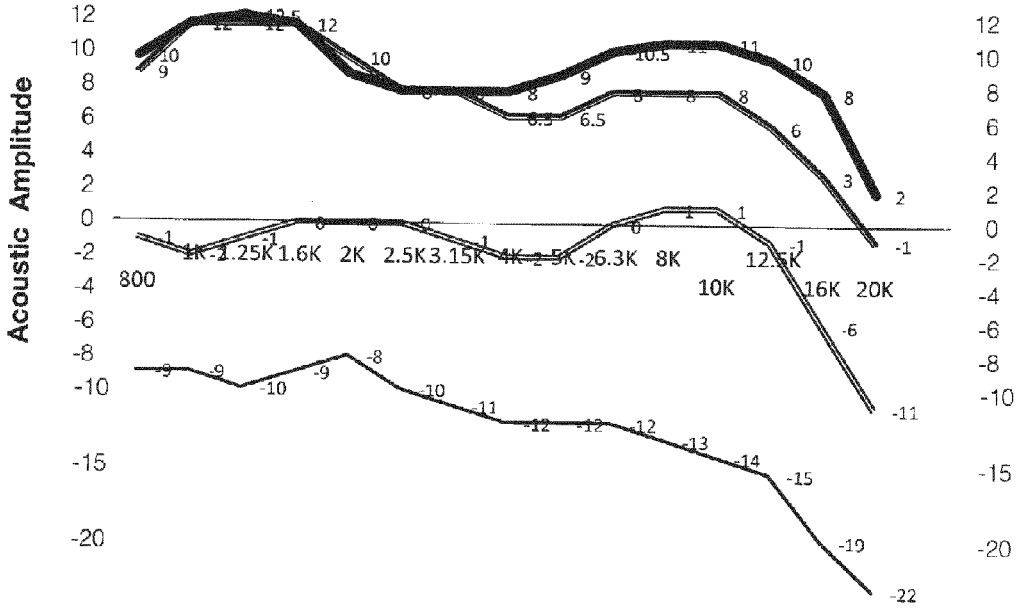

Spectrum analysis using medium-size 100% recycled high-performance PLASTIC surfaced Embodiment system showing significant increase in conservation of speaker energy, more than double acoustic amplitude increase at listener's location (19a) versus Control (without Embodiment structure, in open room), plus the added acoustic effect of adding Sound Shapers. 6dB = double acoustic amplitude. Listener's location is center-located in front of 2 Harbeth HL-P3 speakers spaced 36" apart. Microphone is placed at 36" speaker tweeter height level. Spectrum analysis measurements were performed with Real Time Spectrum Analyzer SA-3050A, performed in 11 foot x 23 foot room with carpeting. The size of this medium-size Embodiment system is 66" w x 60" l x 48" h. The drop above 10K is due to roll-off of small Harbeth HL-P3 speakers producing the pink noise. Pink noise volume level was set at the same level for all tests.

Fig. 1F

Spectrum analysis at listener's location (19a), 52" from speakers using high-performance PLASTIC surfaced Embodiment system with Sound Shapers. Acoustic amplitude and directional sound are increased to listener by about 7 dB with Embodiment system plus another 3 dB with Sound Shapers for a substantial total increase of about 10 dB. 6 dB = double acoustic amplitude.

Spectrum analysis at listener's location (19a), 52" from speakers using high-performance PAPER surfaced system with Sound Shapers. Acoustic amplitude and directional sound to listener are increased by about 7 dB by system plus another 1 dB with Sound Shapers for a total increase of about 8 dB.

Spectrum analysis at listener's location (19a), 52" from speakers. NO EMBODIMENT SYSTEM PRESENT (CONTROL) - in open room. [Same equipment, setup, system volume level (pink noise), and same distance from the speakers, without Embodiment system.]

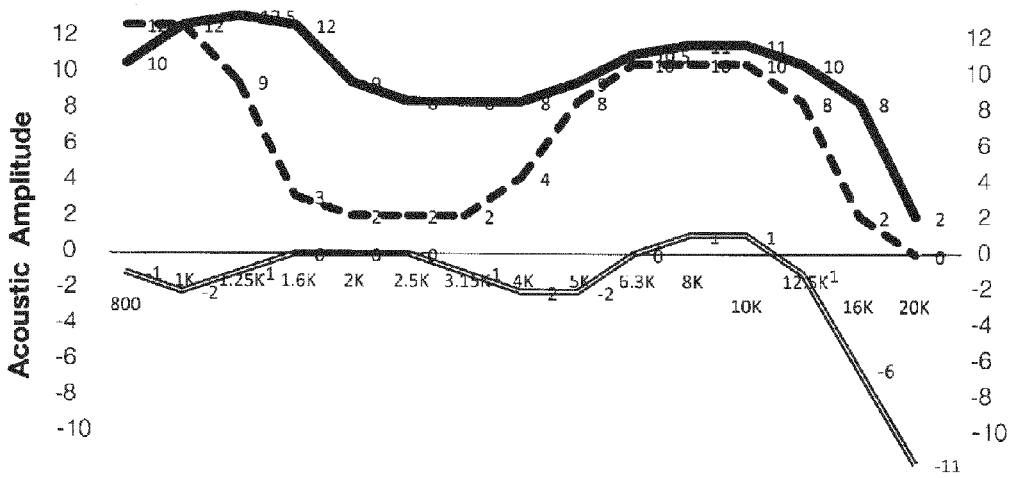

Spectrum analysis showing the comparative acoustic effect of being able to use different and varied sound reflective surfaces (100% recycled high-performance PLASTIC and 100% recycled high-performance PAPER surfaces) within the same size Embodiment system to produce different spectrum results for specialized, including custom, acoustic applications. Same medium-size Embodiment system used for both high-performance PLASTIC and PAPER spectrum analysis. Spectrum results also show a significant increase in conservation of speaker energy and double acoustic amplitude at listener's location versus Control (without structure, in open room). Microphone is placed at 36" speaker tweeter height level. Spectrum analysis measurements were performed with Real Time Spectrum Analyzer SA-3050A, performed in 11 foot x 23 foot room with carpeting. The size of this medium-size Embodiment system is 66" w x 60" l x 48" h. The drop above 10K is due to roll-off of small Harbeth HL-P3 speakers producing the pink noise. Pink noise volume level was set at the same level for all tests.

Fig. 1G

- - Spectrum analysis at listener's location (19a), 52" from speakers using high-performance PAPER surfaced Embodiment system with Sound Shapers. Acoustic amplitude and directional sound are increased to listener by about 7 dB with Embodiment system plus another 1 dB with Sound Shapers for a total increase of about 8 dB. 6 dB = double acoustic amplitude.

- - - Spectrum analysis at listener's location (19a), 52" from speakers using high-performance PAPER surfaced system (No Sound Shapers). Acoustic amplitude and directional sound to listener are increased by about 7 dB by system.

═══ Spectrum analysis at listener's location (19a), 52" from speakers. NO EMBODIMENT SYSTEM PRESENT (CONTROL) - in open room. [Same equipment, setup, system volume level (pink noise), and same distance from the speakers, without Embodiment system.]

—— Spectrum analysis at 62" from speakers (just outside of back of Embodiment system - 10" away from listener's location). Sound is dramatically reduced outside of Embodiment system, shielded by the system's acoustic structure.

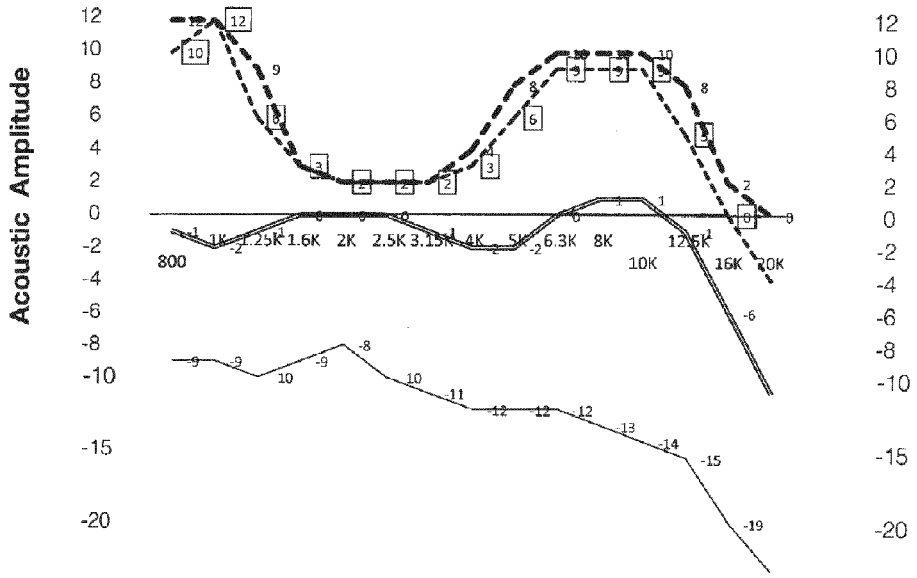

Spectrum analysis using medium-size 100% recycled high-performance PAPER surfaced Embodiment system showing one of the many custom acoustic effects of using different reflective surfaced materials for specialized applications. Also shows the different results with and without the use of Sound Shapers for this reflective material in the same size system. 6 dB = double acoustic amplitude. Spectrum results show a significant increase in conservation of speaker energy and an approximate doubling of acoustic amplitude at listener's location (19a) versus Control (without Embodiment system structure in open room).

Microphone is placed at 36" speaker tweeter height level. Spectrum analysis measurements were performed with Real Time Spectrum Analyzer SA-3050A, performed in 11 foot x 23 foot room with carpeting. The size of this medium-size Embodiment system is 66" w x 60" l x 48" h. The drop above 10K is due to roll-off of small Harbeth HL-P3 speakers producing the pink noise. Pink noise volume level was set at the same level for all tests.

Acoustic Amplitude Comparisons

+/- 6 dB Difference = Double/Half Acoustic Amplitude

Comparisons:
- At Listener's Location 19a, For A (Control) vs B, C, D, E, F and G
- Without vs With An Embodiment System ..... A vs B - G
- At Different Distances From Speakers ..... 37" to 120"
- Using Different Reflective Surfaces ..... P1 vs P2
- With vs Without Sound Shapers ..... D vs A, B and C

Figure 1H cont.

Acoustic Amplitude Comparisons

Measured In Decibels (dB)

+/- 6 dB Difference = Double/Half Acoustic Amplitude

Comparisons:
- At Listener's Location, 19a, For A (Control) vs B, C, D, E, F, and G
- Without vs With An Embodiment System ..... A vs B - G
- At Different Distances From Speakers ..... 37" to 120"
- Different Shapes and Sizes ..... Small, Medium, Medium-Large
- With vs Without Sound Shapers ..... D vs A, E, F and G

A (Control)

NO EMBODIMENT SYSTEM

Same Setup, Volume Level,
And Same Distance From Speakers

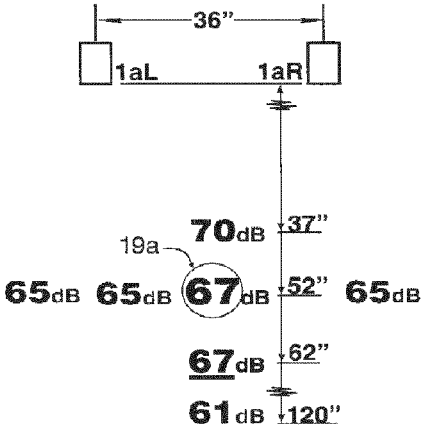

E

Wing Embodiment System
w/ 100% Recycled High-Performance
PLASTIC Surfaced Panels (P2)
(NO Sound Shapers or Acoustic Extenders)

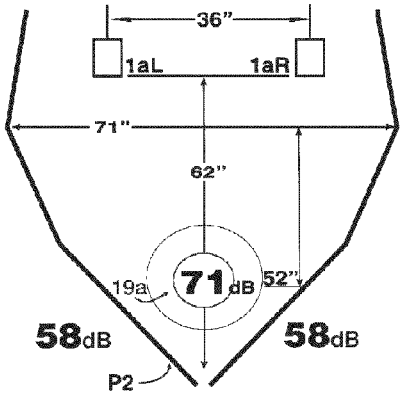

F

Small Embodiment System
w/ 100% Recycled High-Performance
PLASTIC Surfaced Panels (P2)
(NO Sound Shapers or Acoustic Extenders)

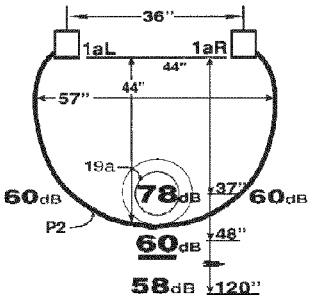

G

Medium-Large Embodiment System
w/ 100% Recycled High-Performance
PLASTIC Surfaced Panels (P2)
(NO Sound Shapers or Acoustic Extenders)

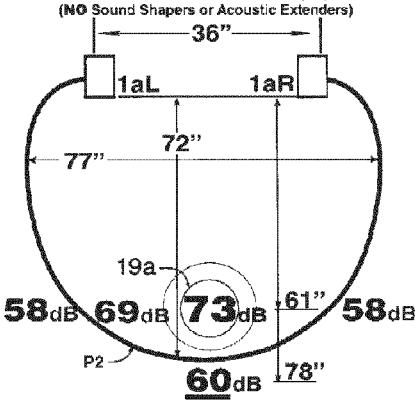

Figure 1H cont.

Acoustic Amplitude Decibel (db) Test Results

Acoustic amplitude comparison tests, parts 1 and 2, shown in Figure 1H, test results A through G, demonstrate acoustic amplitude differences measured in decibels (dB) comparing the substantial differences in sound amplitude at the same locations with, as compared to without, an Embodiment system positioned with the speakers in a listening room. Control A provides the comparative benchmark decibel level of acoustic amplitude in an open, standard listening room without the presence of an Embodiment system using the same equipment, setup, volume level (pink noise), and measured from the same distances from the speakers. Acoustic amplitudes are referenced at different distances from the speakers 1aL and 1aR, at 37", 52", 62", and 120". The listener's location, 19a, however, is especially noteworthy as indicated by the circled areas.

As measured at this listener's location, 19a, acoustic amplitude is increased to the listener by about 8 dB (from 67 dB without an Embodiment system to 75 dB with either Embodiment system B or C) using a selection of different high-performance reflective materials (P1 in test B and P2 in test C) in comparison to the same location (Control A) without the positioning and acoustic advantage of an Embodiment system. This 8 db increase at the listener's location is a substantial acoustic amplitude increase when 6 bB is considered a doubling of acoustic amplitude. The 8 bB is further increased by another 2 bB with the aid of sound shapers and acoustic extenders (test D) for a total increase of 10 dB over Control A with an Embodiment system at the same listener's location.

A dramatic sound reduction is also demonstrated from the listener's location inside of an Embodiment system as compared to a close location just outside of the system, only 10 inches away from the listener's location 19a, as noted by the acoustic measurements shown with a heavy underline mark at the 62" location. Acoustic amplitude test results show an acoustic amplitude reduction of from 13 dB, to an even greater reduction of 18 dB, between these two 10" apart locations. The 13 dB reduction is from 73 dB at the listener's location 19a, down to 60 dB at the 62" mark in test Embodiment system G. The 18 dB reduction is from 78 dB at the listener's location 19a, down to 60 dB at the 10" away 62" mark in test Embodiment system F. These acoustic amplitude differences demonstrate a substantial quieting and sound reduction of acoustic amplitude outside of the system by the acoustic shielding or the sound blocking capabilities of the system. The two different dB results at the same physical locations occur from using two different size Embodiment systems, F vs G. Other acoustic comparisons can also be cross-referenced by acoustic comparative tests A though G, Figure 1H.

Listener locations were center-located in front of 2 Harbeth HL-P3 speakers spaced 36" apart in all tests. The test analysis microphone was placed 36" above the floor on the same horizontal plane as the speaker tweeters. Tests were performed in a 11' x 23' room with carpeting. Decibel (dB) acoustic measurements were performed with a Real Time Spectrum Analyzer SA-3050A, repeated three times and averaged using standard pink noise generated through the Harbeth speakers. Pink noise volume level was set at the same level for all tests.

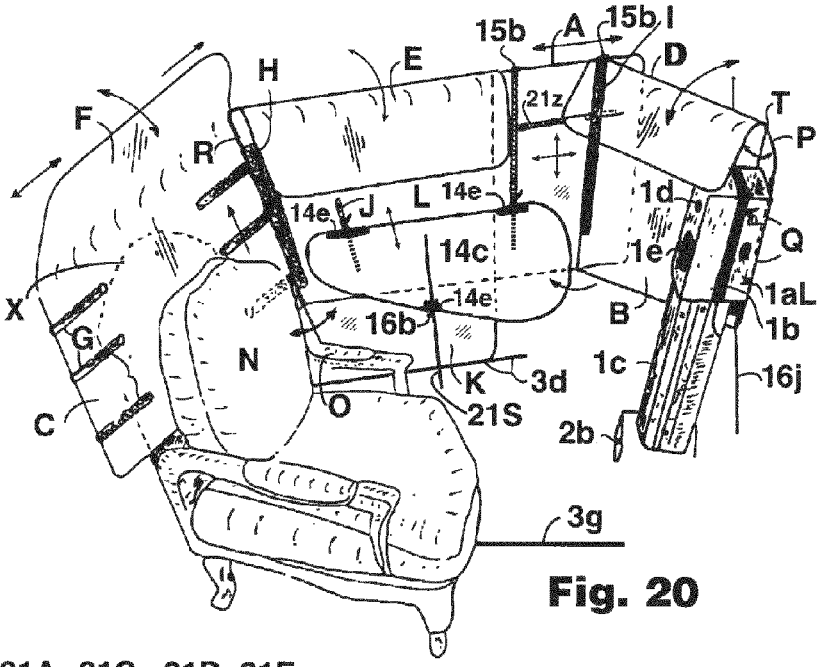
Fig. 20
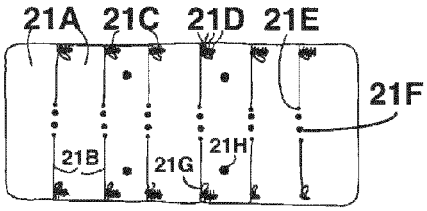
Fig. 21-A
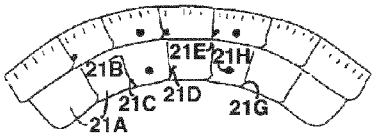
Fig. 21-B
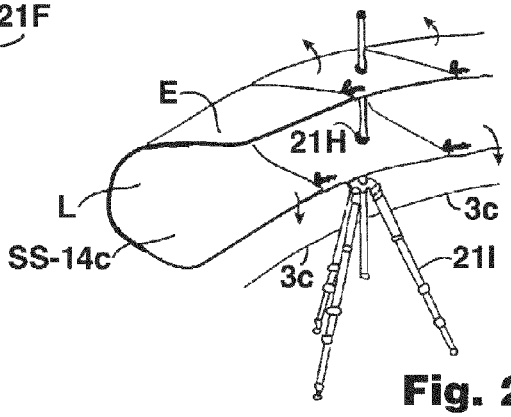
Fig. 21-C
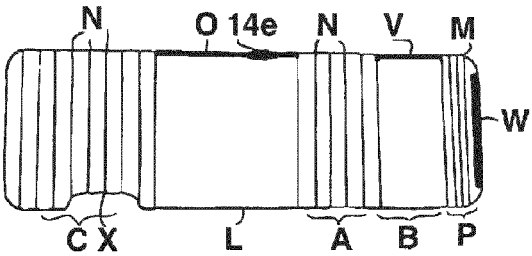
Fig. 22
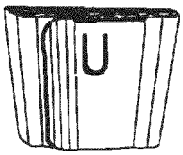
Fig. 22-A

PORTABLE SOUND SYSTEM

CROSS-REFERENCE TO RELATED PATENT APPLICATION

This application claims benefit of and priority to Provisional Patent Application Ser. No. U.S. 61/852,248, filed Mar. 15, 2013 and listing Richard O'Polka as the inventor, which is incorporated herein by reference.

BACKGROUND

The present disclosure relates to an economical, environmentally-responsible, and highly-portable energy-saving indirect sound capturing acoustic system for non-electronically canceling stereo speaker crosstalk and preventing out-of-sync listening room reflections using the normally non-utilized output from universally-available stereo speakers to also provide real acoustically-pure three-dimensional surround sound to the listener from universally-available two-channel stereo signals without having to electronically manipulate or corrupt the sound signals.

The presented embodiments relate to a low-cost environmentally-responsible indirect sound capturing mostly-portable sound system and non-electronic energy-saving method, for effectively canceling the direct audio sound reproduction problem of stereo speaker crosstalk by using the normally-wasted and non-utilized output from universally-available stereo speakers to add exclusive right and left side sound to the nearest ear of the listener, simultaneously preventing the indirect sound problem of out-of-sync listening room reflections by using the sound controlling components of this sound system to block the uncontrolled broadcast of substantial quantities of normally acoustic damaging indirect sound from traveling out of the sound system, and to provide real acoustically-pure three-dimensional surround sound to the listener from universally-available two-channel stereo signals without having to electronically-manipulate or corrupt the signals.

Supplemental background information has been added in this document because the following system and method of application has been missing from stereo sound reproduction since its inception over eighty years ago. The following background section is presented to help the reader understand cross talk and out-of-sync listening room reflections, how they have affected the audio listener and the stereo sound reproduction industry, and the advantages resulting from eliminating these two problems that may not be immediately apparent even to those skilled in the art.

In large part because of the commercial inability of prior art to substantially and inexpensively solve the above-mentioned two separate stereo audio sound reproduction problems, the pursuit of a high-performance stereo and surround sound experience for the audio consumer has historically been perplexing, time-consuming, expensive, and requiring a highly-disciplined process that has severely restricted the potential benefits to consumers. With this in mind, the following audio consumer needs and expectations is presented below. It applies to audio consumers, commercial sound studios, audio equipment showrooms, music therapy venues, and other high-performance consumers of audio hardware and software. It relates to the purchase, implementation and operation of high-performance audio equipment, with a special emphasis on those audio consumers in pursuit of a high-performance combination of an audio and/or audio-visual system capable of producing a real three-dimensional full-sphere holographic surround sound experience for the listener quickly, easily, dependably, and economically. It is presented for close comparison between the current state of the prior art and the presentation of the following embodiments.

Human Psycho-Acoustic and Brain-Ear Mechanisms Affecting a Realistically-Natural Three Dimensional Surround Sound Experience It is well known in high-performance sound reproduction circles that one of the most difficult tasks in the acoustic design of sound reproduction is not the simple reproduction of the sound, but the capture and recreation of the sound within a three-dimensional sound field including the realistic horizontal and vertical localization of acoustic objects and events so that they are believably-localized within a three-dimensional holographic sound field that surrounds the listener in a natural way.

An individual can locate sounds in three dimensions—in range (distance), in direction above and below, in direction in front and to the rear, as well left and right on either side of their head. The human auditory system's natural kinesthetic feedback mechanism, including sound localizing head-turning feedback such as slight non-cognizant head movements, even minimum turning or rotating of the head while listening to sounds, provide the listener with important and subtly enhanced sound source kinesthetic feedback that the auditory system and brain use to help pinpoint the sound location. These include three essential psycho-acoustic components of frequency change (including harmonic variation), amplitude change (including starts, stops, and transients) and acoustic directional change (especially in the lateral horizontal plane around a listener). This automatic function of the human psycho-acoustic mechanism gives priority attention to surrounding acoustic movement or acoustic directional change.

For a reproduced surround sound system, therefore, to produce human interest, attention and emotional response to the human brain as a realistically-natural surround sound created within a real three-dimensional space around a listener, especially for the reproduction of a multiplicity of realistically-natural three-dimensional full-sphere holographic audio musical sounds surrounding the listener, it is essential that the above-mentioned fundamental human psycho-acoustic and brain-ear surround sound components also be included as significant reference standards for close comparison between the prior art produced surround sounds and the surround sounds produced by the following embodiments.

Acoustic Damaging Problems Associated with Stereo Audio Sound and Surround Sound Reproduction Audio sound, including audio or acoustic radiation, is composed of both sound information and sound wave energy emitted from speakers (e.g., individual transducers or transducer drivers including those located on conventional audio sound speakers or other electronic devices).

Both mono and stereo sound is normally emitted by the speakers and projected or dispersed outwardly in all directions from the speaker's sound emission area into a multiplicity of room directions. It has been known for some time that stereo audio signals, including universally-available two-channel stereo audio signals, like audio music recordings and live audio-visual program material, contain three-dimensional surround sound information.

The process whereby original surrounding sound field information can be initially three-dimensionally encoded into two simple signals can be understood conceptually when it is considered that, minimally, the use of just two stereo microphones operate substantially similar to our two ears. That is, a plurality of acoustic information from individual sounds can be simultaneously precision-localized to form a three-dimensional surrounding sound field by mathematical-based progressively time-delayed acoustic directional, amplitude and acoustic distance cues substantially picked-up by the two stereo microphones. Unfortunately for the sound reproduction industry and for the listener, the stereo audio sound signal unlocking and electronic signal reproduction process has been substantially difficult, cumbersome, and exponentially expensive to accomplish since the very beginning of audio sound reproduction eighty year ago. This is largely due to the following problems and limitations.

Stereo audio sound emitted from conventional stereo speakers into a conventional listening room is divided into direct and indirect sound components. Direct sound and indirect sound are emitted together from conventional stereo speakers. Direct sound is a very small percentage, less than 2%, of the speaker's total sound output that travels directly from the speaker, primarily from the tweeter and woofer transducer driver components of the speaker. Indirect sound is all of the rest of the speaker's total emitted mass of sound information and sonic energy. Throughout the history of stereo audio sound reproduction, the speaker's direct sound component has been the most important, the most traditionally-tested, sought-after and compared speaker component value, whereas the indirect sound component has traditionally been viewed and regarded in the exact opposite.

One of the reasons is that indirect sound is considered a nuisance sound because it is heard as corrupted sound. This is because this largest and most substantial indirect sound portion of sound energy, while still in its acoustically-pure state, is allowed to be first projected out into a room in a plurality of directions with little purposeful initial overall control between the speakers and the listener. What normally happens then is that, after being uncontrollably projected out into the listening room, the indirect sound interacting with conventional listening room itself substantially damages the purity of this originally-pure speaker emitted indirect sound component. This is because the room's boundary walls, ceiling, windows, floor, open spaces, the shape and texture of its furnishings, and all the materials and accessories within the listening room corrupts the pure sound by then reflecting, diffusing, absorbing, diffracting, dispersing, reshaping, and further dispersing this indirect sound energy, as illustrated in FIG. 1A by uncontrolled indirect speaker emitted sound IS.

Without adequate indirect sound control mechanisms, this uncontrolled indirect acoustic energy, that was originally a cohesive mass of acoustically-pure speaker-emitted indirect sound energy, is allowed, by default, to then return back to the listener's ears. At the listener's ears, after different, varying, and random first, second and third order reflections and diffusions, these sounds are heard as substantially distorted and corrupted out-of-sync indirect acoustic energy sounds and parts of sounds that can haphazardly intermix in confusing and negative ways with the speakers' direct sound component.

What is significant is that once this substantial quantity of originally acoustically-pure indirect sound is allowed to become corrupted, the substantial acoustic utility and value of its high-performance content are lost forever to the listener. What is lost is the original purity of the sound for the listener. This includes important acoustic components of the original sound presentation including the loss of individual spatial sound localizations, subtle acoustic nuances, important progressive time-delay cues, the original three-dimensional sound picture of the surrounding sound field, and the sound field's associated acoustically-pure natural reverberant energy component. Out-of-sync room reflections may include indirect sound problem and loss of important encoded acoustic information to the listener.

Another different, but severely-disruptive stereo audio listening room speaker-related acoustic problem that occurs with the smaller direct sound component is commonly referred to as direct sound stereo speaker "crosstalk". In FIGS. 1A and 1B, direct sound stereo speaker crosstalk Lc is shown from the left conventional 60° projecting speaker to the listener's left and right ears. Stereo speaker crosstalk changes the direct sound component from the speakers above, into severely distorted and corrupted direct sound to the listener's ears and brain. Crosstalk is caused by the two or more stereo speakers projecting multiple parts of the same sound in direct uninterrupted straight lines to the two ears of a listener from two or more different speaker sound source locations. This is a very distorting to the human auditory system because it is an unnatural intermixing of multiple parts of the same sound hitting the listener's left and right ears from multiple directions. These multiple different directions of the same sound are also heard by the listener's two ears at slightly-different, but none-the-less disruptive, time-delay intervals. The result is that there are two, or even more, sound source locations for the one sound from the two or more speakers arriving at the listeners left and right ears in a straight uninterrupted path directly from the two or more different speaker locations.

These confusing multiple speaker crosstalk sounds from the direct sound component are then made substantially worse when they are also intermixed at the listener's ears with uncontrolled indirect sounds from the same two speakers that arrive to the listener's ears from a substantial plurality of uncontrolled, and variable directions, angles, and at different amplitude levels, frequencies, and progressive time-delay intervals. The total acoustic result for the listener is seriously acoustically-corrupted both direct and indirect sound that substantially interferes with and muddles-up the sound heard by the listener to the extent that what was originally acoustically-pure speaker-emitted sound has now become substantially corrupted sound to the listener's brain.

Introduction to Prior Art Acoustic Solutions

Listening rooms (e.g., high performance listening rooms) may include consumer and residential listening rooms; sound reproduction rooms; professional and commercial sound studios; retail audio equipment demonstration rooms, including speaker demonstration booths; meditation, stress management, behavior modification, health, fitness and wellness, and acoustic therapy facilities; audio-visual entertainment centers; and the like. Structurally, they usually require an acoustic room setup solution that typically includes a whole acoustically-preferential room or a substantial majority of the whole room. The rooms are to be acoustically sized, shaped, configured, and often need to be reserved, set-aside and are often greatly altered to enhance sound and surround sound.

High performance prior art listening room solutions often dictate highly restrictive, non-adjustable, or exclusive structural room placement of the speakers and the listener within a pre-set area at the center only portion of the listening room. This helps reduce and neutralize the acoustically-damaging negative effects of indirect sound emitted from speakers into the listening room. It is conventionally required that the stereo speakers and the listener not be placed in any other section or portion of a listening room. Speakers and/or listener are not to be positioned off to one side of a room, adjacent to windows, or near to an asymmetrical room configuration area of the listening room.

High performance prior art solutions structurally require, recommend or fundamentally expect the audio consumer to place a multiplicity of expensive, difficult-to-locationally position, and often high-energy consuming speakers, amplifiers, time-consuming extensive lengths of expensive special wiring installation, connective cables and a plurality of surround sound electronic equipment into the listening room to enhance sound and surround sound. This also conventionally requires extensive, time-consuming and cumbersome testing and trial-and-error speaker setup placement experimentation in order to determine the proper final speaker location(s) within the listening room.

One of the first and most important acoustic goals for high-performance sound and surround sound reproduction is to stay faithful to the original sound event and to limit compromising the original sound, limiting the amount of distortion, reproducing the highest fidelity in order for the listener to hear the audio signal without alteration. Electronic-based surround sound signal processing techniques, however, are not designed to reproduce the original signal without alternation. They are designed to compensate artificially for otherwise natural originally-localized surround sounds and surround sound fields. This is normally done either by artificial electronically manufactured surround sound or by artificially and electronically processing the original audio signal, often substantially.

SUMMARY

One embodiment relates to a system for enhancing sound provided by a pair of speakers relative to a listener that includes a support structure, a first panel, and a second panel. The first panel is a material having a sound reflective surface and is disposed upright relative to the ground and the listener by the support structure. The first panel extends between a first area proximate a first speaker and a second area proximate the listener. The second panel is a material having a sound reflective surface and is disposed upright relative to the ground and the listener by the support structure. The second panel extends between a third area proximate a second speaker and a fourth area proximate the listener. The first panel and the second panel are shaped such that sound waves emitted laterally from the first speaker and the second speaker are reflected and focused toward the listener.

Another embodiment relates to a kit that includes a support structure, a first panel, and a second panel. The first panel is a material having a sound reflective surface and is configured to be disposed upright relative to a ground and a listener by the support structure. The first panel is configured to extend between a first area proximate a first speaker and a second area proximate the listener. The second panel is a material having a sound reflective surface and is configured to be disposed upright relative to the ground and the listener by the support structure. The second panel is configured to extend between a third area proximate a second speaker and a fourth area proximate the listener. The first panel and the second panel are configured to be shaped such that sound waves emitted laterally from the first speaker and the second speaker are reflected and focused toward the listener.

Still another embodiment relates to an audio system that includes a first speaker and a second speaker, a first panel that is an acoustically reflective material, the first panel having a distal end positioned at the first speaker and a proximal end positioned proximate a listener, a second panel that is an acoustically reflective material, the second panel having a distal end positioned at the second speaker and a proximal end coupled to the proximal end of the first panel, and a support structure configured to hold the first panel and the second panel upright relative to the ground and the listener. The first panel and the second panel define a listening area and are shaped such that sound waves emitted laterally from the first speaker and the second speaker are reflected and focused toward the listening area.

The invention is capable of other embodiments and of being carried out in various ways. Alternative exemplary embodiments relate to other features and combinations of features as may be generally recited in the claims.

BRIEF DESCRIPTION OF THE FIGURES

Figures may not be illustrated according to relative scale and include components that are freely listener-adjustable, optional, and/or interconnected as the listener and acoustic designer so chooses including components and component positions other than those specifically detailed or illustrated.

Multiple operations will be described as discrete, and in a manner that is intended to be most helpful in understanding the presented embodiments. However, the size depicted and order of the description does not imply that the operations are size or order dependent. The operations need not be performed in the order presented.

FIG. 1E is a spectrum analysis showing medium-size 100% recycled high-performance plastic surfaced embodiment system showing significant increase in conservation of speaker energy, more than double acoustic amplitude at listener's location (19*a*) versus control (without structure, in open room), plus the added acoustic effect of adding sound shapers. (6 dB=double acoustic amplitude.)

FIG. 1F is spectrum analysis showing the comparative different acoustic effect of being able to use different and varied sound reflective surfaces (100% recycled high-performance plastic and 100% recycled experimental paper surfaces) within the same size embodiment system to produce different spectrum results for specialized and custom acoustic applications. Same medium-size embodiment system used for both high-performance plastic and experimental paper. Spectrum results also show a significant increase in conservation of speaker energy and double acoustic amplitude at listener's location versus control (without structure, in open room). 6 dB=double acoustic amplitude.

FIG. 1G is spectrum analysis using a medium-size 100% recycled high-performance experimental paper surfaced embodiment system showing a significant increase in conservation of speaker energy, approximate doubling of acoustic amplitude at listener's location (19*a*) versus control (without structure, in open room), and one of the many custom acoustic effects of using different reflective materials for specialized applications in the same size embodiment system. Also shows the different results with and without the use of sound shapers with this experimental sound reflective material. 6 dB=double acoustic amplitude.

FIG. 20 shows a perspective view of a portable, fully-setup, fully-operational, left side of adjustable-size embodiment system with a domestic listener sitting device.

FIG. 21-A shows a front view of a portable, adjustable-size embodiment system.

FIG. 21-B shows a perspective view of left side of a portable, adjustable-size embodiment system.

FIG. 21-C shows a perspective view of left side of a portable, adjustable-size embodiment system.

FIG. 22 shows a front view of a portable, adjustable-size embodiment system.

FIG. 22-A shows a front view of folded-up portable, adjustable-size embodiment system.

DETAILED DESCRIPTION

Overview

Before presenting the specific individual embodiment system drawings, their separate components, and the interaction among those separate components in the following individual embodiment system sections, this section provides an overview of commonly-shared connective information that is relevant to all of the presented embodiments and their shared presently-revealed method of application.

The following embodiment system apparatuses and presently-revealed method of application along with their incorporated perspectives, principles, and practices are radically different from prior art perspectives, principles and practices, methods and apparatuses including those detailed in the prior art section of this disclosure. As more extensively illustrated by FIGS. 1B through 1H, and in the following embodiment system sections, the following embodiments utilize a synergistic and mostly-symmetrical interaction of one or more mostly smooth, optionally-specular, first-order sound-controlling surfaces. They are suitably-shaped, of substantial acoustic size, and suitably acoustically-positioned to substantially-capture, symmetrically-control, and beneficially-utilize, for a plurality of acoustic problem solving and beneficial purposes, a significant portion and substantial quantity of acoustically-pure indirect sound wave energy from universally-available standard stereo audio speakers.

In marked contrast to prior generalized views of indirect sound, the following embodiments demonstrate, teach, support, and clearly prove that not only is indirect sound energy which has been historically expensive and difficult to control and which has traditionally been viewed as harmful, damaging, and problematic—not expensive or difficult to control; and not a harmful or an acoustic damaging problem, but that, instead, stereo speaker emitted indirect sound energy, far the largest portion of the speakers' total output of sound energy, naturally carries within it unexpected, incredibly-advantageous, and substantial sound reproduction and acoustic problem solving enhancements.

Figure 1A:
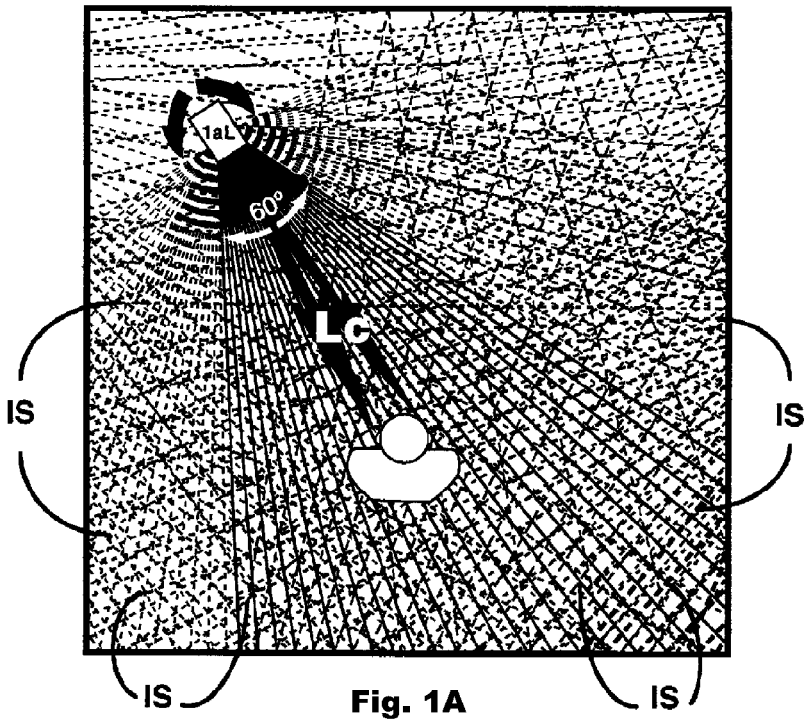
FIG. 1A is a prior art listening room, showing conventional speaker output (60° beam spread), speaker's direct sound component (Lc), crosstalk component (c), and uncontrolled indirect sound component (scattering of sound waves around room creating out-of-sync listening room reflection problem).
Figure 1B:
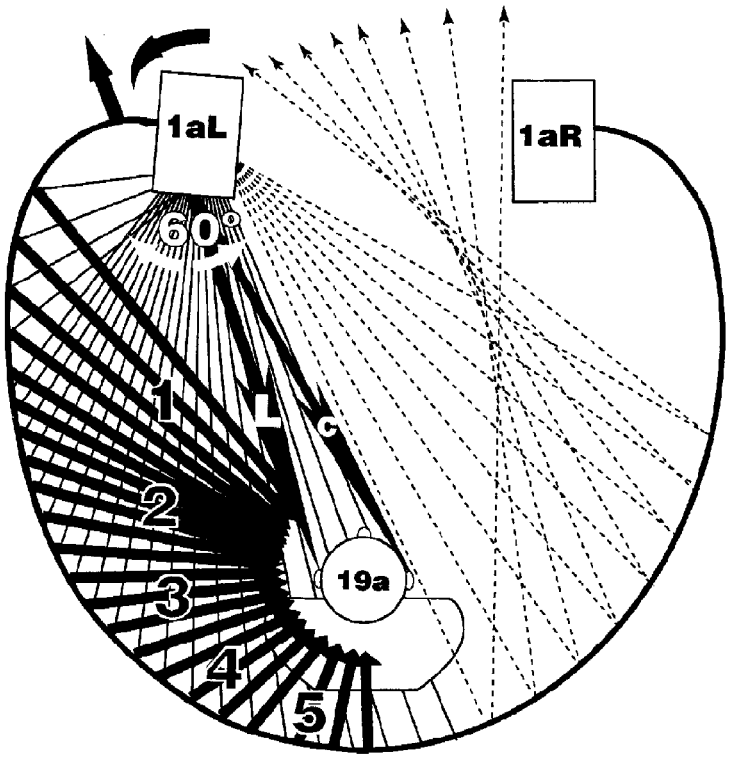
FIG. 1B is an acoustic structure, capturing and controlling normally non-utilized or wasted and acoustically harmful indirect sound (arrows 1-5) usefully directing it toward listener, simultaneously 1) canceling crosstalk non-electronically 2) preventing out-of-sync listening room reflections, and 3) recreating a significantly-enhanced three-dimensional sound field replica of the original encoded two-channel acoustic sound field around the listener without added speakers, wires, permanent installations, and without having to electronically manipulate or corrupt the sound signals.
Figure 1C:
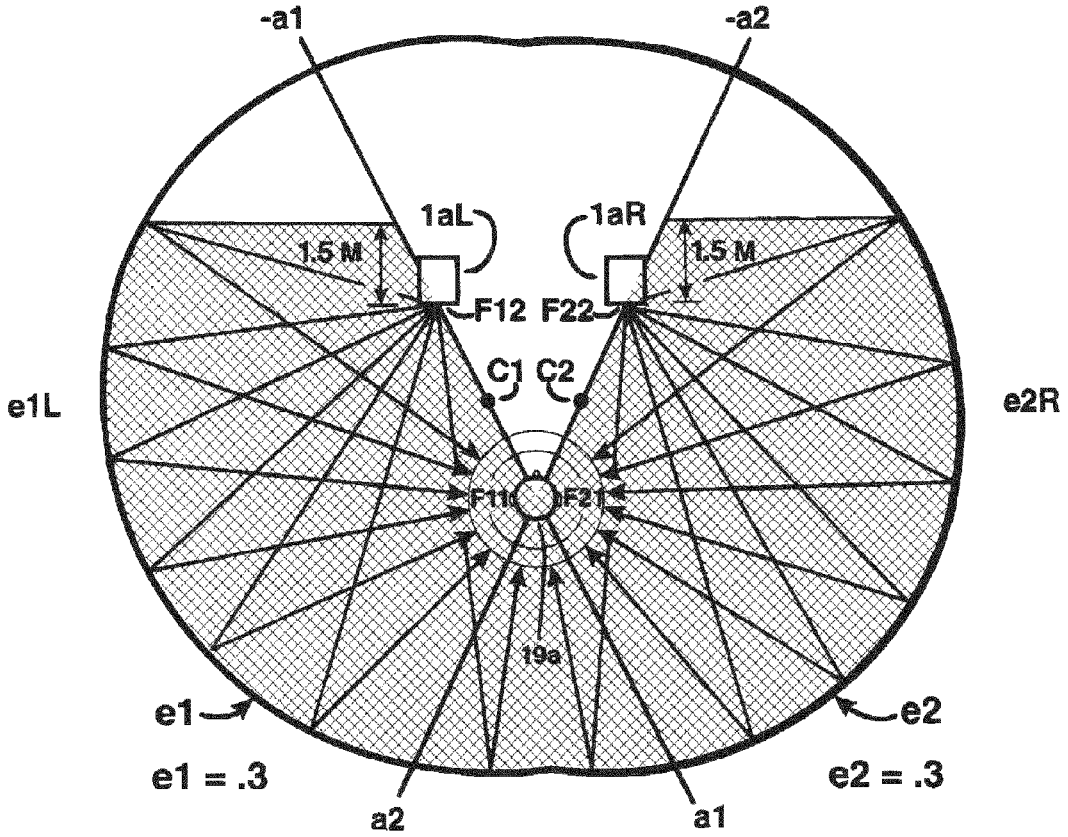
FIG. 1C is an embodiment system acoustic structure and performance area as defined by the specialized embodiment system use of the laws of elliptical reflection.

The embodiment system acoustic structure and performance area as defined by the specialized embodiment system use of the laws of elliptical reflection is described using FIG. 1C as a reference guide. The performance area of the presented embodiments comprise an acoustic structure with at least two (2) stereo speakers 1*a*L, 1*a*R, and at least one (1) listener 19*a* where a mostly vertical positioned and mostly specular sound reflective surfaced structure having one or more planar portions, one or more curved portions, or a combination of portions thereof sound-reflective shape can be positioned within the space created within the horizontal boundaries of an area defined by the specialized use of the laws of elliptical reflection including the vertical space at least extending one and one-half (1.5) meters above and below this plane. In this regard, the performance area of the presented embodiments consists of a specialized portion of the area that exists within two acoustic ellipses, one left ellipse e1 and one right ellipse e2, having the same shared eccentricity of 0.3 with the two respective elliptical center points being C1, C2. Each of the two acoustic ellipses has as one of its two focus points a stereo speaker tweeter driver where the left ellipse e1 has as one of its focus points the leftmost speaker tweeter driver F12 and where the right ellipse e2 has as one of its focus points the rightmost speaker tweeter driver F22. The other focus points of the two ellipses, E1 and E2, are brought together to become a common and shared concentrated focus point at the listener location 19*a*, specifically at the listener's location, F11, F21.

One of the reasons this embodiment system application of these ellipses is specialized is that ellipses are normally used separately, but are, instead, in a manner that has never been done before, joined together by the presented embodiments and interconnected together at a listener location 19*a* into one highly-specialized and cooperative combined and powerful acoustic ellipse system e1, e2. In addition, the presented embodiments strategically take advantage of only specific and limited selected portion of the area (less than 50%) within each of these two ellipses e1, e2 in order to take maximized acoustic advantage of their reflective power. At the same time, however, for acoustically-cooperative and advantageous reasons, the presented embodiments do not use and purposefully avoid using other specific areas within the two ellipses e1, e2.

Specifically, the presented embodiments purposefully cut-in-half both the ellipses, e1 and e2, along each their major axes. That is, along the major axis of the left acoustic ellipse e1, specifically at −a, a1 through the left speaker's tweeter driver F12, and along the major axis of the right acoustic ellipse e2 specifically at −a2, a2 through the right speaker's tweeter driver F22. Of significant acoustic value and variance from typical ellipse applications is that the major axis portions of the two cut-in-half acoustic ellipses e1 and e2 are joined together, cross each other, and precisely go through the listener's location 19*a* on the same plane as the listener's location at the ellipses' two other focus point locations F11, F21, such that one symmetrically shared listener focus point, F11, F21 is the same common and acoustically concentrated focus point for the two outer halves of the acoustic ellipses e1 and e2.

Furthermore, the presented embodiments purposefully utilize as their strategic shared performance area primarily only the area between the major axes of these two cut-in-half left and right ellipses, −a1, a1, and −a2, a2, and the outermost sides of these two ellipses e1L, e2R (the portion represented by the arrows and #'s). In addition, what is specifically not used is the right half of the left ellipse e1 and the left half of the right ellipse e2. The acoustic result is that embodiment system sound reflective components positioned within the cross-hatch area of the left and right ellipses e1L, e2R can substantially, symmetrically, and synergistically capture significant quantities of lateral indirect sound emitted from the nearest of the two speakers F12, F22 from their nearest focal point locations F12, F22 and focus that sound toward the nearest ear of the listener 19*a* at the shared listener focus points F11, F21. In this regard, the embodiment system sound controlling components are symmetrically disposed such that the incident rays from the speakers can be efficiently reflected off from an extended or elongated Embodiment system's specular sound-reflective surface. The reflected acoustic rays are focus directed toward the listener's location 19*a* from a plurality of simultaneously arranged symmetrical positions from all along the horizontal and vertical specular sound-reflective surfaces that are positioned and angled in the embodiments' expanse of space especially between the speakers and the listener's location. The reflected sound waves from the speakers directed at the listener's location can approach that location from a plurality of angles and directions simultaneously and with amplitude levels close to the original incident ray from the speakers. It causes the sound picture taken from the original encoded sound field to be presented to the listener in an impactful three-dimensional manner causing a believably-real and acoustically-pleasing audiophile-grade surround sound experience for the listener, without electronically manipulating or corrupting the sound signals.

The specialized restricted utilization of the above-mentioned selected portions and areas of acoustic ellipses e1, e2 with the specialized embodiments' and their sound reflective component arrangements allows the embodiments to purposefully use these specialized acoustic ellipse portions and areas to quickly, economically, energy-efficiently, and with synergistic effectiveness, acoustically solve two major stereo audio sound reproduction problems simultaneously, stereo speaker crosstalk and out-of-sync listening room reflections. At the same time, this allows the presented embodiments to provide the listener with substantial audiophile-grade acoustic improvements in universally-available two-channel stereo audio sound reproduction that have not been previously available to the industry at any price point.

In addition, as mentioned above, the presented embodiments purposefully do not use essentially the remaining halves and up to two-thirds of the area within the rest of these two ellipses e1, e2 for two separate and acoustically-important reasons. One reason is that, if the other half or two-thirds of the ellipses were to be used as is normally the case for ellipses, this would add substantially-destructive acoustic energy into the system's performance area, including harmfully increasing stereo speaker crosstalk at the listener's position, instead of allowing the embodiments to reduce or effectively cancel speaker crosstalk with the presented specialized acoustic arrangement, as further detailed in the crosstalk explanation section. The second important acoustic reason is that the presented embodiments specifically do not use acoustic portions of the ellipse located behind the speakers that are located more than one and one half (1.5) meters behind a line between the speaker's foci points F12 and F22. This is because if the portions of the acoustic ellipse behind the speakers were to be used to reflect back radiating sound from the speakers as is normally the case for ellipses, these portions of the ellipse would introduce destructive out-of-phase sound from the back of the two speakers' foci points F12, F22 into the embodiments' performance area (see arrows and cross-hatched areas), thereby harmfully affecting, instead of substantially enhancing, the sound to the listener.

The distance between the speaker tweeters can vary from less 30 centimeters to more than 1.5 meters apart, and the speakers' toe angle positions can vary substantially without dramatically affecting the above detailed left and right side embodiment system performance areas.

In summary, the presented embodiments' effective performance area consists of the left half e1L of the left ellipse e1 and the right half e2R of the right ellipse e2 up to their major axes locations, respectively −a1, a1, and −a2, a2, and minus the area beyond one and one half (1.5) meters behind the back of the speaker tweeters F12, F22. The embodiments' specialized acoustic application is a highly-precise double-combined symmetrical ellipse acoustic setup arrangement. However, a precision setup can be significantly simplified for quick setup in almost any room or space in any room in less than 15 minutes by the listener/user with the aid of an optional symmetrical part-alignment positioning system (SPAPS) and their quick-reference positioning symbols (QRPS), detailed below.

The following is a description of the presented embodiments in one of their simplest forms. As illustrated in general FIGS. 1B, 1C, 1D, and 1H, the embodiment system assemblies presented herein can be reduced to a one or more generally vertical, mostly specular sound reflective surfaced panel that can be planar, curved, or combinations thereof, that is supported in no particular way. It is arranged on each of the outermost sides of a listener and the outermost sides of two universally-available stereo speakers (speaker assembly including the speaker stands if needed), where the speakers 1*a*L and 1*a*R (and/or speaker assembly) and the listener 19*a* are arranged in a traditional triangular setup arrangement. The panel extends between and on the same plane as the speakers' tweeter drivers and the listener's ears as depicted in illustrations throughout this document. The front of the overall assembly can be open or closed and be positioned spread-apart from or in close proximity to the speakers, including to physically touch, be attached or connected to, or be a component part of one or more parts of the speaker assembly, or combinations thereof. The listener end of the panel can be arranged from 3 meters to close to or touching the outermost sides of the listener and where the assembly is capable of non-electronically capturing significant quantities of normally wasted and acoustically-corrupting indirect sound especially between the speakers and the listener which is typically allowed to be uncontrollably emitted and broadcast out into a listening room from the speakers, but which is prevented by the sound controlling panel arrangement to a degree that the captured sound from the speakers is able to be substantially utilized by the embodiment system sound controlling surfaced panel arrangement by substantially reflecting the incident captured indirect sound from the speakers toward the listener's ears in a coordinated, symmetrically-controlled focusing arrangement from both sides of the listener simultaneously. The expanse of sound is able to be coordinated and time-line arranged by the horizontally and vertically extended sound reflecting and/or sound reflective surfaced panel arrangement to where the captured indirect sound is substantially utilized by the assembly to effectively cancel stereo speaker crosstalk and effectively prevent out-of-sync room reflections from corrupting the speaker emitted stereo sound heard by the listener, and where the stereo sound is then able to be heard by the listener in a substantially-enhanced, more spatially delineated way. This includes presenting the listener with a three-dimensional sound picture taken from the surrounding sound field encoded in universally-available two-channel stereo sound signals that is a truer sound picture of the originally encoded three-dimensional sound presentation than what is normally able to be heard by a listener in a listening room and where acoustically-significant embodiment system sound controlling panels can also be extended or added from the side of the listener to the back of the listener and can include overhead portions of one or more listeners and/or speakers.

The structures and compositions of the following embodiments may include one or more expansive, substantially-extended sound-controlling surfaces or panel components. They may be configured with one or more substantially planar portions, one or more substantially curved portions, or a combination of portions thereof. They may be portable, compact, freestanding, knock-down, flexible, permanent, and/or optionally adjustable and user interactant. They may be comprised to acoustically function as above detailed with one or more audio speakers, and similar, dissimilar or a mixed combination of suitable sound-controlling surfaces, materials, modules or panel components which include one or more primarily smooth first-order mostly specular sound-controlling surfaces, materials or panels, made up of one or more sizes, and shapes, including suitable non-sound-reflective materials, organically-shaped structural materials, single modular elements, of a variety of micro and macro acoustic formations, including sustainably-responsible materials and standardized interchangeable components such as sound shapers, acoustic extenders and acoustic skins (e.g., materials having more than one layer and be capable of reflecting sound waves but that may not be self supporting or have a dimensionally stable structure) that essentially create their own acoustically-pure listening environments, and that can be adapted quickly, easily, inexpensively, and energy-efficiently to a wide variety of professional, commercial, medical, therapeutic, and consumer acoustic listening spaces, individual listening preferences, and listening applications, as detailed and illustrated in the following sections of this document.

As referenced in FIGS. 1B through 1H, one or more acoustic controlling embodiment system components including one or more substantially-extended sound-controlling surfaces or panel components, which may be continuously connected together, non-continuously connected, separated apart or overlapped independent components on the same or different planes, including a combination thereof, as detailed and illustrated herein. They are suitably precision-shaped and suitably acoustically located at least in the substantial expanse of open space between the speakers and extending at least to the sides of the one or more listeners. They are thereby acoustically position-optimized to suitably capture, extract, and coordinate focus macro and micro progressively time-line-arrayed surround sounds that may be captured and reproduced from the localized surround sounds that may have been naturally encoded within stereo signals. This includes conventional two-channel stereo audio sound signal sources that may also include original stereo audio sound signal sources, thereby beneficially captured in order to be able to be beneficially utilized by one of more sound-controlling embodiment system acoustic components from the audio speakers' normally inefficiently-wasted and normally harmfully uncontrolled indirect sound energy signal output.

After suitably capturing and controlling the speakers' indirect sound information including its time-line-arrayed surround sounds, one or more sound-controlling embodiment system components reposition and project this captured and controlled sound information substantially toward and around one or more listener positions. The sound is repositioned and projected from a plurality of mostly symmetrically-balanced progressively time-line-delayed horizontal and vertical locations, directions and angles from all along one or more sound-controlling embodiment system components including from all along the embodiment system substantially-extended sound-controlling surfaces or panel components.

The sound-controlling components of the presented embodiments thereby capture, control, utilize, and can redirect to the listener natural time-delayed or progressive time-line-encoded acoustically-pure sounds captured and reproduced from the localized surround sounds that may have been naturally encoded within stereo signals. This includes, for example, sounds that may have been originally encoded into historic legacy original stereo signal sources, utilizing subtle encoded sounds, which in the past have been previously substantially unavailable to the listener. These sounds arrive to and around the listener's position directionally and chronologically in a proportionately-natural-sounding, time-delayed acoustic spread pattern where they can easily be pinpoint recognized by the listener and spatially differentiated from other nearby sounds up to a 360° space around the listener.

These acoustic controlling embodiment system components create a coordinated, complementary, acoustic interrelationship with one other, and with other acoustic components, including with and between embodiment system sound-controlling surfaced panel components. This creates a type of intimate enclosure that may substantially encompass the audio speakers and that may extend to the back and above one or more listeners, such that the embodiment system acoustic enclosure structure creates a form of synergistic acoustic interrelationship between the audio signal, the audio speakers, an optional audio-visual display, one or more listeners, and the sound-controlling embodiment system acoustic components, as more extensively detailed in the following embodiments, and as generally illustrated in FIGS. 1B, 1H, 9, 13, 19, 21, 21-A, 26, 28, 29, 30, 31, 32, 33 and 34.

Embodiment system sound-controlling components including embodiment system acoustic enclosures are purposefully and suitably acoustically position-optimized to utilize a significant portion and substantial quantity of the speakers' acoustically-pure progressively time-line-encoded indirect sound information and sound energy as the sound waves bloom, develop and expand outwardly and away from speaker propagation points.

Embodiment system sound controlling components are positioned to capture significant portions and substantial quantities of speaker emitted indirect sound energy critically before this acoustically-pure indirect sound information and sound energy can become acoustically-corrupted, inefficiently-wasted, and serious acoustic-damaging indirect sound information and energy. In this respect, the components act as an optional integral part of the speaker's overall sound radiating and acoustic control system.

Embodiment system acoustically-significant components, such as sound-controlling sidewall panel components, sound shapers, and acoustic extenders may be made of any suitable sound controlling surfaced material that is sufficiently sound-controlling. Generally, when a more acoustically-defined, stronger, more vivid and more sharply-focused sound picture is desired with a smaller, more controllable, and more focused beam spread pattern (see double circles on acoustic amplitude tests B through G, FIG. 1H, for the acoustic focal area position at and around the listener's position 19*a*), especially for example, for the more sound controllable embodiment system locations and acoustically significant components, a harder, denser, flatter, smoother, glossier, non-porous, and more acoustically specular sound-controlling surfaced material can be utilized on one or more substantial sound-controlling acoustic components or parts thereof with the presented embodiments to provide these high-performance reflective acoustic results.

On the other hand, when a more generalized, broader, less defined, weaker, more sound diffused and less focused sound picture is desired with a wider, less defined beam spread pattern and focal area, especially for example, for embodiment system sound-controlling locations receiving a less direct or more obstructed line of incident sound wave energy from the speakers, a hard but rougher, less flat, less smooth, more matte, less dense, more porous, more diffused and/or more sound absorbing surfaced material can be utilized on one or more sound-controlling components or component locations of the presented embodiment system to successfully provide these reflective results.

Being able to provide personalized sound reflective surfaced embodiments with different customized acoustic results, including low-cost embodiments provide a better accommodation for a wide variety of acoustic needs and applications. However, depending on such acoustic factors as, for example, (1) the quality, type, and content of the sound source stereo signals, (2) whether the playback system is well-balanced, on the bright side, or more laid-back, (3) the speakers' acoustic sound signature, (4) the distance between the speakers and the listener, (5) the size of the employed or preferred embodiment system, (6) the quality and quantity of sound concentration desired, (7) the degree of embodiment system component symmetry, (8) the embodiment system's intended acoustic application, (9) the acoustic needs and preferences of the listener and acoustic designer, and the like, the former is often far more preferred over the later for most high-performance sound source material and for most of the sound-controlling embodiment system component surfaces on the following embodiments.

Directional sound frequencies and directional sound frequency ranges are also important for speaker interaction and the cooperative association of a directional sound-controlling embodiment system for assisting listeners and acoustic designers with being able to directionally discern where one or more sounds are coming from around the listener within an employed embodiment system. Directional sound localization of natural human hearing is not present in the lower frequencies. Important directional sound localization starts to take place at frequencies of approximately 1,600 Hz and higher, with more precisely-localized directional sound discernment occurring in the horizontal plane in frequency ranges from about 2,000 Hz upward to 20,000 Hz, with increasing directional ease of discerning horizontal and vertical sounds and surround sound group delay information occurring more in frequencies above 4,000 Hz. The use of middle to higher frequencies, therefore, is more directionally and spatially important to the average listener and for the design and use of embodiments, because these are the frequencies that can assemble for the listener a natural sounding directional surround sound field of up to 360° around the listener's position, including from a multiplicity of horizontal and vertical incoming angles and directions simultaneously.

Conventional stereo systems, however, due to the limitations of using only two front-located speakers to reproduce an entire 360° surround sound field that is often encoded within two-channel stereo signals, tend to congest, bind-up, restrict, and compact the surround sounds and the surround sound field information encoded within two-channel sound signals into a narrow plane or area in front of the listener. The presented embodiments, because they can provide natural surround sounds and a greatly-expanded surround sound field of up to 360° around the listener's position 19*a*, including from a multiplicity of simultaneous horizontal and vertical incoming angles and directions (while using the same sound field information encoded within same two-channel sound signals to do so), the ability and responsibility to separate close proximity sounds away from each other, and to enable the listener to discern precisely where an individual sound is coming from within this greatly-expanded sound field space surrounding the listener becomes much more important to the average listener and for the fundamental functional design of an employed embodiment system.

Because the above mentioned ratio of reflected acoustic power to incident acoustic power of a reflective material and its capability to provide highly-localized pinpoint sounds within an expansive sound field increases and approaches one as directional sound frequency increases, as the use of higher specular sound reflective surfaces increase, and because of the cooperative association of expansive symmetrically-positioned embodiment system sound-controlling components as detailed and illustrated in FIGS. 1B-1D and 1H, the presented embodiments can better control incident indirect sound. It especially controls its more directional middle to higher frequencies more efficiently and can better utilize the maximum power within that added energy source.

In addition to the sound-reflective surface and the material composition of the embodiment system sound-controlling components, sound-controlling embodiments' sound controlling components need to be properly structurally sized, shaped, and positioned in relation to the speakers and the listeners.

Figure 19:
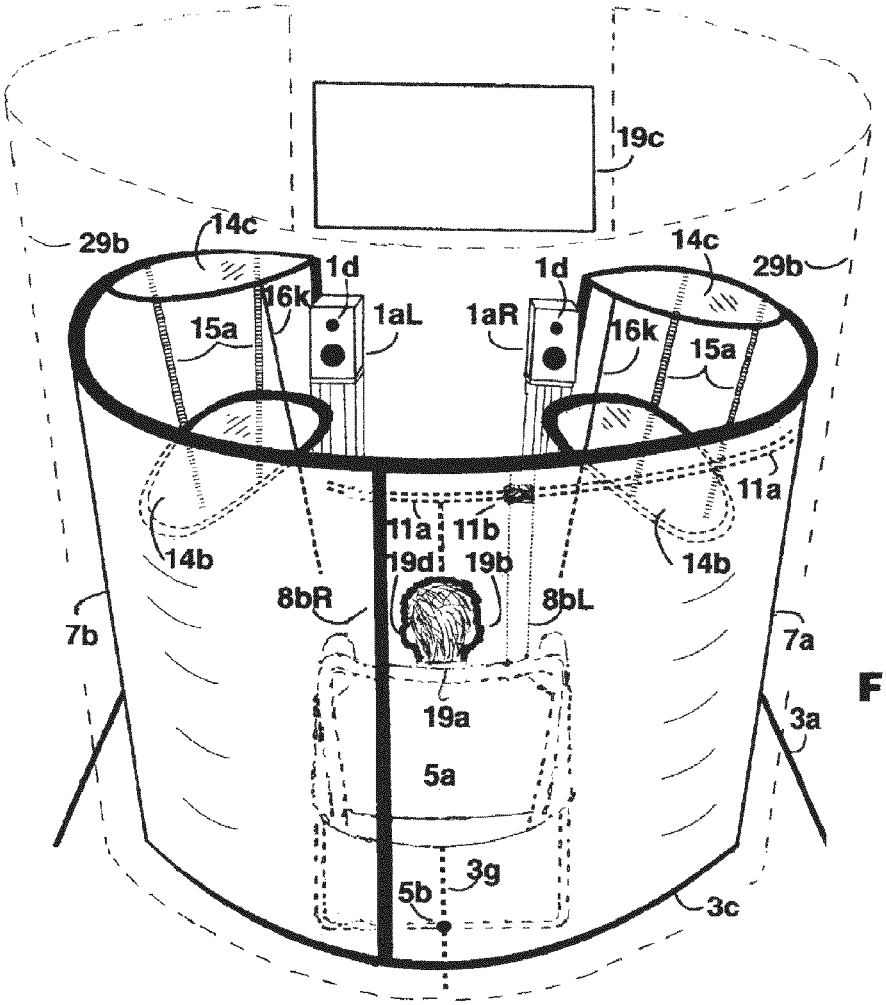
FIG. 19 shows a perspective view of a portable, fully-setup, fully-operational, adjustable-size embodiment system showing upper and lower sound shapers, speakers, and listener in precision symmetrical alignment, along with an audio-visual device.

In this regard, because embodiments' sound controlling composition can be composed of a wide variety of suitable sound reflective surfaces, one or more sound-controlling embodiment system components, such as one or more sound-controlling sidewall panel components 7*a* and 7*b*, FIG. 19, can be manufactured, for example, more expensively as a combined audio-visual embodiment system using large flat, or newer curved, widescreen high-definition visual display units as embodiment system sidewalls. They can serve a dual purpose of being used both for their normal visual display purpose, but also acoustically positioned at the left and right embodiment system sidewall locations 7*a* and 7*b* to also effectively capture, control, and reflectively focus-utilize speaker emitted indirect sound toward the listener 19*a*. Two or more of these left and right sidewall positioned visual displays, therefore, can serve as an acoustic skin form of visual display. These symmetrically-positioned sidewall visual displays can be added to the center-located visual display 19*c* illustrated in FIG. 19.

Embodiment system structures can also be constructed, for example, using expensive and less precise acoustic techniques and an assortment of heavy weight, highly-non-portable, rigidly-structured, high base cost materials, including those requiring extensive support structures that do not add acoustic enhancement or operational benefits, including imprecise, acoustically-variable sound-controlling structures that use environmentally unfriendly materials. These embodiment system structures can also be manufactured using more cumbersome acoustic designs that require substantially extended setup times. Embodiment system designs can also include less precise acoustic shapes, positions, inclinations and angles than detailed or illustrated in FIGS. 1B-1D and 1H.

The functional purpose of any size of this assembly of sound-controlling embodiments acoustically significant components is to capture and progressively time-line spread-out around the listener the significant portion and substantial quantity of captured acoustically-pure indirect sound utilizing the unmodified acoustically-pure output from a standard stereo speakers as detailed and illustrated FIGS. 1B-1D and 1H. This substantially-extended, suitably-sound-controlling-surfaced embodiment system acoustic structure, as illustrated in FIGS. 1B through 1D, 1H, and 19, must be substantially large enough, extended enough, positioned mathematically appropriately enough, and arranged in such a suitable acoustic manner that the sound-controlling embodiments' acoustically significant components cause significant portions and substantial quantities of acoustically-pure indirect sound information and sonic energy from the unmodified speaker source to be symmetrically focused and to converge substantially toward the listener's position in a continuous, cohesively-interconnected progressively time-aligned manner.

The embodiment systems stay faithful to the original sound event, limit compromising the original sound, limit the amount of distortion, and reproduce the highest fidelity in order for the listener to hear the audio signal without alteration. In this respect, even though one of the substantial acoustic results of positioning an embodiment system with a stereo audio system is a substantially acoustic addition to the overall sound heard by the listener, as referenced by FIGS. 1B through 1H, the embodiments, because they are able to use the unmodified acoustically-pure output from standard stereo system speakers, add nothing to either the above-mentioned sound information or sound energy encoded into the acoustically-pure audio sound signals and nothing is acoustically added to the sound information or sound energy emitted by the stereo speakers. Nothing is added by the embodiments and nothing is subtracted. Nothing in the acoustically-pure signal is modified, altered, created, equalized, or changed by the presented embodiments. Furthermore, no echoes, reverberant acoustic effects, or surround sound artifacts are introduced into the signal by the following embodiments.

On the initial audio sound recording and encoding side in a simple two-channel stereo recording and encoding process of a pure recording of a live sound event, for example, two professional stereo audio sound recording microphones, which may represent two stereo speakers on the sound reproduction side, are placed in strategically chosen locations relative to the sound source(s), with both recording simultaneously. The two recorded channels will be similar, but each will have its own unique and distinct acoustic vantage point with its own, for example, progressive time-of-arrival and sound pressure level information from each sound. This information is used to then initially capture and record the plurality of different macro and micro sounds in real time into the sound signals from the plurality of individual, separate and detached surrounding sound sources that are pinpoint-positioned and spread-out around the recording microphones within the real three-dimensional holographic sound field, thereby simultaneously and automatically recording and encoding this massive accumulation of macro and micro sound information separately and uniquely onto its own audio sound source signal.

On the audio sound reproduction side, during playback, the embodiment system sound-controlling reproduction process utilizes its precision-positioned acoustic components to capture those subtle differences in timing and sound level information.

The embodiments' sound reproduction process utilizes its precision symmetrical-positioned acoustic components to help substantially-capture, control, and present to the listener essentially the same macro and micro sound information that was originally-captured and macro and micro recorded by the original recording microphones.

When comparing the microphone sound recording process to the embodiment system provided surround-sound decoding and reconstruction process, it is helpful to comparatively note that the physical location of the original sounds, surround sounds, and surround sound field being recorded by the stereo recording microphones and encoded into the two stereo signals are, in fact, substantially detached from and separated out in all directions from the recording microphones and their microphone location(s). In the same similar way but in inverse order, the embodiment system decoded and reproduced localized sounds, surround sounds, and surrounding sound field can also be physically substantially detached from the physical location of their propagating speakers and spread out in all directions around the listener in a similar inverse way that the original encoded sounds, surround sounds, and the surrounding sound field are physically detached and spread out in all directions around the physical location of the recording microphones.

As detailed and illustrated in FIGS. 1B through 1H, the embodiment system's substantial capture and controlled utilization of a significant portion and substantial quantity of normally wasted acoustically-pure indirect sound energy power from the speakers successfully provides the listener 19*a* and acoustic designer with a wide selection of listener-adjustable embodiment system sound shaping, sound-controlling, and sound revealing devices, materials, setup arrangements, and acoustic focusing options, including acoustic skins, sound shapers, and acoustic extenders that are fast, simple, and inexpensive to use, optionally adjust, and interchange. They also accommodate the acoustic designer's need for specific acoustic application control, including the ability to select acoustic options needed or desired by specific listeners.

Specifically, with reference to FIGS. 1B through 1H, the presented embodiments successfully provide the ability and opportunity to quickly and easily increase or decrease the intensity, quantity, or amplitude of embodiment system provided acoustically-pure sound heard by the listener 19*a*, and decrease or increase the size of the embodiment system acoustic focal area around the listener 19*a*; increase or decrease the intensity, quantity, or amplitude of particular frequency ranges of sound heard by the listener 19*a*; change the shape, directional characteristics and/or the acoustic focal point of individual locational sound propagation points and/or the entire acoustic focal area, including up, down, sideways, forward, or backward; and/or increase or decrease the intensity, quantity or amplitude of spillover leakage sound or nuisance sound as heard by nearby non-listening neighbors, family members, or individuals outside of the embodiment system sound-controlling enclosure.

Flexible sound-controlling materials allow for the sound shaping and sound control opportunities outlined below such that, for example, curved shaped sound-controlling materials can either more tightly focus or more widely spread embodiment system provided acoustically-pure sound.

Also, as the curved shape of flexible sound-controlling reflective surfaced materials and individual sound-controlling embodiment system reflective surfaced components are either increased or decreased, as the same size of a sound-controlling acoustic component is moved either closer or further away from the speakers and the listener, and as the inclination or rotation angle of sound-controlling reflective surfaced materials and components are angularly inclined, rotated, or positioned either incrementally toward or away from the nearest sound source speaker in relation to the listener's position 19*a*, the amount of surface area exposed to incident sound from the speaker source and subsequently directed toward the listener's position 19*a* is allowed to be respectively increased or decreased accordingly. Thus, sound shaping and sound control opportunities may be attained.

As the sound-controlling reflective surface is made more or less specular, sound shaping and sound control opportunities may be attained. A given sound-controlling reflective surface, internal wall composition, and add-on panel components are increased in size and/or made more sound diffusing, sound absorbing, or sound deadening as explained in this document, sound shaping and sound control opportunities may be obtained.

As the size of one or more embodiment system sound-controlling components is increased or decreased, and as the overall size of the overall embodiment system enclosure is decreased or increased, the overall system amplitude level of embodiment system provided acoustically-pure sound may be adjusted respectively up or down while simultaneously attaining the same approximate system and/or sound source speaker amplitude level. Thus the sound shaping and sound control opportunities may be obtained, such that as the overall embodiment system size is reduced, higher frequency ranges of sound may be made more relatively apparent to the listener's position 19*a*, and as the overall size is increased, midrange and lower frequencies may be made more relatively apparent to the listener 19*a* while higher frequency ranges may be made less relatively apparent to the listener's position 19*a*.

As the size of one or more embodiment system sound-controlling components is increased or decreased, and as the overall size of the overall embodiment system enclosure is decreased or increased, that the overall amplitude level of the system and/or sound source speaker amplitude level may be adjusted respectively down or up while being able to simultaneously attain the same approximate amplitude level at the listener's position 19*a*, thus the sound shaping and sound control opportunities may be obtained.

By expanding or concentrating the system's acoustic focal area of sound concentration, including moving the listener 19*a* into or out of that acoustic focal area (see double circles around the listener's location 19*a* in FIG. 1H), that the sound shaping and sound control opportunities may be attained. The sound shaping and sound control opportunities may also be attained so that as the listener 19*a* moves more into the system's acoustic focal area (double circles around the listener's location 19*a* in FIG. 1H). As that acoustic focal area is reduced in size, higher frequency ranges of acoustically-pure sound may be realized and made more apparent relative to the listener's position 19*a*. Also, as the listener 19*a* moves more out of the system's acoustic focal area and as that acoustic focal area is increased in size, midrange frequency ranges of acoustically-pure sound may be realized and made more apparent relative to the listener's position 19*a*, and higher frequency ranges of sound may be made less apparent relative to the listener's position 19*a*.

An embodiment system structure together with sound shaping control devices, materials, and presently-revealed method of application, including acoustic skins, sound shapers, and/or acoustic extenders allow for two acoustic focal areas or one horizontally-elongated focal area to be realized within one embodiment system, such that the two focal areas or one horizontally elongated acoustic focal area may trade off sound shaping and sound control opportunities, and that their sound shaping and sound control opportunities may be combined onto two or one elongated focal area. This can be attained by spreading apart the listener location 19*a* shown in FIGS. 1B through 1D and 1H.

One or more of the individual sound shapings and sound controls above may be combined together with one or more other individual sound shapings and sound controls to successfully provide an exponential plurality of unique, optional, and adjustable levels of listener interactive sound shaping and sound-controlling abilities and opportunities for the listener and the acoustic designer.

Presentation of the Many Advantages Provided by the Various Embodiments

A left side only description is explained for simplification. Although the following information applies to the effective elimination of stereo speaker crosstalk for a whole embodiment system, with both left and right sides symmetrically combined into a synergistic embodiment system structure, the following will be explained in left-side only component detail and illustration in order to help simplify it's understanding. The right side presently-revealed method of application is the same embodiment system method as explained, but applied to a symmetrically-positioned mirror image right side of the employed embodiment system.

A substantial quantity of otherwise wasted indirect sound is captured from the left speaker by the left side of the presented embodiments as acoustically-pure sound, and is exclusively added to the left side of the listener. This includes additionally-added, acoustically-pure, left side acoustic amplitude, spatial localization, progressive time-delay information, as well as listener-adjustable levels of associated acoustically-pure, left side only, indirect stereo sound wave energy (refer to arrows 1 through 5 in FIG. 1B). Additionally, the embodiments' non-conventional "toed-out" speaker angle position (speaker positions 1*a*L and 1*a*R in FIG. 1B) advantageously produces a reduced, sometimes significantly reduced, quantity of damaging crossover crosstalk sound than does the conventional "toed-in" angled speaker arrangement (as shown by speaker 1*a*L, Figure in 1A). Additional potentially destructive left-speaker crossover crosstalk propagation paths to the right side of the listener (dotted lines in FIG. 1B) can be deflected harmlessly and substantially away from the listener's right side by the presented embodiments to help further effectively reduce the remnants of stereo speaker crosstalk for the listener. To complete the embodiment system process, both independent left and right side operations are symmetrically and synergistically combined.

The presented embodiments cancel stereo speaker crosstalk without electronically manipulating or corrupting the original sound signals. The presented embodiments provide simple, low-cost, energy-efficient stereo speaker crosstalk cancellation.

The presented embodiments effectively block and prevent acoustic-damaging out-of-sync listening room reflections thereby eliminating their harmful acoustic effects. The presented embodiments provide quick, easy, uncomplicated, reliable, repeatable, energy efficient audiophile-grade sound. Embodiment system solutions can be manufactured affordably and sold at a commercially-affordable price. The presented embodiments can dramatically surround and immerse the listener with normally difficult to reproduce music surround sounds.

The embodiments can cause sounds to arrive both simultaneously and time-line positioned. The embodiment system-provided indirect sound can be used alone, or seamlessly combined with direct sound. The embodiments successfully provide the optional acoustic ability to capture, control, and exclusively utilize either the speaker's acoustically-pure indirect component alone, or optionally seamlessly time-line combine both the speaker's direct and indirect sound propagating components together in a seamless, acoustically-pure, time-line coordinated, and ordered process. The embodiments can combine indirect and direct sound in different ways.

The presented embodiments unlock and symmetrically present natural time-line encoded surround sounds. The presented embodiments deliver a natural, believably-real three-dimensional surround sound replica of surround sound fields around the listener.

The embodiments can turn the sound from two speakers into highly-impactful three-dimensional holographic surround sound. The embodiments reveal and spatially localize around the listener important subtle normally-buried acoustic details, neuances, and information. The presented embodiments can unlock pleasing, low-level sonic cues that are of audiophile-grade quality. The presented embodiment system acoustically-pure surround sounds have unrestricted movement around the listener.

The embodiments deliver acoustically-pure sound from an unlimited number of sound projection sites around the listener. The presented embodiments allow all encoded sounds to utilize all parts of reflector surface simultaneously and fluidly. The embodiments deliver surround sounds to listener that are authentic and exactly like real surround sounds. The presented embodiments create an adjustable, acoustically-immersive, sound reflecting projection-screen and resulting sound image field around the listener. The embodiments' sound reflecting projection-screen successfully provides an uncountable number of individual, naturally-positioned, pin-point-localized, physically-real, sound locations, angles, and directions to the listener. The presented embodiments' sound reflecting projection-screen can be positioned around the listener to not only reflect and project sound but also be a high-value audio-visual display.

The presented embodiments' captured acoustically-pure indirect sound greatly exceeds sound received directly from speakers providing high-performance sound enhancement. The embodiments' substantial addition of acoustically-pure sound provides believably-real positioning of surround sounds. The presented embodiments deliver substantially more of the original whole sound to the listener.

The embodiments can greatly increase the value of entire sound reproduction systems and their individual system components. The embodiments greatly can expand the normal performance ability of lower cost systems. The presented embodiments substantially expand listener and audio industry speaker choices for high-performance acoustic applications. The presented embodiments provide energy savings, including substantial energy power usage reductions for a surround sound system, at the same or better acoustic performance level. The presented embodiments need only a 7 Watt amplifier to successfully deliver three-dimensional audiophile level surround sound results.

The presented embodiments can use original pure signals to reproduce their originally-encoded surround sounds. The embodiment system captured acoustically-pure indirect sound and direct sound are heard as one seamless, uncorrupted, completely integrated sound, producing a surround sound field independent of the speakers' location(s). The embodiments present surround sounds to the listener that are not heard as originating from the direction of the speakers. The embodiments' resulting surround sound field can provide surround sounds holographically to and around the listener. The embodiments can entirely acoustically replace the surrounding room, thereby nullifying, the surrounding room's damaging acoustics. The embodiment system avoids common proprietary acoustic mismatch problems and incapabilities because it doesn't use electronics.

The presented embodiments can dramatically improve the emotional and perceived quality level of low quality reproduced sounds. The embodiments high quality results can be enhanced, customized and even further demonstrated with improved stereo systems and components.

The following details of the embodiment system are presented in reference to their use as embodiment system surround sound listening rooms (ESSSLRs). The presented ESSSLRs are portable, are adjustable, and can be setup into surround sound listening rooms in less than 15 minutes. The presented ESSSLRs are inexpensive and simple to setup and use because their main sound-controlling components can also serve as structural components without requiring added structural components.

The presented portable ESSSLRs and their components are constructed of extremely lightweight, tough, durable materials that can be made with high dent and impact resistant. The presented portable ESSSLRs are person, pet, household goods and furniture friendly.

The presented ESSSLRs shield and block acoustic damaging listening room reflections without requiring permanent installations. The presented ESSSLRs provide symmetrically-balanced acoustically-pure sound. The presented ESSSLRs provide portable dedicated listening rooms without typical dedicated listening room construction costs and space requirements. The presented ESSSLRs are dependable and incrementally sizable and resizable. The presented ESSSLRs totally replace both the physical and the acoustic limitations of any room. The surround sound listening room can now be reduced down to the physical size of any ESSSLR. The presented ESSSLRs can be placed almost anywhere. The presented ESSSLRs easily adjust both physically and acoustically for a number of applications, including special needs environments.

The ESSSLRs can provide the same dependable, consistent and repeatable positive acoustic results each time—even in acoustically unsuitable rooms. The presented ESSSLRs can be placed in any part of room, faced in any direction, with the same audiophile-grade results. The presented ESSSLRs create quick, easy, low-cost, and energy efficient listening experiences. The presented ESSSLRs provide consistency between what listeners' hear in the showroom and what listeners' will hear at home or in their apartments after purchase. The presented ESSSLRs provide low-cost, adjustable, standardized, and highly-reproducible listening room experiences that are reproducible almost anywhere even by the average listener. The ESSSLRs can provide full-room size, or fully-portable, fully-modular, chair, and desk size options. The presented ESSSLRs provide different sizes, acoustic materials, component selections, and price options. The ESSSLRs can be completely disassembled, and placed out-of-sight, in 5 to 15 minutes.

The following explains and details the many ways that the presented embodiments, referred to above as surround sound listening rooms or ESSSLRs, utilize symmetrical part-alignment positioning systems (SPAPS) with pre-marked and attached quick-reference positioning symbols (QRPS) to quickly, easily and substantially enhance the precise, symmetrical, and synergistic setup, positioning, adjustment, and experimental use of the embodiments, including their three categories of acoustically-significant sound-controlling components.

Figure 6:
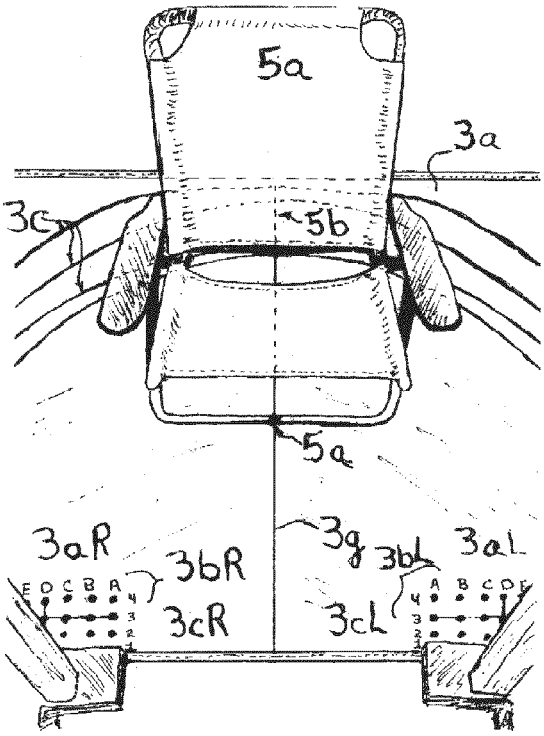
FIG. 6 shows a normal 15 minute general setup arrangement. Close-up perspective view showing floor template type of symmetrical part-alignment positioning system and quick-reference positioning symbols showing speakers and listener positions precision coordinated and symmetrically aligned.

Examples of the presented embodiment system symmetrical part-alignment positioning system (SPAPS) components include: Portable floor template symmetrical part-alignment positioning system (SPAPS) (example 3*a*, FIG. 3); Symmetrical speaker SPAPS (example 2*b*, FIG. 2); Symmetrical speaker SPAPS examples 3*b*L and 3*b*R (FIGS. 3 and 6); Symmetrical part alignment wall expansion and contraction positioning system (SPAPS) (example 11*a*, FIG. 12); Hook-loop covered wall-mounted slidable positioning fastener hanger system with SPAPS (example 15*b*, FIGS. 13, 15, and 18); Telescoping cross-part adjusting device SPAPS (example 16*f*, FIGS. 16, 19, 26, 28, 29, and 32*j*); and Wall-mounted SPAPS (example 18*a*, FIG. 18).

Figure 4:
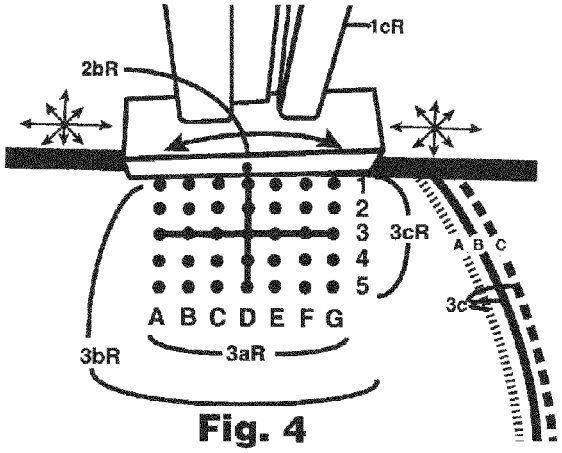
FIG. 4 shows a normal 15 minute general setup arrangement. Perspective view showing floor template type of symmetrical part-alignment positioning system and quick-reference positioning symbols used for simple, fast, and symmetrically-accurate precision positioning of speakers.
Figure 13:
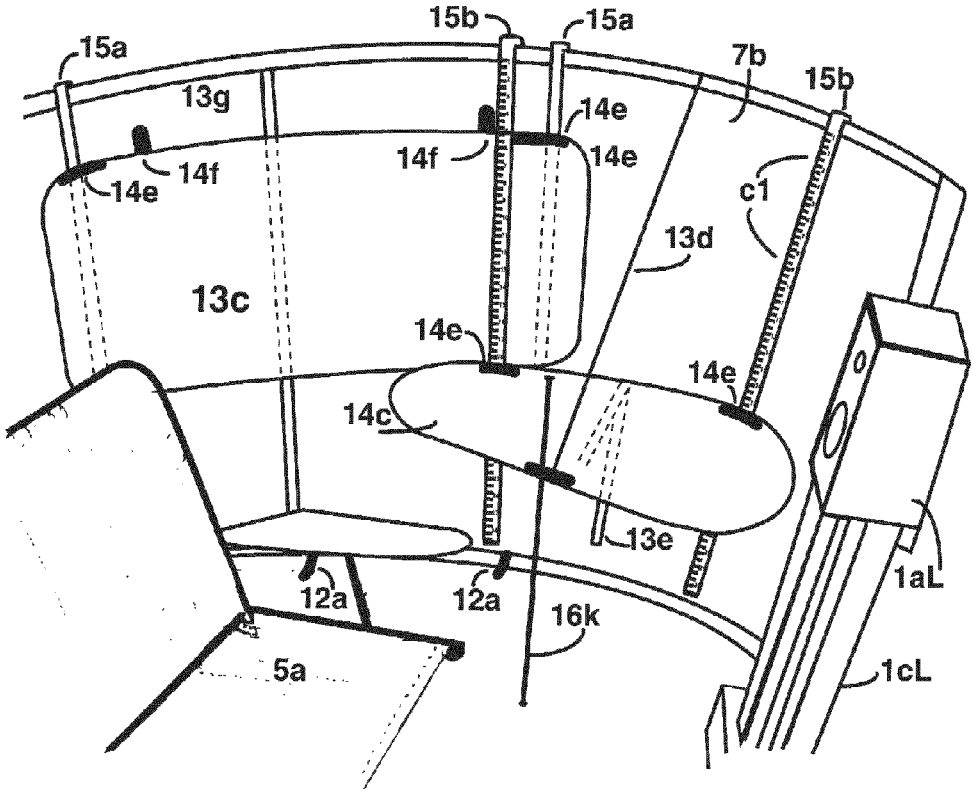
FIG. 13 shows a perspective view of a portable, fully-setup, fully-operational, adjustable-size embodiment system left sidewall 7*b* showing one below-the-ear horizontally-positioned sound shaper 14*c*, acoustic skin 13*c*, and various part attachment devices.
Figure 15:
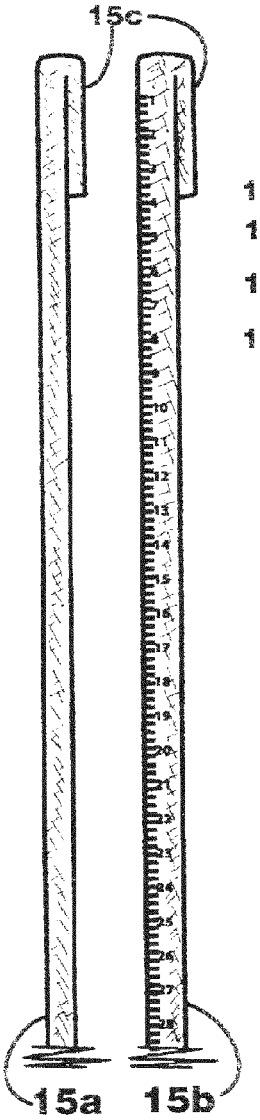
FIG. 15 shows a slidable part-positioning hook-loop hanger attachment part adjusting devices 15*a* and 15*b*, usable for the sidewall positioning of sound shapers for many embodiments.
Figure 16:
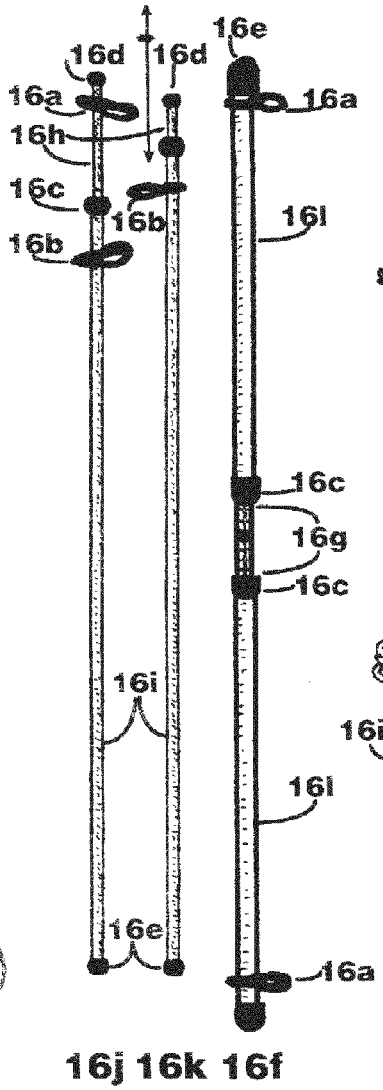
FIG. 16 shows a telescoping part adjusting devices 16*j*, 16*k*, and 16*f*, usable for many positioning applications with most embodiments.
Figure 18:
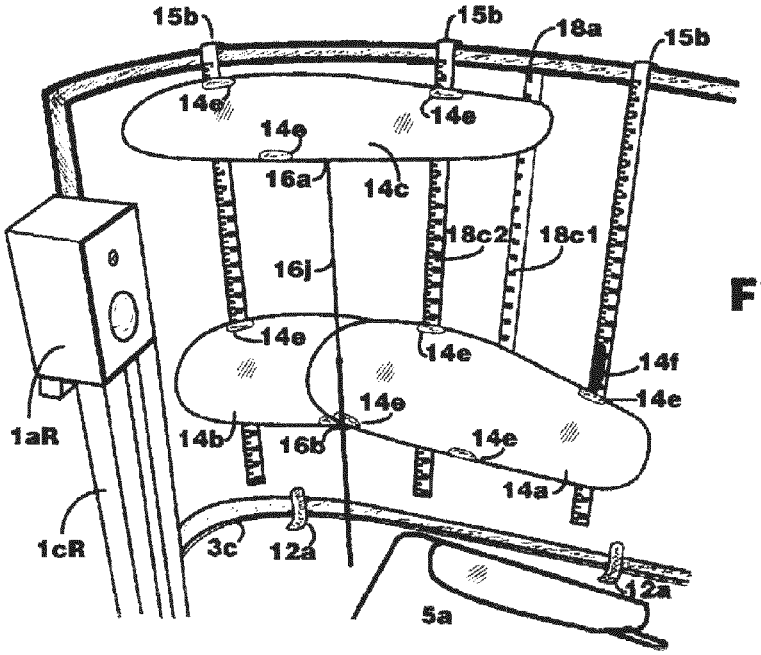
FIG. 18 shows a perspective view of a portable, fully-setup, fully-operational, adjustable-size embodiment system right sidewall 7*a* showing two (2) below-the-ear sound shapers 14*a* and 14*b* and one (1) above-the-ear sound shaper 14*c* adjustably positioned into one of hundreds of combination positions by two slidable part-positioning hook-loop hanger attachment part adjusting devices 15*b* and one (1) telescoping part adjusting device 16*j*. Two (2) symmetrical part-alignment positioning systems and their quick-reference positioning symbols are part of slidable hanger part adjusting devices 15*b* to precisely position sound shapers symmetrically on both sides of the embodiment system in the exact same location.

Examples of embodiment system quick-reference positioning symbols (QRPS) that can be pre-marked, impressioned into, and/or attached to the embodiment system standardized symmetrical part-alignment positioning systems (SPAPS) include: Wall-mounted quick-reference positioning symbols (QRPS) examples "c1" attached, impressioned onto, or otherwise illustrated on the symmetrical part-alignment positioning system 18*a* (FIG. 13); Centerline QRPS example 3*g*, and sound-controlling sidewall positioning QRPS examples 3*d* and 3*c*, attached, impressioned onto, or otherwise illustrated on the portable floor template symmetrical part-alignment positioning system (SPAPS) example 3*a* (FIG. 3); QRPS example letters: A through G; and QRPS example numbers: 1 through 5; illustrated on symmetrical speaker part-alignment positioning systems (SPAPS) examples 3*b*L and 3*b*R (FIGS. 4 and 6); Quick-reference sound shaper, acoustic skin, and acoustic extender positioning symbol (QRPS) example numbers 1 through 19 on the slidable positioning hanger SPAPS component 15*b* illustrated (FIGS. 15 and 18); Centering QRPS examples positioned on part 16*g* of the telescoping cross-part adjusting device 16*f*, (FIG. 16); Sound-controlling sidewall panel component QRPS example line 3*d*, (FIG. 20).

Examples of additional embodiment system components that are mentioned in this embodiment system symmetrical part-alignment positioning system (SPAPS) and their quick-reference positioning symbol (QRPS) include: acoustically-significant components; sound-controlling walls and panels; sound shaping, sound-controlling, and sound revealing (SS-CRCM) sound shaper, acoustic skin, acoustic extender, and sound absorbing/sound deadening panel components.

The presented embodiments' symmetrical part-alignment positioning systems (SPAPS) allow the fast setup of all of the portable embodiments, often within 5 to 15 minutes. The presented embodiments' SPAPS dramatically reduce system setup confusion, the need for measuring, and cumbersome trial and error setup procedures. The presented embodiments' symmetrical part-alignment positioning systems (SPAPS) ensure perfect component positioning to within one (1) centimeter (within a fraction of an inch).

During a listening session, the presented embodiments' SPAPS and QRPS allow parts to be quickly, easily, and precisely added, moved, and acoustically repositioned. Quick-reference positioning coordinates obtained from the presented embodiments' SPAPS and QRPS ensure perfect, dependable, and repeatable positioning of all important components every time.

The presented embodiments' SPAPS and QRPS allow listeners to quickly and easily share, duplicate, and transfer their listening results, setup arrangements, and acoustic experiences among many listeners. The presented embodiment system SPAPS, with their QRPS, permit identical acoustic results almost anywhere. A single identical quick-reference positioning symbol (QRPS) can be used on multiple and different SPAPS to symmetrically position multiple and different components, thus simplifying setup. A single identical QRPS, such as a cutout floor template can be successfully used to synchronize the symmetrical positioning of multiple right and left side components, using that one QRPS as a benchmark guide to position components from or to. The presented embodiments' symmetrical part-alignment positioning systems (SPAPS), with their quick-reference positioning symbols (QRPS), provide even unsophisticated listeners with ability to successfully produce literally thousands of quickly and easily setup listening experiences. The presented embodiment system SPAPS and QRPS allow experimental listening experiences when used as positioning benchmark guides for other non-marked, but symmetrically-arranged component positionings.

The presented embodiments' sound revealing, sound shaping, and sound controlling components (SRSCCMs) provide various adjustable and user-interactive capabilities and advantages.

The presented embodiments consists of sound revealing, sound shaping, and sound-controlling components and application methods (SRSCCMs) which are separate, movable, flexible and non-flexible, sound-controlling components with one or more substantially planar portions, one or more substantially curved portions, or a combination thereof that easily, quickly, and adjustably connect, attach, and/or gravity position to, on, and/or with an employed embodiment system's basic static structure and/or other pre-positioned SRSCCMs.

Examples of embodiments' sound revealing, sound shaping, and sound-controlling components and their application methods (SRSCCMs) include the following presented embodiments: Sound revealing, sound shaping, and sound-controlling surfaced embodiment system panel component examples: sidewall panels 7*a* and 7*b* in FIGS. 8 through 13, 18, and 19; panels A, B, K, and L in FIG. 20, panels A, B, and L in FIG. 22; and panels 7*a* and 7*b* in FIG. 28; Sound revealing, sound shaping, and sound-controlling surfaced embodiment system "sound shaper" examples: sound shapers 14*a*, 14*b*, 14*c*, and 14*d* in FIGS. 13, 14, 18, and 19; panels F, E, D, and sound shaper 14*c* in FIG. 20; 3. Sound revealing, sound shaping, and sound-controlling embodiment system "acoustic skin" component example: acoustic skin 13*c* in FIG. 13; Other sound revealing, sound shaping, and sound-controlling embodiment system surfaced panel components including overhead and outer panel component examples: overhead panel 29*a*, FIG. 29 and outer panel 29*b*, FIGS. 19 and 29.

The presented embodiments' SRSCCMs help to provide the incremental and fluid capturing, revealing, shaping, and controlling of acoustically-pure sound before it becomes corrupted. The presented embodiments' SRSCCMs help create and personalize surround sound audiophile-grade acoustic experiences and acoustic spaces for the listener.

The presented embodiments' SRSCCMs allow the listener to successfully reveal, shape, and control important parameters of acoustically-pure sound. These include the ability to successfully shape, change, directionally move, project, and incrementally fine-tune, in relation to the listeners' position, one or more of the following acoustic parameters, all of which are important to the overall acoustic experience: the apparent time-delay of arrival of uncorrupted acoustically-pure sound; the overall amplitude of that pure sound; various sound frequencies; the apparent space between surround sounds; the apparent direction of individual sounds; the apparent speed and trajectory path of individual sounds; the vertical height of the sound; the pinpoint localization of individual sounds; the apparent localization of sound groupings; the entire surrounding sound field itself as a whole acoustic entity; and the quantity and direction of nuisance spillover sound outside of the embodiment system.

The presented embodiments' SRSCCMs control important acoustic parameters without damaging or corrupting the acoustic purity of the sound or sound signal. Listeners use the presented embodiments' SRSCCMs to integrally control the overall sound radiating, projecting, and acoustic control system. The presented embodiments' SRSCCMs allow listeners/users to shape and fluidly interact with their three-dimensional surround sound listening experience.

Acoustic skins can be positioned over the inside surfaces of embodiment system structures. Acoustic skins can be made from many different materials each with its own unique sound revealing, sound shaping, and/or sound-controlling effect. Acoustic skins successfully provide different sizes and shapes that can be quickly, easily, adjustably, and interchangeably positioned for more acoustic versatility. SRSCCM acoustic skins allow comparing and experimenting with almost any material for its acoustic qualities alone. SCSCCM acoustic skins can use sound reflecting, diffusing, absorbing, and/or barrier materials at different locations, quickly and easily. SCSCCM acoustic skins include flat, curved, or flexible options. SCSCCM acoustic skins can turn even unsuitable sound structures into high performance sound embodiments. With SCSCCM acoustic skins, embodiment system-shapes structures may not even need an original sound reflecting or reflective surface to be high-performance sound embodiments. Different acoustic skins can become the main, or a secondary, embodiments' sound-controlling surface. Acoustic skins do not need to be dimensionally stable to be usable as high-performance sound reflective surfaces. Acoustic skins allow different, varied, acoustic materials to be used on any embodiment system support structure that is comprised of any material.

The presented embodiments' SRSCCMs acoustic sound-shaping components have dimensional stability on their own, and can complement, or contrast, an embodiment system's acoustic attributes. Sound shapers can be added, moved, or adjusted at sound projection locations to control, enhance, and adjust sound and surround sound. Sound shapers can control and project sound, incrementally, at micro to macro levels. For full, functional versatility, sound shapers can have sound reflecting, diffusing, absorbing, and/or barrier surfaces, or combinations, on one or both sides. Sound shapers can be used experimentally, at different locations, at incrementally-adjustable angles, up to 360°. Sound shapers adjustably and fluidly attach, horizontally, vertically and all angles in between, temporarily or permanently, with few restrictions. SRSCCM sound shapers are lightweight and tough, with high impact, dent, and mar resistance. Sound shapers provide immediate real-time feedback and feedback adjustment options, from many positions and angles around the listeners. Embodiments' sound shapers project the overall acoustically-pure sound picture, the entire surrounding sound field, and acoustic experience directly to the listener. Sound shapers can quickly and economically expand or adjust the embodiments' size. Embodiments' sound shapers fine tune, with immediate feedback, overall surround sound balance, the entire surrounding sound field, and the acoustic experience.

The presented embodiments' acoustic extender SRSCCM components can be provided in acoustic-appropriate shapes, sizes, thicknesses, flexibilities, and sound-controlling surfaces to complement, or contrast, existing sound parameters. Acoustic extender SRSCCM components allow simplified, instantaneous, and extremely fluid component placement and movement because it isn't necessary that they be physically connected or disconnected to other items during use. Acoustic extender SRSCCM components position by simple gravity alone, resting or laying them at same or different angles, and/or by sliding them into position. Acoustic extender SRSCCM components require little effort to use. Acoustic extender SRSCCM components provide added sound shaper advantages at a lower market cost.

Other embodiment system SRSCCMs include exterior sound deadening panel components to help reduce unwanted nuisance sound spillover to nearby non-listeners without reducing the acoustic experience for listeners. SRSCCMs allow listener-operators to incrementally shape, control, change, reshape, test, and compare audiophile-grade experiences quickly, easily, and inexpensively. SRSCCMs not only help shape, enhance, and control emotionally impactful audiophile-grade experiences, but also move the listener-operator dramatically closer, and into, the overall acoustic presentation.

The presented embodiments-produced acoustic focal areas (AFAs) are normally extremely difficult and expensive to produce, especially with adjustable control. The embodiments-produced AFA (refer to double circles in FIG. 1H) can be adjustably shaped and reshaped. The presented embodiments-produced AFA help control and direct amplitude, frequency range and the direction of acoustically-pure sound. The presented embodiments-produced acoustic focal areas (AFA) can be shaped and directionally moved around the listener. All presented embodiments-produced AFA sound delivery capabilities and improvements are attained non-electronically, without added energy consumption. The presented embodiments-produced AFAs are easily moveable by the simple movement of the embodiment system's sound-controlling components. The presented embodiments-produced acoustic focal areas (AFAs) provide intuitive, immediate, and continuous automatic feedback to listeners. The presented embodiments-produced AFA can wrap the listener more closely within the original sound field.

Organic scalable sizing (OSS) provides precision geometric symmetry and applied optics. The presented embodiments operate solely on the principles of high-performance acoustics that use precision geometric symmetry and applied optics instead of electronics to provide many of the substantial intra-system and inter-system spatial acoustic capabilities. The following embodiments provide the capability and advantage of harmonious OSS with manageable and scalable sizes in a way that results in optimal spatial acoustic harmony between different sized embodiments.

Organic scalable sizing (OSS) provide interchangeable part options. Organic scalable sizing (OSS) is simplified for the presented embodiment system because the systems' main sound-controlling components can also serve as structural components. Organic scalable sizing (OSS) gives greater fluidity to shape and control sound. Organic scalable sizing (OSS) allows acoustic problem solving and acoustic advantages when symmetrical interrelationships are kept essentially the same. Organic scalable sizing (OSS) systems provide essentially the same positive benefits and acoustic results regardless of their different sizes. Organic scalable sizing (OSS) acoustic results are forgiving and overcome general setup limitations. Organic scalable sizing (OSS) allows interchangeable components to be substituted among one another, totally removed, combined, or overlapped at will. Organic scalable sizing (OSS) interchangeable parts can be easily and inexpensively manufactured with low cost materials. Organic scalable sizing (OSS) accommodates customization for listeners with their individual listening needs or preferences. Organic scalable sizing (OSS) provides present and pathways for future audio-visual upgrades.

The embodiments can morph to meet different commercial and consumer applications for professional, retail, and residential use due to their organic scalable size (OSS) capabilities. The embodiments create acoustically-standardized but highly-precise and repeatable listening, testing, and demonstration rooms. The embodiments provide manufacturers of audio reproduction hardware and software with unique advantages, including using the portable embodiment systems at tradeshows. The embodiments enhance the creative talent and production of acoustic creators. Embodiments provide dependable, reproducible results for reviewers of audio hardware and software.

The presented embodiments deliver the listener with therapeutic health-and-wellness-oriented positive acoustic results thereby providing the following health and wellness advantages. The therapeutic embodiments provide substantially-enhanced three-dimensional therapeutic sensory sound experiences. The therapeutic embodiments enable the user with the ability to utilize natural therapeutic sensory surround sound stimuli in many different ways. The therapeutic embodiments add incrementally-increased levels of physically and emotionally impactful acoustically-pure therapeutic sensory surround sound stimuli based on the sound-distance-to-sound-dispersion law. The therapeutic embodiments allow natural dynamic binaural physical sensory involvement for more intimate and emotional sound immersion. The therapeutic embodiments provide listeners with the ability to fully control and fully adjust their therapeutic acoustic experience simultaneously from a multiplicity of angles and directions creating transformative acoustic therapeutic treatments. The embodiments focus-concentrate natural therapeutically-immersive acoustically-pure auditory sensory surround sound to the listener. The therapeutic embodiments provide options for both fully-passive operator-controlled or fully-active listener-controlled acoustic therapy systems, or a combination. The embodiments including therapeutic-oriented embodiment systems can utilize speakers and systems from multiple sources. The presented therapeutic embodiments allow using the content providers', professional acoustic therapists', and the listener's own therapeutic acoustic furniture, hardware, and software. The therapeutic embodiments immersively sound-wraps the listener in enveloping, acoustically-pure stimulating or relaxing three-dimensional surround sound and positive acoustic experiences for use in many therapeutic treatments and situations.

The presented therapeutic embodiments deliver audiophile-grade therapeutic acoustic stimuli for physical exercise thereby providing various embodiment system advantages.

The four-way embodiment system enclosure sound control benefits both listeners/users and non-listeners/non-users alike. First, embodiment system enclosures reduce speaker noise pollution to nearby non-listeners. Second, embodiment system enclosures reduce nuisance sound to non-listeners/non-users, while they increase and improve audiophile sound to the listener/user, for enhanced, dual-purpose, sound control. Third, for the listener, embodiments' enclosures shield and reduce intrusive, undesirable, and distracting sounds coming from outside the embodiment system structure. Fourth, embodiment system enclosures greatly reduce undesirable sights, light, and visual distractions for a more immersive listener/user surround sound or multimedia experience.

The presented embodiments provide listeners the ability to simply use just two universally and easily-available stereo signals and the output from only two speakers to create a dramatic, never-before-offered, three-dimensional surround sound experience. The embodiments, using just two-channels of acoustically-pure sound, successfully provide all of the embodiments' normally substantially difficult, extremely expensive, and highly-valued problem-solving improvements, enhancements, energy efficiencies, and surround sound experiences. The presented embodiments fully utilize two-channels in their purest form to capture the pure macro and micro signal and surround sound information encoded within their signals, to retain this information in its purest form without letting it become corrupted, and to provide this information to the listeners as never before offered as acoustically-pure three-dimensional surround sound information.

The embodiments, using only two-channels, avoid having to electronically or physically disturb the two pure signals to obtain their surround sound data and the systems provide listeners with an audiophile-grade surround sound experience. The embodiments can decode two-channel encoded three-dimensional surround sound that can be encoded using just two stereo microphones. The embodiments, using two-channels, allow the full use of acoustic inverse proportional law to improve sound.

The embodiments using two-channels allow the continued use of universal open-standard signal indefinitely. The embodiments, using two-channels, allow the continued use of the listeners' own speakers and equipment indefinitely. The embodiments, using two-channels, use the conventional placement of speakers and need or require no non-traditional speaker positioning or placement. The embodiments, using two-channels, require no special or proprietary speakers—no trial and error speaker setup. The embodiments, using two-channels, minimize harmful stereo speaker crosstalk and out-of-sync room reflections. The embodiments, using just two-channels, have the ability to utilize the least number of transducers to reduce their damaging effects. The embodiments, using just two-channels, reduce to the minimum the complexity and cost of media storage and retrieval.

The embodiments, using two-channels, allow the continued, extended use of expensive professional equipment and software, and enhance their performance indefinitely. The embodiments, using two-channels, allow using just two recording microphones to reproduce surround sounds and full-sound fields. The embodiments, using two-channels, optimize equipment use, delay equipment obsolescence, and reduce hazardous landfill concerns.

The embodiments, using two-channels, allow the originator's version of the original work to be better preserved, and better heard and appreciated by listeners. The embodiments, using two-channels, preserve the original surround sounds, the surround sound fields, and the original mix presentation. The embodiment systems, using two-channels, help minimize all types of electronic surround sound signal corruption for the listener.

The embodiments, using two-channels, can use most recorded material—past, present, and future—without changing or corrupting their original presentations. The embodiments, using two-channels, can use and preserve indefinitely hundreds of millions of recordings and media sources inexpensively. The embodiments, using two-channels, assures the continued use of over 95% of the world's audio sound media, without need to future update. The embodiments, using two-channels, recover and present to the listener never before heard sound data previously hidden in their favorite legacy recordings.

The embodiments, using just two-channels, can substantially reduce electronic energy requirements, energy usage, and electricity dependency. The embodiments, using two channels, can move the listener into the original-three dimensional recording space. The embodiments, using two-channels, can reproduce normally-difficult-to-reproduce high-performance music surround sounds quickly, easily, and inexpensively for not only high-end listeners but also for the mass market. The embodiments, using two-channels, can separately-localize around the listener original sounds surrounding the original recording microphone position.

The presented embodiments can use environmentally-responsible, low-impact, materials to provide 100% of embodiment systems' acoustic solutions, provisions, and advantages.

The embodiments focus-concentrate naturally-immersive acoustically-pure sensory surround sound to the listener—without the listener having to resort to harmful listening levels. The embodiments help reduce the potential harmful effects to the listener of having to resort to unnatural, hyper-amplified, and harmful sound reproduction listening levels to increase the quality level of their acoustic experience.

The following details how the newly presented embodiments successfully provide the sound reproduction industry with substantial re-energizing abilities and opportunities, for both the high-end and the mass market consumer that were never-before-available in order to substantially help re-energize and expand significant portions of the audio sound reproduction market and industry using quick, easy, inexpensive, significantly consumer friendly, and energy-efficient products and processes to do so.

The embodiments solve or eliminate many long-time industry sound reproduction problems and limitations inexpensively. The embodiments eliminate many frustrating and intimidating sound reproduction industry setup requirements. The embodiments can now wrap believable surround sound fields and audiophile-grade listening experiences around listeners inexpensively.

The embodiments don't require new methods and changes to existing hardware or software to optimize their acoustic and other advantages. The embodiments provide immediate, high-performance, audiophile-grade experiences without the need for audiophile-grade equipment. The new embodiments support current industry standards, methods, practices, and equipment.

The embodiments use professionally-proven audiophile-grade rules, and simplify rules that are complicated. The addition of an embodiment system provides an audiophile-grade experience at a mass market price. The embodiments systems uncomplicate an otherwise complicated audiophile setup experience with a simple-to-understand, non-complicated, low cost, and forgiving overall package, set up and ready to use in ten to fifteen minutes.

The embodiments provide motivational reasons for the mass market public to seek-out, purchase, and use more entry and mid-level sound reproduction equipment and software. The embodiments provide opportunities to be sales and marketing tools for both the high-end audiophile market and to expand mass market interest in the audio industry. The embodiments provide powerful audiophile-grade listening experiences without the work, confusion, or the high cost, thus, enhancing the sales experience for the marketer and the buyer.

The embodiments provide a simple and dependable way to immediately communicate an unforgettable, first-hand, audiophile-grade experience to the mass market. Using the embodiments, the high-end audiophile-grade listening experience is delivered to the listener immediately, impactfully, energy-efficiently, without ads, and without words. The embodiments enable low cost equipment to sound immediately and significantly better, more interesting, more pleasing, and more valuable.

The embodiments can easily, inexpensively, and dramatically combine the audiophile-grade listening experience with newer flat-screen visual displays, providing expanded market growth potential. This capability provides the natural, and dramatically high-value added, merging capability of the embodiment system's signature surround sound audiophile-grade listening experiences and advantages with a combined visual display device's substantial visual advantages and experiences. The embodiments' substantial surround sound audiophile listening experiences are also non-proprietorially obtained and provided in real-time by all of the presented embodiments.

The embodiments' audiophile experience makes demonstrated audio and visual equipment more marketable both to high-end consumers and mass market consumers. The embodiments' audiophile experience can motivate more potential consumers to visit either audio retail outlets whether local or, often, located far away in urban areas. The embodiments provide the ability to make future audiophiles out of mass market audio enthusiasts. New audiophiles who understand how and why their experience is created, create market potential for the entire audio sound reproduction industry.

The portable embodiments offer an ideal geographically-portable audio equipment demonstration room that can be fully setup in potential client's space in less than 15 minutes. The embodiment system demonstration rooms include portable embodiments that allow salespersons to demonstrate smaller, lighter equipment, in almost any space, quickly and easily. The embodiments demonstration rooms quickly, easily, and inexpensively provide salespersons the ability to demonstrate and add substantial value to home-demonstrated hardware and software.

The embodiments enable in-home or apartment audio demonstrations currently not practical to consider. The embodiments remove or neutralize substantial prior limitations surrounding in-home demonstrations for the benefit of the industry, including room reflections, positioning, transporting heavy and fragile costly equipment, etc. The embodiments' audiophile-grade listening experience can increase the value of the customer's own equipment.

The embodiments provide a personalized home audiophile-grade experience not otherwise easily demonstrated, provided, or made possible. The embodiments provide unquestionable value and purchase confidence to consumers of the expected home audio equipment and experience. The embodiments provide manufacturers' salespersons the ability to quickly demonstrate specific equipment, for many other specific acoustic applications. The embodiments can provide low-cost audiophile experiences to customers and/or patients of all abilities currently not able to visit showrooms.

In sharp contrast to the prior art, the embodiment system's presently contemplated devices, materials and manufacturing processes, the presently contemplated parameters of suitable and appropriate application, the fundamental principles, geometric and mathematical interrelationships, and the presently contemplated listener-interactive and listener-adjustable methods and systems for assembling, utilizing, disassembling and storing. The following sections of this document will also teach and reveal how the aforementioned acoustics-related problems, limitations, and consumer deterrents can be effectively solved, canceled, eliminated and/or replaced by the following presented embodiments and the synergistic complementary acoustic interaction and coordination of their sound-controlling and sound revealing acoustic components. The ensuing description and accompanying drawings will show, fully demonstrate, and document these and additional embodiments' problem-solving abilities, acoustic capability and improvements, significant three-dimensional surround sound advantages, and the extraordinary acoustic value that naturally reside in, and that are provided quickly, easily, dependably, affordably, and energy-efficiently by the employed application of the following disclosed embodiments.

Presentation of Various Embodiments

In order to facilitate understanding of the embodiments, a number of embodiments will be described with typical size, weight, thickness, height, material, and setup times used for purposes of example only. The presented embodiments show modes of the various operations available but do not restrict the embodiments that may be arbitrarily modified within the scope of the presently-revealed method of application.

For brevity and in order to avoid lengthy repetition, in accordance with the following embodiments and their presently-revealed method of application some of the information and illustrated component parts including one or more parts and operations detailed or illustrated with a particular embodiment system may be applicable and interchangeable in whole or in part with other embodiments. Also, many individual component parts, and portions of component parts, detailed or illustrated in the following embodiments may not be required and can be left out of a system while continuing to maintain the system's overall functionality, continuing to enhance stereo audio sound reproduction, and continuing to successfully provide an audiophile-grade surround sound experience for the listener. In addition, for brevity, because many different types of electronic equipment may be used with the following embodiments, no particular electronic stereo component or speaker system will be detailed in this document.

The following information is presented as an overview of the presented embodiments and their shared method of application before describing the individual embodiments. Much of the overview descriptions will not be repeated for each of the individual embodiments if not required.

The presented embodiments are acoustic surround sound systems that include substantially low-cost, variable-sized, non-electronic, symmetrically-balanced, portable listening systems, herein referred to simply as "embodiment system" or "embodiments" comprised of sound reflective surfaced, sound capturing devices, components, and structural assemblies. More specifically, the embodiments use their structures and sound controlling components to substantially capture from universally-available two-channel stereo speakers, a significant quantity of valuable, normally-wasted, acoustically-pure indirect sound and retain this captured indirect sound inside of the embodiment system acoustic structure in order to prevent out-of-sync listening room reflections from distorting reproduced sound heard by the listener. This historically wasted indirect sound energy, normally emitted from a wide variety of universally-available stereo speakers, is first captured by the embodiments in its acoustically-pure form before it becomes wasted and before it has a chance to become corrupted. The embodiments then prevents this sound from being uncontrollably released out into the surrounding room to create acoustic damaging out-of-sync listening room reflections. The embodiments further effectively utilize this captured indirect sound energy, significantly before it becomes corrupted, to effectively cancel stereo speaker crosstalk, without the need to electronically manipulate or corrupt the signals.

This allows the presented embodiments to advantageously-use acoustically-pure non-corrupted sound energy for an assortment of never-before-available, highly-valued, and previously-overlooked listening room-related acoustic solutions and advantages. The embodiments provide the ability to setup an inexpensive, high-performance professional audiophile-grade listening room within a 15 minute period of time. They provide an uncomplicated and inexpensive provision of real, three-dimensional, surround sound to the listener, without additional speakers, wires, or permanent installations added to a listening room.

The presented portable embodiments also use pure, non-electronic, universally-available two-channel stereo signals without the need to electronically-manipulate or corrupt the original signal. Once the listening session is done, these portable embodiments can be put away out-of-view allowing the room it was set up in to be returned to its prior state, therefore taking-up no living space when not in use and permitting the entire room to be completely opened-up and freely utilized for other non audio only purposes.

All of the presented embodiments work cooperatively well with a wide range of universally-available, including user-owned speakers and low-cost stereo speakers, such as speakers 1*a*L and 1*a*R, FIGS. 1B, 1C, 1D, 1H, 3 and 19, and their standard speaker stands 1$c$L and 1$c$R, if needed. This includes a plurality of new or more legacy types of speakers of different sizes, quality levels, price ranges, and shapes including both professional and consumer-owned two-channel stereo audio speakers. Special size, frequency range, and price point speakers can also be made and provided exclusively for particular embodiments and for speciality applications mentioned throughout this document. Appropriate speakers include simple conventional stereo speakers that need not be of any special type, size, power output, or transducer configuration. Also included are most conventional high-performance and even very diminutive size two-channel speakers. Also, this includes the full use of speakers contained in the same speaker housing, so long as the speakers are horizontally separated apart from each other. The embodiments also support an expansive variety of legacy or user-owned to new two-channel electronic devices, including both analog and digital electronic devices.

As shown in the above mentioned figures, the employed embodiment system can partially enclose speaker and listener within an acoustic enclosure structure that forms a general angle of 180° or less within the interior surface of the assembly. The front of the total left-side assembly may be positioned in relation to the speaker at various locations. For example, the front of the assembly can be positioned near to the audio speaker structure assembly which consists the speakers and speaker stands if needed.

The presented portable embodiments are low-cost, lightweight, energy-saving, modular acoustic structures that typically can be setup in most rooms and spaces, and can easily be folded up and stored. The overall structural shapes and lines of multiple differently-sized embodiments conform to an organic, oblong, or oval shape with reduced corners and non-parallel-walls that can essentially replace the box-like structural boundaries and acoustic limitations of the random-shaped and indirect sound corrupting prior art listening room. The presented portable embodiments can include main and secondary sound reflective surfaced panel structures, symmetrical part alignment positioning systems and quick-reference positioning symbols shown in FIGS. 3 and 4, sound shapers, acoustic skins, acoustic extenders shown in FIGS. 13 and 14, add-on components such as panels 30$a$, 30$b$, and 30$c$ in FIG. 30 and panel 29$b$ in FIG. 19, and a assortment of sound controlling part positioning devices such as show in FIGS. 14 through 17.

The overall size of the embodiments needs to be large enough to substantially fill-in the expansive open horizontal, and often desired the vertical space, that exists between the speaker's tweeter location and the listener's location. Sound controlling panels can be varied among and between organically-structured and highly user-versatile embodiment system configurations at scaled sizes. This is provided to accommodate, for example, different distances needed between variable sized and shaped speakers and varied listener positions; to adjustably fit different sitting, reclining and lying devices; to accommodate different listener's acoustic needs and expectations; and to provide user-friendly options for the maximized utility of embodiment system components, including a high level of component interchangeability. One of the many specific examples include the many examples detailed in the embodiment system shown in FIG. 20, such as where three side located panels L, A, and B, shown in FIG. 20, can be combined into one continuous panel of different sizes and extended horizontally and/or vertically and made to be bendable.

Because the human auditory system operates primarily on a forward, horizontal, surround sound field basis, with much less emphasis placed upon the vertical plane, the most powerfully-relevant sound reflective embodiment system surfaces are positioned primarily at the forward horizontal level, especially between the speakers' tweeters and listener's ears, with less acoustic emphasis above or below that specific forward horizontal level. Therefore, as detailed by arrows 1 through 5 in FIG. 1B and detailed with FIGS. 1C and 1D, the most important and least important embodiment system sound reflective surfaced panels and sound controlling components are positioned accordingly and symmetrically, with a more curved, outward-extending-in-the-middle left and right forward-of-the-listener portion configuration, as, for example, also shown with the included quick-reference positioning symbol lines, such as quick-reference positioning lines 3$c$ and 3$d$ on the symmetrical part-alignment positioning system 3$a$ in FIG. 3, and in a number of other figures.

Precision capture, control, and delivery of sound is offered to a centrally-located listener 19$a$ by the solutions of the presented embodiments. For a more specific left-side-only example for more clarity, the most powerfully-relevant sound reflective surfaces are lateral side-located sound reflective surfaces, such as illustrated by left side panels L, A, and B in the embodiment system shown in FIG. 20, positioned in the left-side space between the outermost left-side of the speaker 1$a$L and the left-side of a listener N that are positioned in the expanse of space between the speakers tweeter driver(s) and the left ear of the listener located at listening position N. These areas generally coincide with arrows 1 through 5, FIG. 1B.

Variable vertical sound reflective surfaces may also be provided above and below the ear, such as upper panels E and D and lower sound shaper 14$c$ of the embodiment system shown in FIG. 20. The acoustic effectiveness or results of these and similar above and below the ear sound reflective surfaces, including sound shapers and acoustic extenders, can be referenced in the included sound level comparisons and acoustic spectrum analysis compiled in FIGS. 1E, 1G, and 1H showing the acoustic improvements of using sound shapers and acoustic extenders. For example, in FIG. 1E for the acoustic spectrum analysis and in FIG. 1H for the total dB measurement, show a directional frequency increase of an approximate 8 dB increase for a high-performance plastic surfaced medium-size embodiment system over the same location without the positioning and use of the embodiment system, plus another 3 dB increase with the use of sound shapers for an approximate total increase of 10 dB over the same location without the positioning and use of the embodiment system, along with a balanced and balancing spectrum frequency result from the sound shapers use. This is an impressive acoustic amplitude increase when 6 dB is considered a doubling of acoustic amplitude on its non-linear logarithmic scale.

The embodiments include the advantage of allowing the use of lighter weight, less dimensionally-stable, and lower-cost structural and sound controlling materials for main panels, sound shapers, and acoustic extenders, as well as other embodiment system components detailed in the following individual embodiment system sections. Lighter weight components are more forgiving, easier to assemble and setup, move, and store, and do not require cumbersome and expensive added structural support systems that are only structural and add little value as acoustic reflectors or as functioning operational components. Using very lightweight materials in all ways allow the portable embodiments to be designed to be simple, user-friendly, quickly and easily adjustable, and easy to fully setup and store by a single person without added tools or measuring requirements within the 15 minutes or less as mentioned above.

High-performance sound reflective-surfaced panels can be made up of lightweight materials, such as plastics, thin aluminum, composites, and even paper-based materials. The use of these materials also reflects conventional and new manufacturing materials used in speaker design. In this respect, high-performance sound reproduction speaker drivers and diaphragm membranes have recently been manufactured from not only their long-traditional paper-based materials but also from a variety of newer thin semi-rigid plastic, aluminum, and fiberglass materials, including composites and combinations thereof, that produce their own unique sound signature and that offer excellent, but different, sound wave forming, frequency results, and acoustic signatures. Likewise, acoustically-significant embodiment system components positioned at sound controlling locations can be comprised of, interchanged with, or surfaced over with, any number of sound reflective and/or sound controlling surfaced materials including lightweight plastics, aluminum, composites, paper-based materials, and combinations thereof.

Varied sound reflective-surfaced sound controlling components, such as used in the sound level comparisons, FIG. 1H, and acoustic spectrum analysis compiled in FIGS. 1E, 1F, and 1G, for example, can act as specialized primary sound reflective and sound controlling panels, especially between the speakers' tweeter drivers and the listeners ears represented by arrows 1 through 5, FIG. 1B. The ability for the presented embodiments to adjustably use may different types of primary and experimental sound reflective surfaced substrates for different sound controlling areas, such as with the use of acoustic skins detailed below, allow the presented embodiments' sound reflective surfaces on one or more embodiments to use different materials for acoustically-significant embodiment system components, including main panels and sound shapers for not only traditional listening needs but also for expansive specialized including varied and custom applications.

Specialized embodiment system sound controlling surfaces can be made, and they can be made to be adjustable, for example, to accommodate individual's listening preferences, specific need requirements, or to suit individual stereo systems and so on. For example, the choice of sound reflective materials may be suggested to the listener by the acoustic designer or sales staff depending on the listener's existing or considered sound system. It may be suggested, for example, that a brighter sounding audio system may be better accommodated with a less smooth, less specular sound reflecting, or slightly sound absorbing surfaced sound reflective material to advantageously help tone down the brightness of their system. Alternately, a more bass heavy or laid-back audio system can sound better with a smoother, more specular sound reflecting surfaced embodiment system like a high-performance plastic, aluminum-surfaced, or experimental paper-surfaced material to advantageously help brighten-up their existing or considered stereo system, to bring the listener closer to the acoustic presentation, and/or to help their system acoustically clarify more subtle three-dimensional nuances locked within the source stereo signals and which could otherwise be lost by their existing audio system.

Sound controlling embodiments can also be made for specialized and custom acoustic applications, including highly specialized applications for a very low cost, by using specialized acoustic materials for their sound controlling surfaces. One example of a specialized application to explain the advantage of being able to select from a wide variety of customized sound reflective substrates that have different and varied frequency output for the listener at the listener's position 19*a*, is referenced by Real Time Spectrum Analyzer SA-3050A frequency test results for an experimental medium-size paper-surfaced embodiment system with a 52" centered speaker-to-listener-distance shown in FIG. 1G. The embodiment systems shape provides a substantial increase in acoustic amplitude at the listener's position 19*a* as shown in sound level comparisons in FIG. 1H. Using this particular experimental semi-specular paper-based material for the sound controlling surfaces of a medium-sized embodiment system, however, also provides a unique sound reflective characteristic of a higher than normal frequency output at the listener's position 19*a* above approximately 4 kHz, as illustrated in FIG. 1G. This frequency increase beginning at 4 kHz corresponds with the beginning frequency for high-frequency hearing loss in hearing impaired individuals. Common high frequency hearing loss, such as sensorineural hearing loss (SNHL), begins to occur at or around this same 4 kHz area. Because the beginning 4 kHz hearing frequency loss for these hearing impaired individuals closely corresponds with the 4 kHz frequency boost provided by the use of the low-cost semi-specular paper material when this material is used as the primary sound controlling material for a medium-sized embodiment system, FIG. 1G, this allows an embodiment system, for example, to be offered with fully-functional specialty paper-surface that is frequency customized to help high frequency hearing impaired persons hear better and have a more natural, fulfilling, and pleasing acoustic experience with a variety of acoustic presentations at a very low cost.

Being able to select from a wide variety of customized sound reflective substrates that have different and varied frequency output for the listener at the listener's position 19*a*, especially with low-cost materials, promotes better acoustic results for the listener and provides a gateway to interactive audiophile acoustic experiences.

Although smooth, flat, and specular sound reflective surfaces are contemplated for all primary sound controlling surfaces lining the inside of an employed embodiment system, alternative specular including non-specular sound-controlling materials and surfaces may also be suitably utilized to help the user adjust and control the overall sound control functionality of an employed embodiment system, for example, to accommodate a listener's personal acoustic tastes, different employed speakers, variable electronic systems, etc. This further allows the listener and acoustic designer to adapt and adjust the presented embodiments to a variety of different and unique-applications.

Embodiment system sound controlling panels can be also be positioned to attenuate, block, and help prevent speaker-emitted sound from getting past the assembly to corrupt the sound for the listener and to help block unwanted speaker system sounds from disturbing nearby non-listeners. This is an advantage for nearby non-listeners, especially helpful for many quieter, smaller, and more intimate residential environments, such as those located in dense urban areas, apartment complexes, multiple family dwellings, smaller-roomed homes, institutional living facilities, and the like. The same substantial quantity of indirect sound that is captured from the stereo speakers by the structural assembly in its non-corrupted state and advantageously utilized for the listeners is also kept inside of the assembly. The result is that for nearby non-listeners, unwanted disruptive speaker sound energy that would otherwise be normally uncontrollably broadcast out into the surrounding room in all directions by the speakers without the acoustically-significant utilization of an employed embodiment system enclosure structure is not allowed to do so by the sound blocking and absorbing capabilities of the embodiment system enclosure structural walls and surrounding optional acoustic barrier such as outer sound controlling panel 29*b* in FIG. 19. The result successfully reduces the amplitude and quiets the area outside of the enclosure in consideration of nearby non-listeners, while simultaneously maintaining full amplitude inside of the enclosure for the advantage of the listener.

In addition, the same sound controlling panels used to keep sounds IN the assembly can also be simultaneously and effectively used to help keep unwanted exterior sounds OUT of the assembly by blocking surrounding environmental sounds like interfering background noise, distracting street sounds, and nearby environmental sounds such as undesirable noise from heat and air conditioner air vents, blowers, refrigerators, washing machines, and the like, from entering the assembly from outside the assembly, thus reducing the ability of these outside unwanted noises from disturbing the listener during a listening session.

Figure 32:
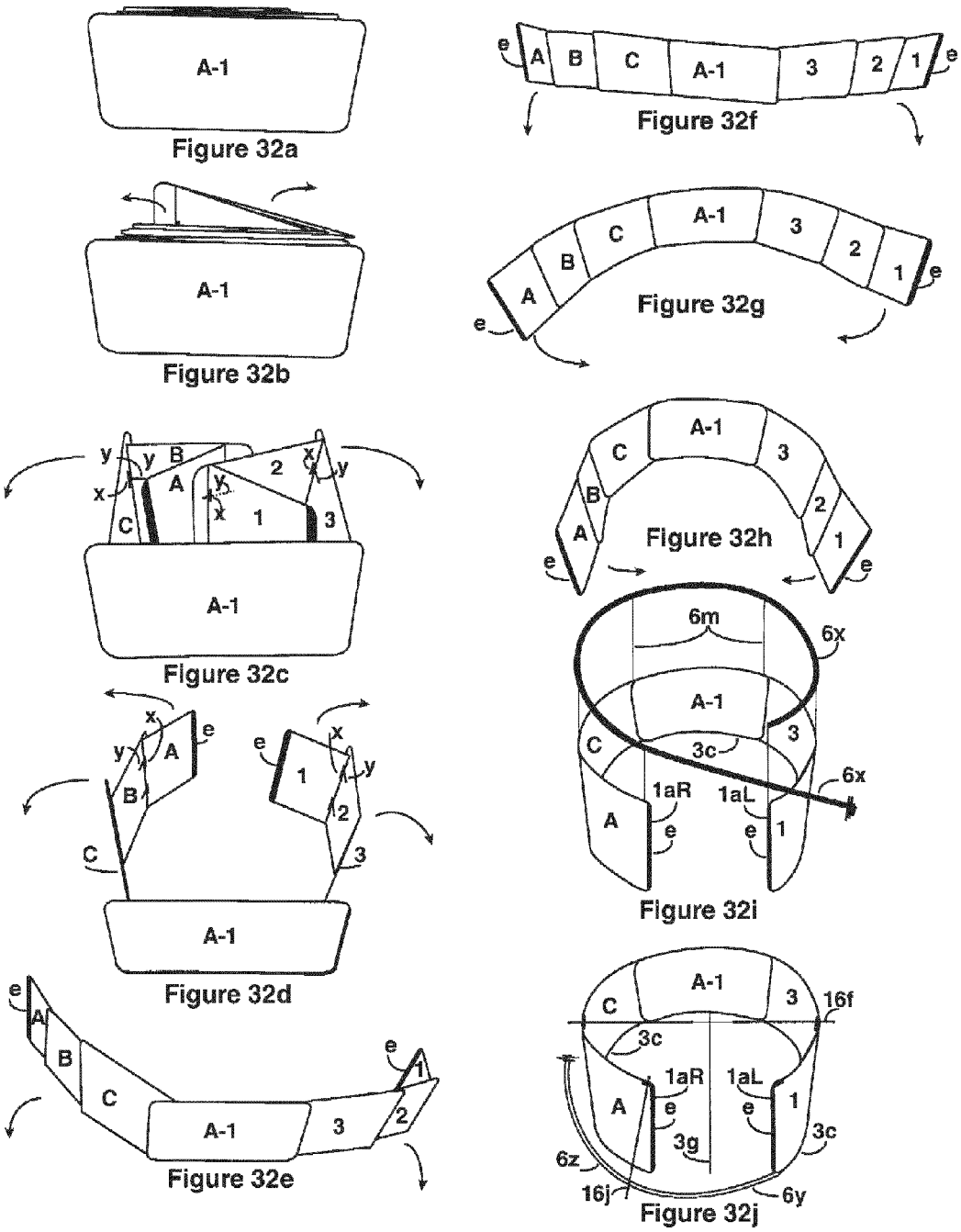
FIGS. 32*a*-32*h* show perspective view of an embodiment system showing a progressive series of connectively-attached, adjustable-size, adjustable number, sound controlling panels being unfolded from a storage size into a fully-setup, fully-operational, adjustable-size embodiment system that is a free-standing, self-supporting, portable, knock-down modular sound-controlling enclosure assembly that is fast and easy to assemble, disassemble, store and transport in a substantially flat position.
FIG. 32*i* shows a perspective view of an embodiment system showing a series of connectively-attached, adjustable-size, adjustable number, sound controlling panels that can be one continuous panel having an overhead rail and at least one attachment mechanism for securing the rail to the ceiling and embodiment system to the rail, holding the wall of the embodiment system in a desired vertical and horizontal position.
FIG. 32*j* shows a perspective view of embodiment system showing a series of connectively-attached, adjustable-size, adjustable number, sound controlling panels that can be one continuous panel having an floor rail and at least one attachment mechanism for securing embodiment system to the rail, holding the wall of embodiment system in a desired vertical and horizontal position.

Panels and other embodiment system components of this and most other embodiments can be connected together by various components and, except for the embodiment system shown in FIG. 32, in no specific order using common lightweight, inexpensive, connective fasteners including hooks, clamps, tape, hook-loop fasteners and other connective fasteners as described in illustrations with individual embodiments. Internal and external panel stabilizing and/or positioning devices of many types include those detailed below, and shown in FIGS. 15-17, can also be used to help dimensionally-stabilize, support, and position sound controlling embodiment system components into needed sound controlling positions.

For most of the portable embodiments, the panels themselves need only serve as structural devices and it is not required that each be made themselves of sound reflective materials. One of the reasons for this is that one or more symmetrically-positioned, and even non-reflective, embodiment system structure components can be surface-lined on the interior with one or more different sound reflective materials, for example, a fully specular or diffused surfaced material, at one or more sound controlling locations that can then serve as the dominant sound controlling surface at that specific location. For example, acoustic skins, such as acoustic skin 13*c*, FIG. 13, which may be comprised of a sheet of plastic, composite material, aluminum, paper, or any material for example, can be added to one or more temporary or more permanent locations of an employed embodiment system structure in order to capture, control, and/or focus the indirect sound emitted from the speakers to the listener from that acoustic skin covered interior location on the employed embodiment system structure, thereby providing different and sometimes dramatic acoustic changes to the overall embodiment system acoustic experience for the listener 19*a*. The sound-controlling materials may include an interchangeable amalgamation of unique and different, even non-dimensionally stable, often very low-cost, lightweight sound-controlling materials that can provide the listener with subtle to not-so-subtle acoustic experience variations.

Acoustic skins can vary from sound absorptive to fully specular sound reflective surfaces at the listener and acoustic designer's option, can be used alone or in combination with other acoustic skins, on the same structure or interchangeable with other sound-controlling embodiment system structures, and they do not need to be dimensionally-stable or structurally supportive materials to be used for their sound reflective provisions.

Assembly panels, sound shapers, and sound controlling positioning devices can be precision-positioned quickly and easily using quick-reference positioning symbol lines and symmetrical part-alignment positioning systems located at the same strategic symmetrical positioning locations on both sides of an employed assembly. These systems can be provided with the assembly to ensure optimized, consistent, fast, easy setup of an employed acoustic assembly and to ensure the main sound controlling panels and other sound controlling components, including sound shapers and speakers, are symmetrically positioned in the same horizontal and vertical position, including front to back and left to right, on both sides of an embodiment system assembly in a consistent and symmetrically appropriate location in relationship to the listener.

Examples of symmetrical part-alignment positioning systems with their quick-reference positioning symbols are shown in FIGS. 3 and 4 with symmetrical part-alignment positioning system 3*a*, for example, and quick-reference positioning symbols 3*c*, 3*d* and 3*g*. Using a symmetrical part-alignment positioning system with its quick reference positioning symbols usually allows entire employed embodiment system listening rooms to be setup within the above mentioned 10 to 15 minutes, without measurements, without added tools, and without any special skill. The only thing the listener must do once the embodiment system listening room is setup is to turn on his or her stereo system and immediately begin to enjoy a precision-positioned, symmetrically-accurate, audiophile-grade dedicated surround sound with the presented embodiments in almost any room in their home or other space, and in any part of that room/space, with no added wires, no added speakers, no added amplifiers or electronics, and no permanent installation of any kind. This has never been possible before at any price point. In fact, the price point of these complete embodiment system portable listening room structures can cost less in their entirety than the price of a single high performance audio cable alone.

Sound shapers and acoustic extenders can be made from a variety of materials including currently-available, lightweight, tough, high-impact resistant, and mar-resistant materials, that include the same or different materials as used for main embodiment system sound controlling panel components. They can be dimensionally-stabilized, made flexible, connected, and positioned as described below for general panels, at almost any angle, position, and location on or near an employed embodiment system assembly. They are generally standardized parts usable by all embodiment system structures at different sizes and employed at the same symmetrical mirror image locations on both sides or top of an employed embodiment system structure. They normally are employed both above and below the listener's ears in all parts of the assembly to help reveal, shape, and control focus one or more elements of the speaker-emitted three-dimensional sound field picture toward the centrally located listener.

Different size embodiment system panels, including sound shapers, and acoustic extenders, can easily be interchangeably substituted among one another with few placement restrictions. They can be usable on both sides with a different sound reflective surface on each side. They can be used in concave or convex reflective shapes, and combined or overlapped with one or more sound shapers or acoustic extenders to, for example, extend or reduce the size of the assembly or their reflective pattern from specific sound control locations around the listener. They can help, sometimes dramatically, to acoustically change or vary, qualitatively control, quantitively control, directionally control and/or chronologically time-delay control symmetrically-captured embodiment system acoustically-pure indirect sound elements from a multiplicity of specific sound control locations around the listener.

Because sound shapers and embodiment system panels can be mostly soft-edged, organic-shaped, and can be made to be ultra-lightweight, they help protect furniture and can be made to easily disengage from their connection points to reduce disruption to attached main panels upon accidental impact. Also, because they can be made ultra-lightweight, sound shapers can be freely-positioned, gravity-positioned, and/or slidably-positioned in multiple numbers as acoustic extenders with or over other sound shapers into various angles, inclinations, and curved shapes to catch sound from the speakers and transmit it to the listener from a multiplicity of symmetrical angles and directions. They can be side wall cantilevered, bracket positioned such as by part positioning flexible angle bracket 13*e* in FIG. 13, self-supported, proximity positioned adjacent or near to other sound shapers and embodiment system components. As with other panels and embodiment system components, they can also be easily and inexpensively connectively-used with many common lightweight connective fasteners and adjustably-stabilized by various support devices including a variety part positioning devices such as floor, overhead, or panel supported part positioning devices shown in FIGS. 15-17 and by still other components.

As shown in FIGS. 1E through 1F, sound shapers and acoustic extenders allow the listener and acoustic designer to make an incrementally variable (i.e. modular) larger or smaller overall embodiment system sound-controlling structures without having to necessarily add on more or larger main sound controlling panels in order to accommodate a closer or further speaker-to-listener distance, to accommodate different sitting, reclining or lying device requirements, and to shape and control many acoustic characteristics that affect important nuances of sound around the listener. This also allows the simplified, inexpensive manufacture of these interchangeable standardized parts using low cost materials, thus providing substantial economies of scale and lower consumer prices through higher volume standardized production methods.

Although sound shapers, acoustic extenders, acoustic skins, and the like, provide substantial adjustability and versatility to many embodiments these adjustability options are not required for operation of any of the presented embodiments. For most listening sessions, it is a setup-once-and-forget type of an arrangement where one standard set of arrangement is sufficient for full enjoyment of the acoustic presentation.

Sound shapers, acoustic extenders, acoustic skins, and the like enhance the overall acoustic functionality of the assembly, however, these can be viewed as tweaking devices that, in addition to above explained uses, can help the listener and acoustic designer to, for example, realize a more maximized and interactive high-performance listening experience using a wide range of customized listening arrangements that can be adjust to better fit the original purpose of the sound presentation as intended by its artists and acoustic engineers. They can help also adjust, expand, and/or extend the normal shape, size, and acoustic functionality of a particular employed embodiment system. This also allows the listener to adjust the sound field picture, for example, horizontally and or vertically that results, for example, from different miking arrangements. Although, it is advantageous not to be restricted to only one setup arrangement to fully acoustically experience the many different sound presentations that have been miked and encoded substantially differently over the last sixty to eighty years of stereo audio sound reproduction, in most instances, these adjustments are not needed for full appreciation of a particular acoustic presentation by most individual users.

Where acoustic skins, sound shapers, and the like come into play as high-value advantages is because many audiophiles enjoy acoustically tweaking their systems and the sound they significantly hear and impactfully appreciate. For those individuals, these and similar devices provide that tweaking ability, to an almost unlimited degree. For example, for audiophiles, the versatility of these devices allow a favorite soundtrack listened to many times before, for example, to be experienced by the listener in any number of new, incrementally variable, and subtle nuanced acoustic presentation differences that present the sound picture to the listener in many different, but still very enjoyable, ways. Also, having this versatility instinctively encourages most listeners to extend their normal listening sessions and expand their customary types of acoustic genres because of the added variety and options for subtle, and sometimes not-so-subtle, differences that are provided and enhanced by the presented embodiments and these tweaking devices. Their use, however, is not required to enhance all or many sound presentations. This is because they add to an already enhanced sound presentation provided by the basic setup arrangements employed by most embodiments to, for example, help overcome stereo speaker crosstalk and prevent out-of-sync listening room reflections from muddling up the basic presented sound presentation.

In regard to setting up a system once and not tweaking anything during the listening session, the functionality of such tweaking devices as sound shapers and acoustic skins are replaced in the more simple embodiment system designs, especially in the smaller, more portable embodiments, by, for example, one connected panel that may also be a flexible, or a combination panel. For example, combination panel E, L, and K of the embodiment system shown in FIG. 20 has an attached upper flexible panel E that takes the place of an upper, or above the ear, sound shaper. In fact, panel E is a form of a connected sound shaper that provides the same, but perhaps slightly less versatile, acoustic functionality. For example, the standard initial setup arrangement for panel E is to flex it into an approximate right-angled horizontal position and leave it in this position, without moving or adjusting it, during a normal listening session.

To explain the overlap of structural functionality among different or other embodiment system structural setup arrangements, note that panels C, L, A, B, and P in FIG. 22 for a smaller closer to the speakers' positioned also correspond to panels with the same letter, C, L, A, B, and P shown in FIG. 20. Although the embodiment system of FIG. 20 is a much smaller version of the embodiment system of FIG. 22, the panels in both embodiments are structurally placed in the precise same position and angle between the speaker and the listener, they use the same precision geometric symmetry and applied optics, can be made from the same materials, and serve the same acoustic purpose and functionality of precision capturing substantial quantities of speaker emitted indirect sound and precision advantageously using and focusing it toward a centrally-located listener.

Another example using the same FIG. 20 structure is shown between FIGS. 21-A and 21-C, where top panel E, side panel L, and lower panel SS-14C shown in FIG. 21-C are the same as top panel E, side panel L, and lower sound shaper 14C shown in FIG. 20. Although they are supported differently, and the lower attached panel SS-14C replaces hook-loop attached sound shaper 14C, the panels in both embodiments are structurally placed in the precise same position and angle between the speaker and the listener, they use the same precision geometric symmetry and applied optics, can be made from the same materials, and serve the same acoustic purpose and functionality of precision capturing substantial quantities of speaker emitted indirect sound and advantageously using and focusing it precisely toward a centrally-located listener.

The same principles of precision geometric symmetry and applied optics are used by the presented embodiments to acquire size scalability or organic scalable sizing among the presented embodiments. The embodiments rely upon several portions of the law of elliptical reflection to provide precision geometric symmetry as a fundamental part of its structure. The embodiments use portions of these elliptical laws to provide precision geometric symmetrical structures that have, as a fundamental part of their design, the ability to be scaled up or down into other sizes without severely affecting their acoustic performance. This means that a small portable compact chair size to a far larger-sized embodiment system can use different size parts but provide fundamentally the same geometric and optical embodiment system interrelationship and result between and among these same key components and parts. This includes the ability for inter-system and intra-system movement or the interchangeability of the same component part that can be made of the same material at different sizes among the same or other embodiments in order to provide essentially the same embodiment system acoustic problem solving and listener advantage results, but at scaled sizes for different applications to accommodate, for example, different distances between the speakers and the listener's position and to adjustably fit different sitting, reclining and lying devices, etc.

The result is that all of structures of the presented embodiments are able to be coupled together with the speakers into a cooperative symmetrical relationship in order to construct a highly controlled reflection pattern and sound picture around the listener, especially between, and on the same horizontal plane as, the speaker drivers and the listener's position. These listening room structures can also quickly, easily, and inexpensively be morphed into and become, for example, the size, shape, and structure of highly-controllable portable sound studios for audio sound reproduction that are capable of being used almost anywhere, in any room including rooms normally totally unsuitable for high-performance audiophile grade sound reproduction. These include serving as highly standardized multi-functional sound studios, retail demonstration showrooms, audio equipment and software evaluation rooms, music therapy rooms, video game rooms and like for professional, retail, commercial, and residential use. The results gained from these standardized listening rooms can then be repeated almost anywhere in any other room using the same system and the same specific quick-reference positioning symbols to specify and setup the same sized embodiment system listening room that can then be used to duplicate the same original acoustic results.

Just as a real sound arrives to the listener's position from a specific, real, and separate physical location around the listener, each individual sound provided by an employed embodiment system also arrives to the listener from a specific, real, and separate physical location around the listener from one or more progressive time-line-oriented embodiment system components. That is, the employed embodiment system's captured and precision controlled sounds are in reality real sounds, their sound propagation paths are in reality real sound propagation paths, and the time aligned projection locations from which these real sound paths arrive to the listener are in reality from true, real, embodiment system time-aligned physical locations from on and along the extended embodiment system's acoustically-significant components that are precision positioned between the speakers and the listener as well as optionally around the listener as illustrated in FIG. 1B with arrows 1 through 5. Thus, the listener's ears and brain respond to these embodiment system provided real surround sounds as if they were real surround sounds to the extent that it is not uncommon to observe a listener feeling compelled to instinctively turn his or her head in the direction of and look at the assumed individual sound source location even though that physical sound location that the listener's ears and brain are hearing that sound arriving from may, in reality, be located a substantial physical distance apart from its actual speaker sound source location.

As an environmental note, all of the structural panels of portable embodiments can be fabricated very economically from a selection of extremely lightweight, low-cost, durable, and currently-available structural panel materials that have a wide range of sound reflective surfaces. These include sustainably-produced, recycled, recyclable, and 100% biodegradable panels that are highly dent and crush resistant, easily-cleanable, accident-friendly, and can be lean manufactured with low material waste using environmentally responsible fabrication methods. The embodiments themselves use essentially obsolete-free, non-electronic embodiment system components to deliver 100% of their results non-electronically without adding wires, speakers, permanent installation, or added electrical use. In addition, they capture and beneficially utilize substantial quantities of otherwise wasted and damaging sound energy to create a plurality of substantially inexpensive, significantly-helpful, and long sought-after acoustic solutions, industry provisions, and audiophile-grade listening experiences that have been, until now, extremely difficult to provide at any price point or energy consumption level.

With an embodiment system in place, the listener can now not only hear the substantial spatial pinpoint localization of the originally-encoded three-dimensional surround sounds but the listener can now acoustically transport himself or herself, by the strategic positioning of embodiment system acoustic components, to the substantial middle and acoustic energy focal center of the original recording site strategically acoustically-positioned at or between the microphone's original physical recording location(s). From this strategic acoustic vantage position, the acoustic presentation is now able to be decoded, substantially reconstructed, triangulated, pinpoint positioned and three-dimensionally delivered to the listener's position from a multiplicity of embodiment system provided directions and angles in a similar inverse way as when this acoustically-significant information was originally recorded, thus surrounding the listener with a believably-real replica of the original sound field, not only completing the stereo audio sound reproduction process, but also creating a true audiophile experience for the listener.

FIGS. 20, 21-A, 21-B, 21-C, 22, and 22-A show stereo speaker sound systems. For brevity and more simplified explanation, the left sides of a left and right side assembly is shown for these systems. The unseen right side is a mirror image of the shown left side and is assembled basically the same as the left side. A first system is shown in FIG. 20, a second system is shown in FIGS. 21-A, 21-B, and 21-C. A third system is shown in FIGS. 22 and 22-A. FIG. 20 shows a front and perspective view facing the inside portion of the left and back sides of a of complementing, interconnected, and listener-adjustable components of the portable system.

The assembly of the components in FIG. 20, make up one of the many usable shapes that can be utilized by the listener and acoustic designer to substantially capture and advantageously utilize the normally wasted and acoustic damaging indirect sound from universally-available speakers such as speaker 1*a*L.

The following descriptive information, although specific to the system of FIG. 20, can also apply to other portable systems as described below. As with other portable embodiments, this acoustic structure follows the performance area detailed in FIGS. 1C and 1D. The combined use of the symmetrical left and right sides of an employed embodiment system as one synergistically-cooperative sound-controlling assembly normally results in a synergistic interrelationship of the two sides working together symmetrically. For brevity and for a more simplified explanation of the system of FIG. 20 shows a perspective view of only the left side. Although a complete left side or a complete right side, or the individual acoustically-significant parts of an employed embodiment system's two sides can be used separately and independently, in most instances the unseen right side uses, positions, and applies the same parts in the same way as the symmetrical left side with the right side parts made and arranged as a symmetrical mirror image of the left side. This symmetrical positioning is realized by using a unifying quick-reference centerline symbol, such as centerline symbol 3*g* in FIG. 20, as the symmetrical center of the assembly. It is assumed that the left side information provided below will be duplicated on the right-side for the combined assembly.

The embodiments are a system of portable lightweight sound reflecting and sound reflective surfaced panels and components that are used with a stereo systems' pair of universally-available left and right stereo speakers. These speakers can even be the users' existing two-channel stereo speakers or they can be supplied with the portable embodiments. Embodiments can be supplied as one panel, one left and right panel such as shown with the embodiments, or can be multiple individual panels such as with the embodiment system of FIG. 20 that can be made from a wide variety of materials, connected together, and the panels positioned to extend approximately between each side of the listener's location and the outermost sides of the speakers. The panels can be expanded or contracted to adjustably fit the space between the listener and the speakers, and to accommodate, for example, different sitting, reclining, and lying devices, listener arrangements, and the like.

Most panels are supplied with the components to temporarily but securely connectively attach one or more sides, edges, or portions of the panels to one or more adjacent panels. This provides reinforced locations to flex, pivot, curve, bend, shape, and connect components of the system in order to best size, position, and angle them to collectively capture a significant portion and substantial quantity of normally uncontrolled, non-utilized, and acoustic damaging indirect speaker-emitted sound. The sound reflecting and/or sound reflective surfaced components and their positioned angles can then collectively focus that sound, in its pure and uncorrupted state, toward the listener's position from a multiplicity of sequentially-ordered, especially lateral locations from along the expanse of sound reflective surface area of the embodiments panels positioned between the listener and the speakers. One of more panels can be removed, added, flexed into various positions and freely-held into those positions by the dimensionally stable panels themselves and by the connective nature of the integrated panel system, where the panels are mostly connected at two or more locations on the panel thus providing connective dimensional stability. Once these panels are properly positioned, for example, along a specific precision quick-reference positioning symbol line, like quick reference positioning symbol line 3*d*, FIG. 20, the sound field encoded within stereo signals can be provided to the listener in a substantially enhanced and believable acoustic form.

The embodiment system of FIG. 20 panel structures includes one or more panels that can be portable, movable, interchangable, and repositionable with one or more substantially planar portions, one or more substantially curved portions, or combinations of planar or curved portions that adjustably connect, attach, and/or gravity position into various generally equally-positioned left and right side symmetrical positions.

The panels illustrated in FIG. 20 include side and front panels L, K, A, B, and P, top panels F, E, and D and back panel C. The panels can vary in size, number, flexibility, shape, position, level of reflectance, and combinations thereof. Adjustable size and number of parts and the detailed versatility of the overall assembly, allows the overall structure to be quickly, easily, and incrementally adjustable including adjustably expanded or reduced to allow the listener and acoustic designer the option to quickly, easily, and incrementally adjust, shape, and reshape (tweak) parts or the overall structure in relation to the speaker 1*a*L and the listener's position N prior to and during the listening session. This allows the high-performance listener maximized and interactive high-performance listening experience using a wide range of customized listening arrangements that best fit the sound requirements of the sound source, including being able to more closely connect with the source artists, the intent of the source's acoustic engineers, subtle acoustic characteristics of instruments used, and the reverberation component of the original sound field.

As mentioned above in the general section relevant to all embodiments, the overall size of the employed embodiment system of FIG. 20 needs to be sized large enough to approximately fill-in the expansive open horizontal and, if desired, vertical space that exists between the speaker's location 1*a*L and the listener's location N. The employed embodiment system can also extend from the side of the listener N to the back of the listener N. It can also extend to include overhead portions of the listener N and/or the speaker 1*a*L.

Embodiment system of FIG. 20 components can be varied among and between organically-shaped and more planar-shaped embodiment system configurations at scaled sizes that accommodate, for example, different variable sized and shaped speakers and varied listener's positions and to provide user-friendly options for the maximized utility of embodiment system components, including a high level of component interchangeability. Some examples include the following with specific references to specific embodiments.

Using as an example, side located panels L, A, and B, shown in embodiment system of FIG. 20, can be combined to be one continuous panel and that panel can be made to be bendable. This configuration is illustrated in embodiment system of FIGS. 22 and 22-A that shows corresponding side panels with the same corresponding panel identification letters, L, A, and B, shown in FIG. 22, that have already been combined into one continuous bendable panel. These two combined panels can be interchangeable if needed, for example, to accommodate a shorter or longer speaker to listener distance or different sitting, reclining, or lying devices.

Upper sound reflective surfaced panel E of FIG. 20, and lower sound shaper 14*c* can be combined into one continuous panel with the addition of side panel L. The three panels, upper panel E, side panel L, and lower sound shaper panel 14*c*, can also be one continuous panel that can also be a bendable panel.

This same embodiment system panel configuration of upper panel E, side panel L, and lower sound shaper 14*c* shown in FIG. 20, correspond to the same upper panel E, side panel L, and lower panel SS-14*c* of FIG. 21-C which are shown as one continuous and bendable panel with the same panel position, the same panel configuration, that can be made of the same materials, and that have the same reflective application as those same three (3) panels visually exampled in FIG. 20, as panels E, L, and sound shaper panel 14*c*, making these, the above, and many of the below examples, mutually interchangeable components among different sized, but same configurations of the embodiments.

This creates a "C" shaped side panel corresponding to upper panel E, side panel L, and lower panel SS-14*c* of FIG. 21-C, where the distinction between the top, middle, and bottom panels are much less distinct because all 3 panels E, L, and the sound shaper replacement panel SS-14*c*, are now essentially one continuous panel that can be flexible and pivoted across the entire panel or at specific portions as now shown, for example, between panels E and L. This "C" shaped panel can then be extended forward, as one or more, same or different-sized, rigid or flexible, continuous or separated, segmented or non-segmented panels toward the speaker 1*a*L, where they can be positioned near to the outermost side of, attached to, partially around, or as a part of speaker 1*a*L. One or both ends of flexible embodiment system can also be shaped, drawn-in, or made smaller, like a funnel, to help capture and deliver acoustically-pure sound to the listener or acoustic designer.

This flexibility to be larger at one end and smaller at the other end offers advantages of more continuously controlling the unfolding of the sound wave from the speaker propagation point to the listener, or varying the concentration of the indirect sound from the speaker more controllably and optionally for the listener and acoustic designer.

FIGS. 21-A, 21-B and 21-C illustrate an embodiment system in accordance with the presented embodiments and their method of application which is a combined sound controlling panel version of the embodiment shown in FIG. 20. The embodiment system shown in FIG. 21-C is a highly-portable, inexpensive, variable-shaped, variable-segmented, flexible sound controlling side wall that can replace in a smaller form the following embodiment system illustrated left side wall sound controlling components: sound controlling panels E, L, K, A, D, and B.

FIG. 21-A shows a left-side embodiment system in its flat form after it has been unrolled from a small portable shipping, storage, or transport container. It shows a view of the embodiment system similar to the view of the combined panels E, L, K, A, D, and B as illustrated in FIG. 20 if panels E, D, and B were to be pivoted to be on the same plane as panels L, K and A. That is, when these six panels are flat and on the same plane with each other, before they are pivoted into the position shown in FIG. 20. FIG. 21-B shows a view of the embodiment system from a front overhead position after it has been assembled into one of any number of sound controlling shapes. As illustrated in FIG. 21-B, panels 21A can be separated (e.g., cut apart at cut lines 21B) to become individual panels. These individual panels can be overlapped and connected with adjacent panels to form a shaped sound catching wall structure, such as shown in FIG. 21-C, that can be held in place with positioning or holding fasteners 21C such a clips, catch edges, hook-loop fasteners, and the like, to connect and hold the two adjacent panels 21A into an overlapped position. To precision position the joint (e.g., overlap joint) where the sound controlling panels 21A are connected together, a symmetrical part-alignment positioning system with quick-reference positioning symbols 21D can be placed at one or more connective locations 21B to precisely overlap the sound controlling panels 21A at precise user-specified overlap distances. These panel overlap distances can then be easily matched or adjustably-positioned with other connective overlap locations, such as on a symmetrically matched opposite side, in order to quickly, easily, and accurately shape the combined assembly into it's particular shape desired by the listener.

A system of holes 21E can be fabricated into the embodiment system. Hole system such as hole system 21E can be a system of shaped holes to help stop the cut line 21B from continuing when the sound controlling panels 21A are stressed and bent into an overlapped position as above mentioned, to help avoid creasing the sound controlling panels 21A from the overlap and panel bending stress. Reinforcement system 21F can be a panel reinforcement system constructed of at least one layer of reinforcing fasteners following the straight line created by cut lines 21B that can be positioned on each side of the panel. Once the assembly is connected together, such as shown in FIGS. 21-B and 21-C, the assembly of connected sound controlling panels can be stabilized into that particular connected shape by a number of support methods known to those skilled in the art. This left side angled sidewall is symmetrically repeated on the opposite right side (e.g., with a mirror-image copy).

The embodiments can also be inexpensively and easily manufactured from currently-available methods and materials mentioned above. For the embodiment system of FIG. 21, this also includes telescoping portions. In addition, they can be easily assembled, held into shape by various components and devices, and supported temporarily or more permanently by devices mentioned with the presented embodiments, and those commonly available or known to those skilled in the art.

Most portable embodiments can be inexpensively manufactured with a different number of segments at varying distances apart, with different materials, thicknesses, and the like, to adjust, for example, for different size speakers, different size setup configurations, different support devices, and variable acoustic experiences, as mentioned above.

These fundamental embodiment system panel and component combinations, and those detailed above and below, all precision capture and advantageously utilize a substantial portion of valuable, pure, indirect sound from speaker 1*a*L in the same way, capturing, precision directing, and focusing it to the listener from a multiplicity of embodiment system directions and angles, resulting in the many advantages of the presented embodiments Panels that are used in the assembly and other components of this and other embodiments can be connected or adjoined together by various components including using commonly-available fasteners such as by cutting or scoring panel components and creating flex joints at those points, using clips, clamps, adhesives, hooks, tapes, snaps, hangers, flexible hinges, cording, magnets, slidable rivets of various sizes and shapes, and other components to fasten together these panel components in order to also allow user-adjustable movement during setup and use. Using, for example, hook-loop fasteners with the various panels positioned in FIG. 20 as a guide, the floor supported combination panels K, L, E, and A can be attached to back panel C, if panel C is used, and then to combination panels B and D, if they are used, which can be connected to panel P if panel P is used, in no specific order generally as shown in FIG. 20 using hook-loop fasteners such as at hook-loop connection points G, H, 15*b* and Q.

In addition, the embodiment system can be assembled at various connection points. One or more connection points can be a pivotal and slidable connection point, such as by using a hook-loop "hinge" or a slidable part positioning device such as a slidable part positioning hook-loop hanger device 15*b* with an attached symmetrical part-alignment positioning system illustrated in FIGS. 15 and 21. A pivotal hook-loop hinge can be created, for example, by adding a hook-loop fastener, such as hook-loop fastener 14*e* in FIGS. 14 and 20, to a connecting edge of a panel in one or more locations along that connecting edge, then connecting the hook-loop edge of that panel to another panel that has an opposite hook-loop fastener added to it, such as where panel B is attached to panel A at location I and where panel C is attached to panel L at location H, FIG. 20. Once this attachment is securely made between panels, for example, between panels A and B, the perpendicular attached panel, such as panel B, can be pivoted up to 180° on the plane of panel A while remaining securely attached to panel A. This provides fluid pivotal movement to panel B with little effort while remaining securely attached to panel A. This is one way to change of overall size of the assembly and the angle of these and other attached panels in regard to the sound output from speaker 1*a*L toward or away from the listener position N, which, in turn, influences the direction of the reflectance pattern off sound controlling panels A, B, and D and other attached panels. This action is quickly and easily attained simply by the listener sliding or moving hanger device 15*b* along the top of sound controlling panel A, thereby providing one of the systems for adjusting the surround sound picture and other acoustical characteristics.

Another alternative connective options is using a slidable hook-loop part positioning hanger device such as 15*b*, with a hook-loop fastener attached to it that connects panel B to panel A. Using a slidable hook-loop part positioning hanger device such as 15*b* provides panel B with the double advantage of both providing a pivotal connection to panel A and a slidable movable connection along panel A, allowing panel B to be securely attached to panel A but also providing the ability to be fluidly moved left and right along panel A without the need for a reattachment that would normally be required because the connection is made using a stationary positioned hook-loop fastener alone that is physically attached to panel A. This is because the user does not have to first disconnect panel B from the original hook-loop connection point on panel A, choose a new hook-loop connection point on panel A, and then reattach panel B to the new connection point along panel A. That process would be required if using a stationary hook-loop fastener permanently attached to panel A. This provides the user with a quicker, easier, and more fluid way to adjust panel B to many positions along panel A that it connectively hangs from using a slidable part positioning hook-loop hanger device such as 15*b*. In addition, adding a symmetrical part-alignment positioning system to panel A, such as is provided by symmetrical part-alignment positioning system 21*z* in FIG. 20, allows panel B to be quickly, easily, precisely, and symmetrically positioned and repositioned, at a very specific point on panel A which also can match-up with, and be repeated in the same way, on the right side of the assembly with the right side panels there to provide a symmetrically-balanced, overall precision-aligned embodiment system assembly for the user quickly, easily, and inexpensively. Removable connective fasteners including those explained above and other connective devices can be liberally utilized across the different presented embodiments including with sound shapers.

Figure 30:
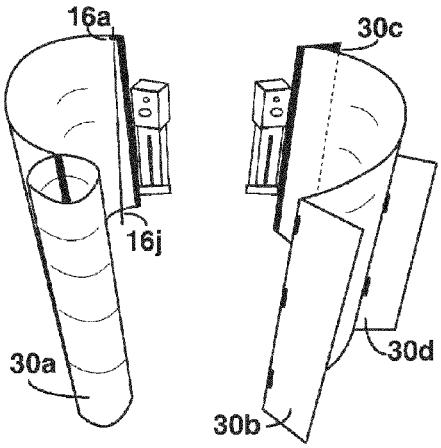
FIG. 30 shows a perspective view showing a portable, fully-operational, adjustable-size embodiment system with versions of free-standing open sound controlling sidewalls 7*a* and 7*b* from back and outside of system.

Combination panels B and D are adjustable and can be expanded, reduced, or extended to the floor like adjustable adjacent combination panels K, L, E, and A, and can be supported as a floor supported panel. It could be shortened and connected to a connection panel such as panel P. Panel P can be expanded, reduced, and extended to the floor to be a floor supported panel. This panel P can be used as shown connected to the back or side of speaker-stand 1*a*L-1*c*, not used at all, or replaced by another connection device for combo panels B and D. Combo panels B and D can be used with or without a connective panel P, with or without top panel D, not used at all (where panel A can then be swung near to speaker 1*a*L) and/or simply be left freely attached to adjacent panels such as combination panels K, L, E, and A. It does not need to be attached or connected to anything and can simply be a floor-supported free-standing panel positioned approximately as shown. Or, the panel can also use other support systems to keep it roughly in a vertical position including the use of panel support devices. It can use part adjusting devices including telescoping part adjusting devices 16*j* and 16*k* such as shown in FIGS. 16, 21, and 30, to help stabilize it into an approximate position. It can use slidable part positioning hook-loop hanger devices such as 15*a* or 15*b*, in FIGS. 15 and 20, and other components to position the panels B and D known to those skilled in the art. In addition, it's shape, size, and degree of flexibility, for example, can change so long as it is positioned on the outermost left side of speaker 1*a*L and listener N and generally extended in the expanse of space that exists between the listener's left side and the speaker's left tweeter driver 1*d*. If the overall assembly is using a particular quick-reference part positioning symbol line on a symmetrical part-alignment positioning system in order to quickly, easily, and symmetrically positions itself, such as quick-reference positioning line 3*d*, panel B can quickly, easily, and symmetrically be positioned along that same or nearby quick-reference symbol line 3*d*. As shown in FIG. 20, panel B is not using a quick-reference part positioning symbol line and is being supported and attached vertically on its left side by a part positioning device, here a part positioning hook-loop hanger device 15*b* with an attached symmetrical part-alignment positioning system. Combination panels B and D, with or without top panel D, can have a highly variable sound reflective surface, from a highly specular sound reflective surface to no sound reflective surface.

The panels mentioned below, used alone and/or in combination, can be used as a reference guide for how these and other panels in this and other embodiments can also be varied in size, shape and flexibility to keep them, for example, in an approximate position especially between the speaker's tweeter driver 1*d* and the listener N and allow their use, for example, with any number of different sitting, reclining, and lying devices.

The exact dimensions and shape of the left and right side sound-controlling panel components, as with other embodiments, such as those illustrated in FIG. 20, are not as important as the placement and symmetrical positioning of those sound controlling components, especially in the expanse of space between the outermost portion of the speaker and the listener in order to substantially capture significant quantities of indirect sound propagating from the speakers.

As shown in FIG. 20, combined key reflective surfaced panels E, L, K, and A can be expanded, reduced, positioned, connected, supported, stabilized, angled, and can use the same or other devices as described above for combination panels B and D. Combination panels E, L, K, and A are sized, shaped, and positioned to adjustably capture indirect sound from speaker 1*a*L and to retain that sound inside of the embodiment system structure so that a substantial quantity of indirect sound from speaker 1*a*L is not allowed to escape from the structure, bounce around the room, come back to muddle up the sound for the listener, and so that embodiment system captured sound can be advantageously utilized as detailed above. As with left-side positioned sound reflective surfaced panels of other embodiments, combined panels E, L, K, and A are also sized, shaped, and positioned to reflectively use the captured information from the sound signals directing it toward the listener in a time-aligned ordered presentation to help retain the original sound field encoded within the original signals as close as possible to the way it was adjustably-encoded within the original sound signal sources.

Figure 14:
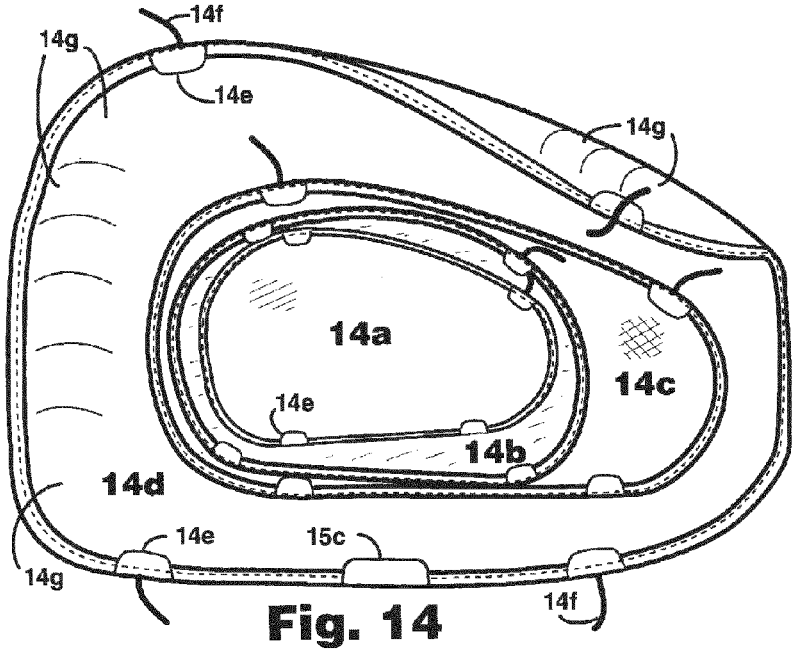
FIG. 14 shows a different size sound shapers for higher and lower variable positioning above and below the ear, usable for all embodiments.

Also, replacing sound shaper 14*c* with flexible sound shaper 14*d*, as shown in FIG. 14, creates a continuously bendable and flexible sound controlling portion that can be duplicated and/or repeated at locations anywhere along side panels L, A, and B, including at their top or sides. For example, one or more larger flexible connective sound shapers can be vertically attached to side panels L, and/or A and/or B, on either an inside or outside portion of these panels, thereby replacing top panel E and/or D with one or more flexible and connectively repositionable top panels that can be variably and considerably extended, for example, for larger setup configurations, that can extend further over the listener, and that can be flexed and bent into any number of different sound shaping and sound controlling configurations.

Combination panels E, L, K, and A can be one continuous panel or one or more individual panels, for example, to allow adjustable horizontal and/or vertical expansion or reduction in the overall size of the assembly. For example, one or more panels E, L, K, and A can be separate panels. Panels K and L can be separate panels, for example, where two larger panels K and L can be overlapped and detachably connected together, for example by repositionable attachment devices such as hook-loop or fastener device strips, at one or more overlapped locations allowing the overall height of the assembly to be vertically adjusted up or down by expanding or reducing the overlapped area to provide adjustable height to accommodate, for example, different sitting, reclining and/or lying devices. In another example, panels L and A can be separate panels where panel A can be extended to the floor and two larger panels L and A can be overlapped and detachably connected together at one or more overlapped locations allowing the overall length of the assembly to be horizontally extended or reduced by reducing or extending the overlapped area to provide, for example, adjustable distances between the left speaker and the listener. Many other examples and methods of connection known to those skilled in the art can be made to provide the listener and acoustic designer with adjustable sized-to-fit acoustic assemblies to help match the listener's particular system and their preferred listening distances. In addition, using quick-reference positioning symbols added at overlapped areas, such as shown on overlapped side panels 7*a* and 7*b* at 11*a* and 11*b* locations in FIG. 12, can allow quick and precise symmetrical alignment of these panels on both sides of the symmetrical assembly.

As illustrated in FIG. 20, panels A and L are shown in an approximate vertical position. However, these and other panels can be easily adjustably tilted or angled in off-vertical positions by the listener and acoustic designer before and during a listening session as they so desire, for example, to adjust parts of the sound picture being reflectively presented to the listener by the panels and by the overall assembly from the stereo signals. Flexible top combined panels F, E and D can be part of, added onto, the lower respective panel components C, L and B, or they can be removably, and temporarily attached to panel components C, L and B using, as explained above with other combination panels. Top panel components, such as top panel components F, E and D, can be independently and separately forward or backward flexed into a curved or bent position to capture indirect sound from the speaker in any number of positions or they can take on other positions such as a backward or parallel vertical shape along the same plane as lower panel components such as panels C, L and B.

Combination panels, as with all embodiment system panels, can be used by the listener and acoustic designer in various creative, user-friendly configurations, positions, angles, and the like in ways even other than those generally shown. Examples include using combinations that are reversed and used upside down from their shown position. For example, combination panels L and K can be used with an attached flexible top panel, such as flexible top panel E shown in FIG. 20, or can be turned over and used in its visual example position in FIG. 20, or in another position such as a replacement for panel A, where flexible top panel E can be flexibly reversed and turned upside down with attached panels L and K to become a floor-based support panel that is now capable of pivotally supporting panels L and K, instead of and overhead sound controlling panel. The turned-over combination panel arrangement of K, L, and E, with panel E now serving as a floor-positioned support panel, can then be easily used as either a self-supporting free-standing panel arrangement that is easily positioned, pivoted, and/or angled as needed by the listener and acoustic designer. It can also be used, with or without other sound shaping panels, or connectively attached to or with other panels as desired.

Embodiment system component parts, including sound-controlling panel components, sound shaping and sound-controlling devices, support devices, adjustment devices, part-alignment positioning systems, etc. described and illustrated with embodiments such as embodiments can be fabricated from, with, and by substantially more expensive, environment-unfriendly components and non-lean manufacturing methods than are detailed and illustrated herein. However, it has been determined through extensive comparative acoustic testing that these much more expensive, otherwise suitable, yet non-lean manufacturing materials and fabrication methods to manufacture the presented embodiments and their components are not necessary to dramatically-enhance even difficult-to-properly-reproduce sound and acoustics, such as high-performance stereo audio music surround sound and acoustics, and to substantially localize surround sounds and surround sound fields around a listener. In this regard, the presented embodiments can be successfully fabricated at a very low cost, while substantially-reducing energy-consumption and material waste, using substantially-efficient, conventionally-available, environmentally-sustainable materials, and while using non-electronic and non-electricity dependent yet high acoustic performance embodiment system components.

For example, it has been determined through extensive comparative acoustic and sound-controlling substrate testing between conventional and non-conventional sound-controlling materials, that even though embodiment system sound-controlling panel components can be fabricated from a variety of very expensive, thicker and substantially heavier conventional materials such as conventional safety glass, conventional 0.3 cm (0.125 inch) steel and aluminum, conventional 0.6 cm (0.25 inch) polycarbonate or conventional 1.3 cm (0.50 inch) acrylic sheeting and other conventional sound-controlling materials that are presently being used to fabricate sound-controlling devices for a variety of indoor and exterior sound-controlling and sound barrier applications, that very similar and even better sound-controlling results can be achieved for the presented embodiments using non-conventional sound-controlling materials detailed herein that have been tested and proven to not only deliver equal or better sound enhancing performance with the presented embodiments but which are also substantially more efficient and environmentally-sustainable sound-controlling materials that automatically provide responsible lower cost options for lean manufacturing methods as detailed with the presented embodiments. This, therefore, results in substantially lower overall embodiment system costs by optionally substituting and replacing these expensive, heavier, thicker conventional sound-controlling materials and manufacturing methods with non-conventional much lighter weight, much less expensive and much more portable sound-controlling materials, substrates and surfaces, including options like thin paper, fiberglass, aluminum, plastic, composite, sound reflective surfaces, substrates, and combinations thereof. Examples are detailed below that have been and continue to be used extensively in high-performance acoustic speaker drivers and diaphragms and that have been proven in comparative acoustic amplitude and spectrum analyzer testing, such as shown in FIGS. 1E through 1H, to be substantially high-performance sound-controlling substrates for use in many embodiments presented herein and which, by the nature of the substrates, can also be sustainably-produced from 100% recycled materials that are highly-recyclable at end-of-life.

Note that the below-mentioned materials included with this embodiment system and the other presented embodiments in this document, for example high-performance embodiment system sound-controlling panel components, are not only often manufactured from renewable resources, low energy input and recycled content materials but, in addition to their superior and unique sound-controlling qualities, non-hazardous content and low cost, can also provide such embodiment system acoustic and user-friendly advantages as being optionally transparent, translucent or opaque, highly-rigid, dimensionally-stable, lightweight, highly dent, mar, and crush resistant, easily cleanable, accident-friendly, fully printable on both sides, available in a variety of standard and specialty sizes, available in a number of calipers and acoustically-variable performance options and can be generally easy to die-cut, score, shape, cut, attach fasteners to, and sew by various application methods.

It has been further determined through rigorous comparative acoustic trial-and-error testing that each of the acoustic component products detailed in this document have their own unique sound-controlling value which can be used to allow the listener to advantageously adapt and adjust the presented embodiments to produce a variety of unique-sounding professional, commercial and consumer audio sound systems affects and enhance the overall acoustic listening experience. It should be noted here for key comparative and qualitative reference that, for many decades, speaker drivers and diaphragm membranes have been manufactured using thin, semi-rigid fabricated paper cone materials, including paper composites, which often can be used because their superb sound wave forming acoustics. Likewise, for the same acoustic-related reasons that thin paper material has been preferred for speaker driver and diaphragm sound wave formation, a selection of different surfaced, thin, tightly-stretched, semi-rigid fabricated paper-faced products have been found to provide excellent acoustic control, sound enhancement and audio surround sound acoustic advantages and to beneficially complement many variable-sounding audio sound systems such as those professional, commercial and consumer audio sound systems allowing them to project a more defined spatially localized top-end or a more directionally-enhanced treble-oriented sound presentation.

If an environmentally-responsible very lightweight specular sound-controlling material is utilized to fabricate sound-controlling panel components with embodiments and that material is 100% biodegradable and responsibly manufactured, it is presently contemplated that these embodiments employ, at least as an option, the below-mentioned responsibly-manufactured 100% biodegradable, two-wall paper-faced, foam board panel from The Gilman Brothers Company due to its combined lightweight and environmentally-conscious composition. However, the embodiment system shown in FIG. 20 can be produced from one or more other recyclable dimensionally-stable, flexible, sound-controlling materials described with this and other embodiments presented in this document and that provide different and unique sound-controlling acoustics for variable listener-controlled sound enhancement, including sound shaping devices such as sound shaping component 14*c* illustrated in FIG. 20.

For example, highly dimensionally-stable, thin 0.5 cm to 1.3 cm (0.188 inch to 0.50 inch), semi-rigid lightweight, stretched paper-faced foam core or foam board materials are currently available from such manufacturers as The Gilman Brothers Company of Gilman Conn. which manufactures an environmentally-responsible Biodegradable paper-faced foamboard panel which is 100% bio-degradable. In addition, United Industries of Bentonville, Ark. manufactures a 100% recyclable foam core panel, and Kommerling USA of Huntsville, Ala. produces a denser, harder surface foam board panel. Also, an example of a variety of highly dimensionally-stable lightweight sustainably-produced 4 mm to 6 mm recycled corrugated specular sound-controlling plastic products are being produced by US companies such as Corrugated Plastics of Hillsborough, N.J., which manufactures corrugated plastic panels comprised from 100% recycled plastics that are 100% recyclable at end-of-life, and Coroplast of Vanceburg, Ky. which manufacturers a lightweight, dimensionally-stable, 4 mm to 6 mm sustainable CoroGreen recyclable corrugated plastic sheet made from 100% recycled plastics including transparent, translucent, and opaque corrugated recyclable plastic sheets of various gauges and flute sizes, and a more rigid recyclable Stinger brand honeycomb plastic board that is manufactured in a variety of gauges and thicknesses.

An example of a variety of highly dimensionally-stable, thin 0.3 cm (0.125 inch), semi-rigid, lightweight, recycled and recyclable corrugated paper board products made from 100% recycled paper base materials is manufactured by Liberty Carton Company of Minneapolis Minn. which manufactures an environmentally-sustainable, lightweight, dimensionally-rigid Enviro-Corr 0.3 cm (0.125 inch) tri-wall double-flute corrugated specular sound-controlling paper board panel made from 100% recycled paper products.

All of the above-mentioned products, including many other products that the cited companies manufacture are exceptionally suitable as good to excellent but unique sound-controlling surfaces and sound-controlling panel component applications appropriate for use with this embodiment system and one or more of the other embodiments presented here.

Embodiments can also be easily and effectively comprised of the same materials as other embodiments presented herein, including 30 mil recyclable rigid polyvinyl chloride, high density polyethylene, thermoformed plastics etc.; metals including aluminum; glass such as safety glass, fiberglass and glass-reinforced plastics; carbon fiber; wood materials; paper, plastic, foil, etc. covered screens or panels; rigid plastic substrates, acrylonitrile butadiene styrene, polyethylene terephthalate, polycarbonate sheeting, etc.; including various metallized versions, composites, layers, and combinations of these materials, and other suitable sound-controlling materials known to those skilled in the art.

Other examples of a variety of recyclable, highly dimensionally-stable, semi-rigid, opaque, translucent or transparent, lightweight, specular sound-controlling solid plastic sheeting that also provide a suitable sound-controlling panel component material for use with fabricating other embodiments include 20 to 60 gauge recyclable polycarbonate, thermo-formed plastics, fiberglass, carbon fiber composites, polyethylene terephthalate, acrylic, glass-filled nylon, rigid polyvinyl chloride, acrylonitrile butadiene styrene, etc. manufactured by such companies as Bayer-Sheffield Plastics of Sheffield, Mass. and Plaskolite, Inc. with numerous manufacturing facilities located in the US and abroad. Aluminum and composite sheeting are replaceable options. The selection of sound-controlling materials available for use with this and other embodiments can also include an interchangeable amalgamation of unique and different, even non-dimensionally stable, often very low-cost, lightweight, and often highly recyclable sound-controlling materials used temporarily or permanently, alone or in combination, on the same sound-controlling embodiment system assembly. Examples include sound-controlling acoustic skins and acoustic extenders, whereby different sound-controlling materials can be temporarily or interchangeably attached to any of the sound-controlling panel components illustrated in FIG. 20, and more fully explained with FIG. 13.

If the sustainably-produced 4 mm to 6 mm corrugated polypropylene panels from Corrugated Plastics are used, for example, for flexible sound-controlling panel components with the embodiment system shown in FIG. 20, these and other panel components can be cut out of 1.2 m×2.4 m (4×8 foot) panels with the flute direction running vertically for side sound-controlling panel components E, L and K as well as the flexible sound-controlling panel components F, E and D, if these sound-controlling panel components are included with the embodiment system. The panel components can be printed first including top coated, using a wide-format dedicated digital printer such as from Agfa Graphics or Hewlett-Packard, and the perimeter radius edges and outer borders of the plastic sheet panel components can be die cut out or cut by other devices or application methods such as razor cut using a CNC machine and then cut horizontally or transversely across the a using parallel straight or V cuts approximately half the depth of the 4 mm or 6 mm sheet with the parallel cut lines running from 1.3 cm (0.5 inches) to 5 cm (2.0 inches) apart depending upon the amount of bend radius needed, with these parallel cuts running the entire length of the final panel components, using the closer-together cuts, such as the 5 cm (0.5 inches) apart cuts for a tighter bend requirement and 5 cm (2.0 inches) apart cuts for broader curve locations. These straight parallel edge-to-edge straight cuts then become long-lasting, strong, parallel flexible joints allowing the otherwise rigid, dimensionally-stable panel component to be easily flexed at these flexible joint locations. Aesthetic covering materials can also be added to the cut panel components.

Referring to the panel components, the corrugated paper and plastic products manufactured with a double-wall and a length-wise flute direction, for example, with the flutes running the 2.4 m (8 foot) direction on a 1.2 m×2.4 m (8 foot by 4 foot) sheet size, can be considered for maximum efficiency with most embodiments presented here. A double-wall length-wise flute direction arrangement generally allows for the maximum area of product use per sheet, with fewer left-over remnants of unusable yet recyclable product. On the other hand, sound-controlling panel components can be fabricated using double-wall plastic corrugated product with the flutes running the opposite way or width-wise and vertical to the finished product. This allows for easy hand cutting of one of the outside layers of the double wall corrugated material by simply cutting through the top layer along the flute direction using standard flute cutting tools designed for this purpose. For example, a Plast-Kut Knife from www.ProfessionalPlastics.com which then allows the corrugated sheet to have a highly durable flexible joint or natural hinge located at virtually any point or points, which helps when needing a flexible joint at any particular product location, such as illustrated on flexible sound-controlling panel components like flexible sound-controlling panel components F, E and D in FIG. 20. The corrugated double-wall products with the flutes running product length-wise can also be cut through one of the wall layers and partially cut through the thickness of the corrugated sheet on one or both sides of the sheet, cutting diagonal to the flute direction, using a razor and straightedge guide tools, as well as by automatic CNC router machines, such as a Swiss Zund G3 Digital Cutter manufactured for Zund America Inc. of Franklin Wis. However, if a single wall corrugated such as a single wall corrugated 5 mm or 6 mm plastic product can be produced with an "S" shaped flute, instead of the standard box flute currently being used in most plastic corrugated products, and if it can be produced with the flute direction running width-wise or in the vertical direction on the finished product, the cutting operation mentioned below may not be needed and a naturally-flexible, yet dimensionally-stable, product may be more efficiently produced.

Added panels can be connected, stabilized, and can use the same part positioning devices as described above to allow the listener to adjustably accommodate the employed embodiment system to their needed listening arrangements.

If panels need a flexible bend at a specific location to provide, for example, combination flexible panels such as combination flexible panel D and B, these panels can be comprised of one of several materials including lightweight plastic and paper-based materials that can be used to make a flexible bend that can also be positioned in dimensionally stable positions such as stabilized at a 90° right angle.

Dimensionally stable flexible bends can be made in many ways. For example, metal wire can be inserted inside one or more flutes of a corrugated material such as a thin, lightweight corrugated plastic material that can be used to make lightweight combination flexible panels, such as combination flexible panel D and B, slitting through the back wall of the panel at one or more needed flexible panel locations. If the flutes run in a direction other than the flexible bend direction, wire locations can be pre-drilled through the flute walls in the direction of the bend and the wire or wires can then be inserted in the pre-drilled holes located between the corrugated walls of the panel. Once inserted into the flutes or between the walls of the panel, the wires allow the panel to then be flexed at the slit locations and held into a fixed and more dimensionally stabilized position. This adds rigidity to panel sections instead of flexibility, therefore, larger size, stiffer, and more rigid materials can be substituted for more smaller and more flexible wire.

The number of slits in the back of the panel, the number of wires and their thickness can vary depending on such things as the size and length of the extended flexible panel that needs to be held in a dimensionally stabilized, weight-bearing, position and the tightness of the angle at the bend locations. For example, using thinner, lighter weight corrugated plastic or paper sheets allow smaller wires, less wire locations, and/or fewer numbers of wires to be used. Aesthetic flexible covering materials can also be added to cover the slits in the back of the panel if needed and/or desired.

If using a non-corrugated flexible panel material, for example lightweight flexible plastic sheet materials, for combination flexible panels such as combination panels D and B, sound shapers, overlapping panels such as 7*a* and 7*b* in an embodiment system shown in FIG. 19, and/or other flexible components of other employed embodiments that are flexible but need to be made more dimensionally stable, metal wire or wires can be inserted into a binding material along the edges of the panel allowing the entire panel to then be flexibly bent and stabilized into a number of dimensionally stable angular bends.

If using a corrugated paper or plastic sheet material, flexible bends can also be created, for example, at needed bend locations by scoring the sheet at flexible bend locations, such as shown in FIG. 22.

Many other methods for making flexible bends are known to those skilled in the art. The exact thickness, sizes, and dimensions of the sound-controlling panel components are not as important as the purposes of this embodiment system as the substantial horizontal and vertical front and side locational placement of expansive sound-controlling panel components as they are placed in the substantial expansion of space between the speakers and the listener in order to substantially capture significant quantities of indirect sound propagating from the speakers as illustrated with the presented embodiment system sections contained herein.

One or more portable panel components such as the portable panel components shown in FIG. 20 can be stored with one or more parts still connected together after their first setup and easily folded-up and then quickly and easily re-setup with their pre-assembled relative positions intact. They can be reset up, as mentioned, along quick-reference positioning symbol line 3*d* locations of a symmetrical part-alignment positioning system such as the floor template type of symmetrical part-alignment positioning system 3*a* shown in FIG. 3.

Approximate setup times to setup and put away the embodiments of FIGS. 20-22 are minimal. For example, for FIG. 20, the average setup time for this shown nine panel left side flexible surround sound embodiment system is approximately six minutes with four minutes to dismantle, remove the panels, fold them up and put them away. Average setup time for FIG. 21 with its shown 7 upper and 7 lower 21A through 21F panels for shown left side only is 10 to 15 minutes with 5 minutes to dismantle. Average setup time for FIG. 22, on the other hand, for its shown five panel left and right-side flexible assembly is only approximately two minutes with one minute to dismantle, fold them up and, for example, put them into a closet, behind the couch, or other convenient out-of-way storage.

For normal first time assembly, the embodiments can be taken from their storage position, which takes up only about 0.2 sq. m (2 square feet) of storage floor space, assembled, and positioned near to the speakers and the listener positions. A complete initial beginning general setup arrangement for this and other portable embodiments is fully detailed in embodiment system shown in FIG. 19 because it clearly illustrates both left and right speakers and sides of an assembly and is a typical setup assembly for the three important embodiment system component positioning categories for all embodiments which are:

One or more stereo speakers and their acoustic-related speaker components, such as a pair of stereo audio speakers 1*a*L and 1*a*R and their speaker stands 1*c* if needed, positioned in a speaker setup arrangement explained in FIGS. 1I through 13 and 19;

One or more listeners, such as listener 19*a*, as components, or sitting, reclining or lying device components N shown for FIGS. 20, and 19*a* shown for FIG. 19, and The sound controlling parts of the employed embodiment system, as shown throughout this document.

As with many portable embodiments presented herein, it is helpful to note that embodiment system components can be placed into one or more precise positions in the expanse of space between speaker 1*a*L and the listener sitting device N quickly and easily with the aid of an optional symmetrical part-alignment positioning system and their quick-reference positioning symbols. For example, an embodiment system component position for a more planar floor-positioned sidewall such as panel K, FIG. 20, can be precision-positioned to be closely-aligned with pre-tested sidewall quick-reference positioning symbol lines such as pre-tested planer straight-sided sidewall quick-reference positioning symbol line 3*d*, FIG. 20, located on a template such as floor template 3*a* illustrated in FIG. 3. The speakers, (in FIG. 20, speaker 1*a*L) and the listener's sitting, reclining, or lying device (in FIG. 20, sitting device N) can also be quickly, easily, precisely, and symmetrically positioned into place along a quick-reference positioning symbol centerline, for example, centerline 3*g*, FIG. 20, which is the symmetrical center of the overall assembly.

If a part-alignment positioning system, such as the portable symmetrical part-alignment positioning system 3*a* illustrated in FIG. 3, were utilized with FIG. 20, for example, the sound-controlling sidewall panel component quick-reference positioning symbol lines 3*d* shown in FIG. 3 can be the approximate starting-out angle, or relative positioning angle, to quickly, easily, simply, appropriately, precisely, and symmetrically position the left and right side embodiment system side walls, with accurate symmetrical positioning reference to the speakers and listener in order to quickly, easily, appropriately, and symmetrically position these key components. This is especially helpful, for example, for beginner's early listening sessions because it successfully provides quick, easy, symmetrically-appropriate, pre-tested, listener-controlled acoustic setup arrangements, adjustments for individual sound tracks, for sitting, reclining or lying device movement considerations, for individual listener acoustic preferences, and standardizes favorite setup positions for future listening sessions.

Once speakers 1*a*L, employed embodiment system sound controlling components, and sitting device N are positioned, the listener can then simply enjoy the acoustic presentation from the listener's position that is being three-dimensionally presented to him or her on a significantly-enhanced basis.

FIGS. 22 and 22-A are perspective views that help detail, explain and illustrate the function, materials, construction, presently-revealed method of application, and a representative example of one of the structural options incorporated by an embodiment system listening room structure. The perspective views shown in FIGS. 22 and 22-A are not illustrated according to relative scale and may include one or more elements that may be freely listener-adjustable, optional, and/or cooperatively-interconnected in ways other than those specifically detailed or illustrated, including elements that may be expandable or reducible in number, size, and shape. The perspective views shown in FIGS. 22 and 22-A are facing the sound-controlling inside portion of the left-side of a substantial indirect sound capturing, symmetrically controlling, and stereo surround sound reproduction system showing an extended assembly of complementarily interconnected and listener adjustable indirect sound-controlling embodiment system components that make up the basic structure of this portable listening room assembly that can be set up in just two (2) minutes. This includes listener-adjustable structural elements and other components as described above.

The embodiment system of FIG. 22 can be used alone and positioned as the embodiment system illustrated in FIG. 20 as a left-side only sound-controlling system or as an opposite inverse mirror image configuration used as a right-side only sound-controlling system or, for considerably more acoustic advantage, can be comprised of a symmetrically-aligned combination of both a left and an inverse mirror right-side image sound-controlling assembly used together in the same system assembly. If used as a combined symmetrically-aligned system assembly, both the left and the right reflective sides would be mirror images of each other with a line down the center of the listener including down the center of a sitting, reclining or lying device and the line extending equidistant between the two speakers and being the center of the symmetrically-aligned combination assembly. Even though it will be assumed that this will be used as a symmetrically-aligned combination assembly, the following detailed description will be limited to refer to the illustrated left-side sound-controlling system with the assumption that this information will be duplicated for the right-side of the symmetrically aligned combination assembly.

The embodiment system illustrated in FIGS. 22 and 22-A, is a smaller, closer-to the-speaker positioned, and substantially low cost version of, and is positioned similar to, the embodiment system of FIG. 20 with few parts and extremely fast to setup and remove. As with other portable embodiments, this acoustic structure follows the performance area detailed in FIGS. 1C and 1D. Even though it is physically smaller than the other embodiment system, the embodiment system of FIG. 22 still provides full acoustically-satisfying stereo audio sound enhancement for the listener and high-performance horizontal surround sound for all but the back of the listener, which can be optionally filled-in with a sound-controlling panel component sized and, as explained, be placed with a sound-controlling back panel component C and F with the embodiment system of FIG. 20. The embodiment system of FIG. 22 is fully adjustable with different sizes that can be available, for example, to fit different sitting, reclining and lying devices and a wide assortment of different applications. The shown version in FIG. 20 is a one piece left and one piece right device serviceable with many different types of speakers and chairs. Applications for this small, portable, lightweight, extremely cost effective embodiment system include video gaming, children's education, home-bound patients recovering from illness or injury, demonstration applications, and smaller highly-immersive acoustic environments with the use of more horizontal positioned sound shapers as detailed in this document. The embodiment system shown in FIG. 22 provides an almost disposable, advertising speciality, or even a give-away type of unit that can be made available to large numbers of users in a short time at a substantially low cost. It can be used as explained, positioned and stabilized with part adjusting devices such as on FIGS. 16 and 17, used with acoustic skins, sound shapers as explained with other embodiments, attached to or with nearby objects, or simply positioned vertically upright on or near to a sitting, reclining, or lying device.

As illustrated in FIGS. 22 and 22-A, it has a tested effective triangular component relationship of (1) a speaker-to-speaker distance apart of 66 cm (26 inches) as measured between the centers of both left and right speakers; and (2) a horizontal speaker-tweeter 1*d* to listener distance of 79 cm (31 inches), equalized for both left and right speakers to the centered listener. Using a small type of speaker such as the small speaker illustrated in FIG. 20 and a small power amplifier, many embodiments presented here can reduce energy consumption and electrical dependency to as little as 7 watts per speaker, which then allows the use of a much smaller and comparatively lower-priced speaker along with the smaller and lower-cost embodiment system that is still capable of producing high-end acoustic audiophile grade sound while also providing a fast and easy adjustable operation of all system components.

Compared to the panel component system illustrated in FIG. 20, embodiment system illustrated in FIG. 22 need only use one extended continuous assembly of interconnected sound-controlling panel components, such as sound-controlling panel components C, L, A, B and P of the embodiment system of FIG. 20 alone, where sound-controlling panel component C in the embodiment system of FIG. 22 need only be approximately a 50 cm (20 inches) wide partial panel component that can be supported and held in position by a plurality of interchangeable application methods and devices in order to flexibly allow adjustable adaption of embodiment system components to a variety of listening room configurations. For example, sound-controlling panel component C can be supported and held into the position of sound-controlling panel component L illustrated in FIG. 20 by fitting the arm rest groove X located at the bottom edge of a vertically positioned sound-controlling panel component C in FIG. 22 over a sitting or reclining device's arm such as sitting device arm 0 illustrated in FIG. 20; by simply gravity supporting the bottom edge of a vertically-positioned sound-controlling panel component C on top of a sitting, reclining or lying device near to the listener's head and ear location; or by using other suitable connecting, fastening, and/or attachment devices, or application methods of various suitable types such as fastener devices detailed in this document with other presented embodiments, as well as other suitable attachment and fastener devices or application methods known to those skilled in the art.

One or more sound-controlling panel components of the embodiment system structure can also be adjustably-positioned, stabilized and optionally-attached to each other and to other components, including sound shapers, by part adjusting devices such as one or more of the part adjusting devices illustrated on FIGS. 13, 16-17, 19-21, 26 and 28-33, where panel component P is optionally-attached to the back of a speaker or speaker stand like in FIG. 20, by a fastener attachment tool such as by a 5 cm (2 inches) wide by 38 cm (15 inches) long wrap-around-the-edge strip of hook-loop fastener tool attached to location W on the front speaker edge portion of panel component P illustrated in FIG. 22 and attached to the backside of nearby supported speaker, such as speaker 1*a*L illustrated in FIG. 20. Flexible joints can be placed at user-adjustable flexible points N and M locations illustrated on FIG. 22, which are at similar locations as flexible joint locations R, I, and T illustrated on FIG. 20.

The embodiment system of FIG. 22 can have a total sound-controlling size per left and right-side of only 50 cm (20 inches) of vertical panel component height by 1.5 m (60 inches) of total horizontal panel component length. During the listening session the approximate initial starting position for the vertical positioned and symmetrically placed left and right sound-controlling embodiment system panel components can be vertically height adjusted above the floor and vertically centered into position around the listener at an approximate vertically centered sound controlling panel component height above the floor that is approximately horizontally level with the speaker's tweeters height and the listener's ear height above the floor. The total weight of all panels of both left and right-sides is less than 1.4 k (3 US pounds) using an above-described 0.5 cm (0.188 inches) responsibly-manufactured 100% biodegradable paper-faced sound-controlling foam board panel from The Gilman Brothers Company. Other low-cost, lightweight, and environmentally-conscience recyclable sound-controlling panel materials and material compositions, such as those listed with the embodiment system shown in FIG. 20 above, can also be effectively and interchangeably used with the embodiment system shown in FIG. 22 instead of foam board to provide a sustainable sound-controlling material while also providing variable surround sound field reproduction options for the listener.

Strips of lightweight plastic "U" channel can be used to reinforce the embodiment system at two locations, such as at a 30 cm (12 inch) wide location V and at a 50 cm (20 inch) wide location O. Appropriate plastic "U" channels can be obtained interchangeably from a plurality of sources, including ABS plastic cap #1135 from Outwater Plastics Industries, Inc. of Bogota, N.J., and polyvinyl chloride "U" channel #8115266601 from FFr Inc. of Clevelands, such as pressure-sensitive adhesive or glued onto sound-controlling panels with tubular construction adhesives, riveted on, covered over with reinforced structural tape, and other suitable methods known to those skilled in the art.

If flexible locations are put into the embodiment system panel component assembly, after the perimeter of panel components are cut-out to approximately the above sizes by through-cut die cutting machinery, the flexible or pivotal hinge locations can be scored into the foam board using straight-line die-cutting equipment, such as by placing a 0.3 cm (0.125 inch) apart, triple die-cut score lines into the sound-controlling face side of the panel approximately every 2.5 cm (1 inch apart) at tight flexible locations, such as locations M and 5 cm (2 inch) apart for more gradual curved flexible locations, such as locations N. Instead of scoring the face side of the sound-controlling panel to produce flexible locations in this type of rigid dimensionally-stable panel component, straight parallel edge-to-edge razor cuts can be placed through the backside layer only of the two layer panel approximately every 1.3 cm (0.5 inch) apart at tight flexible locations and approximately 5 cm (2 inch) apart for more gradual curved flexible locations, making only one straight cut that each location. Aesthetic edge trims and aesthetic covering materials such as detailed with other embodiments can be added for aesthetic purposes.

The acoustic result of the embodiments sound controlling panel component assembly, allowing for the two-channel acoustic stereo fill-in between the speakers, results in and successfully provides a totally immersive, believably-real, full-across-the-front to 270° left and right lateral real surround sound field with the only missing part of a full 360° horizontal surround sound field being surround sounds coming from the back of the listener which is easily filled-in by simply adding on another, or extended, sound-controlling panel component such as sound-controlling panel component C in FIG. 20. FIG. 22-A shows the same left-side of the embodiment system shown in FIG. 22 folded-up and ready for convenient storage at only 50 cm×50 cm×5 cm (20 inches×20 inches×2 inches) and weighing only 0.7 k (1½ US pounds) And, when the embodiment system is not in use and put away out of sight, the entire room returns to its normal state and can now be used for other non-listening oriented living and other beneficial purposes.

It should be noted here that the dominant psycho-acoustic brain function operates primarily on a 360° horizontal plane surround sound field basis, with much less emphasis placed upon the vertical plane, therefore the most powerfully-relevant reflective surfaces for this and other presented embodiments, are located approximately at the horizontal, or same plane, speaker-tweeter to listener-ear level, with much less acoustic interest and emotional involvement arriving to the listener from above or below that specific horizontal level. It is also significant to note here that with all presented embodiments, the larger the quantity and the larger the percentage of indirect sound that can be captured and controlled from the speakers and beneficially utilized by any embodiment system presented here, the larger, the more whole, the more complete and the more believably-real an individual reproduced sound can become, the greater the acoustic pressure, and the larger and the more acoustically complex and detailed the reproduced surround sound field can become for the listener. The overall acoustic result, in order to be best captured, controlled and utilized by one of the presented embodiments, is, of course, also based upon the quality of the original signal, the surround sound information encoded within the signal, and the speakers utilized to reproduce the signal.

Although it is generally assumed that physically larger-sized sound-controlling surfaces or enclosures are needed to capture, control and utilize a larger quantity of indirect sound, this is only generally necessary with a non-adjustable room size and with a pre-set speaker-to-listener distance.

However, because the adjustable and portable embodiments presented here become their own independent, self-contained sound studios and dedicated listening rooms in and of themselves, the size of the embodiment system becomes the size of the sound studio or the dedicated listening room without any acoustic loss of indirect sound captured, controlled or thereby utilized. Also, the physical size of the embodiment system used not only fits into the physical size of the actual room it is being placed into, but the embodiment system's high-performance precision acoustics also totally replaces virtually all of the substantial acoustic-related limitations of the room it is being placed into.

Extensive trial and error experimentation has led to the understanding that the total size of the embodiment system can be substantially reduced without an acoustic loss of sound capture, control or utilization. This translates into the significant understanding that not only can the physical distance between the propagating speakers and the listener be adjustably reduced without an acoustic loss of sound capture, control or utilization, but that, as the size of the embodiment system enclosure is reduced, less physical sound-controlling surface area is needed by any embodiment system presented here to maximally capture, maximally control and maximally utilize the same quantity of indirect sound energy being reproduced and emitted by any speaker assembly to deliver high-performance, nuanced sound, This advantageously provides the listener with the ability to substantially reduce, at will, the size of an adjustable embodiment system and the amplitude level of the overall system, thereby allowing a substantially smaller-size sound-controlling embodiment system enclosure to be adjustably used at the listener's discretion without any acoustic loss of indirect sound captured, controlled or utilized by the embodiment system enclosure, and without any loss of sound amplitude for the listener.

With a smaller embodiment size and with the listener being physically closer to the speakers, a lower system amplitude is allowed providing the listener with the same real listening amplitude thereby providing the same listening amplitude to the listener while also reducing the amplitude of unwanted spillover or nuisance sound that can be heard by nearby neighbors, family members, or others. This is a substantial advantage especially for late night listening and for more restricted living areas such as smaller apartments. A smaller area also helps avoid nearby room objects from obstructing the overall symmetrical setup of the presented embodiments as well as helps avoid their possible acoustic interference thereby allowing the sound controlling acoustic components to more efficiently and directly radiate a more defined and acoustically-pure sound picture and level of acoustic experience to the listener.

The approximate equalized horizontal left and right speaker-tweeter to centered listener distance illustrated in FIG. 20 is approximately 127 cm (50 inches). If this 127 cm (50 inches) distance was expanded by approximately 40% to a 178 cm (70 inches) equalized horizontal left and right speaker-tweeter to centered listener distance, the square footage of sound-controlling surface area needed to capture the same approximate amount of indirect sound energy would have to be increased by approximately 100% to be equally-effective in capturing, controlling and utilizing the indirect sound being reproduced and emitted by the speakers and therefore can reproduce a similar surround sound field that may be larger in apparent size. This advantageously provides for an economy of construction for a smaller-sized embodiment system such as this embodiment system whereby a less-expensive, material-saving, smaller-sized, faster-to-set up, lighter-weight, more energy efficient embodiment system sound-controlling surface area is all that may be needed to provide the listener with an outstanding, full acoustic energy capturing, realistically-natural reproduced surround sound field as the embodiment system's horizontal speaker-tweeter-to-listener-ear distance is reduced to a shorter distance and, therefore, as to the overall size of the embodiment system's dedicated listening room is reduced to a smaller overall size.

The addition of embodiment system sound-controlling components including sound-controlling sound shapers, acoustic extenders, over-the-top extended acoustic panel components, outer sound-controlling panel components detailed in the following embodiment system sections, and other embodiment system sound-controlling components detailed throughout this document can be utilized to further enhance, shape, nuance, and control the sound for the listener.

Figure 29:
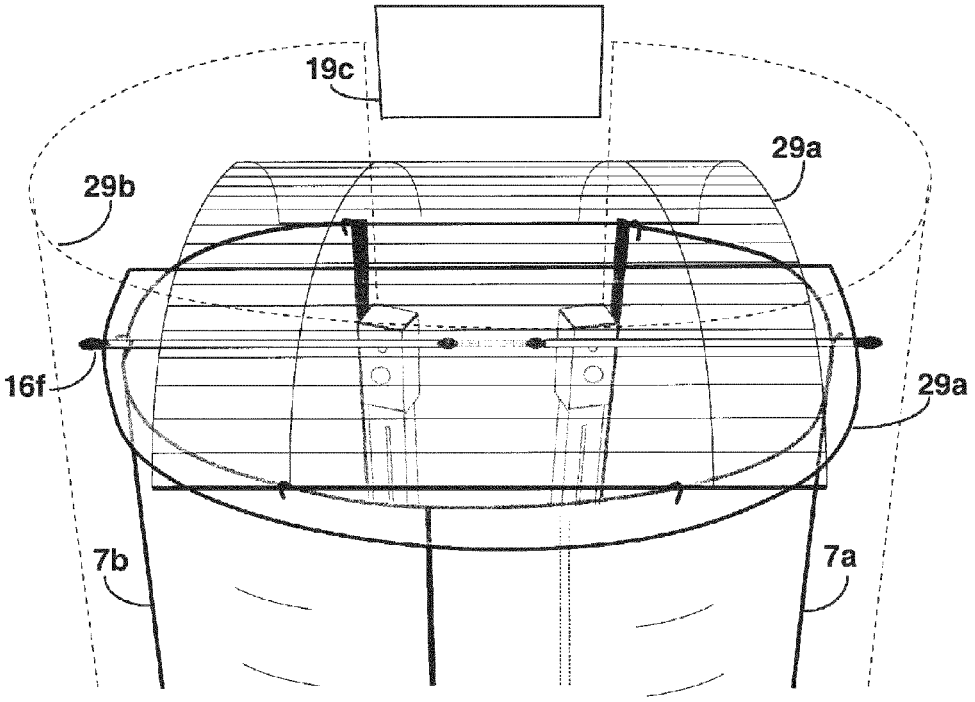
FIG. 29 shows a perspective view showing a portable, fully setup, fully-operational, adjustable-size embodiment system with connected double interlocking sound controlling sidewalls 7*a* and 7*b* from back and outside of system with two forms of optional over-the-top added exterior sound-controlling panel 29*b*, usable on other embodiments.

One or more of these sound-controlling embodiment system components such as over-the-top extended panel components 29A and outer sound-controlling panel components 29*b* shown and detailed in FIG. 29 can be made of substantially lightweight and dimensionally-stable acoustic foam that can be laminated to other structural materials, for example, 0.5 cm-1.3 cm (0.188-0.50 inches) thick foam board or other similar lightweight acoustic controlling materials detailed herein and suitably used with this and other presented embodiments in order to help control, for example, different frequencies of sound for the listener and acoustic designer.

Additionally by the presented embodiments' capturing and utilizing more indirect sound and projecting it toward the closer listener inside of a smaller, closer, more intimate enclosure, amplitude can be further reduced and even less indirect sound can be projected and directed outside of the embodiments sound controlling components and enclosures. At the same time, as mentioned, this overall lower sound amplitude level successfully provides an advantageous noise reducing advantage for non-listeners located outside but near to the embodiment system enclosure, but without reducing the listener's amplitude or acoustic satisfaction level.

And, the embodiments allow indirect sound that without the acoustic advantages of one of the presented embodiments would be reproduced and emitted uncontrollably in multiplicities of angles and directions by the speakers into the listening room and then reflected by room boundaries, etc. only to return to the listener at different random time-delays and from a random assortment of directions thus significantly muddling up the acoustic presentation.

The lower system amplitude level provided by and resulting from the presented embodiments also allow the embodiments employed to responsibly and efficiently reduce energy consumption and to maximize the sonic utility of the speakers and the speaker amplifier.

And because important embodiment system quick-reference positioning symbols from one or more prior listening sessions can be easily saved, used, and easily-referenced, any new listening session can be quickly and easily setup several times in precisely the same embodiment system structural and acoustic position as used in any prior listening session, simply by using the embodiment system quick-reference positioning symbols.

As detailed above, the presented embodiments' noteworthy ability to both substantially capture, substantially control and substantially precision-utilize a large percentage of indirect sound coupled with the ability to substantially shrink down the size of the embodiments without any acoustic loss of indirect sound captured, controlled or utilized, places many of the presented embodiments at the unique and noteworthy audio sound reproduction intersection and convergence point between the traditional use of headsets for the playback of audio sound on one end of the spectrum and the traditional use of speakers placed into a conventional, typically much larger and permanent, listening room on the other end of the spectrum.

The presented embodiments, especially the smaller, more portable embodiments presented herein, bring together and fill-in the substantial stereo audio sound reproduction white space and the gap that exists between the use and application of conventional head-worn stereo speakers in the form of headsets on one hand, and the use and application of conventional stereo room speakers on the other, with the use of smaller head-worn acoustic devices such as stereo headsets and earphones that are physically ported on the listener's head with the stereo output of their attached stereo speakers' focused directly into the listener's ears on one end of the spectrum, and the traditional placement of larger stereo speakers in the much more expansive space physically far-removed from the listener's ears on the other end of the spectrum.

The convergence of these two now separate and distinct forms of stereo audio sound reproduction can be presented as understandable in the presented embodiments and their presently-revealed method of application because the presented embodiments not only fill-in the expansion of space that exists between the speakers and the listener's ears in a theoretical sense, but the presented embodiments understandably also fill-in this expansion of space physically, acoustically, and operationally as well.

It this noteworthy that this substantial embodiment system convergence process also advantageously solves literally all of the listener-related acoustic problems associated with stereophonic sound reproduction for both ends of the audio sound reproduction industry and spectrum. At the same time, they advantageously provide the listener with substantially all of the combined acoustic advantages, plus significant additional noteworthy, never-before-available, acoustic advantages, and detailed and illustrated with the presented embodiments of this document, now provided to the listener as a direct result of the presented embodiments' capabilities.

Alternative Embodiment System

Another embodiment system sound structure, is presented in a series of five progressive perspective-view illustrations shown in FIGS. 23-27 to help detail, explain and illustrate the function, materials, construction, methods of use, and a basic representative apparatus example of a substantial indirect sound capturing, symmetrically controlling, and stereo surround sound reproduction system. The series of five perspective views in FIGS. 23-27 show a progressive methods of assembly and reversed disassembly for the embodiment system that may not be illustrated according to relative scale and may include one or more elements that may be freely listener-adjustable, optional, and/or cooperatively-interconnected in ways other than those specifically detailed or illustrated, including elements that may be expandable or reducible in number, size, and shape. FIGS. 23-27 show an extended assembly of complementary interconnected and listener adjustable indirect sound-controlling embodiment system components that make up the basic structure of this portable 3 minute setup time listening room assembly, including listener adjustable structural elements, symmetrical part-alignment positioning systems and other devices to be explained herein.

The embodiment system is a modular panel-type of embodiment system acoustic structure with a limited number of individual panels that can be economically cut, stamped, or manufactured out of one or two pieces of various low-cost, lightweight, sound reflective-surfaced materials such as those detailed in previously discussed and other presented embodiments. As with other portable embodiments, this acoustic structure follows the performance area detailed in FIGS. 1C and 1D. Also, as with other portable embodiment system acoustic structures, variable-sized left and opposite mirror-image right panels can be positioned between the outermost sides of the listener 5*a* and the speakers 1*a*L and 1*a*R. Protruding edge portions 23*b*, 23*c*, 23*f*, and 23*e*, can be perforated, scored, or manufactured at predetermined bend and flex points, such as bend and flex points 23*a* and 23*h*, to bend and flex the edge portions of the system at these predetermined points. This can result in a number of user-defined sound capturing shapes, without the user having to handle or position multiple numbers of separate individual panels. Many of the shapes are similar to the shapes explained in the embodiments of FIGS. 20-22. For example, side panels 23*b* and 23*c*, FIGS. 23 through 26, can be bent or flexed inwardly toward the user from a planar position into a shaped position to create side and back panels similar to side panel B and back panel C, the embodiment system shown in FIG. 20. Similarly, top panel 23*e* can be flexed downward similar to panels F, E, and D, FIG. 20.

Figure 25:
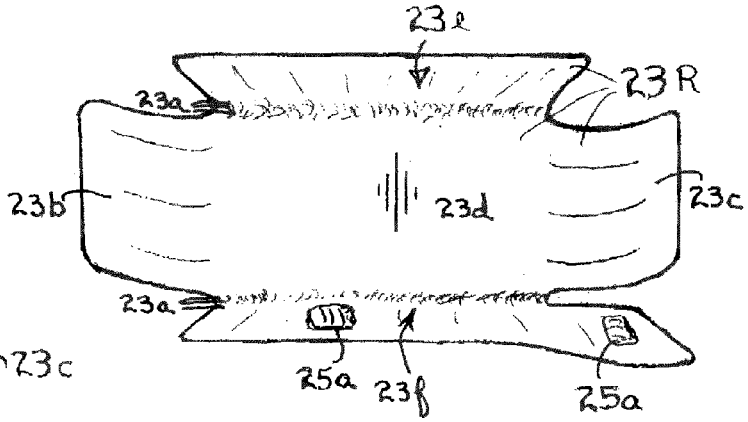
FIG. 25 shows a normal 3 minute setup for a portable, adjustable-size embodiment system. Front view of one continuous right side panel in process of being folded into operational position (2 minutes before being fully setup).
Figure 26:
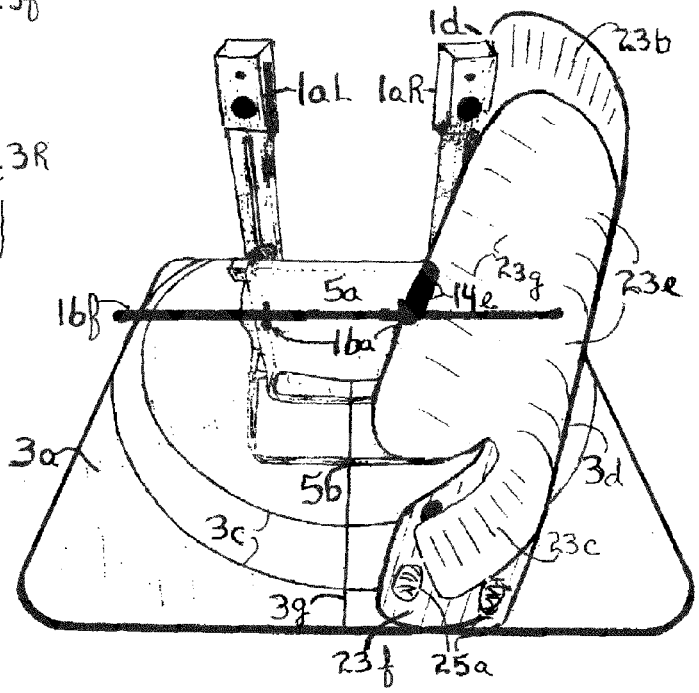
FIG. 26 shows a perspective view of a portable, fully-setup one continuous right side panel version of embodiment system folded into symmetrical operational position before left side is added (1½ minutes before being fully setup).

In addition, the embodiment system provides a base panel structure 23*f* that can support the entire larger structure into an approximate vertical upright or self-supporting, freestanding position by bending base panel 23*f* at an approximate 90° angle and positioning the panel 23*f*, for example, along a predefined quick-reference positioning symbol (QRPS) line such as QRPS line 3*d*, FIGS. 3 and 26. Stabilizing and positioning the overall structure can be assisted by using one or more positioning or stabilizing devices, such as weight devices 25*a* or overhead telescoping part adjusting devices 16*f*. Once the front panel 23*b*, side panel 23*d*, and back panel 23*c* are placed in an angular position between the speakers and the listener and the top panel 23*e* and base panel 23*f* are bent to form a shell, similar to FIG. 26, they allow the system to reduce stereo speaker crosstalk, reduce out-of-sync listening room reflections, and direct captured otherwise uncontrollable indirect pure sound emitted by speakers 1*a*L and 1*a*R to the listener from a multiplicity of angles along the embodiment system shown in FIG. 23-27 sound reflective surfaced panels. As with other embodiments, separate sound reflective surfaced panels such as sound shapers, acoustic skins, and acoustic extenders, can also be utilized to adjustably enhance and help shape and reveal sound nuances from within provided two channel signal stereo sources.

Figure 23:
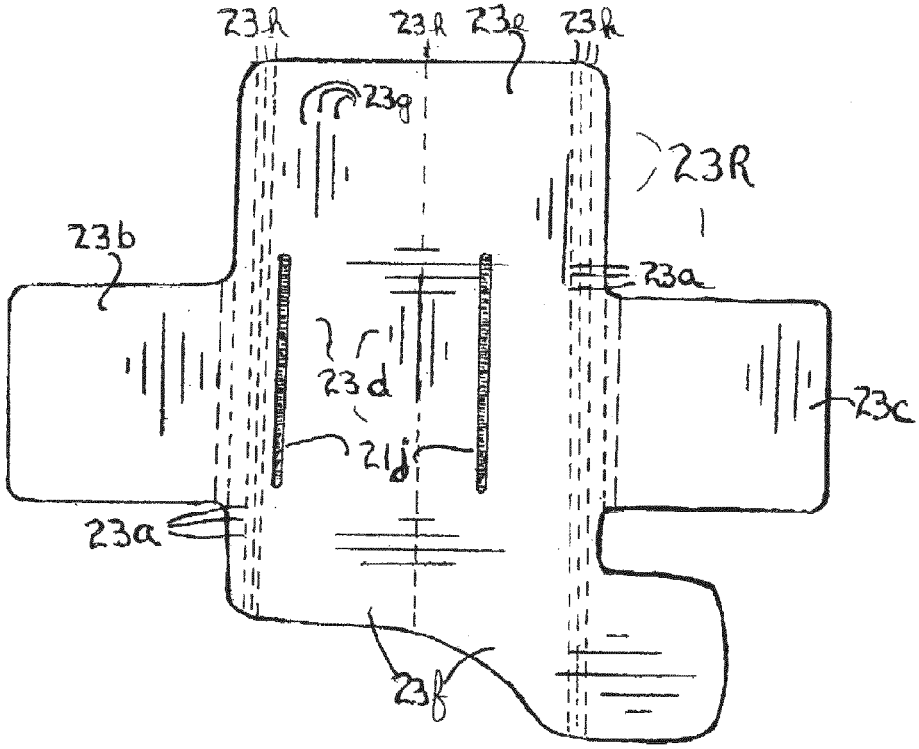
FIG. 23 shows a front view of a fully-open one continuous portable right side panel version of embodiment system (after it was just manufactured) (3 minutes before being fully setup).

FIG. 23 is a full view of the right side, 23R of the presented embodiment system when facing the sound-controlling inside portion of the open and extended structure. If the embodiment system shown in FIG. 23-27 is used without it's symmetrical left side and right-sides, FIG. 23 shows a sound-controlling right-side, 23R, that can be economically manufactured out of a plurality of variable sound-controlling materials. If an environmentally-responsible, very lightweight, low cost, and durable specular sound-controlling material is used to fabricate the embodiment system's sound-controlling panels that is also biodegradable and responsibly manufactured. It is presently contemplated that this embodiment system employ, at least optionally, one or more panels, such as two sheets of suitably appropriate sizes, such as 3 m×2 m (10 feet×6 feet) in size, and made of one or more suitably environmentally-responsible, low cost, and very lightweight sound-controlling materials. Materials include the below-detailed 4 mm or 6 mm recyclable corrugated sheet manufactured from 100% sustainably-recycled polypropylene plastic made by companies such as Corrugated Plastics of Hillsborough N.J. to be thereby used to manufacture a top sound-controlling panel component 23*e*, a bottom sound-controlling panel component 23*f*, and side sound-controlling panel components 23*b*, 23*d*, and 23*c*, with the flute direction 23*g* that can run vertically in connected sound-controlling panel components 23*e*, 23*d* and 23*f* and which can run in either direction for side sound-controlling panel components 23*c* and 23*c*.

Like the embodiments of FIGS. 20-22, this embodiment system performs in the same way and can be manufactured from the same sound-controlling materials as the other portable embodiments presented throughout this document. For example, the illustrated sound-controlling panel component can first be printed and top-coated on one or both sides, such as printed and top-coated on a wide-format dedicated digital printer from Agfa Graphics or Hewlett-Packard. The perimeter radius edges and outer borders of the optionally printed sound-controlling panel can then be die-cut out or cut by other devices or application methods, such as by hand or machine razor cutting using a CNC router machine, similar to the sound-controlling panels illustrated and detailed in other presented embodiments. It should be noted that the composition and aesthetic structure of the perimeter edges and outer borders do not comprise the sound enhancement or surround sound performance acoustic advantages of this embodiment system, and are primarily shown as aesthetic variations which can easily and substantially be changed without seriously affecting the sound performance of this or any embodiment system presented here.

If an environmentally-sustainable recycled sound-controlling panel is used with the embodiment system shown in FIG. 23-27 that material can also be used to make flexible joints, such as explained below. It is presently contemplated that this embodiment system employ, at least optionally, the above-mentioned 100% sustainably-recycled 4 mm or 6 mm corrugated polypropylene or other similar recycled sound-controlling material due to its environmental sustainability composition, light-weight, durability, low cost, and sound-controlling characteristics. However, the addition of flexible joints are not required for overall sound enhancement, although their addition makes the assembly more acoustically-adjustable for the listener and provides greater opportunity for the listener to capture more indirect sound energy and be provided with a more enveloping three-dimensional surround sound field resulting from stereo audio sound signals that are propagating from a plurality of audio speakers. Therefore, if one or more FIG. 23 locations are to be provided with flexible joints such as at flexible joint locations 23*a*, additional reinforcement devices or application methods explained in the embodiment system shown in FIG. 20, such as wires, can be added, as explained in the embodiment system shown in FIG. 20. Also through flexible joint locations 23*h* in order to provide optional listener-adjustable stabilized and flexible sound-controlling panel flexible joints at these locations.

Figure 24:
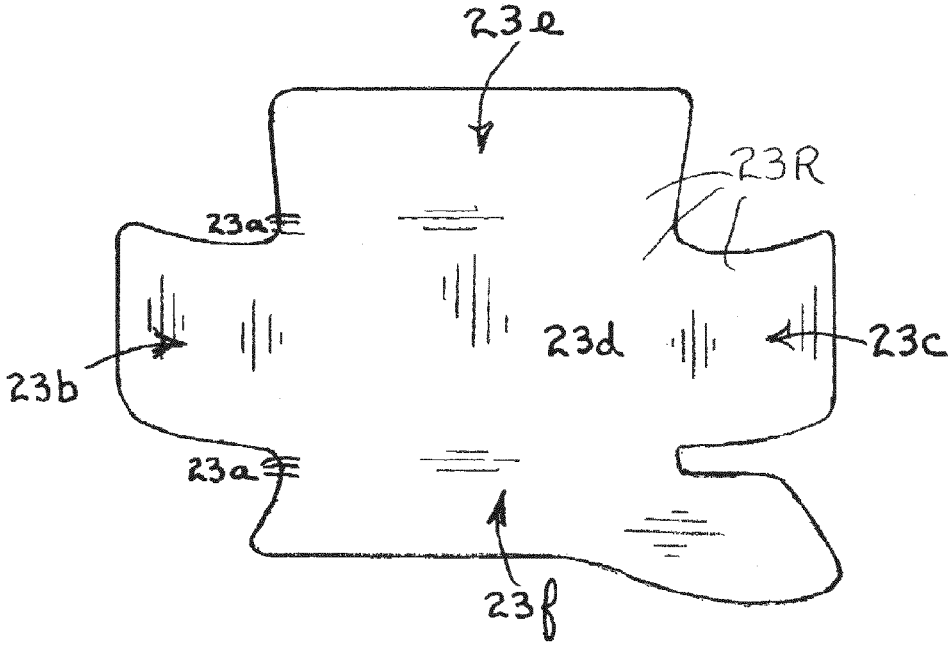
FIG. 24 shows a normal 3 minute setup for a portable, adjustable-size embodiment system. Front view of one continuous right side panel in process of being folded into operational position (2½ minutes before being fully setup).

In order to provide adjustable bend to sound-controlling panels 23*b* and 23*c* when they have a vertical flute direction, the outside layer on the back of the double wall corrugated sound-controlling panels can be cut along the flute direction as explained above. This will then allow these side sound-controlling panels to be flexed, curved and bent forward into a multitude of angles as illustrated in FIGS. 24-26. The adjustably angled panels capture incoming acoustic waves from the speakers by permitting a listener, who is either standing, sitting, reclining or lying in a sitting, reclining or lying device, including sitting device 5*a*, to obtain maximum sound control, high levels of individual surround sound localization and produce a more realistically-natural sound field surrounding the listener.

The sound-controlling side panel components 23*b* and 23*c* can adjustably be attached to sound-controlling panel 23*d* using connecting, fastening, and/or attachment devices, or by using various application methods known to those skilled in the art including hook-loop fasteners, such as hook-loop fastener strips J, G, and H illustrated in FIG. 20 that also provide flexible hook-loop hinge locations detailed further above. However, these and all attached sound-controlling panel components can adjustably be connected in many different ways as described with the other embodiments presented. Stiffening devices such as lengths of straightened wire can also be used to flexibly stiffen these panel components. Straightening wires might include wire drilled through the panel flute walls in any direction such as between an outer and inner layers of a two-layered corrugated panel including at flexible pivot locations 23*a* as described above.

The reason that bottom panel component 23*f* is not shown to be symmetrically-proportioned is because the front portion of this panel component is left free and so that, once this embodiment system is setup, this helps keep the panel from interfering with the floor portion of the listener's sitting device 5*a*, if a sitting device 5*a* is used with this embodiment system. This is illustrated in FIG. 26, but not specifically shown in the illustration. It should be explained that sound-controlling panel component 23*f* is not needed for sound-controlling purposes, but mostly for stabilization and structure support and therefore can be any size or shape, not needed at all, or replaced by other stabilizing and support devices or application methods including positioning, stabilizing and support devices or application methods such as those illustrated in this and other embodiments herein.

The panel components' flexible and/or bendable positions can be added, removed or moved to different locations, including making the entire structure flexible and/or bendable as detailed elsewhere in this document in order to provide the listener with more control two capture, focus, and control the speakers indirect sound output for the listener and to the listener. However, sound-controlling panel components, or parts of sound-controlling panel components need not flex or bend to provide adequate sound control and sound enhancement for the listener. Hook-loop fasteners J, H, G, and Q in FIG. 20 as well as other connecting, attachment and fastening devices detailed with other embodiments illustrate examples of many other fasteners and locations where one or more other fasteners, connecting or attachment devices, or application methods can be added to this embodiment system including hook-loop fasteners, sound control devices such as a sound shaper 14*c*, standardized symmetrical part-alignment positioning systems such as a standardized symmetrical part-alignment positioning system 3*a*, in FIG. 3, and other suitable connecting, fastening, and/or attachment devices, or application methods of various suitable types known to those skilled in the art.

FIG. 24 shows the embodiment system from the same angle and view as illustrated in FIG. 23 but with top sound-controlling panel component 23*e* and bottom sound-controlling panel component 23*f* flex-bent or curved inwardly toward the viewer from the top and bottom at flex point 23*a* locations. FIG. 24 also shows side sound-controlling panel components 23*b* and 23*c* also being universally flex-bent or curved inwardly toward the listener from the left and right-sides, while center sound-controlling panel component 23*d* is shown retaining its original flatter orientation. Flexible joints such as flexible joints made in left side sound-controlling panel component 23*b* and in right side sound-controlling panel component 23*c* locations need not be rigidly stabilized because, as illustrated, they are nonstructural sound-controlling appendages. However, normally non-weight bearing panel components such as sound-controlling panel components 23*b* and 23*c* can be stabilized or used for structural support devices. Structural support devices include devices like devices that are extended to the floor to add extra stability and weight to these panel components instead of being non-weight bearing and freely-extended, or, panels can include front sound-controlling panel component 23*b*, instead of it being supported by other devices or application methods, such as slightly leaning against the side of right speaker 1*a*R as illustrated in FIG. 26.

FIG. 25 shows the embodiment system from the same frontal angle, with the top and bottom panel components, respectively panel components 23*e* and 23*f*, flex-bent or curved into one of this embodiment system's surround sound performance configurations more fully illustrated in FIG. 26, with an optional stabilizing device, such as one or more embodiment system stabilizing devices like floor panel component 23*f* weighted sandbag devices 25*a*, placed at one or more locations on floor-located panel component 23*f* to help stabilize the device during setup and use. Alternately, bottom panel component 23*f* can be enlarged and positioned under the sitting, reclining, or lying device to stabilize both left and right side panels 23*f* without the need for auxiliary support devices such as 25*a*.

FIG. 26 is a perspective view from a back overhead central position and is an example of a right-side sound-controlling assembly of the embodiment system that was illustrated from the front in FIG. 25. This assembly can be used alone as a right-side only sound-controlling assembly or as an opposite inverse-mirror image of this right-sided sound-controlling assembly and used as a left-side only sound-controlling assembly. Alternately, for additional acoustic advantage as explained with the embodiment system shown in FIG. 20, this embodiment system can be comprised of a symmetrically-aligned combination of both a right and a mirror image left-side sound-controlling assembly combined together into the same sound-controlling assembly system.

If used as a combined symmetrically-aligned sound-controlling system assembly to substantially enhance the acoustic experience, both the right and left sound-controlling sides would be facing the interior of the embodiment system and essentially be a mirror image of each other with each part of the left side being equidistant from and symmetrically aligned with each part of the right side, with each system assembly side positioned on the outside portion of the two speakers, such as speakers 1*a*L and 1*a*R, and extended to at least the left and right respective sides of the listener's position. The left and right sides would also be symmetrically offset left and right along a centerline, such as centerline 3*g*, with a listener standing, sitting, reclining or lying on a sitting, reclining or lying device such as listener sitting device 5*a* with the listener centrally located along the same centerline such as centerline 3*g*, at acoustic-related locations chosen by the listener.

In addition to, or in place of, one or more part connecting, stabilizing and adjustment devices including one or more optional stabilizing devices as those mentioned above and illustrated floor panel component 23*f*, weighted sandbag stabilizing devices 25*a*, many other part connecting, stabilizing, and adjustment devices can be used as options with the embodiment system shown in FIG. 23-27 including one or more part adjusting devices like user-slidable telescoping cross-part adjusting device 16*f*, illustrated in FIG. 26. Telescoping part adjusting device 16*f* is fully-detailed, illustrated, and is shown with other suitable part adjusting devices in FIGS. 16 and 17. It can be used with or without symmetrical part-alignment positioning systems, to symmetrically connect, stabilize, and adjust embodiment system components. This includes left and right embodiment system sound-controlling panel components combined at an overhead centralized location using a telescoping cross-part adjusting device 16*f*. In this case, the listener can be standing, sitting, reclining or lying and can quickly, easily and confidently connect, stabilize and adjust embodiment system components, individually or as an assembled whole, before and during use. The listener can optionally position components symmetrically inwardly or outwardly to the listener's desired sound-controlling positions in order to symmetrically-balance and acoustically-adjust substantial quantities of otherwise inefficiently-wasted indirect sound energy that is simultaneously emitted by the speakers such as speakers 1*a*L and 1*a*R.

An adjustable measurement and/or support device, such as the telescoping overhead cross-part adjusting device 16*f*, FIG. 26, described above can be attached to symmetrical embodiment system components. They can be attached to suitable locations on the embodiment system, including on left and right sound-controlling panel components by way of simplified connecting, fastening, and/or attachment devices, or application methods of various types including hook-loop fastener devices such as hook-loop adjustable or user-slidable fastener attachment device 16*a* illustrated in FIGS. 26, 16 and 17 and explained with embodiments shown in FIGS. 19 and 20. They can be slidably-attached to telescoping cross-part adjusting device 16*f* where the mate of this connecting or fastening device, such as the mate to the hook-loop adjustable or user-slidable fastener attachment device 16*a*, can be one or more hook-loop attachment devices 14*e* illustrated in FIG. 14, attached to appropriate connection locations on embodiment system components. Examples include appropriate connection locations on sound-controlling panel 23*e* by attachment devices or application methods like adhesives, clamps, rivets, snaps, punched holes, sewing, cords, hooks, and other devices or application methods known to those skilled in the art. Positioning support devices such as telescoping cross-part adjusting device 16*f* can then be easily and flexibly connected and reconnected to the embodiments symmetrical components such as to left and right side sound-controlling panel components 23*e* by attaching the connecting fastener devices together at suitable connecting locations such as connecting location 14*e*.

Embodiment system adjustment devices include symmetrical sound centering devices and extended positioning or connecting devices. Examples include the simple and economic center-marked telescoping overhead cross-part adjusting device 16*f* and include manufacturing methods described elsewhere in this document. These devices can be manufactured in a multiplicity of suitable ways including as a non-telescoping cross-part adjusting devices manufactured from a single strong lightweight cross support connecting device such as a rod or tube, including a rod or tube manufactured from recycled resin-impregnated reinforced paperboard, aluminum, rigid polyvinyl chloride, fiberglass, carbon fiber composite, glass-filled nylon, lightweight filament wound epoxy, acrylic, etc. The device can be manufactured with or without quick-reference positioning symbols and with or without an attachment or fastener device or application methods. Examples include suitable attachments, faster devices, or application methods positioned on each end of a non-telescoping cross support adjusting device like two hook-loop user-slidable fastener attachment devices 16*a*, FIG. 16, positioned on each end of the outer shaft of a suitably-extended rod or tube in order to quickly and easily connect and reconnect symmetrical components. An example includes left and right side sound-controlling panel components 23*e*, and other components of this and other embodiments by connecting and attaching the fastener devices together at appropriate locations. Other suitable and appropriate support connective devices or application methods can be provided by those skilled in the art.

The right-side of the embodiment system, illustrated in FIG. 26, is placed into the initial semi-vertical surround sound-controlling position closely-aligned with the previously-explained sound-controlling sidewall positioning lines. Those include examples like the sound-controlling sidewall placement lines 3*d* shown as pre-marked on a floor-positioned standardized symmetrical part-alignment positioning system, such as the floor template standardized symmetrical part-alignment positioning system 3*a* illustrated in FIG. 3. Although a standardized symmetrical part-alignment positioning system, such as floor template standardized symmetrical part-alignment positioning system 3*a*, FIG. 3, may not be, and may not need to be, required to be included with this or other embodiments, when it is included, additional left and right sound-controlling sidewalls that extend to, or near to, the floor can easily be positioned. As illustrated, they can be positioned into left and right symmetrical alignment using pre-tested quick-reference positioning symbols such as sound-controlling sidewall quick-reference positioning symbol lines 3*d*, illustrated in FIG. 3, that correspond to pre-tested maximum-effect sound-controlling sidewall symmetrical quick-reference positioning symbol locations and coordinate angles that are located between the speakers and the listener.

Sound shaping and sound-controlling devices such as sound shaper 14*c*, FIG. 14, if used with this embodiment system, can also be attached at adjustable sound control locations and coordinate angles such as along sound-controlling sidewall 23*d* of this embodiment system. Sound-controlling devices such as sound shaper 14*c*, in addition to being adjustably-attached to sidewalls such as to sound-controlling sidewall 23*d* as explained elsewhere in this document, sound-controlling devices can also be supported in multiple extended, adjustably-angled and horizontal positions at different locations on this and other embodiment system components, including embodiment system sidewalls, by a number of other connecting, fastening, and/or attachment devices, or application methods of a suitable type including by adjustment devices. These adjusting devices, are illustrated as adjusting devices 16*j*, 16*k* and 16*f* in FIGS. 16 and 17 and by other adjustment devices including attachments such as adjustable drop-down-from-above fastener 13*d*, and adjustable sidewall connecting device 13*e*, FIG. 13.

Instead of using the floor as a primary base to adjust a sound control device, such as a part adjusting device 21S explained with the embodiment system shown in FIG. 20 or part adjusting devices 16*j* and 16*k* explained with embodiment system shown in FIG. 19, to support, position and angle the listener side of an adjustable wall-attached sound control device like a sound shaper, FIG. 14, other fasteners and adjusting devices including adjustable drop-down-from-above fastener attachments like a cord, strap or tube extending from a part adjusting device like an overhead cross-part adjusting device 16*f*, illustrated in FIGS. 16-17, 26, 28-29 and 32*j* can be used.

Using an overhead adjusting device such as part adjusting devices 16*j*, 13*e*, or 13*d*, FIG. 13, to replace a floor support device, such as part adjusting device 21S, FIG. 20, to adjust the listener side of one or more sound control devices like sound shaper 14*b*, FIG. 14, opens up the floor space around the listener. No floor supported adjusting device need be used to position or angle optional sound control devices such as sound shapers resulting in additional unobstructed floor room and space (so the listener can add tables, beverage holders, personal computers, food trays, floor lamps, etc.). The opposite end of cross-part adjusting device 16*f*, FIG. 26, attaches itself to the unseen left sound-controlling sidewall in the same fashion as illustrated and herein explained for the shown and detailed right-side.

Figure 27:
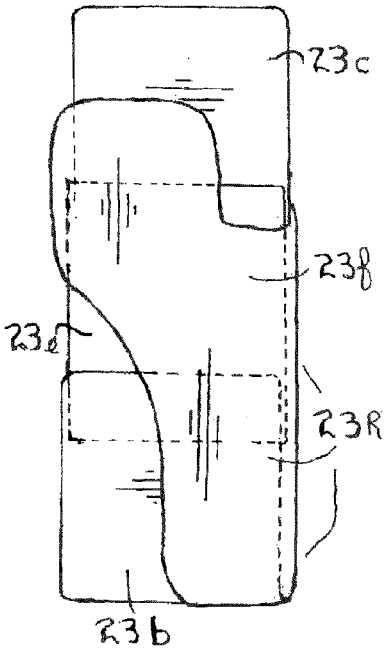
FIG. 27 shows a front view of a portable, one continuous planar right side panel version of adjustable-size embodiment system folded into a small storage and transport size.

FIG. 27 shows the prior-illustrated right side of the embodiment system in one of the easy-to-fold-up configurations that can be used for convenient transport and storage.

One of the initial preliminary setup options, including horizontally level speaker setup option that may be used with the embodiment system shown in FIG. 23-27, or with other embodiments, in order to capture, control and utilize the maximum indirect sound energy from the centrally located speakers, such as speakers 1*a*L and 1*a*R, creating the maximum amount of enhanced three-dimensional surround sound for the listener, is illustrated and explained thoroughly in the explanation of FIGS. 1I-19 and in FIGS. 23 through 26.

The user removes a folded-up embodiment system from a storage location roughly illustrated in FIG. 27, for example, as approximately 89 cm (35 inches) high by 1.5 m (60 inches) long by 13 cm (5 inches) deep and weighing approximately 5 k (11 US pounds). The user, in a three-minute operation, simply unfolds or opens the embodiment system shown in FIG. 23-27 sound-controlling panel components 23*e* and 23*f*, while flexing-in side sound-controlling panel components 23*b* and 23*c* into position as illustrated in FIG. 26. Alternately, sound-controlling panel components, such as side sound-controlling panel components 23*b* and 23*c*, may be removed and added for smaller storage, or simply attached and folded-in for storage and then folded out and flexed for sound-controlling performance use, or not included at all.

As illustrated, and thoroughly explained with other embodiments, indirect sound emitted from speakers like speakers 1*a*L and 1*a*R, and that would normally be uncontrolled and wasted is, with the embodiment system, captured by the large specular sound-controlling surfaced panel components and then directed by precision time-line controlled first surface specular reflection off from these sound-controlling panel components and other panel components to focus and direct this plurality of indirect reflections toward the listener. As a result of the embodiment system, the surround sound information encoded within the stereo signals are time-line-replicated and time-delay reproduced for the listener from a plurality of real angles and directions with adjustable acoustic surround sound controls provided by the embodiment system. The embodiments allow the listener to quickly and easily shape and reshape the individual localized sounds as well as the surrounding sound field. For example, by flexing top sound-controlling panel component 23*e* into a roughly horizontal position parallel to the floor position or lower and physically moving the entire structure into the position roughly illustrated in FIG. 26, will result in the system being able to capture a significant amount of indirect sound energy coming from the right speaker 1*a*R.

Additionally, flexing sound-controlling panel component 23*e* downward versus bending it backward can capture a significant more quantity of indirect sound energy coming from the speakers than from the side sound-controlling panel components 23*b*, 23*d* and 23*c* used alone. Because the weight of the entire left or right-side of the structure amounts to only approximately 5.5 k (12 US pounds) using a sound-controlling panel such as recyclable 4 mm corrugated sheet manufactured from 100% sustainably-recycled polypropylene, and because the entire structure can be free-standing and essentially self-supporting, the entire left or right-side of the structure can easily be moved or shifted before use, during use, and after use, often from the comfort of a sitting or reclining position, and, with minimal effort. Supplemental adjustment handles at various locations, such as sidewall-connected part adjusting device 12*a* simplifies this adjustment procedure by allowing the sitting or reclining listener to use handles to lift and shift portions of the structure with minimum effort. Moving the entire left and right sound-controlling structure simultaneously and symmetrically forward toward the speakers or swinging it inward toward the listener or outward away from the listener even 2 centimeters (fraction of an inch) can alter, sometimes radically, the surround sound field and the position of individual surround sound nuances localized to the listener who is listener standing, sitting, reclining or lying in sitting, reclining or lying device. A listener's sitting, reclining or lying device such as listener sitting device 5*a*, FIG. 26, can be also be nudged or moved forward or moved backward along centerline 3*g* to horizontally align the listener or listeners with the surrounding sound-controlling assembly and it's projected surround sound field. In these cases, the speakers' indirect sound is reflected toward the listener(s) from the embodiments substantially-extended surrounding sound-controlling surfaces.

But, by simultaneously flexing and opening up the left and right top sound-controlling panels, shown as sound-controlling panel component 23*e*, FIG. 26, the sound field encoded within the original stereo signals as perceived at the listeners position will broaden and expand, which will enhance some soundtracks as recorded and lift-up and widen the entire surround sound field for many audio soundtracks. It has been observed that a flexed movement as a little as 10° in any larger sound-controlling panel component on any of the embodiments presented here will affect very specific localized sounds encoded within the stereo signals and cause them to move in location or become either more or less pinpoint localized in a specific horizontal and/or vertical position.

With the embodiment system, these individual pinpoint-localized surround sounds remain stabilized real sounds localized around the listener at highly-fixed locations as their sound continues and repeats, as these original surround sounds were originally-encoded to continue and repeat, while the listener is free to move, twist or turn his or her head in any direction or angle with no perceptual loss of effect on the spatial position of the pinpoint localized sounds for at least a normal head movement range of angles from +120° to −120°. With the embodiments presented in this document, the listener may both freely move and naturally turn his or her head during a listening session, and is highly-encouraged to do so if even slightly, due to the natural dynamic binaural physical sensory involvement of this movement. Even slight natural head movements provide the listener with important and subtly-enhanced added sound source localization feedback information that the brain uses to obtain additional important vantage points of acoustic reference of the 360° sound source location.

With the embodiment system, so strong is the impression of a localized sound source that listeners often have no difficulty pinpointing with 5° individual localized sounds at specific multiple positions both horizontally and vertically surrounding the listener. This perceptually correlates to a true sound source and a true surround sound field. It is not surprising because the systems' sound-controlling surface area that surrounds the listener and the synergistic purity of the progressively time-line replication of the individual surround sounds encoded within the original signals are true and expansive enough, and presented correctly enough, to physically and psycho-acoustically overpower the actual physical listening room and its physical surround sound field. In addition to the actual physical listening room being acoustically replaced by the embodiment system's surrounding sound-controlling structure and components, the speakers and their location, that in fact generate the sound source that allow the recreation of this expansive surround sound field for the listener, virtually disappear from the acoustic sound stage, disappear from the reproduced surround sound field and disappear from the listener's perception of the actual physical position of these individual sound propagating sources which are replaced by a substantially-whole, realistically-natural, three-dimensional surround sound field re-created from the original stereo signals.

Moreover, while substantially unlike traditional prior art sound studios or dedicated listening rooms with their substantial plurality of aforementioned limitations, many of the embodiments presented here are so totally portable and easy to setup and put-away that they can be quickly and easily setup in remote locations and for highly temporary applications. Additionally, substantially-unlike mostly permanent, high-cost and traditionally non-portable dedicated prior art listening rooms and sound studios, these low-cost portable embodiments once quickly and easily put-away out of view allow the whole room it was placed into to be opened-up to permit all of the room's space to be freely used for other beneficial non-audio purposes and other domestic activities.

Alternative Embodiment System

Figure 28:
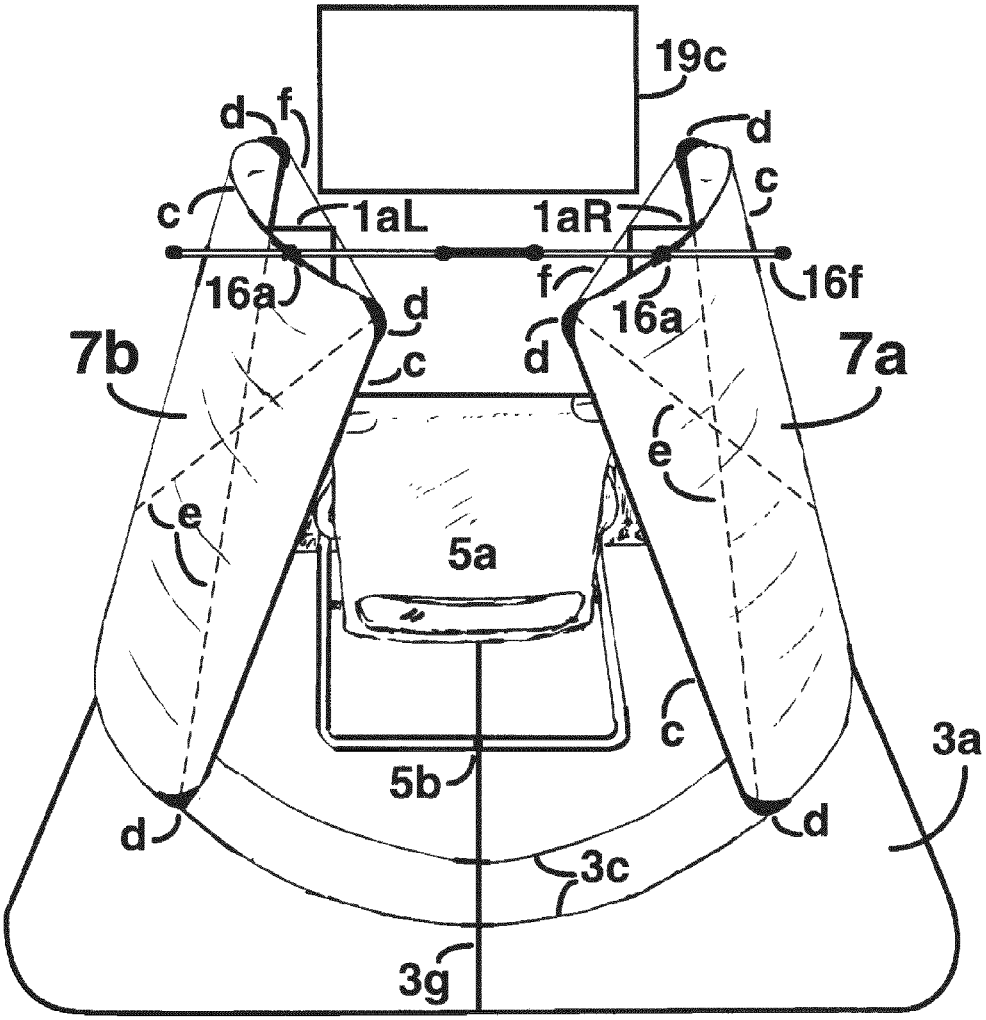
FIG. 28 shows a perspective view of a portable, fully-setup, fully-operational, adjustable-size embodiment system with audio-visual display.

FIG. 28 is a perspective view to help detail, explain and illustrate the function, materials, construction, methods of use, and a representative apparatus example of one of the structural options incorporated by an embodiment system listening room structure. The perspective view, shown in FIG. 28, may not be illustrated according to relative scale and may include one or more elements that may be freely listener-adjustable, optional, and/or cooperatively-interconnected in ways other than those specifically detailed or illustrated, including elements that may be expandable or reducible in number, size, and shape. FIG. 28 shows an interconnected left-side sound-controlling panel component system 7*b* and a right-side sound-controlling panel component system 7*a* of a complementary interconnected and listener adjustable indirect sound-controlling embodiment system of components that make up the basic structure of this portable 10 minute setup time listening room assembly, including listener adjustable structural elements, symmetrical part-alignment positioning systems and other components to be explained herein. FIG. 28's perspective view is from a back overhead centrally located position of this representative example of the embodiment system facing toward the speakers 1*a*L and 1*a*R as would be a standing, sitting, reclining or lying listener such as a listener sitting in a listener sitting device such as sitting in listener sitting device 5*a* if a listener sitting device is so utilized with this embodiment system.

The embodiments is another portable, personalized, and customizable-shaped sound reflective interior-surfaced embodiment system structure. It allows the listener to use a reduced number of individual panels to provide crosstalk reduction, reduce out-of-sync listening room reflections, and significantly enhance two-channel stereo audio sound reproduction from the user's own, or provided, speakers, 1*a*L and 1*a*R. As with other portable embodiments, this acoustic structure follows the performance area detailed in FIGS. 1C and 1D. This unit, in addition to multiple other portable embodiments, can be easily stored out of the way when not in use and can also be utilized with audio-visual devices, like audio-visual device 19*c*, to provide a large number of low-cost, fast-to-setup and use embodiment system applications.

The embodiment system's sound reflective side panels 7*a* and 7*b* can be flexed into and held stationary in their sound reflective shape by tensioning devices, such as adjustable tensioning cords or rods, that contract the panels by fasteners positioned at two or more corners. These tensioning devices allow the user to flex the panel into adjustably different positions by adding or subtracting tension between the corners. Panel edge reinforcement devices such as plastic, metal, or composite "U" channels, detailed in other embodiments, can be used to stabilize the opposite vertical edges of the embodiments' sound reflective-surfaced panels 7*a* and 7*b* while the other two horizontal edges of panels 7*a* and 7*b* are left free to allow the listener to flex the into multiple shapes.

As with other portable embodiments, stabilizing and positioning the overall structure can be assisted by one or more positioning or stabilizing devices, such as: heavy weight devices 25*a*, FIG. 26; lightweight overhead telescoping part adjusting devices, 16*f*; and, other devices. This allows the structure to be adjustably positioned to accommodate, for example, different sitting, reclining, and lying devices, speaker sizes, etc. The two main sound reflective surfaced-panels 7*a* and 7*b* illustrated in FIG. 28, when bent into a curved shape and positioned symmetrically, such as floor positioned at quick-reference positioning symbol line 3*c* provided on a symmetrical part-alignment positioning system 3*a*, FIGS. 3 and 19, can then form a type of lightweight sound reflective enclosure around the listener 5*a*.

If a symmetrical part-alignment positioning system is utilized with the embodiment system shown in FIG. 28, sound-controlling panel components such as sound-controlling sound-controlling panel components 7*a* and 7*b* can be symmetrically aligned along one of the symmetrically-aligned quick-reference positioning symbols. If a sitting device such as sitting device 5*a* is utilized with the embodiment system, it can be symmetrically positioned along a symmetrical centerline, such as symmetrical centerline 3*g*, at center locations including center location 5*b* that can be marked on a symmetrical part-alignment positioning system.

If an environmentally-sustainable recycled sound-controlling panel device is utilized with the embodiment system that is low-cost, durable, and environmentally-responsibly produced, it is presently contemplated that this embodiment system employ, at least optionally, the sustainably-manufactured 100% recycled plastic corrugated panel device from Corrugated Plastics detailed in the embodiment system shown in FIG. 20 for it's combined low-cost, durability, and environmental-sustainability. However the embodiment system can also be manufactured out of many materials with different sound-controlling, cost, and structural qualities, including high-cost premium sound-controlling materials such as multilayer aluminum sheeting, or produced out of similar inexpensive, lightweight, dimensionally-stable, recycled and recyclable sound-controlling materials detailed in other embodiments, such as detailed in other embodiments. This embodiment system can also be manufactured out of non-corrugated, solid, including metallized, semi or fully flexible sound-controlling materials such as recyclable polyethylene terephthalate or polypropylene plastic film or sheeting, one or more layers of aluminum, composite materials including other flexible or non-flexible recyclable sound-controlling materials such as polyethylene terephthalate film, and/or which can be laminated or structurally reinforced such as by a reinforcing support rods, wire, metal screen material, laminated scrim or other suitably attached materials, for example as a stretched specular fabric kite-like structure with a reinforcement backing, and other dimensionally-supportable structural materials including specular sound reflective materials detailed throughout this document. Reinforcement locations "d" including pockets at those locations for attachment devices "e" can require additional layers and/or added fasteners such as grommets, rivets, eyelets and the like.

If the 100% recycled corrugated sound-controlling panel device such as from Corrugated Plastics is used with the embodiment system, these corrugated sound-controlling panel devices can also be manufactured to be flexible at specific bendable or flexible-hinge locations, including manufactured with a universal multi-directionally-angled bendable or flexible sound-controlling surface on the entire sound-controlling panel device, applicable to this and another embodiments, including flexible sound shapers, in order to provide flexible listener-controlled angled sound-controlling location(s) for any sound-controlling panel device. This can be achieved on a two-walled corrugated panel, for example, by placing crisscross cuts the length of the sound-controlling panel diagonally across the flute direction of the corrugated sound-controlling panel at angles roughly parallel to the flex angles desired, with parallel cuts spaced approximately 0.6 cm (0.25 inch) apart, cutting through only the back side of the two-wall corrugated sound-controlling panel at needed flexible locations. The interior sound-controlling side can remain uncut. That is, not cutting the interior concave sound-controlling panel side that is facing toward the interior inside portion of most embodiments presented herein.

The backside, on the other hand, can be cut on the convex side of the two-wall sound-controlling panel, whereby the cutting action allows the back wall of the two-wall corrugated panel at these cut locations to open up and expand away from the cut lines. This allows the two-wall corrugated panel to be flexibly bent or curved inwardly at these cut locations, toward the concave sound-controlling side of the panel. Optionally cutting only through the inside wall portion of the two-wall corrugated panel, on the other hand, allows the sound-controlling panel to then be flexibly bent or curved outwardly. Two-wall corrugated panels can also be cut as above described on both sides of the panel in order to allow the panel to flex in both inwardly and/or outwardly directions.

Flexible locations can be reinforced by stiffening including reinforcing tools such as flute wires explained in other embodiment system. After the cuts are placed through the back walls of the sound-controlling panel at the needed flexible locations, such as near to the corners and at illustrated gradual bend locations, the entire cut backside of the sound-controlling panel can be covered over by aesthetic covering materials for aesthetic purposes with an expandable material attached to the cut side of the sound-controlling surface panel, such as a stretchable polyurethane fabric backing material made, for example, with expandable spandex, and attached to the pre-cut side of the panel by adhesives such as pressure sensitive transfer adhesives and/or other suitable devices or application methods. The sound-controlling panels can be perimeter cut into multisided triangular, square or rectangular-shaped, or oval or round shaped, sound-controlling panels. The loose edges can be sewn in place with suitable edge sewing or an edge binding material, for example, at the perimeter edges "c" using a cloth or plastic material such as a 20-30 gauge semi-rigid polyvinyl chloride plastic sheeting which can be pre slit into 3.8 cm (1.5 inches) wide strips, folded over, and sewn over and around one or more of the edges "c". The base material itself can be used without an edge binding or the stretchable backing material can be extended beyond the outer edges and folded-over along one or more of the outer perimeter edges "c" and secured in place at the edges by suitable devices or application methods.

Instead of using a multidirectional flexibly-angled sound-controlling panel device, such as the above-mentioned multidirectional crosscut flexibly-angled corrugated plastic sound-controlling panel, a recyclable solid sound-controlling flexible material, such as the above-mentioned recyclable sound-controlling polyethylene terephthalate film or material can be used with the embodiment system, where the same film, or another material such as above-mentioned pre-slit semirigid polyvinyl chloride plastic binding, can be folded-over along the outer perimeter edges "c" and sewn or otherwise attached into place to create a holding pocket or stabilizing tool containment system, for one or more extended small diameter flexible reinforcement/stabilizing tools, such as 0.5 cm (0.188 inch) diameter flexible fiberglass or nylon rods, or other suitable flexibly-extended reinforcement/stabilizing tool which can be inserted into at least two or more sewn holding pocket edges around the "c" perimeter of triangular, square, rectangular sound-controlling shapes, for example, with the ends of the flexible tool rods "d" optionally extended an inch or two beyond the corners as illustrated in FIG. 28.

One or more lengths of stiffening or reinforcing tools and tool holding mechanisms, such as those detailed with above embodiments, can also be utilized to help flexibly stiffen, reinforce including dimensionally-stabilize sound-controlling panels across the diagonal direction of the sound-controlling panels at flexible joint locations and other locations as above mentioned. The resulting sound-controlling assembly structure is extremely flexible, lightweight and can easily be left flat or flexed into a plurality of portable angled shapes and adjustably-retained into those portable shapes by a simple cross-corner connecting mechanism, such as the opposite corner, cross diagonal connecting and holding mechanism illustrated in FIG. 28, for example using one or more stretched lengths of cord or one or more part adjusting devices, such as cross-part adjusting device **16*f*, at locations "e" and/or "f", cross connecting the optionally-extended ends of the above-mentioned 0.5 cm (0.188 inch) pocket edge inserted flexible rods at opposite cross diagonal corners "d" of the structure, whereupon the angular sound-controlling shapes, such as shown on FIG. 28**, can then be adjustably placed and held into in angular sound-controlling position. Corners of flexible sound-controlling material can also be stiffened, reinforced including dimensionally stabilized by other cross corner connecting corner pocket devices in order to stretch out and hold flexible material into shapes and in place at the corners such as used by recreational kite devices, archery devices like bowstring connecting and holding devices and other suitable connecting and holding devices or application methods known to those skilled in the art.

In addition to these straight-sided sound-controlling shapes with corners, non-cornered sound-controlling shapes, such as oval or rounded shapes of various sizes, can also be used with the same above mentioned stretched-edge tension construction. Oval or rounded shapes allow the use of even smaller diameter and more flexible reinforcement/stabilizing adjustment tools to be used than used with the above corner shapes including the use of smaller diameter fiberglass or nylon rods such as one or more 0.3 cm (0.125 inch) fiberglass rods, to be inserted or otherwise utilized with a perimeter holding pocket or stabilizing tool containment system, such as a pocket edge sewn around the outer perimeter of these oval or circular shaped sound-controlling structures using methods explained above, whereby the inserted stabilizing adjustment tools such as 0.3 cm (0.125 inch) fiberglass rods help retain the sound-controlling fabric into a stretched flat shape, which can then be left flat or angular flexed and held into position as shown on FIG. 28 utilizing cross-part adjusting devices explained above to position and hold the sound-controlling panel into shape and position. These above shapes can also be used separately in various sizes as optionally-listener-adjustable add-on sound-controlling panels including as a sound shapers for this and other embodiments presented herein.

Other component parts including embodiment system sound shaping and sound-controlling devices, such as acoustic skins and sound shapers illustrated in FIGS. 13 and 14, and additional listener-controllable and optionally-listener-adjustable universal embodiment system interchangeable parts shown in FIGS. 1I-7, 12, 15-18, 21, 22, 26 and 28-31 can also be interchangeably added in order to provide the listener with optionally interchangeable, reusable, and recyclable stereo audio sound enhancement components along with provisions for listener-interactive high-performance surround sound adjustability and control.

For example, structure adjustment devices including part adjusting devices such as cross-part adjusting device 16*f* and sound-controlling including sound reflective, sound diffusing, sound absorbing, and/or sound barrier surfaced panel component devices can be positioned near to, in back of, including over the top of, and disconnected from and outside of, sound-controlling parts of the embodiment system's sound-controlling assembly as illustrated and detailed in the presented embodiment system sections. For example, one or more embodiment system sound-controlling panel component devices such as an over-the-top extended sound-controlling panel component device 29*a*, FIGS. 19 and 29, and/or one or more outer sound-controlling panel component devices 29*b* illustrated in FIG. 29 can be used with this and other presented embodiments to successfully provide interactive degrees of variable and repeatable sound control for one or more listeners and acoustic designers.

Many connecting, fastening, and/or attachment devices or application methods of various suitable types can also be appropriately utilized that are detailed and illustrated throughout this document including fasteners such as hook-loop fasteners; clip, clamp, hook and hanger attachment devices; snaps, wires, straps, magnets, and additional part adjusting devices, as well as other suitable connective part adjusting devices known to those skilled in the art.

One of the initial preliminary setup options for the embodiment system shown in FIG. 28, including an initial horizontally-level speaker setup system, that can be used with this or other embodiments, is illustrated and explained thoroughly in the associated explanation with the embodiment system shown in FIG. 19, and in FIGS. 1I-18. The two speakers 1*a*L and 1*a*R illustrated in FIG. 28 have been placed apart and positioned at one of the quick-reference positioning symbol line coordinate locations 3*c* using the floor positioned symmetrical part-alignment positioning system 3*a* used with this embodiment system for reference explanation purposes, which is more fully illustrated in FIG. 4. Note in this regard that the sound-controlling panel devices left 7*b* and the right 7*a* of the embodiment system as illustrated in FIG. 28 have been symmetrically placed along one of these pretested user-selectable symmetrically-precise surround-sound floor located quick-reference positioning symbols, specifically illustrated here at the quick-reference positioning symbol location 3*c*, which is shown here as attached onto a symmetrical part-alignment positioning system device such as a floor template type of symmetrical part-alignment positioning system device illustrated here as floor template 3*a*. This symmetrical part-alignment positioning system device then allows one person to quickly, easily and precisely setup a fully-functional surround sound-controlling assembly around the listener and the stereo speaker system within a 5 to 10 minute time period with no measurements, using no tools and thereby can fully and professionally start using such a system after this substantially-short amount of setup time. Adjustment devices such as part adjustment devices 16*a*, 16*j*, 16*f*, and sound shapers explained elsewhere in this document can be added in similar fashion such as explained and illustrated on FIGS. 18, 26 and 28.

Complete disassembly and put-away time normally takes even less time, whereby the listener need only to stand-up, remove the interconnected sound-controlling panel devices, flatten or mate them together and place them, for example, along with other associated devices into a nearby closet or out-of-view behind a couch thereby immediately opening up the entire room to other useful purposes as explained elsewhere in this document with other portable embodiments.

A visual display device, such as visual display 19*c* illustrated in FIG. 28, has been added with this illustrated embodiment system to show the approximate position and location of such a device in relationship to the surround sound audio reproduction system presented here if an optional sound-controlling panel device is not also utilized within the space between the left and right speakers. In the conventional prior art, a pair of stereo speakers located on either side of the visual display, such as illustrated in FIG. 28 by speakers 1*a*L and 1*a*R, conventionally confined the sound field along with the visual field in front of the listener. However, with the speakers left in the same position, with one or more of the embodiments presented here, the listener can now enjoy a high-performance, substantially whole three-dimensional surround sound experience enveloping the listener with the true original surround sound field reproduced in real time from the original set of stereo signals that normally accompany any visual display.

To provide full visual display accompaniment with most embodiments presented herein, individual embodiments have been intentionally arranged to optionally accommodate the use of the visual display's conventionally-recommended eye-level height and natural front and center viewing angle for visual displays which appreciably accompany a stereo audio sound system. Also, as illustrated in FIG. 28, most embodiments are designed to optionally allow the visual device, such as a 60 inch high-definition visual display, to be placed in front of and physically away from the immediate open front portion of this and most embodiments presented herein and thereby positioned at the recommended appropriate conventional viewing distance and height from the viewer-listener, while at the same time providing a remarkably-enhanced complementary surround sound field re-created from the live or a reproduced set of commonly-provided two-channel stereo audio sound signals that normally accompany the visual display device. For example, most embodiments can be setup to optionally allow a three foot or more distance between the back of the speakers and the front of the visual device while allowing that visual device to be placed on a conventional display structure such as a display stand or simply attached to a wall in the conventional manner. In addition, the presented embodiments as detailed above, and in accordance with the presently-revealed method of application, can also position large flat or newer curved widescreen high-definition visual displays not only conventionally in front of the listener as detailed but also positioned on the sides of the listeners in positions on, over the interior surface of, or in place of, the embodiment system sound-controlling sidewalls.

The reason for this embodiment system provided three foot or more open space distance, therefore, is to allow the viewer-listener to enjoy a full surround sound visual accompaniment experience without any physical listener interference or unusual adjustments needed, for example without requiring any unusual viewing angle, without having to alter the normal traditional front and center visual display placement position, without causing any viewer distance eyestrain and without adding any visual obstruction interference, yet, at the same time, allowing the viewer-listener a large enough centrally located space between, and far in back of, the placement of the speakers for comfortable traditional viewing and for convenient non-constrained entry and egress into and out of the surround sound reproduction enclosure at all times before, during and after the listening-viewing sessions.

This means that the provided easy-in and easy-out viewer-listener space arrangement optionally allows enough natural clearance space between the speakers and the visual device to allow the viewer-listener to quickly and easily enter or leave the listener sitting, reclining or lying device. This embodiment system provided viewer-to-listener space arrangement allows the viewer-listener to quickly and easily enter and leave, for example, a listener sitting device such as listener sitting device 5*a* by simply standing up and moving straight forward to exit the surround sound enclosure while also leaving the viewer-listener with enough natural clearance between the embodiment system and the visual device to not be inconvenienced by having to walk too close to the speakers or the visual display before, during, or after the viewer-listener session. This also optionally allows the viewer-listener to return past the visual display and through the opening between the speakers directly to the listening position, without having to move any obstruction or to physically rearrange any embodiment system component part, while also providing the viewer-listener with a realistically-natural three-dimensional holographic surround sound field experience with full adjustable control of this surround sound assembly from the convenience of the sitting, reclining or lying device such as from a sitting device 5*a*. For example, a standing, sitting or reclining viewer-listener can easily, precisely, conveniently, simultaneously and symmetrically adjust both sound-controlling panel components left 7*b* and right 7*a* at the same time inwardly or outwardly by using part adjusting devices such as a floor part adjusting device 12*a* illustrated in FIG. 12, and/or an overhead cross-part adjusting device 16*f* illustrated in FIGS. 16, 17, 19, 26, 28, 29 and 32*j*, thereby altering the surround sound effect and the individual placement of localized sounds within the reproduced sound field even from the sitting or reclining position.

Figure 10:
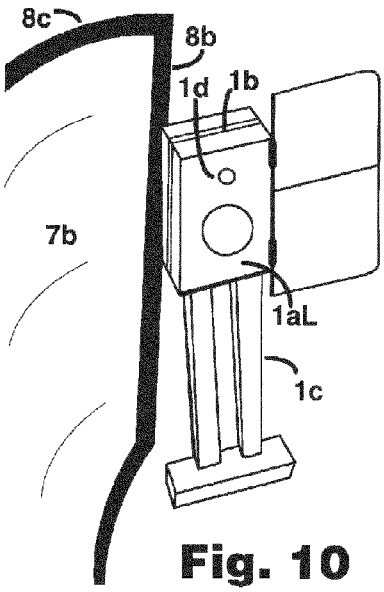
FIG. 10 shows a normal 15 minute setup for a portable, adjustable-size embodiment system. Perspective view showing left embodiment system sound controlling sidewall 7*b* next to left speaker 1*a*L and a sound controlling panel attached to left speaker 1*a*L (8 minutes before being fully setup).

The standing, sitting or reclining viewer-listener can also adjustably-flex the edges of the panel components, such as panel component edge 8*b* illustrated in FIG. 10, to alter the sound-controlling pattern and therefore alter the acoustic aesthetics of the individual localized surround sounds including the entire reproduced surround sound field as experienced from the listener's position of this and other presented embodiments. The viewer-listener can also use other quick-reference positioning symbols at another pre-tested location on the floor template to quickly and easily move and adjust sound-controlling panel components left 7*b* and right 7*a* outwardly or inwardly at the floor base to adjust or vary the surround sound experience in order to provide a viewer-listener with a preferred specific sound-controlling assembly arrangement that best suits the viewer-listener for that particular set of audio signals being real-time reproduced for the viewer-listener into a substantially whole original surround sound field along with the visual display signal.

Alternative Embodiment System

FIGS. 1I-19 and 29-31 show, illustrate and follow an initial beginner's progressive 10 minute setup arrangement for an embodiment system listening room structure, with relevance to many other portable presented embodiments that helps illustrate the function, materials, construction, methods of use of a representative apparatus of one of the many structural setup arrangement options available to the embodiment system. These figures are perspective views of the embodiment system that may not be illustrated according to relative scale and include elements that are be listener-adjustable, optional, and/or cooperatively-interconnected in ways other than those specifically detailed or illustrated, including elements that may be expandable or reducible in number, size, and shape.

The embodiment system starts out as an either one extended panel or two (2) interconnectable and overlapping semi-flexible panels 7*a* and 7*b* that can be incrementally-expanded and contracted in size by overlapping the two panels 7*a* and 7*b* in the back either more or less. This document will detail the two panel system that allows the listener to simply, quickly, and easily setup, expand, or contract the overall mostly vertical embodiment system panel structure by micro and incremental degrees, thereby providing extensive flexibility for the listener and allowing different sizes of the embodiment system to fit into a large number of surrounding rooms and spaces as appropriately needed, even rooms and spaces that otherwise are acoustically inappropriate for high performance sound and surround sound listening rooms. As with other portable embodiments, this acoustic structure follows the performance area detailed in FIGS. 1C and 1D. The overlapping structure of the two panels 7*a* and 7*b* provide one integrated cooperative support method for making this a free-standing, portable, lightweight embodiment system. This embodiment system also allows the system to be setup and taken down within minutes. Setup is attained simply by unrolling the panels 7*a* and 7*b* from a small storage area, overlapping them to a specific degree as indicated by a set of quick-reference positioning symbols along the overlapping joint between the two panels 7*a* and 7*b*, and then positioning the two panels 7*a* and 7*b* along an optional floor positioned symmetrical part-alignment positioning system, such as symmetrical part-alignment positioning system 3*a* shown in FIGS. 3 and 19.

Additional panels can be easily added at will by the listener and acoustic designer. For example, additional expansion panels 31*a*, FIG. 31, can be quickly added between panels 7*a* and 7*b* to significantly expand the size of the embodiment system. Acoustic panels such as acoustic screen panel 31*b*, can be quickly added to fill-in the gap between the two speakers thereby also providing added acoustic sound barrier and different acoustics properties to the embodiment system. Other panels including overhead panels and surrounding soundproofing panels such as overhead panels 29*a* and surrounding soundproof panel 29*b* are among other panels that can also be quickly and easily added or removed. As with all of the presented embodiments, multiple sound shapers, acoustic skins, and acoustic extenders can be added in an unlimited number of variable positions, angles and overlapping locations along the walls especially between the listener 19*a* and the speakers 1*a*L and 1*a*R. The embodiment system provides a truly versatile, exceptionally functional, and fully immersive acoustic and surround sound system for a high number of professional, high-end audiophile, retail, sound studio, domestic, and mass-market appropriate applications.

The perspective view of FIG. 19 is from a centrally-located position above and behind an extended assembly of complementary interconnected and listener adjustable indirect sound-controlling embodiment system components that make up the basic structure of this portable listening room assembly. It faces the same general direction as the listener and shows the three important embodiment system component positioning categories for all embodiments: 1) One or more stereo speakers and their acoustic-related speaker components, such as a pair of stereo audio speakers 1*a*L and 1*a*R and their speaker stands 1*c* positioned in a speaker setup arrangement explained below; 2) One or more listeners, such as listener 19*a*, as components, or sitting, reclining or lying device components 5*a*, and 3) The employed embodiment system, including all of its acoustically-significant and sound-controlling components.

The acoustically-significant and sound controlling components shown in FIG. 19 consist of two adjustable main sound controlling side wall panel components that can also serve as structural elements 7*a* and 7*b*; symmetrical part-alignment positioning systems such as symmetrical part-alignment positioning system 3*a* shown in FIG. 3; the listener 19*a*; sound controlling devices such as sound shapers illustrated in FIG. 14; and adjustable part positioning devices such as slidable part positioning hook-loop hanger device 15*a*, telescoping part adjusting devices 16*k* and other sound revealing, sound shaping and sound controlling components to be explained herein.

Figure 1D:
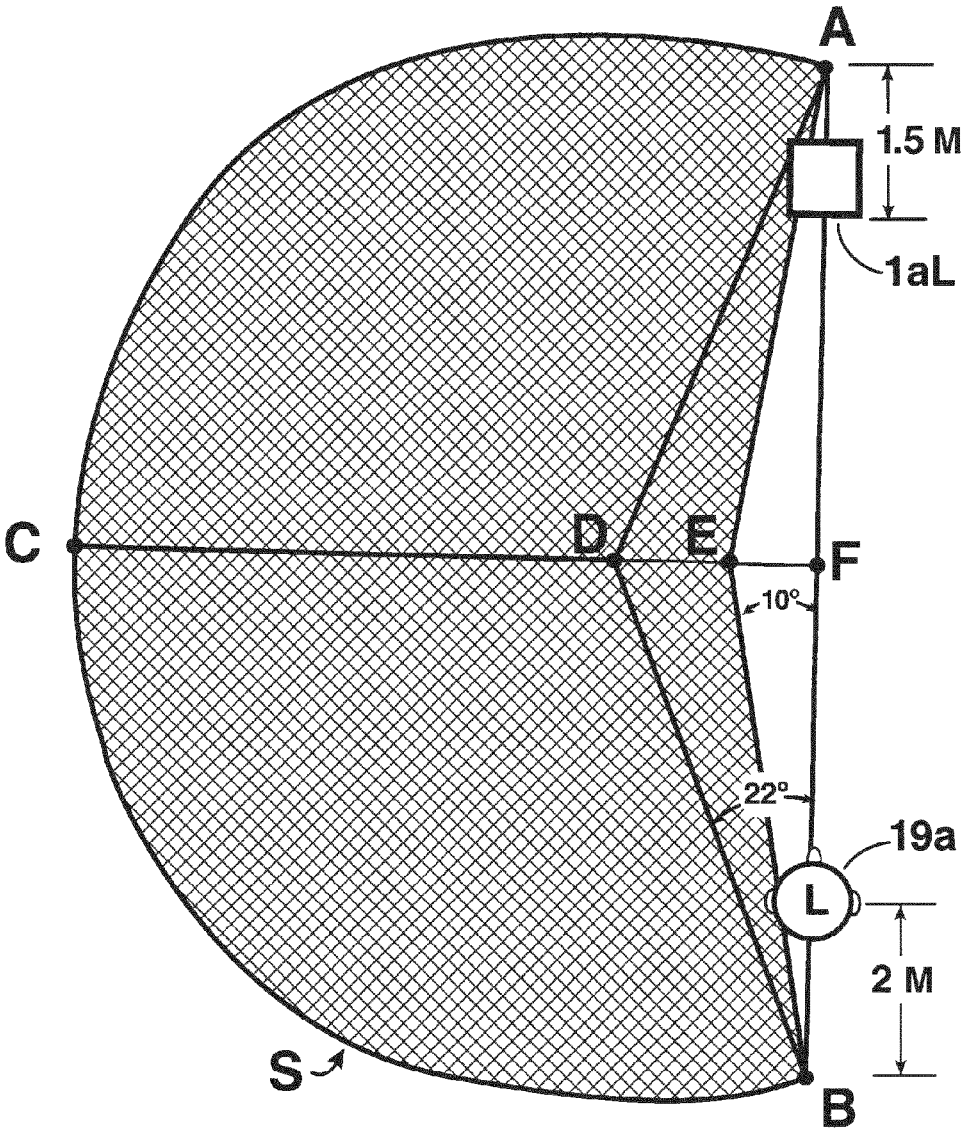
FIG. 1D is an embodiment system acoustic structure and performance area as defined by the principles of plane and solid geometric mathematics.
Figure 1H:
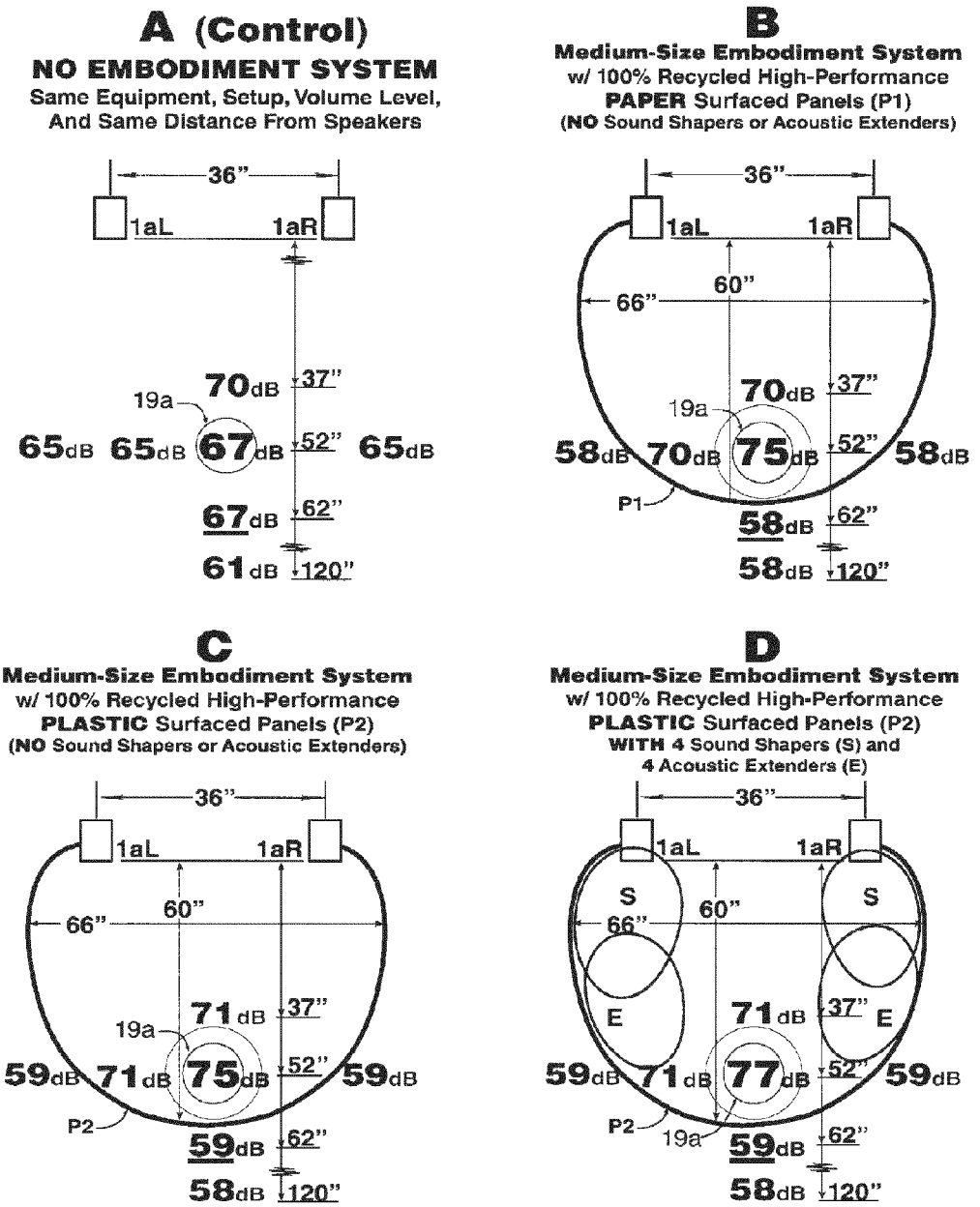
FIG. 1H shows sound level comparisons using decibels (dB) for different sizes and shapes of embodiment system with different sound reflective surfaces (100% recycled high-performance plastic and 100% recycled high-performance experimental paper) showing significant increase in conservation of speaker energy and more than double acoustic amplitude at listener's location (19*a*) versus control (without structure, in open room) and the added acoustic effect of sound shapers. 6 dB=double acoustic amplitude.

Referring to FIGS. 1B, 1I, 2, and 19 and with additional reference to FIGS. 1C and 1D, the initial first time the listener sets-up the embodiment system speaker-listener arrangement, it can include a two-channel front left speaker 1*a*L and front right speaker 1*a*R setup arrangement that is applicable to all portable presented embodiments. It takes the form of an isosceles right triangle with speaker 1*a*L having a left channel output and speaker 1*a*R having a right channel output being placed equidistantly spaced from the listener's location 19*a*, at each vertex along the base of the triangle with the listener 19*a*, or listeners sitting, reclining, or lying device 5*a*, being positioned at the triangle's top or third vertex position opposite the base and equal distant from a line 3*g* that is equal distant from both speakers 1*a*L and 1*a*R. During a listening session, the distance between the speakers 1*a*L and 1*a*R can be varied to be closer or further apart, while remaining at their triangle base vertex position and the listener 19*a* can reposition himself or herself at a distance closer to or further away from the speakers' position 1*a*L and 1*a*R while maintaining equal distant to the line 3*g* at the midpoint from both speakers 1*a*L and 1*a*R at the triangle's third vertex position.

Figure 1I:
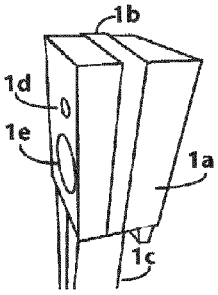
FIG. 1I shows an initial 10 minute one-time-only setup (strapping small speakers to their stands).
Figure 2:
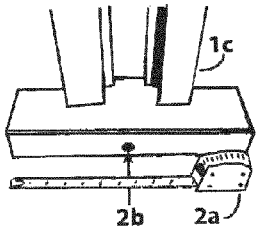
FIG. 2 shows another part of the same initial 10 minute one-time-only setup. Setting up speakers to be a part of a symmetrical part-alignment positioning system.
Figure 3:
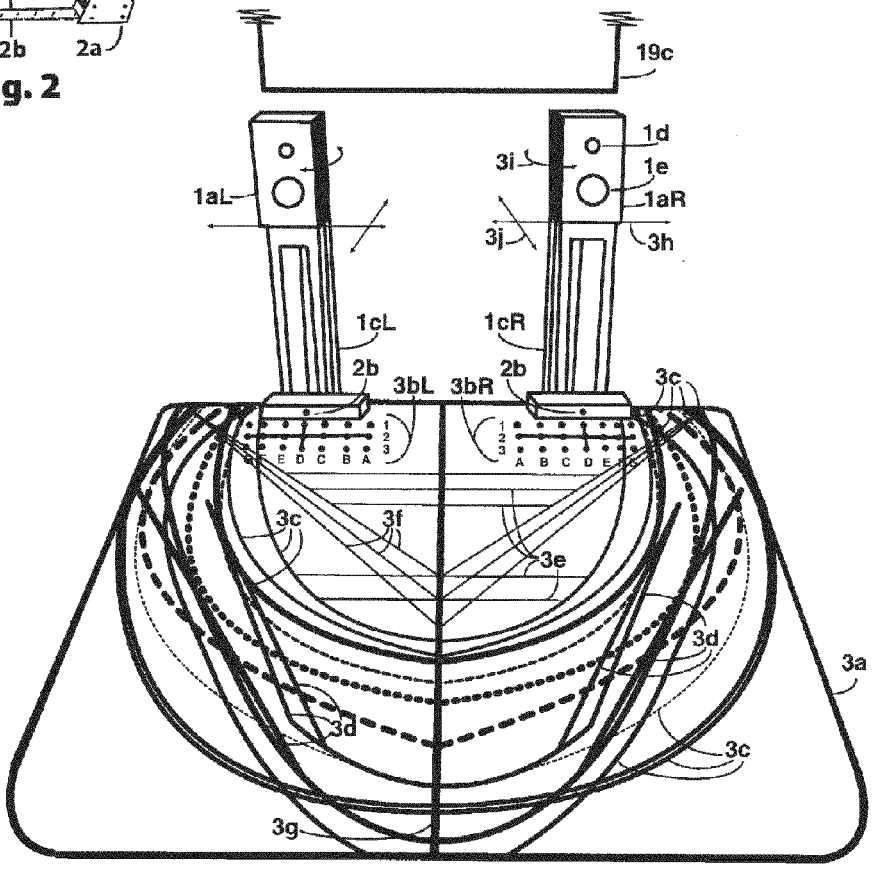
FIG. 3 shows the beginning of a normal 15 minute general setup. Perspective view showing floor template symmetrical part-alignment positioning system and quick-reference symbols used for simple, fast, and symmetrically-accurate precision positioning of embodiment system sidewalls, speakers and listener.

Starting an initial standard setup arrangement, FIGS. 1I and 2 show and explain an initial five-minute, one-time-only, standardized setup operation that does not need to be repeated using a standardized symmetrical part-alignment positioning system, such as this template type of portable floor-mounted standardized symmetrical part-alignment positioning system 3*a* shown in FIG. 3. FIG. 1I is a perspective view showing the side, front and top view of an audio speaker, such as a stereo audio speaker 1*a*, that can be utilized with one or more of the presented embodiments, and can be comprised of simple two-channel stereo speaker that need not be of any special type, size, power output, or transducer configuration, but that can minimally be a small compact stereo speaker driven by a low-power stereo amplifier to reduce energy consumption and electrical dependence. The speakers' tweeter drivers 1*d* and the listener's ears are positioned on approximately the same plane or vertical height above the floor. This is a natural consideration for all embodiments because it has been found that a more natural-sounding, horizontally-level, believably-real surround sound field is reproduced for the listener and acoustic designer without having to alter, electronically modify, or corrupt the original encoded signals, when the listener's ears are on the same approximate plane as, or are approximately horizontally-level aligned with, the highly-spatial and directional frequencies emitted from the speakers tweeters 1*d*. Speaker midrange driver such as speaker midrange driver 1*e* in FIG. 1I identifies the typical location of a speaker's midrange driver. This information is only identified here for reference and not necessarily included within positioning parameters for any embodiment system.

The precision of the setup becomes almost automatic after one or two 15 minute trial assembly setup arrangements. The precision of the initial setup, which is simple and fast with the aid of an optional symmetrical part-alignment positioning system such as symmetrical part-alignment positioning system 3*a*, FIGS. 3 and 19, also rewards the listener during the entire listening session.

Using two stereo speakers, there is no known limit to the number of variable independent symmetrical positions, including symmetrical angles, heights, and separation distances that the two speakers can be positioned into for ideal surround sound reproduction. As detailed elsewhere in this document, the presented embodiments provide the ability and opportunity to symmetrically turn (toe out) or setup the speakers to utilize either the speaker's indirect component alone to provide the presented embodiment system's substantial acoustic problem solving and application advantages, or to time-line combine both the speaker's indirect and direct sound propagating components together in an acoustically-seamless, time-line coordinated, and ordered process to provide the embodiments' same acoustic problem solving and application advantages, while also providing the ability to subsequently redirect their captured indirect, including combined indirect and direct, sound information and sonic energy to the listener's position directionally and chronologically appropriately in a proportionately-natural-sounding, time-delayed spread pattern.

However, regardless of whether only the indirect sound alone, or the combined direct and indirect sound components, are utilized by this or other embodiments, the ideal stereo reproduction of a believable surround sound field using this or other presented embodiments requires no more than two-channels and two speakers with separation distance or rotation of the speakers that can be symmetrically varied to the listener and to the surrounding embodiment system within broad limits without altering, distorting or limiting the surround sound field around the listener.

General speaker stand 1*c* of FIG. 1I identifies a speaker stand that is traditionally smaller than stands that non-floor speakers are traditionally mounted on. In the event that the speakers are not mechanically attached to the speaker stand, due to the closer proximity of the listener and parts of the embodiment system to the speakers, they are sometimes prone to accidentally toppling off the stand quite easily unless they have been securely attached to the stand. To prevent this for both speakers, a speaker stand attachment device, such as a speaker stand attachment strap 1*b* can be securely wrapped around each speaker and the top of its respective speaker stand to support the speaker and to securely physically connect the left and right speakers to their respective speaker stands. This prevents a speaker from being accidentally toppled off its speaker stand, for example, by the listener passing by and physically connecting with the speaker, or during setup and use of this and other embodiments that are placed close to, at the side of, or which can touch or be physically attached to one or more speakers and/or their stands. Speaker stand attachment strap 1*b* can be comprised of large elastic or rubber bands, a length of double-sided tightly-stretched hook-loop fastener material, flat cording material, cloth strips, ratcheting tightening bands, extended length cloth strips, plastic loop connectors, and other suitable non speaker damaging but strong and flexible speaker-to-stand connecting methods. Other devices or application methods known to those skilled in the art can also be used to attach, connect or mechanically fasten speakers to their respective speaker stands.

FIG. 2 is a perspective view of the center front side of the bottom portion of a general speaker stand such as the speaker stand 1*c*. A measuring device such as standardized tape measuring device 2*a* or tape measure can be used to quickly and easily determine the precise exact center of the front side of both the left and right speaker stands if desired where a marking device, such as a pressure sensitive marking device "dot" 2*b* can be applied. This marking device can then be left on and used thereafter as a standardized speaker-centering reference point location for a number of highly precise, but fast to setup speaker positioning location options.

The helpfulness of this simple speaker-centering reference point 2*b* and other associated marking devices will be demonstrated throughout this document and in the following illustrations, and can be used, for example, to quickly, easily, precisely, dependably and repeatably setup, adjust and replicate one or more of the presented embodiments into a wide range of listener-selectable symmetrically-aligned standardized surround sound reproduction system positions before and during a listening session thereby providing a wide range of standardized but different listener-selectable and listener-variable symmetrically-balanced three-dimensional holographic surround sound options for the listener.

After quick and simple speaker setup procedures and attached marking devices, such as those above described, are applied, they can be left on and never have to be repeated when using any of the embodiment. They will save the listener a considerable amount of setup and adjustment time, frustration and guesswork.

Figure 5:
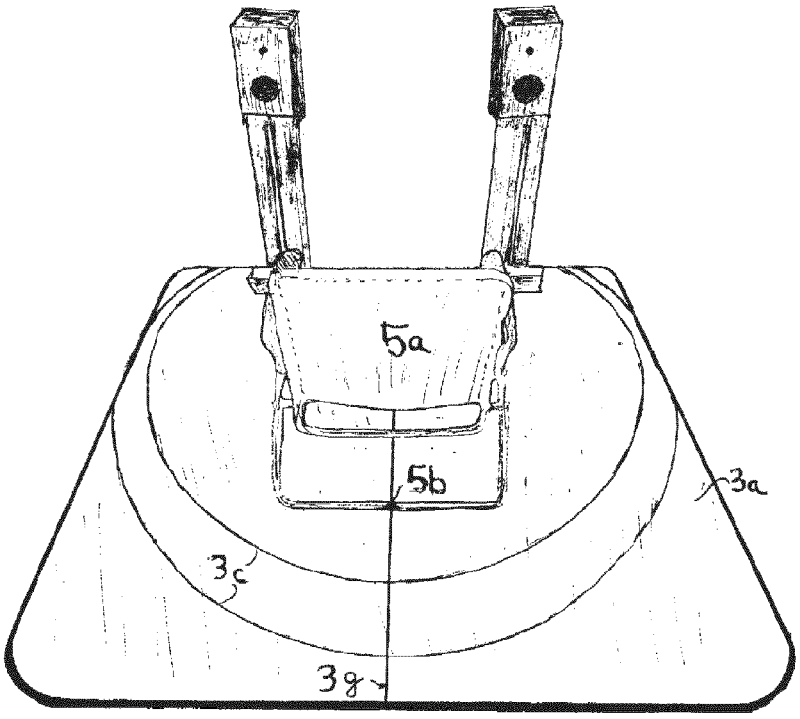
FIG. 5 shows a normal 15 minute general setup arrangement. Perspective view showing floor template type of symmetrical part-alignment positioning system and quick-reference positioning symbols showing speakers and listener positions precision coordinated and symmetrically aligned.

FIG. 3 is a perspective view of the embodiment system taken from approximately the same height and position as FIGS. 5 and 19 showing three standardized symmetrical part-alignment positioning systems 3*a*, 3*b*L and 3*b*R, comprised of three sets of standardized, pre-tested, and precision pre-marked quick-reference positioning symbols, 3*c*, 3*e*, 3*f*, 3*d*, 3*g*; 1-3; and A-G, some of which are also shown close-up on FIG. 4. The three sets of precision-placed quick-reference positioning symbols 3*c*, 3*e*, 3*f*, 3*d*, 3*g*; 1-3; and A-G of the standardized symmetrical part-alignment positioning systems 3*a*, 3*b*L and 3*b*R, such as quick-reference positioning symbol lines, dots, characters, numbers, etc. are presented here for reference only. The standardized quick-reference positioning symbols illustrated can change and one or more symbols (not necessarily letters or numbers) can be added, moved or removed with this or other embodiments. Multiple different symmetrical part alignment positioning systems can also be successfully provided in accordance with the presented embodiments and their presently-revealed method of application with this and other embodiments along with different quick-reference positioning symbols.

Figure 7:
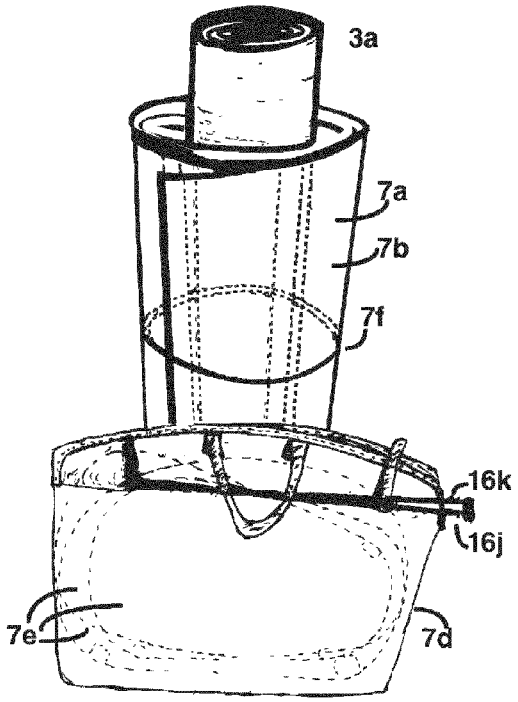
FIG. 7 shows the beginning of a normal 15 minute setup for an adjustable-size embodiment system. Perspective view showing the embodiment system with rolled-up sound controlling sidewall panels and floor template, with sound shapers, acoustic extenders and acoustic skins in their own "self-healing" carrying pouch, in a package that is ready for transportation, storage, or quick setup (15 minutes before being fully setup).

One of the purposes for a standardized symmetrical part-alignment positioning system, such as the standardized symmetrical part-alignment positioning systems 3*a*, 3*b*L and 3*b*R, is that entire embodiments, such as the portable embodiment system shown in FIGS. 7 and 19, can be placed into a wide variety of different-shaped and different-sized listener-chosen rooms, positioned in any listener-chosen part of the room, and positioned facing in any listener-chosen direction within the room quickly, easily, inexpensively, and at adjustable, symmetrically-precise acoustic positions.

After the aforementioned initial five minute one-time-only pre-marking and setup preparation, the standardized symmetrical part-alignment positioning system then allows one person to quickly, easily, precisely, and repeatably setup the entire fully-functional embodiment system surround sound-controlling assembly system shown in FIG. 19 within an approximate 7 to 10 minute time period, with no measurements, using no tools, and thereby can fully and professionally start using such a setup system with no confusion, without any tedious positioning procedures, and without the traditionally expensive and cumbersome dedicated prior art listening room constraints as further explained with other embodiments.

Standardized symmetrical part-alignment positioning systems such as the floor template type of symmetrical part-alignment positioning system 3*a* can greatly assist listeners to facilitate a fast, easy, fully-symmetrical and correctly-assembled high-performance acoustic embodiment system in a more reliable, dependable and repeatable way, thus, enhancing not only professional appeal but also retail sound equipment demonstration appeal and mass market selection and utilization appeal as well.

If an environmentally-sustainable lightweight and highly dimensionally-stable sound-controlling panel is utilized with the embodiment system that is environmentally-responsibly produced for sound-controlling panels and materials 7*a* and 7*b* illustrated in FIG. 7 that is both recycled and recyclable, it is presently contemplated that the embodiment system employ sustainably-manufactured materials, at least as an appropriate environmentally-responsible option. Such materials can include those mentioned with the embodiment system shown in FIG. 20. They include extremely lightweight, low-cost, acoustically-suitable, and highly durable 4 mm to 6 mm corrugated polypropylene panel produced from recycled plastic detailed above, including utilizing the manufacturing operations and reinforcing tools also detailed above due to this material and panel's environmental sustainability, sound-controlling qualities and material composition advantages. However, this embodiment system, as with other presented embodiments, can also be easily and inexpensively manufactured out of one or more of the same materials as other embodiments presented in this document including structurally reinforced or as is 20-40 mil recyclable rigid polyvinyl chloride, high density polyethylene, thermoformed plastics, metallized materials, and the like; aluminum sheeting materials; metal composites; glass including safety glass, fiberglass and glass-reinforced plastics; composites including carbon fiber composites; wood materials, including composites and combinations thereof; hinged or non-hinged paper, plastic, foil etc. thermo-formed plastics, covered screen panels, scored materials, or a combination thereof; rigid plastic composites, acrylonitrile butadiene styrene, polyethylene terephthalate, polycarbonate sheeting, etc.; including various combinations of these materials, and other suitable sound-controlling materials known to those skilled in the art.

Additionally, the embodiment system can be comprised of different sound shaping and sound-controlling materials to provide the acoustic designer and listener with the same or different sound-controlling properties for selectively-variable acoustic performance options. Options include suitable selectively-variable structural materials such as plexiglass and lightweight aluminum panels, such as 20 mil sheet aluminum, or suitably hinge-connected multi-layer aluminum composite panel strips. Sound-controlling panel components 7*a* and 7*b* can also be one continuous panel, an assembly of same or different sized and/or shaped panels with each part or panel having one or more different sound-controlling characteristic. Panel components can be cut and interconnected together with one or more connecting, fastening, and/or attachment device or application methods of various suitable types including various suitable structural or panel connection fasteners, hinges, and releasably connective devices like those described with other embodiments, and elsewhere in this document. These embodiment system panel components can be suitably structured and acoustically utilized in a number of ways in accordance with the presented embodiments and their presently-revealed method of application including one or more sound-controlling panels attached to a ceiling, wall or floor-attached, vertically-stabilized or non-stabilized mobile transporting tool or tools like rolling devices that include tracks, wheels, or an assembly of push or pull ceiling, wall, or floor positioning assistance gliders that provide no or low-weight bearing transport assistance for the embodiment system or other embodiment system sound-controlling panel components presented herein.

If an environmentally-sustainable recycled and recyclable floor mounted template type of symmetrical part-alignment positioning system material is utilized with the embodiment system such as floor-mounted symmetrical part-alignment positioning system 3*a*, that is environmentally-responsibly produced, it is presently contemplated that this embodiment system employ, at least optionally, the below mentioned sustainably-manufactured 100% recycled from plastic bottles floor covering material from Foss Manufacturing Company. This material is contemplated due to its environmentally sustainable composition, however floor mounted symmetrical part-alignment positioning systems can be cut out from, organized or comprised of, including manufactured into a wide variety of different positional indicating templates and can also use different dimensional shapes and made from different materials such as flooring or floor covering materials, wall paneling material, dimensionally-stable composite laminates, plastic sheets, reinforced recycled paperboard, coated cardboard, woven and non-woven plastic or fabric materials including closed-cell foam, pressure sensitive tape and canvas fabrics that can be plastic-coated, as well as other suitable portable, adjustable or permanent positional indicating templates.

If a floor-positioned indicating template is used with a floor covering material like that mentioned above, for example, a commercial lay-flat carpeting material, inexpensive sustainably-recycled indoor-outdoor carpeting materials are manufactured in a variety of thicknesses, gauges, colors, and durability specifications, including a 100% recycled polyethylene terephthalate carpet fabric from Foss Manufacturing Company, LLC of Hampton, N.H. made of 100% recycled plastic bottles called Eco-Fi fabric, whereby approximately 48 recycled bottles are used to manufacture approximately 4.46 square meters (48 ft.$^2$), or a suitable 1.82×2.4 (6 feet×8 feet) sheet, of Eco-Fi carpet, which can also itself be recycled at the end of its useful life. Other suitable floor covering material compositions can also be made and utilized by those skilled in the art.

As illustrated on FIG. 3, standardized pre-tested and precision pre-marked quick-reference positioning symbols which can be part of a standardized symmetrical part-alignment positioning system, such as those attached to a floor mounted type of symmetrical part-alignment positioning system 3*a*, can be comprised of a plurality of above-described standardized strategically placed line and symbol quick-reference positioning symbols, including quick-reference positioning symmetrical centering symbols, such as symmetrical center line 3*g*, that divides the left and right half of a standardized symmetrically aligned assembly of parts and the standardized location for the symmetrical center of the standing, sitting, reclining or lying listener or the listener sitting, reclining or lying device. These standardized lines, symbols and quick-reference positioning symbols can be comprised of any number of shapes and sizes and can be applied by using a wide range of application methods for marking large sheets or panels of above-mentioned suitable materials, including: being brushed, roller-coated or spray-painted onto the parts using a fast-dry or low VOC paint applied through a perforated top plate placed over one of the above-described suitable materials; digitally printed, silkscreened or stamped on by various methods; heat-sealed into one or more of the above suitable materials such as onto the top surface of a vinyl-coded canvas fabric; perforated into or through the material using die-cutting equipment such as hole plugs, spaced perforators or segmented blades, as well as other suitable marking methods known to those skilled in the art. Individual outline circumference templates, with minimal or no markings on the surface of them, can be used for their perimeter shape alone, especially for mass market and standard size applications. Multiple different quick-reference part positioning symbol line sizes and shapes, such as quick-reference part positioning symbols 3*c* on symmetrical part-positioning system 3*a*, FIG. 3, can also be cut-out as individual templates for standardized low-cost setup arrangements. Prepackaged do-it-yourself applied quick-reference positioning symbols can also be attached by the end user, either permanently or on a temporary basis, to also prepackaged or user-supplied floor materials If symmetrical part-alignment positioning systems and their quick-reference positioning symbols are used as reference points with the embodiment system, such as the quick-reference positioning symbol lines and symbols illustrated in FIGS. 3, 4, and 6, they can be incorporated into an overall symmetrical part-alignment positioning system for the straightforward, simple-to-understand, fast, precise, and dependable standardized positioning and the coordinated mutual symmetrical placement of all three important embodiment system component part positioning categories previously mentioned above. These three primary system component part positioning categories successfully provide a high number of standardized synergistically-interconnected preconfigured triangulated embodiment system placement positioning options that can then be quickly, easily, inexpensively, and symmetrically arranged with a precise acoustic spatial symmetrical relationship to each other in order to create standardized acoustic symmetry among all three primary component parts to then substantially-capture, symmetrically-control and beneficially-utilize progressive time-line encoded sound energy from the speakers' normally inefficiently-wasted indirect sound and substantially-focus it toward the listener from a plurality of angles and directions in order to reproduce acoustically-enhanced stereo audio sound and a realistically-natural three-dimensional holographic surround sound field. Precision placement, especially precision symmetrical placement of all acoustically-significant components in high-end stereo systems is, and has been, a fundamental key for gaining true audiophile sound experiences. However, these experiences are rare outside of the industry. The following setup arrangement uses those high-end precision audiophile principles in the simplified user-friendly embodiment system form and a highly-specialized precision embodiment system to provide those experiences to the user without the past and current limitations.

For the more portable embodiments, including this embodiment system, a listener, for example, can first place a standardized symmetrical part-alignment positioning system, such as a portable standardized symmetrical part-alignment positioning system 3*a*, into any position at any listener desired location within a desired room or space within a room of their choice in order to quickly place all three primary component parts detailed above into a chosen preconfigured symmetrical position, based on this pre-tested symmetrical part-alignment positioning system. This extremely-fluid user-friendly room-positioning, yet high-performance embodiment system setup arrangement, is substantially unlike typical audiophile setup arrangements. The speakers, for example, which normally need to be laboriously-placed with meticulous pre-measurements and cumbersome trial-and-error rearrangement into a centrally-located position within an acoustically proper listening room to reproduce above-average acoustic results, can now be adjustably and symmetrically placed anywhere within a room of the listener's choice and facing in any desired direction using the symmetrical part-alignment positioning system as a guide. This is because the symmetrical part-alignment positioning system can be placed just about anywhere within a room and the boundary of the embodiment system listening room, which is one of the pre-marked boundaries on the symmetrical part-alignment positioning system, now completely replaces the box-like boundaries of the physical prior art listening room, thereby allowing the embodiments replacement listening room, and its advantageous acoustic results, to be placed anywhere in the room that the symmetrical part-alignment positioning system can be placed. Utilizing symmetrical part-alignment positioning systems and their quick-reference positioning symbols such as illustrated in FIGS. 3, 4 and 6 allows the speakers, listener, and one or more of the presented embodiments to then be quickly, easily and symmetrically precision-placed, and symmetrically user-adjusted, before and during a listening session which successfully provides the listener and acoustic designer with a plurality of previously substantially expensive and otherwise difficult-to-achieve problem-solving solutions, user-friendly advantages, excellent acoustic results, needed industry provisions, and positive overall listening experience improvements. Once the symmetrical part-positioning system is placed at the user's desired location in the room which in this example is on a floor space in a room of their choice, the following information will help first time users quickly get setup to use either the speakers provided with the system or their own set of typical speakers as detailed with this and other embodiments herein.

FIGS. 3, 4 and 6 show the individual lines, dots, numbers, letters and other symbols to help demonstrate the complex coordinated interrelationship of symmetrical part-alignment positioning systems and their standardized quick-reference positioning symbols that have now been meticulously worked out in advance, pre-tested, pre-configured and permanently setup with synergistic mathematical precision for the listener and acoustic designer, and can now be visually used as a simple standardized adjustable precision placement guide for all three primary component parts. For example, standardized quick-reference positioning symbols, such as quick-reference positioning symbol lines 3*e* in FIG. 3 can be successfully used by a standing, sitting, reclining or lying listener to quickly visually notice the forward to backward placement and perpendicular alignment of the listener position or the position of a sitting, reclining or lying device by a instantaneous visual reference to one or more of these lines in relationship to the angle of the listener sitting device if a listener sitting device is used. Quick-reference positioning symbols, such as quick-reference positioning symbol lines 3*f*, along with a center symmetrical positioning symbol line 3*g*, can be visually used by the listener, even while standing, sitting, or reclining, to quickly determine if the listener is centered and symmetrical which can, if symmetrically off balanced, affect the overall acoustic experience for the listener as explained elsewhere. Quick-reference positioning symbol lines, such as lines 3*c*, can be visually used by the listener to quickly, easily, precisely and symmetrically place sound-controlling sidewall embodiment system component parts, and to maintain or to adjust their position before and during a listening session into different, but acoustically-precise, symmetrically-aligned, configurations.

Straight lines, such as straight lines 3*d*, can be used by the listener to quickly, easily, precisely, and symmetrically place and adjust generally straight-sided or planer sound-controlling sidewall embodiment system components such as illustrated in FIGS. 19, 20, and 23 through 28. Other standardized lines, such as speaker positioning lines and quick-reference speaker positioning symbols on the floor-template embodiment system symmetrical part-alignment positioning system 3*b*R, is detailed and illustrated in FIG. 4. These symmetrical part alignment positioning systems and their quick-reference positioning symbols, in addition to their obvious and explained setup advantages, can be made with any symbol or mark in accordance with the presented embodiments and their presently-revealed method of application. They have been found to be substantially helpful to the listener and acoustic designer by being able to successfully provide them with near instantaneous and precisely-positioned standardized component part placement, feedback, and immediate guidance for confirming and reestablishing complete system symmetrical alignment of one or more of the above-mentioned three primary embodiment system component positioning categories and their resulting acoustic experiences including during long listening sessions and after multiple part readjustment procedures by the listener.

Figure 17:
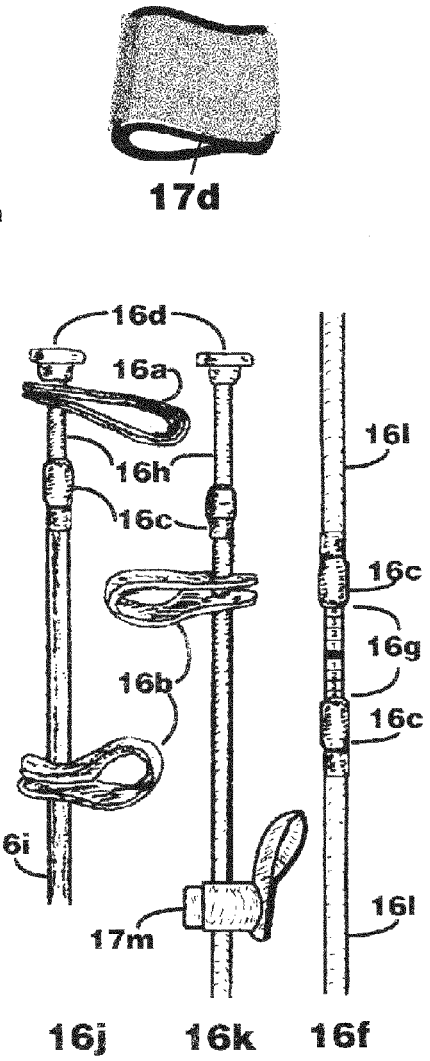
FIG. 17 shows a close-up view of connecting pieces of telescoping part adjusting devices 16*j*, 16*k*, and 16*f*, usable for many positioning applications with most embodiments.

The listener, many times even from the standing, sitting, reclining or lying position, can choose to use from a substantial plurality of suitably-different standardized quick-reference positioning symbols, including those not shown quick-reference positioning symbols and locational positioning tools such as laser positioning tools, sound centering devices, suitable positioning devices such as an extended center-marked telescoping cross-part adjusting device 16*f* illustrated in FIGS. 17 and 29, and other suitable positioning tools and devices known to those skilled in the art to quickly, easily, accurately, repeatably, and symmetrically position, including adjust, move, interchange, and cross connect, for example, left and right sided acoustically-significant sound-controlling embodiment system component parts into different including larger or smaller, outwardly or inwardly, forward or backward, higher or lower, including at various different angular and articulating positions, locations, and relationships and combinations thereof, using one or more sets of simple symmetrical part-alignment positioning systems and their quick-reference positioning symbols, such as a floor base and other positional symbols, in order to adjust or vary the listener's and acoustic designer's sound and surround sound listening experiences thereby providing the listener and acoustic designer with such variable choices as being able to select a preferred specific sound-controlling assembly arrangement or be able to replicate a specific assembly arrangement that best suits the listener or the listener-viewer for a particular favorite acoustic or audio-visual selection experience.

As illustrated in FIGS. 3 and 6, standardized symmetrical part-alignment positioning systems such as symmetrical part-alignment positioning systems 3*b*L and 3*b*R and their quick-reference positioning symbols 3*a*L and 3*c*L for the left side and 3*a*R and 3*c*R for the right side, can be used to symmetrically precision position and align both the left and right speakers 1*a*L and 1*a*R which can be of any type, size, or variety of speaker, and may or may not be used with speaker stands such as speaker stands 1*c*L and 1*c*R. These two illustrated coordinated symmetrical part-alignment positioning systems 3*b*L and 3*b*R and their also coordinated but opposite left and right sided quick-reference positioning symbols 3*a*L and 3*c*L for the left side and 3*a*R and 3*c*R for the right side, successfully provide the listener with the controlled interactive ability to adjustably symmetrically precision position both speakers quickly and easily, for example, from a symmetrically-centered quick-reference positioning symbol such as the quick-reference positioning symbol centerline 3*g*, forward or backward, that is closer to or further away from, the listener position while at the same time being optionally listener-adjustably interconnected with all of the other embodiment system quick-reference positioning symbols, part adjusting devices, and component part positions, thereby providing the listener and acoustic designer with a substantial triangulated symmetrical system for quickly, precisely, and symmetrically positioning all important embodiment system component parts.

Note that the speakers 1*a*L and 1*a*R, including their accompanying speaker stands 1*c*L and 1*c*R, can be precisely interconnected with and by these symmetrical part-alignment positioning systems and their quick-reference positioning symbols and then symmetrically adjustably positioned and repositioned, such as forward or backward as indicated by directional indicating arrows 3*j* in FIG. 3, left or right as indicated by directional arrows 3*h*, and/or twisted "toed" inwardly or outwardly as indicated by directional arrows 3*i* and combinations thereof. Also, note that because a speaker stand attachment device, such as strap 1*b* explained with FIG. 1I, can be used to non-statically hold the speakers 1*a*L and 1*a*R to their respective speaker stands 1*c*L and 1*c*R, that this advantageously allows the speakers to be pivoted (toed) and twisted around freely and independently from their respective speaker stands 1*c*L and 1*c*R that the speakers are substantially, but not statically, attached to, as indicated by the directional arrows 3*h*, 3*i*, and 3*j* in FIG. 3. This allows the listener to quickly and easily turn/toe both speakers and to adjustably vary their positioning before and during a listening session along with positioning them in relation to the other embodiment system components for maximum listener-adjustable acoustic versatility, therefore, allowing the listener and acoustic designer to create and accurately reproduce a plurality of different, but highly-precise, repeatable, optionally-listener-adjustable, high-performance surround sound experience options quickly, easily, and expensively.

FIG. 4 is a close-up perspective view of the above-mentioned type of a right side only symmetrical part-alignment positioning system such as the right side symmetrical part-alignment positioning system 3*b*R, its quick-reference positioning symbols 3*a*R and 3*c*R and its center positioning symbol mark 2*b*R pre-marked on the speaker stand 1*c*R for the unseen right speaker 1*a*R illustrated in FIGS. 3 and 6. A symmetrically-coordinated left side symmetrical part-alignment positioning system 3*b*L shown in FIGS. 3 and 6 is also used but not also close-up illustrated in FIG. 4. That is, FIG. 4 is used to illustrate a more detailed close-up view of the right side symmetrical part-alignment positioning system 3*b*R for the unseen right speaker 1*a*R with overall reference also to the unseen left speaker 1*a*L, its unseen left side symmetrical part-alignment positioning system 3*b*L shown in FIGS. 3 and 6, with its quick-reference positioning symbols 3*a*L and 3*c*L, and its pre-positioned left speaker stand 1*c*L center-positioning symbol mark 2*b*L shown in FIG. 2. Using this overall coordinated system, as explained below, the right speaker 1*a*R and left speaker 1*a*L can be quickly and easily precision positioned into near-perfect symmetrically-coordinated but fully adjustably-positioned arrangements to within a repeatable spatial accuracy of less than one (1) centimeter.

This close positioning accuracy is attained simply by symmetrically-positioning the left and right speakers, 1*a*L and 1*a*R, in precise unison, for example, incrementally forward or backward, left or right, diagonally, and combinations thereof into any number of left and right side coordinated and symmetrically-perfect left and right side positions using listener-chosen quick-reference left and right side positioning symbols on the pre-tested left and right side symmetrical part-alignment positioning systems. For example, symmetrically-positioning the left and right speakers 1*a*L and 1*a*R, incrementally forward or backward using the quick-reference positioning symbol numbers 1 through 5 illustrated for the right speaker 1*a*R in FIG. 4 corresponding to five (5) different user-adjustable standardized quick-reference positioning symbol rows or layers 3*c*R, and by symmetrically-positioning the left and right speakers, 1*a*L and 1*a*R, incrementally left and right using listener-chosen quick-reference positioning symbol alphabet letters such as A through G illustrated for the right speaker 1*a*R in FIG. 4 corresponding to seven (7) different user-adjustable standardized columns 3*a*R. Using the center-positioned symbol mark 2*b*R located on the bottom center portion of the right speaker stand 1*c*R as a quick-reference positioning guide to align the right speaker stand 1*c*R, therefore the right speaker 1*a*R, relative to the floor-positioned right side quick-reference positioning symbols 3*a*R and 3*c*R marked on the right side floor-positioned symmetrical part-alignment positioning system 3*b*R, the right speaker 1*a*R, therefore is shown in FIGS. 3, 4, and 6 positioned at the coordinated quick-reference positioning symbol "D-1" position.

Using just one coordinated quick-reference positioning symbol can also be used to quickly and easily communicate the positioning of both speakers as well as both sidewalls into a pre-tested overall standardized synergistic coordinated position with each other. Note in FIG. 4 that the same quick-reference positioning symbol letters A, B, and C appear on both the right symmetrical part-alignment positioning systems 3*b*R for the right speaker 1*a*R and 3*c* for the right sidewall position, and that they track left and right in unison with each other. This allows one coordinated quick-reference positioning symbol, for example, "B-2" to be used to keep both the left and right speakers 1*a*L and 1*a*R, and the left and right sound-controlling sidewalls 7*a* and 7*b* the same pre-tested relative distance apart and in a symmetrically-perfect acoustic relationship with each other as the overall system is expanded or contracted in size simply by using one and the same identical corresponding quick-reference positioning symbol letter on both symmetrical part-alignment positioning systems 3*b*R and 3*a* to position both speakers and sidewall components.

For example, the coordinated quick-reference positioning symbol "B-2" indicates to place the left and right sidewalls 7*a* and 7*b* on quick-reference positioning symbol line "B" of symmetrical part-alignment positioning system 3*a* as well as indicates to place the left and right speakers 1*a*L and 1*a*R at the quick-reference positioning symbol coordinate location "B-2" on symmetrical part-alignment system 3*b*R, thereby using just one quick-reference positioning symbol "B-2" to coordinate the position of two (the speakers and sound controlling Embodiment system sidewalls positioned between the speakers and the listener) of the three important positioning components for all of the presented embodiments into a pre-tested coordinated position. And since the other important positioning component, the position of the listener or the listener's sitting, reclining, or lying device, is always placed along quick-reference positioning symbol line 3*g*, all important components, therefore, with the simple and uncomplicated use of just one coordinated quick-reference positioning symbol (B-2, for example), can be positioned quickly, easily, and accurately into perfect symmetrical alignment with each other, to within a repeatable spatial accuracy of less than one (1) centimeter.

In addition to pre-marked standardized visual quick-reference positioning symbols, additional visually-referenced, but non-marked, positions can be easily and symmetrically located simply by using any of the pre-marked quick-reference positioning symbols on any nearby symmetrical part-alignment positioning system as a visual-reference benchmark guide. This means that the user can reproduce slightly different but symmetrically and harmonically-balanced, believably-real, holographic three-dimensional surround sound fields from the original stereo signals quickly and easily. And, because the various component parts can be quickly and easily adjusted into varying, but highly-precise, standardized symmetrical positions, the listener can also choose to extensively mix and vary embodiment system sound-controlling components and component positions to positively experiment with non-conventional sound-controlling interrelationships using symmetrical part-alignment positioning systems and coordinated quick-reference positioning symbols simply as reference benchmarks or general symmetrical positioning guides.

Coordinate quick-reference positioning symbols such as instantly-noticeable visually-referenced crossed lines placed, for example, the line at positions "3" and "D" coordinate locations on the symmetrical part-alignment positioning system 3*b*R in FIG. 4, can also be added for even faster, easier, even more precise, and almost automatic overall sight-oriented positioning of embodiment system sound controlling components.

Note that the angle or "toe" position of the speaker stands 1*c*R and 1*c*L can also be visually referenced quickly and easily by this quick-reference positioning system. As previously-explained and noticeably unlike traditional toe-in speaker positioning angles, the embodiment system speaker toe angle shown in FIG. 4 by the right speaker stand 1*c*R, is purposefully shown as being slightly toed-out and away from being directly aimed toward the listener's position as illustrated in FIG. 4 as well as in other figures such as FIGS. 5 and 19. This is not the traditional toe angle for traditionally-placed speaker positioning and alignment configurations, however, parallel-positioned speakers or slightly toed-out speaker angle such as this has been found to be an ideal initial starting point toe angle and position for the speakers used with the presented embodiments because it directs the speakers sound approximately equidistant between the sound-controlling sidewalls and the listener's position, instead of directing it mostly toward the listener. This slightly toed-out speaker position angle, although not required, boosts overall sound information to the listener position (see double circles in FIG. 1H) and helps eliminate stereo speaker crosstalk which is especially very damaging acoustically to high-performance stereo audio sound reproduction.

After the speakers are placed in this initial position and the system is acoustically tested out by the listener, the speakers can then be repeatably adjusted or symmetrically toed inwardly, parallel to each other, or outwardly to suit different encoding variations of individual soundtracks and the listener's acoustic interests and preference, including adjustably placed into any mirror-image symmetrical left or right angled toe-in or toe-out position quickly and easily by the listener without the listener also having to physically move the speaker stands. Instead the listener or acoustic designer simply needs to only freely pivot or twist the strap-attached left and right speakers 1*a*L and 1*a*R, while they are flexibly but securely attached to and sitting on top of their speaker stands such as the left and right speaker stands 1*c*L and 1*c*R, which, therefore, avoids the need to physically lift and turn both the speaker and speaker stand assembly together as one unit in order to simply twist or toe the speaker alone, by itself, inwardly or outwardly, independent of its speaker stand.

All embodiments presented in this document lend themselves to being easily utilized from a listener's standing, sitting, reclining, and lying position and can be utilized as is, or with minor modifications, along with a plurality of conventional and non conventional sitting, reclining and lying devices. In this regard, that a listener sitting or reclining device with a lower back, or a lying device without an obstructing back-of-the-head board, therefore, naturally allows the back of the listener's head and ears to not be obstructed by the conventionally higher backplate and cushion that often accompany a conventional domestic sitting, reclining and lying device. The sitting device such as sitting device 5*a*, therefore, allows the listener to be able to unobstructedly hear a full 360° surround sound field and allows the listener to be substantially better able to easily positionally-locate, acoustically catch, decode, perceive, and substantially-appreciate these new emotionally-impactful pinpoint-localized surround sounds that also are now able to be heard from the sides and the back of the listener.

A listener sitting, reclining or lying device can be one-time measured and pre-marked near to the floor on the front and back at the device's symmetrical center point to quickly, easily, and symmetrically visually align that device with the rest of the symmetrical components of the embodiment system. For example, a pre-marked device, such as a listener sitting device 5*a* which has been pre-marked at a bottom back symmetrical center location 5*b*, can be quickly and easily symmetrically aligned with an embodiment system simply by aligning the pre-marked device with a quick-reference positioning symbol such as the quick-reference positioning symbol centerline 3*g* as illustrated in FIGS. 5, 19.

In addition to an above-mentioned standardized symmetrical part-alignment positioning system and their quick-reference positioning symbols to help setup and maintain left and right parts of the embodiment system structure into a symmetrical position on each side of the listener, there are many other readily-available suitable application methods and devices available to those skilled in the art to symmetrically center the listener and other embodiment system component parts described herein. For example, along with other suitable application methods and devices detailed elsewhere in this document, alignment devices such as tape, printed markings, alignment lights, lasers, sound-feedback centering devices, alignment wires or cables, traditional physical relationship and distance measurement devices, plastic or metal center-positioned tracks, and other suitable application methods and devices known to those skilled in the art.

Also, instead of a fully movable in every direction sitting, reclining or lying device that can easily move off-center after it is initially aligned along a pre-set centerline, a fixed, set-position floor or ceiling attached sitting, reclining or lying device can be utilized in accordance with the presented embodiments and their presently-revealed method of application without the need for a centerline. Such a device, which can be permanently pre-set and aligned into a set-position at the symmetrical centerline location, can include a built-in locking forward and backward action that automatically keeps the device centered while also allowing suitable forward and backward movement along that centerline.

Note that the three important embodiment system component positioning categories for all embodiments, the speakers, listener, and the employed embodiment system, can be substantially and independently adjustably positioned, for example, into a plurality of listener-oriented positions, locations, heights, sizes, etc. as long as all embodiment system acoustic components are kept approximately equally symmetrically positioned in relation to each other. This means, for example, that the aforementioned lower-to-the-floor type of sitting, reclining or lying device need not be used with this or other embodiments presented herein in order to maintain the approximate horizontally-level alignment of the listener's ears with the speakers' tweeters. Because a more natural-sounding, horizontally-level, believably-real, properly-height-adjusted surround sound field is reproduced from the stereo encoded signals when the listener's ears are approximately horizontally-level aligned with the speakers' tweeters, a needed change in any one of the aforementioned three important embodiment system component positioning categories for all embodiments for example, a change in the height of the listener, can be easily accommodated by a simple complementary adjustment in the other two acoustic components and still maintain the same approximate horizontally-level alignment of the listener's ears with the speakers' tweeters.

If, for example, the listener wants or needs to be positioned at a higher elevation such as standing up, the other two acoustically-significant components of a fully-functioning embodiment surround sound system, the speakers and the embodiment system's acoustically-significant components, can easily be adjustably positioned into a higher elevation to accommodate the standing listener while also keeping the listener's ears approximately horizontally-level aligned with the spatial-localizing and directional rich frequencies emitted from the speakers' tweeters. The entire surround sound field, therefore, can be shifted into a higher or lower position, without reducing the embodiment system's substantially high directional and three-dimensional acoustic performance, simply by raising all three acoustically-significant embodiment system sound-controlling components equally together thereby keeping the symmetrical arrangement between the embodiment system's acoustic components approximately the same simply by keeping the listener's ears approximately horizontally-level aligned with the speakers' tweeters and the sound-controlling panel components of the embodiment system.

The advantage of the result is, when the listener's ears and the speakers tweeters are kept more or less horizontally equal with the embodiment system's surround sound-controlling system and kept in symmetrical alignment with each other, the entire surround sound field can be moved, along with the embodiment system acoustic components, higher, lower, to the left, to the right, pivoted around including moved to almost any room, place, or location without measurably affecting the system's high acoustic performance of localizing surround sounds, the specific localized placement surrounding the listener, or the dependable reproduction of a three-dimensional holographic surround sound field. That is, so long as the listener's ears and the speakers' tweeters are kept more or less horizontally equal, the listener can be in any room, and can be sitting in a chair, standing up, reclining in a lounger, or lying down in a bed so long as these three necessary acoustically-significant sound-controlling components, including the embodiment system, are kept roughly equalized and kept roughly symmetrically-aligned, as illustrated in this and the other embodiments presented herein.

Note in FIG. 6, the illustrated examples of floor placed speaker and/or speaker stand symmetrical part-alignment positioning systems right 3*b*R and left 3*b*L, are essentially mirror images of each other, and positioned equidistant from a center positioning symbol, such as centerline 3*g*, for quick and easy listener controlled symmetrical speaker/stand positioning, repositioning, instant visual alignment, feedback, and referencing.

FIG. 7 is a perspective view of an example of a complete storage assembly for the embodiment system that illustrates the compact and efficient size, the lightweight portability and the remarkable small amount of floor space needed for storage, less than 0.2 square meters (2 square feet), that a complete portable acoustic enhancement system, a three-dimensional holographic surround sound reproduction system, and a fully-constructed pretested dedicated listening room takes up. Just add the acoustically significant speaker system components if not included with the employed embodiment system.

A holding-connecting device can be used to secure sound-controlling panel components such as sound-controlling panel components 7*a* and 7*b* together for easy moving and compact storage such as a length of double-sided hook-loop holding-connection strap 7*f*, for example, that can be comprised of the same type of hook-loop strapping material detailed in FIG. 1I as a speaker stand attachment strap 1*b* used there to securely attach or connect speakers to their speaker stands. Other suitable materials, fasteners and holding devices such as elastic connectors, hooks, drawstrings, circumference wrapping and holding devices including cloth covered bags, recycled paper, plastic or composite materials, and other wrapping or holding devices or application methods known to those skilled in the art can also be used to temporarily secure these panel components for storage.

One or more standardized symmetrical part-alignment positioning systems such as a template type of portable floor-mounted symmetrical part-alignment positioning system 3*a* detailed with this embodiment system and with other embodiments, is illustrated in FIG. 7 as being located in the center of the illustrated storage assembly. If a moving and storage holding mechanism, such as a structurally-confining compression pouch-like holding and storage mechanism 7*d*, is used with this or other embodiments, it is presently contemplated that this moving and storage mechanism be manufactured, at least partially, out of a recyclable 20 to 40 gauge semi-rigid or rigid heat-sealable, glueable, rivetable and/or stitchable plastic material such as polycarbonate, recycled polypropylene, polyethylene terephthalate, acrylonitrile butadiene styrene, or rigid polyvinyl chloride sheeting for their dimensional-stability, durability and recyclability, and other suitable semi-rigid materials.

The holding and storage mechanism as illustrated by holding and storage pouch mechanism 7*d*, is designed for portable convenience, can also include handles, zippers and other attached or manufactured holding devices including pockets, straps, gussets, interior separator liners, etc. made of suitable similar or non-similar materials. As illustrated in FIG. 7, this holding pouch mechanism 7*d* can be used to transport, hold, store, and restore structural parts of the embodiment system and other embodiments such as sound shapers and acoustic extenders. For example, sound shapers 14*a*, 14*b*, 14*d* illustrated in FIG. 14, and acoustic extender 14*de* illustrated in FIG. 20 respectively and more fully and detailed with other embodiments herein, when inserted within a holding mechanism such as holding pouch mechanism 7*d* will allow originally flat sound shapers and acoustic extenders, that can have become slightly out of shape from excessive use, to physically compression reshape and recondition themselves back into their original dimensional-flat form simply by associated compression when placed within this structurally-confining pouch-like holding and storage mechanism 7*d* when not needed between listening sessions. Additional non-panel component parts such as part adjusting devices such as part adjusting devices 16*j*, 16*k*, 16*f* and 21S that can be used with this and other embodiments are illustrated in FIGS. 15-17 and 20 and more fully explained later in this section, can be conveniently included with this or other holding and storage mechanisms especially on the exterior by various devices or application methods such as straps, chords, outside compartments including built-in pocket devices, etc. illustrated in FIG. 7, in order to provide a convenient combination moving, holding, storage location, and reconditioning mechanism for these devices, but to also keep these irregular-shaped objects physically out of the interior compression pouch, so as not to cause shape deformity to the panel components by associated compression along with the flat panel components. The part adjusting devices shown in FIGS. 16 and 17 can also be conveniently attached to the top of the rolled-up inside sidewalls 7*a* or 7*b* or floor template 3*a*, where they are immediately ready for use as the sidewalls and floor template are unrolled for setup.

Figure 8:
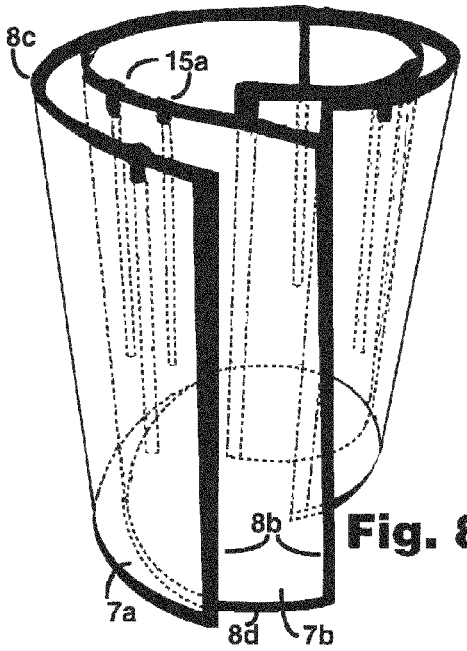
FIG. 8 continues a normal 15 minute setup for a portable, adjustable-size embodiment system. Perspective view showing embodiment system double interlocking sound controlling sidewalls 7*a* and 7*b* (10 minutes before being fully setup).

FIG. 8 is a perspective view that illustrates sound-controlling panel components such as sound-controlling panel components 7*a* and 7*b* during the beginning of a simple 7 to 10 minute setup procedure whereby a holding mechanism such as holding-connection strap 7*f* has been removed to allow the sound-controlling panel components to naturally expand and allow the listener to easily and quickly adjust sound-controlling panel components from the embodiment system shown in FIG. 19 into the sound-controlling assembly structure such as illustrated in FIGS. 9-13, and 18-19, including the option to advantageously utilize a part-alignment positioning device such as a standardized symmetrical part-alignment positioning system 3*a*, illustrated in FIG. 3. Note that one or more part adjustment devices, such as user-positionable hook-loop covered wall-mounted positioning fastener hanger systems 15*a* and 15*b* illustrated in FIGS. 15-17 and detailed elsewhere in this document, has been conveniently left on or attached to the top parts of the sound-controlling panel components during storage, instead of placing them on or into a holding mechanism such as holding and storage pouch mechanism 7*d* between listening sessions. Sound-controlling panel components 7*a* and 7*b*, as illustrated, show dimensionally-stabilized reinforced vertical edges 8*b* on the sound-controlling panel components. These dimensionally-stabilized corner-stabilizing edge-reinforcement devices have been added to vertical edges 8*b* to stiffen, stabilize, and reinforce the vertical edges of thin flexible panel component materials and to prevent these edges from gravity deflecting through vertical use, thereby allowing the utilization of lower-cost, thinner gauge, lighter weight, recyclable sound-controlling panel component materials to be efficiently utilized that, without the use of these corner stabilizing edge-reinforcement devices, are not normally dimensionally-stabilized enough to be used for free-standing, vertically-positioned, portable, light-weight panel components which are also fully-functional sound-controlling panel components taking up less room, and that are relatively easy for one listener to quickly and dependably assemble, adjust, disassemble, lift, move, and store when not in use, with minimum difficulty, by one person, without the use of any additional tools.

If an environmentally-sustainable recycled edge reinforcement device or material is utilized with the embodiment system for an edge reinforcement system such as edge reinforcement system 8*b* illustrated in FIGS. 8 and 10 that is environmentally-responsibly produced, it is presently contemplated that this embodiment system employ, at least optionally, the below mentioned and environmentally-responsible recycled 0.120-0.160 point thickness over-laminated pre-bent or curved 4 cm (1.5 inches) wide by 122 cm (48 inches) long recycled paperboard "U" channel material manufactured from 100% recycled and 100% recyclable paper products from Badger Paperboard Company due to its environmental sustainability composition. However, a selection of many other rigid and flexible edge reinforcement materials and devices can be employed with one or more of the presented embodiments, including using a plastic or metal exterior reinforcing mechanism such as: pre-preformed or molded 0.5 cm to 0.6 (0.188 to 0.25 inches) ID×2.5 cm to 5 cm (1-2 inches) sidewall "U" channel comprised of such materials as Nylon 6 polymer, glass-filled nylon, rigid polypropylene, polystyrene, fiberglass, carbon-filled composite or other rigid, dimensionally-stable suitable plastic or composite materials with a wall thickness appropriate for the material used such as a 0.3 cm (0.125 inch) sidewall; a 0.120-0.160 point thickness over-laminated paperboard "U" channel material manufactured from 100% recycled and 100% recyclable paper products such as similar to the paperboard used for Corner Guards, also known as Corner Boards, Angle Boards, V-Boards, Edge Boards, Edge Protectors including those made by Badger Paperboard, Inc. of Fredonia, Wis.; using materials to construct a sturdy flexible "U" channel edge that is similar to a bookbinding support mechanism such as using two 2.5 cm to 5 cm (1-2 inches) wide flat rigid strips of the same above-mentioned recycled paperboard or of the same thickness of dimensionally stable solid paper fiber slip sheet material from Southern States Packaging Company from Spartanburg, S.C., with a stabilizing device such as 0.8-1.3 (0.3-0.5 inches) diameter rods or tubes made from rigid materials including structural aluminum, nylon 6, fiberglass, composites, cement-filled recycled paperboard tubes, etc., and using an extended length of 5-7 cm (2-3 inches) wide cover support material to contain these items that can be composed of a heavyweight flexible support material such as 30 mil heavy canvas, vinyl-coated cloth, semi-rigid polyvinyl chloride sheeting, scrim reinforced plastic tape, or other suitable heavyweight material that can include a pressure sensitive adhesive backing. Once the flat strips, stabilizing device, and cover support material have been assembled into a flexible "U" channel similar to a bookbinding edge, all three items can be cut off to a length that closely matches the vertical height of the panel component edge 8*b* whereby the cover support material can be first folded around the stabilizing tool at the vertical panel component edge 8*b* mechanically attaching the cover support material to the panel component edge by such devices or application methods as rivets, snaps, industrial adhesives, industrial sewing, etc. with one of the two flat strips of recycled rigid paperboard positioned inside of the cover support material and on each side of the panel component edge before the cover support material is mechanically attached to the panel component edge, thereby producing a sturdy edge similar to a bookbinding support mechanism; using a deburred, degreased metal "U" channel that can be powder-coat painted and which can be comprised of 1.5 mm (0.060 inch) steel formed sheet metal, a lightweight 0.16 (0.064 inch) thick T-3003 H14 aluminum; or a triple-walled "U" shaped formed woven wire material that can be comprised of a 20 mesh 304 stainless steel wire cloth, and other suitable "U" channel materials appropriate for a rigid, high-strength bend-resistant corner edge protection.

The finished length of these "U" channels can be manufactured to closely match the finished height of the panel component edges, which can be a 122 cm (48 inch) height, and connecting, fastening, and/or attachment device, or application method of a suitable type such as steel, aluminum, or nylon rivets, tube-based high set strength construction adhesives including cyanoacrylate and two component epoxy adhesives which can be used alone or in combination to securely attach these fabricated "U" channels onto the corners, or vertical edges, of flexible or semi-flexible sound-controlling panel components are fully-explained elsewhere in this document. Using an interconnected 180° bent or curved two-wall structure such as a "U" channel substantially increases the dimensional stability of a thinner, more flexible gauge of material, thereby providing high strength and bend resistance using a relatively lightweight thin-walled, yet aesthetically pleasing, reinforced corner or edge protector and stabilizing panel component structure which can be easily, economically, and permanently attached using various devices or application methods, including devices or application methods used here with other embodiments to cover or otherwise protect panel component edges. Horizontal edges of sound-controlling panel components such as flexible sound-controlling panel components 7*a* and 7*b* can be comprised of a variety of more flexible edge materials and material application methods such as those fully-explained with the embodiment system shown in FIG. 28 where both horizontal and vertical edges can be as above-described rigidly-stabilized or flexibly-stabilized to allow more bending movement at the top and bottom edges. Additional methods for rigidly and/or flexibly stabilizing horizontal and vertical edges are detailed elsewhere in this document and are known to those skilled in the art.

Figure 9:
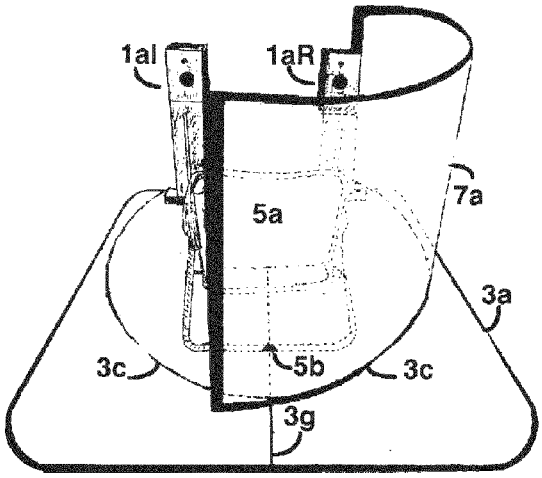
FIG. 9 continues a normal 15 minute setup for a portable, adjustable-size embodiment system. Perspective view showing right embodiment system sound controlling sidewall 7*a* next to right speaker 1*a*R (8 minutes before being fully setup).

FIG. 9 shows a sound-controlling panel component that includes sound-controlling panel component 7*a* being adjustably unfolded, from the FIGS. 7 and 8 position, onto a listener-selectable position on a standardized symmetrical part-alignment positioning system, such as standardized symmetrical part-alignment positioning system 3*a* along a listener-selected positioning symbol such as pre-tested, pre-configured quick-reference positioning symbol line 3*c* also illustrated on FIGS. 3 through 6, using an edge-stabilized sound-controlling panel component to provide lightweight one-person-adjustable positioning and setup.

FIG. 10 shows a perspective view of one of the many user-adjustable vertical and non-vertical sound-controlling panel component edge positions that can be initially setup or readjusted to one of many different operable positions, with a sound-controlling embodiment system panel components, such as sound-controlling panel component 7*b* which can be positioned, as illustrated, leaning on and slightly over the top of an adjacent nearby speaker, such as speaker 1*a*L that has been stabilized to its stand 1*c*L by a speaker stand attachment device in this case speaker stand attachment strap 1*b*. Note that sound-controlling panel component 7*b* has been stabilized at edge 8*b*, top 8*c* and bottom 8*d* by one or more of the above-detailed corner-stabilizing edge-reinforcement devices that allow the listener to position and reposition these panel components quickly and easily into a variety of stable optionally-listener-adjustable angles and positions.

It is helpful to again note that although the sound-controlling panel component 7*b* illustrated in FIG. 10 is shown leaning on, positioned slightly behind and slightly over the top of the speaker 1*a*L, a sound-controlling panel component such as sound-controlling panel component 7*b* can be placed, as explained elsewhere in this document, in any proximity, at any distance from, or at any angle in reference to a speaker, such as speaker 1*a*L. This includes to any speaker stand such as speaker stand 1*c*L. The allowance to do so, provides the listener and acoustic designer with unrestricted, variable, and acoustically-different but acoustically-interesting "tweeking" options that provide sound enhancement and acoustically-rich surround sound results.

Placing a large panel component, such as sound-controlling panel component 7*b* directly next to a speaker, such as illustrated in FIGS. 10-11, 13, 19 for example, has been known to advantageously provide the acoustic advantage of a physical back-to-front speaker sound barrier which helps, sometimes substantially, to block and prevent acoustic-damaging out-of-phase, especially lower frequency sound waves emitted from the back-side of the speaker, from passing around the side of the speaker to the listener where these aberrant sound waves interfere with, conflict with and neutralize the intensity, coherency and quality of the sound emitted from the normal front-side of the speaker.

This general embodiment system adjustably helps the listener preferentially control and adjust their individual acoustic experience greatly. If top-oriented sound shapers such as those illustrated in FIG. 19 as sound shapers 14*c*, are not employed, the adjustability of the employed embodiment system provides the listener with other methods for adjustably capturing this sound. For example, radically angling the top edge 8*c* in FIG. 10 of a sound-controlling panel component such as sound-controlling panel component 7*b*, where the side edge 8*b* of the sound-controlling panel component 7*b* can be leaning on, and physically touching, the speaker and with the top edge 8*c* of panel component 7*b* aggressively angled to extend the top portion or panel component 7*b* slightly over the top portion of the speaker resulting in a much more exaggerated panel component angle than illustrated in FIG. 10 and than illustrated with the mostly vertical panel component positions as illustrated, for example, in FIGS. 11 and 19. This exaggerated panel component angle extending over the top of a left speaker, for example, has been found to generally provide left localized surround sounds from many soundtracks to be more pinpoint focused toward the listener and more acoustically satisfying versus positioning such a panel component in a more absolutely-vertical upright position. This angled position is also provided as a curved and sculptured sound-controlling panel component in other embodiments that can also be used in this embodiment system. This shape is also provided as an optional sound shaper for this embodiment system. However, with other soundtracks, a more vertical-positioned sound-controlling panel component can provide the listener with a more enveloping, more immersive, more reverberant, and acoustically satisfying surround sound experience. It should be noted that although variations such as this occur between soundtracks, the overall acoustic result, even in the aforementioned least acoustically satisfying configuration, has been found to be exponentially more satisfying to the listener than hearing the same soundtrack without using one of the presented embodiments with the speakers.

Figure 11:
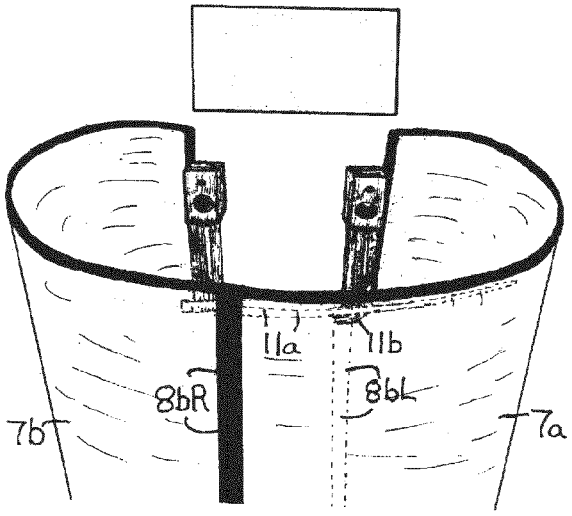
FIG. 11 continues a normal 15 minute setup for a portable, adjustable-size embodiment system. Perspective view showing embodiment system double interlocking sound controlling sidewalls 7*a* and 7*b* from back and outside of system with symmetrical part-alignment system being used to precisely interlock walls at one of hundreds of specific overlap positions to create a highly-precise adjustable overall size for the system within 1 centimeter (a fraction of an inch) (4 minutes before being fully setup).
Figure 12:
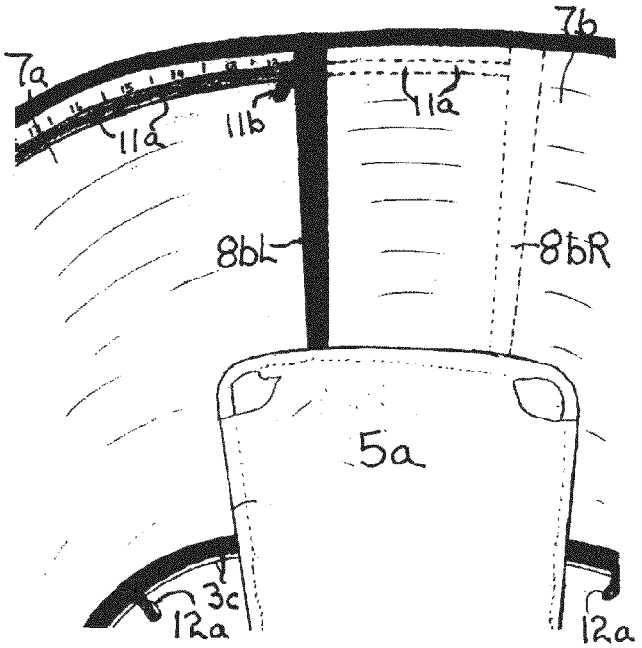
FIG. 12 continues a normal 15 minute setup for a portable, adjustable-size embodiment system. Perspective view showing embodiment system double interlocking sound controlling sidewalls 7*a* and 7*b* from inside of system with symmetrical part-alignment system being used to precisely interlock walls at one of hundreds of specific overlap positions to create a highly-precise adjustable overall size for the system within 1 centimeter (a fraction of an inch) (4 minutes before being fully setup).

FIGS. 11 and 12 are perspective views of the embodiment system with FIG. 11 shown from a back overhead centrally-located position. It may not be illustrated according to relative scale and is facing toward the speakers showing a comprehensive interconnected assembly of acoustic component parts including substantially symmetrically-oriented adjustable specular sound-controlling panel components comprised of a left-side sound-controlling panel component 7*b* and a right-side sound-controlling panel component 7*a* which may be quickly, easily, and substantially expanded or reduced in size and shape. FIG. 12 is an illustration of the same top back part of the embodiment system from about the speaker position facing backward toward the front of an illustrated listener sitting device 5*a* and towards the back portion of essentially the same two interconnected left and right sound-controlling panel components 7*a* and 7*b* illustrated in FIG. 11. As detailed and illustrated, to provide options for recycling component parts, inter-system interchangeability of different component parts among embodiments and variable surround sound control options for the listener, one or more component parts from other embodiments can be added to or left off of the embodiment system. This may include component parts not specifically described or illustrated with the embodiment system.

Sound-controlling panel components, such as sound-controlling panel components 7*a* and 7*b*, can be adjustably precision interconnected at the back top portion such as with a standardized symmetrical part-alignment positioning system including at locations 11*a* and 11*b* illustrated in FIG. 11, and that can be interconnected similarly or differently at the unseen lower or bottom portion including at other suitable locations. The preconfigured symmetrical part-alignment positioning system can be attached to the left and right sound-controlling panel components by way of a simplified low cost fastener assembly, such as an extended length of hook-loop fastener assembly 11*a* and 11*b* in FIGS. 11 and 12, whereby the hook-loop fastener can be offset and opposite attached to respective sound-controlling panel components 7*a* and 7*b* by connecting, fastening, and/or attachment devices, or application methods of various suitable types such as adhesives, rivets, snaps, sewing, and other devices or application methods known to those skilled in the art.

The lower unseen parts of this embodiment system sidewall arrangement 7*a* and 7*b* can also be held together simply by a positioning clip, such as clip 17*d* shown in FIG. 17. Clip 17*d*, which can also be used with sound shapers as discussed elsewhere in this document, when pre-attached at the bottom of one side-wall, allows the other sidewall to simply be dropped into the same clip before the sidewalls are attached together at the top. This then provides an immediate connective devices for the bottom portion of the two panels 7*a* and 7*b* from the convenient user standing position, without the need for direct contact with clip 17*d* or the bottom portion of the two sidewalls 7*a* and 7*b*. Furthermore, if and when the sidewalls are taken apart, they can be unattached at the top first, then one sidewall simply lifted-up out of the same clip 17*d*, again, without the need for direct contact with clip 17*d* or the bottom portion of the two sidewalls.

A symmetrical part-alignment positioning system, if employed, can allow the listener to dependably and reproducibly precision-place and adjust two or more sound-controlling panel components at adjustable standardized points, and then connected, disconnected and reconnected again easily, precisely, and quickly into a plurality of expandable or contractible user-selectable standardized positions. Two or more panel components, such as the two sound-controlling panel components 7*a* and 7*b* in FIG. 12 can be expanded or contracted at-will, and with high precision, using pre-set quick-reference positioning symbols marked on a symmetrical part-alignment positioning system such as the symmetrical part-alignment positioning system 11*a* located on sound-controlling panel component wall 7*a* that successfully allows the listener to position embodiment system component parts at a specific standardized precision-preconfigured size and location. For example, symmetrically-positioned and aligned sound-controlling panel components 7*a* and 7*b* coincide with, and are positioned at, a preconfigured marked location on the floor-positioned symmetrical part-alignment positioning system 3*a* at its quick-reference positioning symbol 3*c* location illustrated in other figures herein using a connecting system 11*a* attached to sound-controlling panel component 7*a* as an enclosure size reference guide thereby allowing the listener and acoustic designer to simply, quickly, and precisely connect the two sound-controlling panel component walls 7*a* and 7*b* together with a precise, dependable, and repeatable accuracy of within 1 centimeter (a fraction of an inch). This accuracy and precision is one of the ways the presented embodiments allow impactful three-dimensional audiophile experiences to be successfully provided to the listener and acoustic designer quickly, easily, inexpensively, and energy-efficiently on a constant, dependable, and repeatable basis.

When the sound-controlling panel component walls 7*a* and 7*b*, for example, are positioned and aligned to the quick-reference positioning symbol 3*c* floor-marked location on the symmetrical part-alignment positioning system, the listener can then securely attach the two panel component walls together at the top of sound-controlling panel component wall 7*a* using the quick-reference positioning symbols marked on the symmetrical part-alignment positioning system 11*a* as a reference location guide, whereby a specific symbol such as the number 12 on the connecting device system 11*a* in FIG. 12 indicates the exact positioning and joining point of the two walls for future replication and to easily communicate this location, and other exact setup configurations, to others. The employed embodiment system can then be quickly expanded or contracted in size using the reference symbols on the connecting device system 11*a* for adjustable listener-controlled surround sound experiences with precise replication, by simple reference to the specific number symbol that indicates the location at which the two sound-controlling panel components are aligned for the convenience and adjustable sound control of the listener.

A connecting, fastening, and/or attachment device, or application method of a suitable type including an attachment and release mechanism such as attachment and release tab 11*b* illustrated on FIG. 12, can be added to simply and securely attach, release and reattach panel component walls, such as sound-controlling panel component walls 7*a* and 7*b* at adjustable interconnection points. Notice in FIG. 12 that the back left vertical edge 8*b*L of panel component wall 7*b* is on the inside portion of the enclosure panel component wall 7*b* (and not on panel component wall 7*a*), with the extended back right vertical edge 8*b*R of sound-controlling panel component wall 7*a* overlapping sound-controlling panel component wall 7*b* on the outside portion of the enclosure. Note in FIGS. 11 and 12 that the two sound-controlling panel component walls 7*a* and 7*b* overlap to allow substantial expansion and contraction to the overall enclosure size of the embodiment system. The symmetrical part-alignment positioning system 11*a* allows the listener to quickly, easily, precisely and dependably set the size of the entire enclosure at a specific preset point within 1 cm (a fraction of an inch). And, once these panel component walls have been attached to each other, they can be kept together and rolled-up together after a listening session is over for fast and easily moving and storage, without disconnecting them. They are then ready to be re-setup in the same position for the next listening session, without having to reconnect the panel component walls together at the respective connective location.

Figure 31:
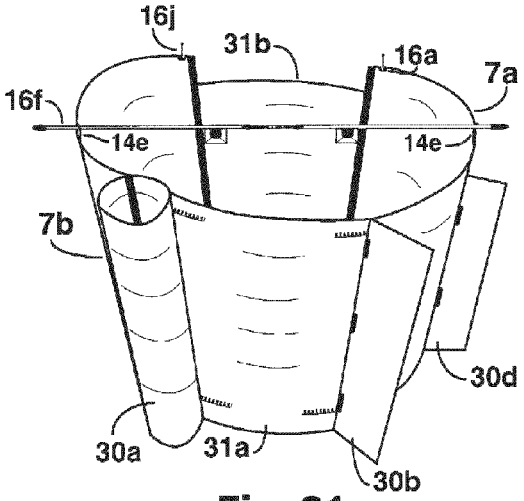
FIG. 31 shows a perspective view showing a portable, fully-operational, adjustable-size 360° embodiment system with interchangeable and an adjustable-sized free-standing open sound controlling sidewalls 7*a* and 7*b* from back and outside of system, with an optional and controversial add-on front-opening panel 31*b* and an optional add-on expansion panel 31*a*.

Additional add-on sound-controlling panel components including sound-controlling front-opening and expansion panel components such as sound-controlling panel components 31*a* and 31*b* in FIG. 31 in accordance with the presented embodiments and their presently-revealed method of application, can also be easily and quickly added the presented embodiments including to the embodiment system and manufactured from the same, or different, sound-controlling materials for that employed embodiment system, using the same manufacturing methods described with these materials. For example, sound-controlling add-on front-opening panel component 31*b*, an example of which is illustrated in FIG. 31 and which adds acoustical control for the indirect sound otherwise directed through that opening, can be a free-standing set-back away from the front opening sound-controlling panel of the main embodiment system structure thereby providing entrance and exit into and out of the embodiment system with minimal movement of the panel component. This panel is a controversial panel because this behind-the-speaker version is thought by some, not all, listeners to reflect out-of-phase and time-distorted behind-the-speaker sound into the embodiment system, however, some versions, including those surfaced with slightly to fully sound diffusing to sound absorbing material do not seem to negatively affect the sound and even slightly improve the sound to some listeners. It can also be more economically-provided as a more specular surfaced sound controlling panel and possibly more acoustically-useful sound controlling panel positioned closer-in, for example, between-the-speakers or toward the employed embodiment system structure, for example, even partially or fully supported by one or more parts of the speakers, speaker stands, or parts of the main embodiment system itself. A front-opening sound-controlling panel component such as this has been found to successfully provide not only added sound control but also slightly enhanced acoustic experiences with suitable software for some listeners, but add-on front-opening panel component 31*b* remains, at this point in time, an optional and controversial add-on panel.

Another add-on sound-controlling panel component such as sound-controlling expansion panel components including the example sound-controlling expansion panel component 31*a* illustrated in FIG. 31 can substantially adjustably expand embodiments simply by opening up two connected sound-controlling panel components where they interconnect such as sound-controlling panel components 7*a* and 7*b* at their respective interconnecting edge locations 8*b*R and 8*b*L shown in FIGS. 11 and 12, expanding the two panel components apart and inserting one or more sound-controlling expansion panel components such as sound-controlling expansion panel component 31*a*. Sound-controlling expansion panel component 31*a*, as with other panel components, can be of made of the same, or different, sound-controlling materials as the main employed embodiment system. Sound-controlling expansion panel component 31*a* can also be the same or different size and can include the same or similar preconfigured quick-reference positioning symbols and connecting device system as the main employed embodiment system.

Specific quick-reference positioning symbols such as those used on the symmetrical part-alignment positioning system 11*a* illustrated in FIGS. 11 and 12 need not be strictly utilized when specifically placing embodiment system components such as sound-controlling panel components into precision or symmetrically-precision positions for use in most embodiment system presented herein. Also, in accordance with the presented embodiments and their presently-revealed method of application, any of the preset quick-reference positioning symbols used on any symmetrical part-alignment positioning system can be changed, used experimentally, or used only as non-conventional general benchmark guides from which to place embodiment system component parts. That is, individual component parts of an embodiment system, including sound-controlling panel components, portions of sound-controlling panel components and entire embodiments themselves, can be, for example, visually positioned into alignment next to specific quick-reference positioning symbols, near to, or far from, any of the lines or symbols used on any symmetrical part-alignment positioning system, thereby only using those quick-reference positioning symbols as a placement reference guide device, whether visual only, by mechanical comparison, with other comparison devices, or a combination thereof, to establish a comparative measurement yardstick or benchmark from which to precisely place one or more embodiment system component parts.

Acoustic placement of embodiment system acoustic components can also be positioned into roughly symmetrical configurations using other suitable devices or application alignment methods. For example, acoustic component alignment can be done by ear or roughly by sight alone. The acoustic results may then vary, sometimes in a surprising way, however important proportional, including symmetrical relationships between component parts can still be easily and quickly maintained.

If panel components such as sound-controlling panel components are interconnected as illustrated in FIGS. 11-12 and 19, it is presently contemplated that this embodiment system employ lengths of the below mentioned 5 cm (2 inch) wide pressure sensitive adhesive backed hook-loop fastener strips as illustrated by hook-loop fastener strips 11*a* and 11*b* in FIGS. 11 and 12 due to their convenient application, extended repeatability and reliable temporary place and release functionality, however two or more independent panel component walls, for example, can be simply and easily also flexibly interconnected together by many different connecting, fastening, and/or attachment devices, or application methods of various suitable types in addition to lengths of hook-loop fastener strips such as fastener strips 11*a* and 11*b*, including the use of clips, clamps, adhesives, sewing, hooks, tape, hangers, snaps, magnets, slidable rivets of various sizes and shapes, etc. to fasten, or connect together panel component walls which also allow user-adjustable movement during setup and use.

As explained previously, additional different sound controlling sizes, shapes, materials, etc. extension, expansion, back, front, and/or overhead positioned panel components, such as sound-controlling acoustic skins may also be adjustably or interchangeably added to or removed from panel components, such as sound-controlling panel component walls 7*a* and 7*b*, and other panel components. For example, an additional set of larger, including substantially higher, acoustic panel components such as sound deading panels 29*b*, FIGS. 19 and 29, can be added for added sound absorbing or sound deadening purposes to significantly reduce nuisance sound leakage outside of the sound-controlling enclosure for the acoustic advantage of nearby non-listeners. This panel 29*b*, and other similar panels, can be utilized and comprised of a number of sound barrier materials. These include 100% recycled highly dimensionally-stable 0.3 cm (0.125 inch) thick triple-wall Enviro-Corr corrugated paper board, that can be parallel vertically cut every 5 cm (2 inches) apart on the back to allow panel component curvature, as detailed with the embodiment system shown in FIG. 20. Such auxiliary sound absorbing or sound deadening panel components such as sound controlling panel 29*b*, can be added close to and outside of the embodiment system sound-controlling panel enclosure components as a free-standing component, or attached directly to embodiment system panel components, such as to the outside of panel component walls 7*a* and 7*b*. This can done using a wide variety of clips, clamps, hooks, slidable rivets, hook and loop fasteners, and other suitable attachment and fastener devices or application methods explained elsewhere in this document as well as those available to those skilled in the art.

FIG. 13 is a perspective view of the left-side of an embodiment system showing one of the associated interrelationship assemblies for different components that can be used on or with embodiments. A sound shaper, such as sound shaper 14*c*, is shown physically attached to a wall-mounted positioning fastener hanger system 15*b*, with an attached symmetrical part-alignment positioning system that can itself also be a part of an overall listener-controlled standardized symmetrical part-alignment positioning system that can be utilized as an entire embodiment system assembly. A sound shaper, such as sound shaper 14*c*, can be generally attached to one or more embodiment system acoustic components including sound shaping and sound-controlling panel components, such as sound-controlling panel component 7*b* including positioning devices, by a number of connecting, fastening, and/or attachment devices, or application methods of various suitable types, including hanger devices, such as slidable left and right user-positionable hook-loop covered wall-mounted positioning fastener hanger systems 15*a* and 15*b*, whereby the sound shaper can be independently, user-adjustably attached and pivoted into a plurality of inclinations, attitudes and angles, placed at different left and right locations and at different up and down elevations using, for example, a complementary attachment and release mechanism such as a hook-loop fastener attachment and release mechanism 14*e* that can be used to attach a sound shaper device, such as the outer perimeter of a sound shaper device, to it by suitable attachment and release methods, along with an optional symmetrical part-alignment positioning system, all three of which are explained in other parts of this document. Note that the listener side of illustrated sound shaper 14*c* is independently attached and supported into an optional horizontally-inclined position by an independent adjustable support mechanism, such as a part adjusting device 16*k*, which allows a side-wall-attached sound shaper 14*c* to be, for example, quickly, easily, independently, adjustably and securely attached and pivoted, inclined including angled such as upwardly or downwardly by a standing, sitting, reclining or lying listener before or during the listening session to test, compare and experience different sound shaper locations, positions, inclinations, angles, etc. and how those different locations, positions, inclinations, angles, etc, comparatively affect the overall surround sound experience for the listener.

The selection of sound shaping and sound-controlling surfaces including specular sound-controlling surfaces available for use with the embodiment system can also include an interchangeable amalgamation of different, even non-dimensionally stable, often very low-cost, lightweight, and often highly recyclable sound-controlling materials used temporarily, adjustably or permanently together on the same sound-controlling embodiment system assembly, whereby a different sound-controlling material can be temporarily or interchangeably attached to or with any of the sound-controlling panel components, such as sound-controlling panel component 7*b* at any sound-controlling location or position as a type of outer sound-controlling acoustic skin, such as an ultra-lightweight but not dimensionally-stable, 61 cm×122 cm (2 foot×4 foot) 8-20 mil thickness aluminum sound-controlling acoustic skin, which itself provides a different reflective acoustic experience that can then be easily and inexpensively obtained when the acoustic skin is simply attached onto the dimensionally-stable substrate construction of the embodiment system at any sound-controlling location using, for example, adjustable, movable, more temporary, or permanent connecting, fastening, and/or attachment devices, or application methods of various suitable types such as adhesives, hook-loop fasteners, hangers, tapes, clips, clamps, hooks, snaps, hook-loop covered positioning hangers (explained later), magnets, slidable rivets and other fastener devices or application methods, etc.

These sound-controlling acoustic skins, which need not be larger than 61 cm×91 cm (2 foot×3 foot) can then be simply rolled up if flexible enough or placed into a protective pouch when not in use for easy handling, transport, and protective storage. The acoustically-advantageous addition of these acoustic skins especially symmetrically applied in a way that the same construction material acoustic skin is positioned on both the left and right sides of the listener at the same mirrored image location, will therefore change, sometimes dramatically, the sound-controlling characteristic of the embodiment system at that specific location. It is noteworthy that adding two or more acoustic skins, such as two identical 12 mil aluminum 61 cm×122 cm (2 foot×4 foot) acoustic skin onto or over the interior reflective surface of any structural component of any embodiment system would allow those exterior aluminum sound-controlling acoustic skins to take on, to become, and to impart the primary sound-controlling surface characteristic of that acoustic skin at that sound-controlling location.

It should be again referenced for acoustic skin placement purposes, that the dominant brain function operates primarily on a horizontal surround sound field basis, with much less emphasis placed upon the vertical plane, therefore the most powerfully-relevant reflective surfaces are located approximately at the horizontal speaker-tweeter-to-listener-ear level, with much less acoustic emphasis above or below that specific horizontal level. Therefore, it is significant to note in accordance with the presented embodiments and their presently-revealed method of application that the addition of different sound-controlling acoustic skins over any surface, even if extended beyond the panel component surface boundaries, can be the primary sound-controlling surface, reflecting, and imparting the primary acoustically-significant characteristic of that particular acoustic skin to the listener from that reflective location. This not only makes the acoustic skin the dominate reflector at that location but substantially subjugates the dimensionally-stable undersurface material that these sound-controlling acoustic skins cover into becoming simply a support structure. This is illustrated in FIG. 13 where a sound-controlling acoustic skin 13*c* is shown adjustably attached to sound-controlling panel component 7*b* by way of a connecting, fastening, and/or other attachment device, or application method of a suitable type including hanger devices such as user-positionable hook-loop covered positioning hanger 15*a* at two locations where complementary fasteners, such as opposite hook-loop fasteners 14*e*, have been applied to the back and/or top of acoustic skin 13*c* by various devices or application methods, thereby not only holding the acoustic skin into close position against the sound-controlling sidewall 7*b* but also allowing the acoustic skin to easily conform to the curved shape of the sidewall, where necessary, simply by sliding the two slidable hook-loop covered positioning hangars 15*a* toward each other.

Note the acoustic skin that is attached by a connecting, fastening, and/or attachment device, or application method of a suitable type including positioning devices, for example, by hook-loop covered positioning hangers 15*a* can be easily slidable to the left or to the right into any horizontal position around the listener individually or in tandem simply by moving the positioning hangers along the top surface of a sidewall panel component such as sidewall panel component 7*b*, thereby allowing the attached acoustic skin to be positioned almost anywhere along the surface of the sidewall panel component without it also interfering with other panel components, acoustic skins, or positioning hangers, such as positioning hanger system 15*b* which can also be comprised of hook-loop covered hangers. This means that other positioning hangers that provide support, for example, for an embodiment system sound shaping, sound-controlling device, such as sound shaper 14*c*, can also be positioned at almost any location without obstruction and without interference from added acoustic skin(s), even though the added acoustic skin(s) can be located at or near to the same general location as shown in FIG. 13, which is shown as directly behind a sound shaper 14*c* and in front of the sound-controlling panel component 7*b*.

In addition to using acoustic skins, acoustic adjustments to the localized surround sound field can also be provided by coordinating the use of a selection of one or more interchangeable embodiment system sound shaping, sound-controlling devices such as the embodiment system sound shapers illustrated in FIG. 14; overhead sound-controlling panel components such as overhead panel components 29*a* illustrated in FIG. 29; outer sound-controlling panel components such as outer panel component 29*b* illustrated in FIGS. 19 and 29; as well as a variety of panel extenders illustrated by panel component extenders 30*b*, 30*c*, and 30*d* in FIG. 30; that can be used alone or coordinated with the other flexible panel components into a variety of listener-controllable highly-adjustable embodiment system structures.

Embodiment system sound shaping, sound-controlling devices, including sound shapers, acoustic skins, and acoustic extenders can be manufactured from extremely-lightweight, rigid, dimensionally-stable, highly dent and crush resistant, easily cleanable materials, including most plastic materials that can also be optionally printable and optionally usable on one or both sides and material substrates that can be made to be flexible at various suitable locations, as detailed with the following embodiments. They can be sized and shaped to easily fit many different embodiment system panel component listening room space locations and can be manufactured into a variety of shapes, contours, thicknesses, and sizes that are furniture and accident-friendly, inexpensive, and that can generally be easy to die-cut, score, shape, cut, attach fasteners to, and fabricate, including sewing by various devices or application methods.

Embodiment system sound shaping, sound-controlling devices can be made from many different structural and acoustic materials and include being one or more connected parts of the basic sound-controlling embodiment system structural boundary sidewalls, with different acoustic surfaces or coverings. The devices can have one or more different sound-controlling characteristics including sound reflective, sound diffusing, sound absorbing and/or sound barrier materials and surfaces on one or both sides, and combinations thereof, in order to provide substantially high acoustic-variable sound control, increased number of surround sound performance options, and flexible embodiment system sound shaping, sound-controlling device positioning options for the listener.

Interior and exterior panel strengthening devices including those detailed above as well as a top or bottom positioned extended metal "U" bracket 13*g* which is a length of metal prefabricated into a "U" shape 2.5 cm to 5 cm (1-2 inches) wide and extending up or down to the height of sound controlling wall panel 7*b* in FIG. 13 positioned on both sides of wall panel 7*b* and fastened it to or though the wall by various devices at different stress points on the wall panel to strengthen and structurally support wall 7*b* at one or more locations where weighted components of various types explained throughout this document hanging on or from the said wall can add stress to a lightweight sound controlling sidewall like wall panel 7*b*.

Additional adjustable exterior connecting, fastening, positioning, and/or attachment devices can also be added such as overhead drop-down strap fastener support devices comprising adjustable flexible straps, cords, wires, strings, extended lengths of hook-loop fasteners, like strap support 13*d*. Strap support 13*d* is comprised of a flexible strap material such as polyester or nylon with one or more connective fasteners such as hook-loop fasteners attached on it or at each one or both ends to connectively attach to and position one or more sound controlling components such as sound shaper 14*c* thereby using wall panel 7*a* to support the full weight of the sound shaper by being attached to opposite edges of sound shaper 14*c*. Using a quick, easy, and inexpensive strap support device like strap support 13*d* also frees-up floor space near to the listener by not needing the use of floor support devices such as telescoping part adjusting device 16*k* and is one of the many ways shown and detailed in this document to adjustably position exterior connecting devices such as sound shapers. Part positioning flexible cantilevered angle bracket 13*e* is yet another method for independently flexibly supporting the same sound controlling components and other side wall attached devices detailed throughout this document such as sound shaper 14*c* into a number of vertical to horizontal angled and extended positions.

FIG. 14 shows an assortment of smaller independent and optionally listener-adjustable combination left and right-side embodiment system sound shaping, sound-controlling sound shapers which may or may not be included with the embodiment system. These can be manufactured and comprised of a specular sound-controlling reflective surface on one or both sides. However, sound shapers with this embodiment system can also be fully or partially manufactured and comprised of other lightweight sound-controlling surfaces including sound-controlling diffusing, absorbing, and/or barrier surfaces, which also can be dimensionally flat, curved, including flexible, which can be adjustably attached and movable to many locations on one or more sound-controlling panel components for example sound-controlling sidewall panel components such as vertical sound-controlling sidewall panel components 7*a* and 7*b* using an assortment of connecting, fastening, and/or attachment devices, or application methods of various suitable types described elsewhere in this document and that include hook-loop fasteners such as hook-loop extension connecting devices 14*e* and 14*f*.

These embodiment system sound shaping, sound-controlling sound shapers can be placed anywhere including on any embodiment system panel component, including on the top or side of an embodiment system panel component or sidewall in order, for example, to efficiently and effectively extend the sound-controlling area, height or width of that panel component and/or a combination thereof. Sound shapers can also be easily adjusted by the listener in order to suit the listener's adjustable sound control needs and acoustic preferences. For example, in addition to the many ways mentioned throughout this document, sound shapers can also utilize slidable connective part positioning devices such as telescoping part adjusting devices such as 16*j* and 16*k* and positioning hangers 15*a* or 15*b*, detailed elsewhere in this document and illustrated in FIGS. 15-17. Also, clip devices such as slidable hook-loop fastener clip-on device 17*d* can be utilized for it many benefits. Slidable hook-loop fastener clip-on device 17*d* in FIG. 17 is a hook-loop outside-covered plastic clip, typically from 2.5 cm to 7.5 cm (1 to 3 inches) in length and width that simply slips on or clips onto sound controlling side wall and sound shaping components at almost any location horizontally and vertically on those parts, therefore, allowing these parts be adjustably slidably-connected to other parts using their open clip, or their hook-loop locations for slidable-free movement between the connected parts. This connection also provides a pivotal hook-loop hinge connection (described elsewhere) at those slidable locations for greatly expanded flexible connections for extended adjustable-angled sound shaping and acoustic control, thereby providing adjustable acoustic experiences with the same or other acoustic structure.

The vertical height, inclination, and angle of these embodiment system sound shapers can, for example, be increased, decreased, set into a fixed position and easily adjusted during use by various components and devices including hook-loop strips, and other devices explained in this document.

It is generally acoustically advantageous to utilize the same size embodiment system sound shaping, sound-controlling devices including sound shapers, acoustic extenders, and acoustic skins positioned symmetrically at the same left and right locations on opposite sides of a sound-controlling enclosure with respect to a quick-reference part positioning center symbol such as a quick-reference positioning symbol centerline 3*g*. Also it is generally advantageous to position and angle the embodiments' sound shaping, sound-controlling devices such as sound shapers and acoustic extenders approximately equidistant from the listener's location and equidistant from speaker locations in a mirror image arrangement as described and illustrated throughout this document. One or more embodiment system sound shaping, sound-controlling devices, such as sound shapers 14*a*, through 14*d*, FIG. 14 can be shaped and attached with connecting, fastening, and/or attachment devices, or application methods of various suitable types, such as hook-loop extension connecting devices 14*e* and 14*f* which can be located on one or both sides of the panel component, that allow sound-controlling devices such as sound shapers to be interchangeably and fully-functionally utilized on both sides of the sound shaper. That is during use, sound-controlling devices such as sound shapers can be used on both sides and be physically turned 180° including turned over and used at the same location or different locations, interchangeably, for one or more purposes, on both left and right-sides of an enclosure and used both above, at and below the listener's ears, adjustably listener-positionable with no placement restrictions for use on or with any sound-controlling panel component. They can be adjustably attached to the panel component or they can be adjustably attached to attachment devices that are adjustably or permanently attached to the panel component. Extension and connecting devices, such as extension connecting devices 14*e* and 14*f*, illustrated in FIGS. 13, 14, 18, and 21 of this document, which can be comprised of an extended length of double-sided hook-loop strap material, permit the adjustable attachment, detachment and flexible positioning of a variety of sizes and shapes of embodiment system sound shaping, sound-controlling devices panel components and sound shapers. For example, extension connecting devices such as hook-loop extension connecting device 14*f* in FIG. 14 permits a larger sound shaper to be positioned into a small tight corner that it normally would be too large to fit into within a smaller sized acoustic enclosure setup by allowing an extend gap between connecting panel components. This permits a sound shaper to "float" away from a sound-controlling sidewall surface at various angles, held at its floating location by attaching one or more extension connecting devices such as hook-loop connecting device 14*f* to one end of the sound shaper and the other end of the hook-loop connecting device to a hook-loop location, for example, on one of the sound-controlling sidewalls.

If an environmentally-sustainable lightweight dimensionally-stable acoustic material is utilized to manufacture embodiment system sound shaping, sound-controlling devices such as sound shapers and acoustic extenders that are recyclable and environmentally-responsibly produced, it is presently contemplated that this embodiment system employ the same recycled component material and component material thicknesses as used to fabricate the sound-controlling side walls due to material and acoustic efficiencies, manufacturing waste considerations, structural dimensional stability, excellent sound-controlling properties, light weight properties, impact resistance, durability, aesthetic matching of components within the same embodiment system, and environmental sustainability composition. However, one or more sound shapers used in the same embodiment system can be comprised of different materials, with different properties, including different sound-controlling and/or structural properties, and they can be manufactured from one or more materials with different stiffness, thickness, flexibility including material recycling properties, or a combination thereof.

They can easily and economically be cut out and processed in the same fashion as other embodiment system sound shaping, sound-controlling devices as detailed above, and they can be sized and shaped to easily fit many different panel locations with consideration given for responsible manufacturing practices, including maximum square footage yield utility and the least material waste of the panel or sheet they are processed from. Also, as mentioned, embodiment system sound shaping, sound-controlling devices such as sound shapers can be comprised from many different structural and acoustic materials, with different acoustic surfaces or coverings, and with one or more different sound-controlling characteristics to allow the listener maximum sound shaping and sound-controlling flexibility, including opaque, translucent, or transparent materials such as 0.3 cm (0.125 inch) polystyrene, rigid polyvinyl chloride, or acrylic polymers. These embodiment system sound shaping, sound-controlling devices can also be manufactured from recycled paper or plastic like light-weight corrugated paperboard or polypropylene panels including prior mentioned 100% recycled 0.3 cm (0.125 inch) thick Enviro-Corr, single or multi-layer plastic including multi-layer polypropylene or polycarbonate, metal materials such as thin aluminum sheeting including 3 mm Graphical multi-layer tri-ply aluminum composite panel made by Mitsubishi Plastics Composites America, Inc., honeycomb board such as 5 mm Stinger honeycomb board from Coroplast, Inc., 4 mm recycled corrugated polypropylene, paper covered foam board or made from acoustic skins materials fully-described elsewhere in this document.

Dimensionally unstable or flexible embodiment system sound shaping, sound-controlling devices, such as flexible sound shaper 14*d* in FIG. 14 can be made with the same above-mentioned materials, methods and environmentally-sustainable considerations and can utilize the same structural stiffening including reinforcing tools such as detailed and illustrated with the embodiment system shown in FIG. 20 to make them flexible at flexible locations such as flexible locations 14*g* on sound shaper 14*d*. Generally speaking, the edges of sound shapers, instead of being sharp cornered, can be organically shaped, sculptured, or curved to both complement the shape of the panel components they are normally attached to, and so as not to catch on clothing or, for example, cause potential harm to equipment, to other sound shaping devices, to the listener, or to domestic furniture, etc., if adversely utilized.

For these reasons, and because these sound-controlling panel components are being moved around a lot, they are generally designed to be thin and ultra-lightweight as well, utilizing the more thin and lightweight sound-controlling materials described above and elsewhere in this document. They also can be manufactured in several different sizes to allow the different sizes to strategically fit at strategic embodiment system locations which are more fully explained and illustrated with FIGS. 13, 18, and 19 as well as with other embodiments presented here. For example, larger sound-controlling devices, such as sound shaper 14*c* can not only fit well with the sidewall angles of the embodiment system, but also, because they are slightly wider, they can also be utilized as an upper sound-controlling panel component, such as for a sound shaper at location 14*c* illustrated in FIGS. 18 and 19, whereby, because of their wider width, they can allow a part adjusting device such as part adjusting device 16*j*, to be utilized for both a upper and a lower sound shaper simultaneously without the part adjusting device having to be substantially angled off the vertical to catch the underneath side of an upper wider embodiment system sound-controlling device such as sound shaper 14*c*, as illustrated in FIG. 18.

Embodiment system sound-controlling devices, including sound shapers and acoustic skins, used with this embodiment system, in addition to being manufactured from the same acoustic component materials as the base sound-controlling structure of the embodiment system described herein, including those sound-controlling materials, substrates, and surfaces that comprise its sound-controlling wall panel components, etc. can also be fully or partially manufactured from, or usable with, other materials, substrates, objects, and devices that can also be used for other dual purposes, but which may provide partial acoustic sound-controlling characteristics. For example, a self-supporting sound-controlling horizontal planar device with legs that can also have height adjustment options and that can be supplementally dual-purpose used as a horizontal table device for operational controls, work space, beverages, personal items, etc. can also be optionally used as a dual-purpose below-the-ear embodiment system sound-controlling sound shaper so long as they are used in same-size symmetrical pairs on each side of the listener. However, although these and other auxiliary devices can provide variable acoustic and other general utility, many of the problem solving solutions, acoustic advantages, industry provisions, and positive overall listening experience improvements are not provided by their use and their example here is only to highlight their secondary use with an employed embodiment system.

Remembering that left and right symmetry of sound-controlling embodiments is normally rewarded by superior surround sound field reproduction for the listener, multiple different sized and shaped acoustic extenders including additional sound shapers can be used, for example in the same general location above and/or below ear level, to help immediately extend, shape, direct, and custom control, both incrementally and fluidly, not only larger portions of indirect sound but indirect sound shaped, directed and custom-focused toward the listener from a larger number and from more complex angles and directions simultaneously. These extended sound shaper and/or acoustic extender provisions are immediately obtained by the listener simply by the listener laying or gravity positioning one or more acoustic extenders, and/or sound shapers used as acoustic extenders, on top of one another and sliding them to one side or the other to immediately and effectively increase the total sound-controlling surface area at that or other angles, inclinations, and/or elevations without the listener having to physically attach these acoustic extenders, including sound shapers used as acoustic extenders, to any part as illustrated in FIGS. 18 and 19. Multiple different shapes, sizes, and reflectivity variations of sound-controlling acoustic extender, sound shaper, including acoustic skin, panel components, materials, and surfaces can be interchanged quite easily, efficiently, and effectively at one or more positions and locations around the employed embodiment system. As noted in FIGS. 18 and 19, often no supplemental stabilizing or attachment devices are required to help stabilize these extra non-attached sound-controlling components, although supplemental adjusting or connecting devices can be additionally needed due to gravity or structural issues when one or more acoustic extenders including sound shapers are cantilever-extended beyond their middle section without supplemental positional support. The result of utilizing these acoustic extenders including sound shapers in this non-attached fashion is that they allow immediate, incremental, and extremely fluid sound shaping control abilities and opportunities for the listener for simplified, fast, precise, cost efficient, and optionally symmetrical listener experimentation, without the need to connect or disconnect these additional acoustic extenders including sound shapers for macro or micro adjustment or movement to different positions and locations.

Variations of different positions and adjustable angles of the added sound shapers including sound extenders by the listener are also very easy to do, for example, angling sound shaper 14*a* in FIG. 18 so that it's pointed out toward the listener location, or placed at an angle such as a 45° angle, instead of being horizontally placed and aligned along the wall at its present illustrated position. As many as four or more sound shapers and below-explained acoustic extenders can be placed on top of a single supported sound shaper at any one location, all aimed at different angles and in different directions but simultaneously equally positioned on both left and right sides of the employed embodiment system for acoustic symmetry and to allow the listener to control, adjust, and experiment with the surround sound field at will for specific stereo audio signal presentations.

FIG. 15 shows slidable positioning hanger devices, such as lengths of listener-positionable 1.3 cm to 5 cm (0.50 inch to 2 inches) wide hook-loop covered slidable positioning hangers 15*a* which can be approx. 2.5 cm (1 inch) wide, and 15*b* which can be approx. 5 cm (2 inches) wide) that are also described and mentioned elsewhere in this document and which can be sustainably manufactured of the same type of materials including stiffening or reinforcing tools explained with the embodiment system shown in FIG. 20 for manufacturing flexible bend locations, including an assortment of semi-flexible to rigid materials, for example 1.3 cm to 5 cm (0.50 inch to 2 inches) wide normally left over "drop" lengths of 4 mm or 6 mm 100% recycled plastic corrugated panel component remnants with edges that can be industrially-sewn or covered with a protective edging such as a flexible edge channel including the flexible edge channels used. Positioning hanger devices such as slidable positioning hanger devices 15*a* and 15*b* can also be made out of many additional materials, thicknesses.

The attachment side or usable surface can then be partially or fully edged or covered with a connecting, fastening, and/or attachment device, or application method of a suitable type such as lengths of pressure sensitive adhesive backed hook-loop fastener. One or more bends 15*c* can also be suitably placed into one or both ends of the positioning hanger as a primary or supplemental top-of-sidewall connecting or attachment application method. Symmetrical part-alignment positioning system components with their quick-reference positioning symbols can also be added to positioning hanger devices, which has been done to slidable positioning hanger device 15*b*, FIG. 15. They can also be used themselves as symmetrical part-alignment positioning system components with quick-reference positioning symbols imprinted or otherwise suitable-attached onto or into them.

The positioning hanger can then be simply gravity hung by the bent or curved end and suitably positioning onto the top of one of the embodiment system sidewall panel components such as sound-controlling panel components 7*a* and 7*b*, or suitably and adjustably attached to or from other objects. One or more other items such as sound shapers, acoustic skins, and non-system objects such as interactive devices, assistance items and personal items, can then be flexibly and adjustably attached to these positioning hangers at any location or angle, while different items can be adjustably-attached on the same positioning hanger at different angles and locations. That is, these positioning hangers allow one or more of the attached items, such as one or more sound shapers or other objects, to be adjustably positioned to these positioning hangers, allowing these attached items to be positioned, with or without the aid of a standardized symmetrical part-alignment positioning system, at different locations anywhere horizontally to vertically along the side(s) of supporting embodiment system wall panel components, thereby allowing the adjustable positioning of these items at any position, height, angle or location, inside of, outside of, on or along any panel component including an embodiment system sidewall such as sound-controlling sidewall 7*b*, or any other panel component or structure.

Once attached in place, the attached items can then be easily and adjustably moved, such as to test different locational acoustic-related effects, simply by disconnecting a sound shaper, for example, from one location on one of the positioning hangers such as positioning hangers 15*a* or 15*b* and reconnecting the sound shaper to a different location on the same or different positioning hanger as illustrated in FIG. 13 at locations 14*e*, and as shown in FIG. 18. The sound shaper panel components, or other items attached to these positioning hangers, can also then be easily and adjustably moved horizontally left or horizontally right along the sound-controlling panel component walls, for example, simply by moving the positioning hangers while these items continue to remain attached to the positioning hangers, (without having to disconnect the items from the positioning hangers), that is, simply by moving the positioning hanger(s) and the items attached to them left or right along the top edge of an embodiment system sidewall, such has along the top edge of sound-controlling sidewall 7*b*. This horizontal left or right adjustable movement can be carried-out with one or a set of item-connected positioning hangers without the positioning hangers or the items attached to them interfering with other sound shapers, acoustic skins or other objects attached to other positioning hangers located on that same wall, such as illustrated in FIG. 13 with sound shaper 14*c*, acoustic skin 13*c* and positioning hanger systems 15*a* and 15*b*.

It should be noted here that the shape, size and sound-controlling surface quality of all sound shapers, as mentioned elsewhere in this document, can be manufactured to be suitably variable to be placed at adjustable locations and angles and to be interchangeable with other embodiment system sound control devices depending on a plurality of acoustic-related realities. These realities include the acoustic characteristics of the listener's sound system such as whether it is on the bright side or on the warm side, the type, quality, and position of stereo encoded surround sounds contained within the sound reproduction signals, the quality of the encoded surround sound field, the playback speakers used, the listener's sound control preferences, the size of the sound-controlling enclosure with a smaller enclosure usually only needing the assistance of smaller sound shaping, acoustic skin, and acoustic extender devices such as illustrated sound shaping device 14*a*, etc.

FIGS. 16-18, including FIG. 13, are described here to illustrate several components specifically detailed previously in FIGS. 16 and 17, and how they can operate with and for other components detailed and explained elsewhere in this document. FIGS. 16 and 17 show three different types of telescoping part adjusting devices with FIG. 17 illustrating a close-up of significant parts of these three telescoping part adjusting devices which can be manufactured out of the same materials and in the same fashion as described in the embodiment system shown in FIG. 20 with part adjusting device 21S, the only essential difference between part adjusting device 21S specifically illustrated in FIG. 20 and telescoping part adjusting devices illustrated in FIGS. 16 and 17, is the fact that part adjusting device 21S is comprised of a single non-telescoping rod or tube whereas the three devices illustrated on FIGS. 16 and 17 are all shown as telescoping tube and/or telescoping rod-type part adjusting devices.

It is helpful to note that the reason part adjusting device 21S may not need to be a telescoping device with the embodiment system shown in FIG. 20 is because part adjusting device 21S is not needed, for example, to adjust anything higher in elevation than a lower-than-ear-level positioned sound shaper like sound shaper 14*c*, which is shown in FIGS. 13 and 21 as an adjustable lower-than-ear-level sound-controlling device. Some higher in vertical elevation and higher than ear-level adjustable devices, for example, flexible and adjustable sound-controlling panel components F, E and D shown in FIG. 20, because they are self-supporting, do not need a support positioning system, such as telescoping part adjusting devices including telescoping part adjusting devices, to help support or position them in extended, angled, or horizontal positions. Telescoping part adjusting devices shown on FIGS. 16 and 17, however, can be utilized in a plurally of applications with many of the presented embodiments.

The lower part 16*i* of telescoping part adjusting device 16*k* shown on FIGS. 16 and 17 along with the double layer of hook-loop fastener strip 16*b*, can be utilized in the same fashion as shown with, and explained with, part adjusting device 21S and hook-loop fastener strip 16*b* with the embodiment system shown in FIG. 20 whereby the lower tube portion 16*i* and hook-loop fastener strip 16*b* can be used to attach to and adjustably support the inside portion (the side closest to the listener) of a lower-than-ear-level extended sound shaper at any sound shaper angle, such as sound shaper 14*a* or 14*b* illustrated in FIGS. 18 and 19.

The extension end of upper telescoping legs of telescoping part adjusting devices such as the upper telescoping legs 16*h* of telescoping part adjusting devices 16*j* and 16*k* can adjustably extend upward to also easily, inexpensively, safely, and adjustably support a higher-than-ear-level upper-positioned and horizontally-extended sound shaper at any location or angle on the underneath side of the upper positioned sound shaper with a soft non-damaging rubbery-like cap such as molded soft rubber cap 16*d* that can be attached to the extended end of these part adjusting devices. Note that upper end of the telescoping part adjusting devices need not be physically attached to the underside of the sound shaper but can simply hold an extended device, such as an extended sound shaper 14*e* illustrated in FIG. 18, into an extended horizontal position by gravity, with the horizontally extended device simply resting on top of cap 16*d*, FIG. 17, thereby allowing sound shaper and the part adjusting device to be quickly and easily repositioned simply by sliding the cap 16*d* along the underneath side of the sound shaper to any location while the part adjusting device and the sound shaper are being adjusted into different positions and angles. This non-attached, slidable action advantageously avoids the listener having to physically detach or reattach anything in order to change sound controlling part positions like adjusting or repositioning a sound shaper. Simply moving the part adjusting device the cap fits over, such as one of the legs of a telescoping part adjustment device 16*j* or 16*k* by, for example, simply pushing it in one direction will cause an immediate connective positional change in the sound shaper the user quickly understands and uses to modify and incrementally change micro details within the sound immersion picture surrounding him or her. Using this non-connective gravity method allows the fluid use of simple gravity to hold the upper extended portion of a horizontally-extended sound shaper in one of many positions.

The advantage of using a non-connective cap method over the hook-loop connective method for supporting, for example, an upper horizontally-extended sound shaper is that, even though the connective hook and loop method provides a more secure connection, the hook-loop connective method is provided without the slidable, fluid, and connection-free movement of using only a slidable non-connectively-attached cap such as soft rubber cap 16*d* to gravity support, for example, the underneath side of an upper, higher-than-ear-level, horizontally-extended sound shaper 14*c* in any number of quick and easy position-changing elevations and angles simply by moving the extension leg, without having to disconnect and reconnect anything. Therefore, even though the non-connective method is less secure, because the upper part, in this case the upper horizontally-extended sound shaper, is also normally either a part of or physically securely connected on its other side at one or more places to the sound-controlling panel component as illustrated in FIG. 18, the need for additional connective attachment security is thereby reduced. The result is that using the non-connective gravity method is one of the embodiment system presently-revealed methods available to allow faster part adjustments due to its not being hook-loop or otherwise more securely connected to the upper positioned device, therefore using the non-connective gravity method successfully provides the faster changing of part positions, thereby the faster changing of acoustic experiences for the listener and acoustic designer, without a high cost and without a substantial or needless loss of connective security.

Additionally, if a top cap such as molded cap 16*d*, as mentioned above, is connectively fasten-attached to the top of a telescoping part adjusting device 16*j* or 16*k*, and non-connectively used to exclusively support (instead of, for example, using a connective hook-loop fastener 16*a*) a horizontally-extended upper-located sound control component, such as when the cap 16*d* is in non-connective contact with the underneath portion of an upper, above-the-ears-located sound shaper, the stationary and controlling pivot point for part adjusting device 16*j* or 16*k* is conveniently and advantageously located at the lower sound shaper attachment point of the component—at the hook-loop fastener attachment component location point 16*b* in FIG. 18, which is located substantially lower, nearer, and immediately next to the listener. This advantageously allows, and encourages, the listener to quickly, easily, and conveniently move and adjust both upper and lower sound shapers, acoustic extenders, and the part adjusting device 16*j* or 16*k* into different positions and angles with minimal loss of stability to the part adjusting device 16*j* or 16*k* or multiple sound shapers, even when the part adjusting device 16*j* or 16*k* can be angled at substantially off-vertical angles. Many times one simple movement in one direction by the controlling telescoping part adjusting device 16*j* or 16*k* from near to this above mentioned controlling pivot point provides adjustably different angles and positioning movement to both upper and lower sound shapers and any acoustic extenders positioned by or with them. This significantly encourages listener involvement, positive listener interaction, and immediate acoustic feedback with the sound experience immediately surrounding him or her. This simple connective action thereby substantially simplifies and speeds-up adjustable moves of the part adjusting devices and extended devices like sound shapers into a substantial plurality of optional listener-adjustable incremental locations, positions and angles quickly, easily, dependably, safely, and inexpensively.

Extension legs on part adjusting devices including legs of telescoping or non telescoping part adjusting devices such as 16*j* 16*k*, and 16*f*, for example, and legs on other embodiment system part adjusting devices, can include one or more of the same or different part connectors. These part connectors can include, in addition to the above mentioned hook-loop fastener strip 16*b*, other user-slidable and/or locking connector devices such as user-slidable and locking cord-lock fastener 17*m* shown in FIG. 17.

The hook-loop fastener strip 16*a* attached to an upper extension leg such as upper extension leg 16*h*, illustrated in FIGS. 16 and 17 is a lightweight, safe-to-nearby-objects, and inexpensive slidable attachment devices that can be comprised of the same hook-loop material, manufactured in the same way, and function in the same way, as hook-loop fastener strip 16*b*, with the only difference that hook-loop fastener strip 16*a* is made to fit smaller diameter upper telescoping tubes used to attach to larger, upper, and extended devices such as an upper, higher-than-ear-level, horizontally-extended sound shaper 14*c*, whereas hook-loop fastener strip 16*b* generally attaches to larger diameter, lower telescoping tubes, and lower-than-ear-level extended devices such as an extended lower-positioned sound shaper 14*b* illustrated in FIG. 18. Extension and fastener strips can be also be easily replaced by many other suitable extension and connective fastener devices known to those skilled in the art.

Among the many overhead part connection, support, and position adjustment devices and methods of operation options available for an upper, higher-than-ear-level, horizontally-extended sound shaper include either using the slidable hook-loop fastener strip 16*a* or the slidable and locking cord-lock fastener 17*m*, both of which can attach to an upper extension such as upper tubular extension leg 16*h* illustrated in FIG. 17. Both part adjusting devices 16*a* and 16*b* can physically hook-loop connect to the outside extended portion of a wall-attached cantilevered sound control device such as a horizontally-extended sound shaper such as those illustrated in FIG. 18.

Other additional adjustable part connectors for part adjusting devices include part connecting devices such as hook-loop extension devices. These include a hook-loop extension connecting device 14*f* which can be used to adjustably extend the connection, for example, between any horizontally-extended sound shaper and a sound-controlling panel component such as sound-controlling panel component 7*a* using available hook-loop connections on those parts as illustrated in FIG. 18. Using an extended fastener arrangement such as extension connecting device 14*f* successfully provides improved positioning flexibility between moving, flexible, adjustable-sized, and different shaped parts as well as a more stabilized and secure sound shaper.

An overhead adjustment device such as overhead cross-part adjusting device 16*f* with a center-located symmetrical part-alignment positioning system 16*g*, can be manufactured out of the same materials, the same size of materials and in the same fashion as the other adjustment devices illustrated on FIGS. 16 and 17, for example using an outer tube constructed of a rigid structural tubular material such as nylon 6, glass-filled nylon, reinforced fiberglass, carbon-fiber composite and lightweight aluminum with an inner diameter slightly smaller than the outer diameter of the inner tube or rod that is used for the telescoping mechanism. For example, for a two-diameter telescoping device, using an inner diameter of approximately 0.75 cm (0.296 inch) for the outer tube and an outer diameter of approximately 0.74 cm (0.291 inch for the inner diameter rod or device in order to leave space for the telescoping mechanism to easily slide without constriction. For a two-diameter telescoping device, the length of the inner extension device rod or tube 16*h* should be no longer than the length of the outer adjusting device tube, and the length of the outer tube such as outer tube 16*i* can be approximately 32 inches long for adjusting devices 16*j* and 16*k*, and the length of a cross-part adjusting device such as cross-part adjusting device 16*f* illustrated on FIGS. 16, 17, 26, 28 and 29 can be adjustably-extendable to approximately 2.4 m (8 feet) for a two-diameter telescoping device and approximately 3.6 m (12 feet) for a three-diameter telescoping device, both of which would also provide a convenient collapsed storage and transport size of approximately 1.2 m (4 feet). This collapsible size also allows convenient storage attachment to a sidewall, such as sizewall 71 or 7*b*.

The addition of incrementally-adjustable pre-marked quick-reference positioning symbols including quick-reference positioning symbol lines and numbers, as illustrated on cross-part adjusting device 16*f* on its symmetrical part-alignment positioning system 16*g* in FIG. 17, other symbols can also be added to the exterior surface of the interior rod or tube of embodiment system adjustment devices to allow easily positioning and adjustable precision reference points that can be used and reused with these adjustment devices. The addition of fasteners including connective fasteners such as hook-loop fastener 16*a*, to one or both ends of cross-part adjusting device 16*f*, as shown in FIG. 16, will allow this device to adjustably, functionally and mechanically attach the cross-part adjusting device 16*f* to sound control devices like sound-controlling panel components, embodiment system sidewalls, and sound shapers so that these devices can be precisely and adjustably cooperatively positioned and stabilized into even highly-angled coordinated symmetrical positions and to provide overhead support for added panel components, such as overhead sound-controlling panel components such as overhead panel components 29*a* illustrated in FIG. 29 that can be placed on top of the cross-part adjusting device 16*f* once it is placed into position such as between two or more opposite embodiment system sidewall panel components; and outer sound-controlling panel components such as outer panel component 29*b* illustrated in FIG. 29, that can be placed outside and/or surrounding one or more sides of the main embodiment system.

End caps, such as bottom end caps 16*e*, can be comprised of rubber, soft polyvinyl chloride, or silicone, for example, can be attached to the bottom end of the part adjusting devices, such as part adjusting devices 16*j* and 16*k* and attached to each end of telescoping cross-part adjusting device 16*f*. When attached to the bottom of part adjusting devices like part adjusting devices 16*j* and 16*f*, these soft bottom-positioned caps help part adjusting devices maintain a stabilized extended upright mostly-vertical position when they are placed onto a variety of dissimilar floor surfaces and held into their mostly vertical position on these dissimilar surfaces even when the part adjusting device can be positioned into a plurality of substantially non-vertical angles.

Also, note that when one part adjusting device, such as when one part adjusting device 16*j* or 16*k* is used to support two or more sound control components such as sound shapers 14*c* or 14*b*, at both upper and lower sound shaper locations illustrated in FIG. 18, that the functional positioning and controlling of the part adjusting device 16*j* or 16*k* is substantially and advantageously increased because of the added weight put on the one part adjusting device 16*j* or 16*k* and from the two different contact locations to that part adjusting device 16*j* or 16*k* from two differently-located upper and lower sound shapers 14*c* or 14*b*. This added weight and additional contact points from the other sound shapers supported by a single part adjusting device 16*j* or 16*k* successfully helps to position and stabilize the entire assembly structure, including the part adjusting device itself that has been positioned at a given location. This may be most helpful to a single part adjusting device 16*j* or 16*k* when the part adjusting device needs to be positioned into substantially non-vertical angles and when the bottom of the part adjusting device 16*j* or 16*k* is placed onto substantially dissimilar floor surfaces, while the same time, increasing, sometimes substantially, the stability to the multiple sound control components, for example sound shapers 14*c* or 14*b*, that are in contact with the part adjusting device 16*j* or 16*k*.

Telescoping part connecting end cap component 16*c* in FIG. 17 fastens over the outer larger telescoping leg of telescoping part adjusting devices, interconnecting the inner 16*h* and outer 16*i* telescoping legs of the same part adjusting device 16*j*, 16*k*, 16*f*, and other similar lightweight connective parts. It is designed as a lightweight, listener interactive, and non-delay adjustment mechanism for two lightweight legs of a lightweight telescoping assembly. It holds and provides easy and repeatable adjustments to, for example, an upper lightweight sound shaper holding it into any number of positions and angles above the listener's ears by continuous pressure fit resistance by end caps 16*c* onto the smaller leg while coupling the smaller leg to the larger telescoping leg.

This allows the user to easily and immediately adjust the telescoping function up or down when desired for more sound control of the whole lightweight assembly with one, user-friendly, action instead of multiple separate actions before, and after, each individual adjustment. To make individual lengthening or shortening adjustments, up or down, to the telescoping part adjusting device, the listener simply expands or contracts the two legs by physical contact with one or both legs, with only one physical contact with the upper leg needed to adjustably reduce, shorten, the overall length.

Normally, in smaller individual listening setup arrangements, such as with most presented embodiments, because the telescoping part is normally physically located immediately next to the listener's position, as indicated in the included illustrations, the listener has convenient access to the telescoping unit and can, and does, make immediate adjustments without restraint and without having to leave the comfort of the listening position. Furthermore, the lightweight resistance between the two lightweight legs by the cap 16*c* allows immediate, easy, fluid, and easily-repeated adjustments without having to un-lock and re-lock a compression device before and after each individual telescoping movement such as needed, for example, as with typical telescoping camera tripods where more weight is involved.

This thereby allows and encourages fluid, immediate, and repeatable adjustments, readjustments by the listener without a time delay before and after each individual adjustment. These simplified, immediate, repeatable, and user-friendly adjustments and readjustments provided by cap 16*c* for above-the-ear sound shapers, acoustic extenders, and other lightweight above-the-ear sound revealing, sound shaping and sound controlling components, for example, without requiring unnecessary disjointed steps before, and after, any and all adjustments, successfully provides substantially minimized disruptive interference during the listening session and encourages, and increases, a more personalized and almost automatic listener interaction with the employed embodiment system and its provided impactful surrounding acoustic experience. This makes the listener feel like, and become, more of an operator of the employed embodiment system and sound picture being projected toward them from a multiplicity of angles and directions at once.

This same continuous lightweight pressure fit resistance is also built into the design of hook-loop fastening, attachment, and connection device 16*b*, which can, when used to position higher-than-ear positioned sound controlling components such as upper sound shapers, also replace the telescoping action of any of the telescoping part adjusting devices by providing the same advantages as just described above for end caps 16*c*. These advantages apply, therefore, to connection device 16*b* wherever it may appear in this document.

Furthermore, for the combined flexibility of both telescoping provisions and connecting provisions, two or more sliding connection devices can be used on the same non-telescoping part positioning device, one for each upper and lower sound shaper, for example, providing independent connected movement for both sound shapers and any associated other sound controlling components used with them, for example acoustic extenders. In addition, for even more flexibility, two or more sliding connection devices 16*a* and 16*b* in FIG. 17 can be used on the same telescoping part adjusting device, such as is provided by telescoping part adjusting device 16*j*, which also provides the above mentioned top molded cap 16*d* thereby also successfully providing its many above mentioned non-connected advantages for higher-than-ear sound revealing, sound shaping and sound controlling devices.

It is helpful to note here, in accordance with the presented embodiments and their presently-revealed method of application, that using flexible sound controlling devices such as flexible sound shapers like flexible sound shaper 14*d* that can be flexible in one or more dimensions and attached, for example, vertically onto either the top, bottom, inside, or outside portion including combinations thereof to sound controlling side walls such as side wall 7*a* or 7*b*; that can be positioned or attached to other embodiment system components or other nearby items; or that extend portions of side walls at one or more locations with, for example, flexible extensions like flexible extensions F, E, and D shown in FIG. 20 and flexible parts such as part 7*a* and 7*b* shown in FIG. 28; can augment and/or replace the function(s) of main or auxiliary sound revealing, sound shaping, and sound controlling components as discussed within this document. Using these types of flexible sound controlling components provide variable sound control at the option of not needing part positioning devices as, for example, shown in FIGS. 13 through 17, 30, and 31.

End caps 16*c* can be economically comprised of the same molded materials as the aforementioned bottom end caps 16*e*, however with slight variation, for example, of using two or more different sized end caps attached at the same location with the larger end cap fitting tightly over the smaller end cap with two small holes prior placed into the top of each of the two different sized end caps and slightly offset from the cross-directional true center location. The slightly off-center holes can be placed into these end caps by various devices or application methods such as a mechanical hole punching operation after which the smaller end cap is affixed to one end of the outer tube 16*i* and the larger outer end cap is placed over the smaller inner end cap with the holes slightly offset from each other, similar to how the double layer of hook-loop attachment component 16*b* is produced and how it functions as detailed above. The extended-use repositioning function of these two caps is also similar to the extended-use repositioning function of the double layer of hook-loop fastener component 16*b* and a hole-size rejuvenation procedure whereby if the hole(s) becomes worn with use over time, the outer larger end cap or layer such as a non-permanently-affixed larger outer end cap can be twisted slightly around from the position of the smaller-sized permanently-affixed end cap under it to realign the two holes into another offset position thereby providing more slide resistance for the inner extension component rod or tube 16*h* at those hole locations. This simple and fast extended-use part renewal action can be repeated any number of times and is usable for the double layer of hook-loop fastener components 16*a* and 16*b*.

Other suitable application methods and devices for interconnecting telescoping component parts, such as those that can also be used to connect telescoping legs on part adjusting devices such as telescoping part adjusting devices 16*j*, 16*k* and 16*f* include connecting application methods and devices used to interconnect and lock-together individual telescoping leg segments for example those used on portable tripod stands for adjustably supporting and stabilizing photographic cameras and the like, three-legged adjustable stools, tables and platforms providing adjustable stability against downward horizontal forces and movements about horizontal axes, adjustable height devices using three adjustable legs such as three twist-locking or clamp-locking length-adjustable support legs to provide better leverage including off-center lateral stability away from the unit's vertical center, and other suitable telescoping leg segment interconnection application methods and devices available to those skilled in the art.

It should be emphasized, as mentioned throughout this document, that although many of the part connecting, moving, positioning, stabilizing, and adjusting components detailed above are helpful for the overall setup and operation of the presented embodiments, they are not the only devices suitable or available for such use, nor are they exclusively needed to assist sound control devices such as sound-controlling panel components, sound shapers, etc., nor are they required in their present form to help position, move or adjustably operate any embodiment system structure or panel component. This is because a plurality of other, additional, and different devices and methods are also suitable and available in accordance with the presented embodiments and their method of application to help position, adjust, and support sound-controlling embodiment system structures and panel components.

These include adjustable internal support mechanisms, for example, adjustable internal panel component wall and sound control device support mechanisms such as those illustrated with sound-controlling flexible and adjustable internally-supported panel components F, E and D in FIG. 20. Alternatives also include internal panel component wall support mechanisms illustrated with sound-controlling panel component 23*e*, and illustrated in FIGS. 23-27. Additional internal panel component wall support mechanisms and construction methods are detailed above with panel component strain relief methods that essentially allow the listener and acoustic designer to support, stabilize and flexibly-position embodiment system structures, for example, flexible panel components, sound shapers, and acoustic extenders into a multiplicity of listener-controllable stereo enhancement, surround sound field correction and acoustic-related feedback positions and angles.

In addition, other suitable support devices can be also easily be used to help position, adjust, and support embodiment system structures and panel components. These include adjustable external support devices such as adjustable external support and/or attachable telescoping part adjusting devices that help adjust, flexibly-position and control embodiment system components into various listener-controllable positions and angles. These include telescoping support stands; floor or side panel component supported flexible angle brackets such as flexible cantilevered angle bracket 13*e*, FIG. 13; and clip-on sidewall positioned devices such as clip 17*d*, FIG. 17. These also include adjustable exterior connecting, fastening, positioning, and/or attachment devices or application methods of various suitable types such as overhead drop-down strap fastener support devices comprising adjustable flexible straps, cords, wires, strings, extended lengths of hook-loop fasteners, like strap support 13*d* illustrated in FIG. 13, that replace and/or work with currently-presented positioning, attaching, and support mechanisms and devices detailed in this document to help position, adjust and control embodiments system components including sound-controlling devices and horizontally-extended sound shapers.

Moreover, other suitable exterior embodiment system part connecting, fastening, positioning, and/or supporting devices and application methods include flexibly-positioned cantilevered wall-attachable and adjustable extension brackets such as flexible cantilevered angle bracket 13*e* illustrated in FIG. 13 which is a "V" shaped flexible force-opening and closing hinge attachment device used to attach sound shapers and other sound controlling components onto sound controlling side walls such as side wall 7*b* in FIG. 13. These articulating mechanisms help support and position sound controlling components into their various horizontally-extended positions can extend up to the full height of the panel component wall such as extended metal "U" bracket 13*g* in FIG. 13, and can connect to, or position on, one or both sides on the panel component wall, either from its top or bottom by various fastening devices.

Various other suitable embodiment system part positioning, supporting and connecting devices include incremental hole and peg support systems such as interlocking horizontal to vertical shelf type of adjustment devices where a protrusion on one part engages and adjustably interlocks with a receptor on another part; using additional adjusting, positioning, controlling, and holding mechanisms such as slidable clips, rivets, hooks, clamps, magnets, and additional suitable support methods and devices known to those skilled in the art that can be constructed with or without the addition of specific pre-marked quick-reference positioning symbols.

Even though the structure of the sound-controlling enclosure, such as an approximately-vertical-positioned sound-controlling enclosure for the embodiment system, is quite dimensionally stable on its own, not using an auxiliary vertical or horizontal support mechanism, like not using a part adjusting device such as part adjusting device 16*j* to help position and support extended panel components that many times are in a horizontally-extended position, forces the walls of the sound-controlling enclosure to take on the full weight of these extended auxiliary panel components such, For example, the weight of horizontally-extended sound shapers can place an extra strain on the sound-controlling sidewalls to maintain the approximately-vertical structural integrity which might cause bending or deflecting over time due to this extra weight of 8 to 10 add-on devices. This is easily counterbalanced by the addition of one or more strategically-located, vertically-positioned part adjusting devices, such as 0.8 cm to 1.3 cm (0.3-0.5 inch) diameter round or square rods or tubes made from highly dimensionally-rigid materials including structural aluminum, nylon 6, glass-filled nylon, reinforced fiberglass, carbon-fiber composites, cement-filled recycled paperboard tubes, etc., that can be mechanically attached to the outside portion of the wall by various attachment devices or application methods detailed elsewhere within this document, or inserted as an integral part of the wall structure itself at strategic potential fatigue locations, as explained above for the extended metal "U" bracket 13*g*, FIG. 13. In addition, if non-reinforced walls of a sound-controlling enclosure such as the sound-controlling enclosure of the embodiment system begin to bend or deflect from the extra weight of add-on devices such as sound control devices or from excessive use over time, they can easily be reshaped by simply rolling them up back into a tight small diameter and letting them set rolled between listening sessions. This often substantially reduces the need for auxiliary or built-in stabilizing part adjusting devices such as detailed above.

FIG. 18 illustrates a small part adjusting device such as a listener-adjustable sidewall-connected part adjusting device 12*a* that can be made from various connecting, fastening, and/or attachment devices, or application methods of various suitable types including flexible materials that include polyethylene terephthalate webbing strap material that can be utilized by the listener, even from the listener's sitting position, to adjust and readjust side reflective surfaced panel component walls to different positions quickly and easily at the listeners convenience. FIG. 18 also shows two types of wall-mounted positioning systems. One is a portable, removable and slidable hanger system 15*b*, with attached quick-reference positioning symbols. The other is a permanently-attached wall-mounted positioning system such as permanently-attached hook-loop wall-mounted symmetrical part-alignment positioning system 18*a* in FIG. 18 which can also be comprised of strips of hook-loop fasteners that can be permanently attached to embodiment system panel components such as sound-controlling side panel component 7*a*. This can allow the quick and simple attachment and release of additional components such as sound shapers as described elsewhere in this document.

Attached onto wall-mounted symmetrical part-alignment positioning system 18*a* in FIG. 18 are wall-mounted quick-reference positioning symbols 18*c*1 and 18*c*2. One or more symmetrical part-alignment positioning system, such as described with this embodiment system, can also be used with these different types of wall-mounted positioning systems that can be permanently or temporarily attached onto, near to, or made a part of these wall-mounted positioning systems. Wall-mounted symmetrical part-alignment positioning systems and/or their quick-reference positioning symbols, for example, can be adhesive attached, sewn, printed, impression applied, heat-sealed, hung onto other parts, or otherwise applied directly onto either the positioning system itself such as onto strips of wall-mounted material, such as hook-loop fastener material itself used for wall-mounted positioning such as with symmetrical part-alignment positioning system 18*a*, or suitably attached to other component parts of or near to the embodiment system such as at or near to component part positioning locations where components can be appropriately attached, adjusted and reattached, such as those in FIGS. 13, 18, and 19.

FIG. 19 shows an assembly for the embodiment system, which is essentially a comprehensive interconnected assembly of acoustic-related components including sound-controlling panel components that can have several independent expandable and/or reducible in number, size and shape adjustable component parts. As mentioned with other presented embodiments, in order to provide inter-system and intra-system interchangeability of component parts, the use of sustainably-responsible end-of-life product recycling options, and reduced product obsolescence for embodiment system component parts, one or more component parts from other embodiments can be added to the embodiment system. This can include component parts not specifically described or illustrated with the embodiment system. One or more parts of the embodiment system can also be interchangeably moved to other locations and used with other embodiments.

FIGS. 30 and 31 illustrate how even some minor adjustments, such as adjustments to panel walls 7*a* and 7*b*, can allow these panel component walls to be used and supported differently. For example, part of the left panel component wall 7*b* is shown as rolled-up 30*a* and another panel component wall 7*a* is shown with shapely-angled wall portions 30*b*, 30*c*, and 30*d* that can be added or built-in anywhere on or along embodiment system panel components. This successfully provides that panel component, including adjacent panel components, with additional panel component stability and allows for different placement configurations, such as an open back as shown in FIG. 30 to allow, for example, easy transport through the apparatus, improved air circulation, and other useful advantages. This also successfully allows individual panel components, for example, to be quickly and easily moved into different positions such as to other quick-reference positioning symbol locations, without the need for additional panel component 7*a* or 7*b* stabilizing, such as without the need for two connected panel components 7*a* and 7*b* illustrated in FIGS. 11 and 12 to be taken apart before movement. This also allows panel component movement without a panel component wall 7*a* or 7*b* touching or being placed near to a speaker for added stability, and without the need to use part adjusting devices such as part adjusting device 16*j* shown extended and attached to panel components 7*a* and 7*b* in FIG. 30 by way of connective fasteners, such as a hook-loop fastener 16*a* which is more fully detailed and illustrated in FIGS. 16 and 17.

Note that the main embodiment system component parts such as both the left and right panel component walls 7*a* and 7*b*, both speakers illustrated in FIGS. 19, 30 and 31, and main embodiment system component parts included with other embodiments presented herein, in accordance with the presented embodiments and their presently-revealed method of application, can be altered, modified or repositioned, including vertically extended upward or downward to allow the surround sound field to also be elevated or lowered respectively and more favorably reconstructed around a standing upright, reclining, lying or passing-through listener or listeners. Applications include walk-through trade show display booths, temporary listening rooms, work-out rooms, promotional kiosks, and the like.

Speakers, for example, can be optionally adjustably turned (toed) and repositioned in many symmetrical positions and angles to each other and from the listener to suit and accommodate the listener's individual acoustic interest and desired experience. The same for the repositioning of the listener as long as the above mentioned speaker-listener triangular relationship is maintained during the listening session.

Figure 34:
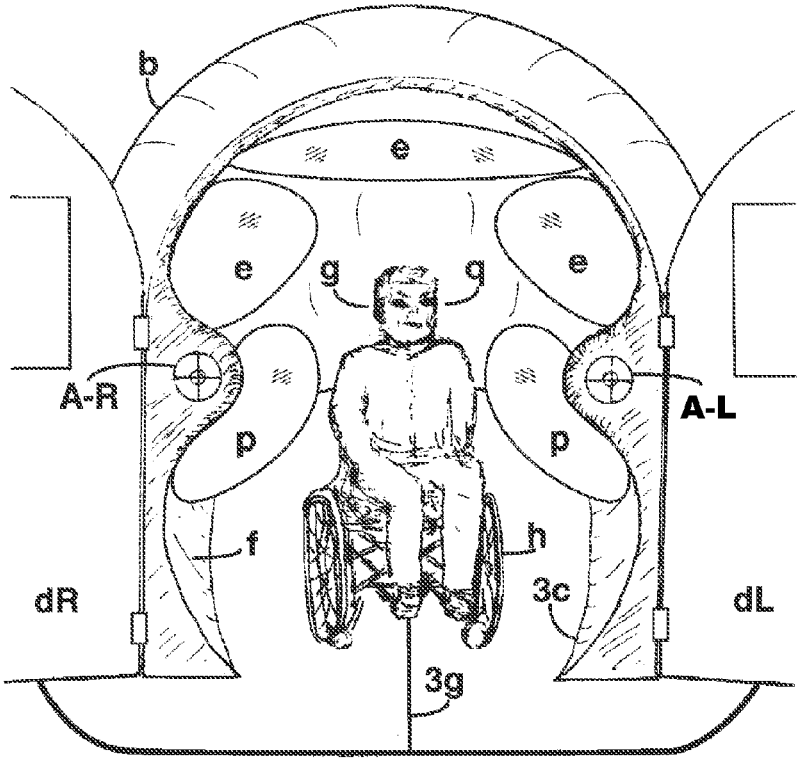
FIG. 34 shows a perspective view of an adjustable-size, interior, or exterior embodiment system that can be a dedicated listening/audio-visual room, with handicap access, that can be a series of separate or connected units, with or without a built-in sitting device, with or without an audio-visual device, and showing a built-in specialized tweeter-in-woofer speaker system.

Note that speakers, especially smaller speakers, need not be maintained in their traditional vertical position and can optionally, temporarily or experimentally be turned horizontally on their sides, and/or slightly elevated in front or back, etc. during normal listening with the presented embodiments in order, for example, for both speakers' tweeter drivers and their mid-range drivers to be located on the same approximate horizontal plane with each other, and where both speaker tweeter drivers and midrange drivers are positioned at approximately the same equal horizontal height above the floor, etc. This provides an additional optional level of acoustic adjustability, experimentation and precision control for the listener because a surround sound field reproduction occurs when the listeners ears are approximately horizontally level or on the same approximate plane simultaneously with the speakers' tweeter drivers as well as the midrange drivers. In that situation, the surround sound field reproduction can focus itself at the listener's location in an slightly more cohesive three-dimensional holographic surround sound field presentation than when the smaller two-driver speakers are vertically mounted. This suggests that speakers with combined tweeter and midrange drivers mounted at the same physical location, such as illustrated in FIG. 34, can also be a part of, and/or included as a premium acoustic component with one or more of the embodiments presented herein.

As with any product, quality will, of course, vary with the quality of the devices used in the surround sound acoustic system. For example, the employed embodiment system will reflect higher quality stereo signals and speakers, and, in general, provide a higher quality acoustic result. This is also partially true with all embodiments presented herein. However, unlike the high-end audio perspective and prior art solutions, with the presented embodiments, advantageously even smaller "B" and "C" range quality audio compact stereo speakers work exceptionally well with all presented embodiments presented herein. Nevertheless, higher-performance integrated stereo playback systems will provide noticeably improved embodiment system results over highly segmented or carelessly assembled playback systems.

It is helpful to understand and assume that the presently-revealed embodiment system capability to reproduce a substantially-whole, three-dimensional surround sound field from the original encoded stereo signals was probably not realized as possible at the time these recordings, especially early stereo audio recordings, were recorded and produced. It simply was, to the present revelation, extraordinarily difficult and expensive to do so. Therefore, these original three-dimensional surround sound fields positioned and encoded within the original signals may not have been setup with a microphone arrangement and encoding process that took full advantage of the now-available with the presented embodiments' provided opportunity to reproduce those original surround sound fields.

This consideration, and because microphone types, setup arrangements, and subsequent signal encoding by acoustic engineers can and do pan and position sounds and surrounding sounds into different, sometimes significantly different, horizontal and/or vertical positions, can cause the stereo audio sound reproduction of those surround sound fields to also vary sometimes considerably, especially from one soundtrack or software release to another.

The need, therefore, to control this variable surround sound field in order to provide the listener with a holistic three-dimensional symmetrically-balanced sound field arrangement, and the need for a simplified built-in feedback system became an important initial consideration and a responsible requirement in order to provide consistent adjustable control, accurate three-dimensional surround sound functionality, instant precise setup, and ongoing feedback to the listener for the consistent and adjustable reproduction of a realistically-natural, acoustically-balanced, three-dimensional holographic surround sound field as properly reproduced from the original stereo audio signals.

This resulted in adding adjustable sound controlling abilities to the presented embodiments. Adjustable embodiment system sound controlling components include listener adjustments and macro sound adjusting and controlling components that allow the listener to quickly adjust the surround sound field as well provide many additional sound revealing, sound shaping and sound controlling abilities and advantages.

Once these macro sound adjusting and sound controlling capabilities were discovered and used, their use was quickly extended substantially beyond simple sound field adjustments to include additional substantial micro sound adjusting and sound controlling capabilities. Additional micro sound adjusting and sound controlling capabilities that provide substantial additional sound controlling capabilities for portable embodiments including many of the embodiments' three-dimensional surround sound advantages, problem-solving solutions, industry provisions, positive listening experience improvements that are now built-into and illustrated in the presented portable embodiments.

For example, symmetrical part-alignment positioning systems, quick-reference positioning symbols, and their strategic positioning among the presented embodiments. As explained elsewhere, these allow the listener and acoustic designer to quickly, easily, and inexpensively ensure the total symmetrical arrangement and alignment of all acoustically-significant sound-controlling embodiment system components at all times by simple instantaneous comparative visual reference observation noticing the apparent relative position of acoustically-significant components relative to quick-reference positioning symbols located at or near acoustically-significant adjustable component locations for a particular embodiment system structure.

Once acoustically significant components are positioned, the listener can also quickly, easily, and accurately often without the listener even having to move from the listener's position, vary, experiment, and macro and micro modify these sound-controlling components, and the resulting acoustically-pure surround sound acoustic experience, at will, without having to electronically modify, alter or corrupt the original signal in the process. For example, the listener can choose to adjust nearby components to help non-electronically modify any sound or built-in surround sound field, or, if the listener desires to shape or tune a specific soundtrack to the listener's individual surround sound acoustic preferences.

In addition to micro adjustments explained above using sound shapers, acoustic skins, acoustic extenders, part positioning devices and like, macro adjustments, to macro control the sound and sound picture for the listener, include, for example simultaneously and symmetrically expanding or contracting the size of the overall embodiment system; Moving the system and/or the listener closer or further away from the speakers; Making speaker positioning adjustments shown in FIG. 4; Adjusting both left and right sides of sound-controlling panel components for example by lightly pulling-in side-positioned sound-controlling panel components such as using sidewall-connected part adjusting devices 12*a* illustrated in FIG. 12, to symmetrically pull these main sound controlling components inward, so they are simultaneously-positioned closer to the speakers and the listener; Moving one or more sound controlling including sound reflecting, sound absorbing, and sound barrier panel components into different positions relative to the listener and the speakers, including behind-the-listener, over the top of the listener, and into variable angles and positions, such as using overhead panels 29*a* illustrated in FIG. 29, and/or positioning sound controlling panels around the outside of the embodiment system such as with outer sound controlling panel 29*b*, FIG. 29; Separating and opening-up the back-located edges of sound-controlling panel components to permit surround sounds arriving to the listener from a behind-the-listener direction through the back opening in the embodiment system enclosure such as illustrated in FIGS. 30 and 31 of the system; Adding two, three, or more symmetrically positioned sets of acoustic extenders at various positions and angles simply by gravity support, for example, by one or more upper sound shapers such as by one sound shaper 14*c* illustrated in FIG. 18; and so on. Note that any one of these horizontal plane listener-interactive immediate-feedback surround sound control and corrective options can be quickly, easily and effectively listener-adjustably employed, shaped, precisely-controlled and mixed with other embodiment system listener-controlled feedback options at his or her discretion and then position-noted, if desired, to a nearby quick-reference positioning symbol for future listener reference.

Each of these individual micro and macro sound adjusting and sound controlling components and their individual sound adjusting and sound controlling capabilities can be utilized and applied incrementally alone, on a precision symmetrical basis on both left and right sides as explained and illustrated in this document, as well as in one or more symmetrical combinations with one or more other micro and macro sound adjusting and sound controlling components. This provides the listener and acoustic designer with a substantial plurality of sound and surround sound choices and acoustic experiences, significantly beyond simple sound field positional adjustments.

The listener's option to precisely and quickly employ and incrementally shape and control any of these simple acoustically-significant, dependable, repeatable and easily-referenced surround sound acoustic control options, helps successfully provide the listener with a selectable number of creative counterbalance control options which can be conveniently used at the listener's discretion to adjust or force-move, for example, the horizontal and vertical surround sound field relative to the listener into a more balanced horizontal and vertical-corrected surround sound field.

However, it has been noted on more than one occasion that a minor surround sound acoustic-related off-balance or contrary sound track effect for one person may be a complementary surround sound, sound effect, or surround sound field acoustic experience for another person which allows the versatility of the embodiments presented in this document to successfully provide equal advantages to both persons aligning with their preferred desired surround sound acoustic experience. This is achieved with the employment, adjustment and precision control of a relatively quick and easy complementary combination of both horizontal and vertical plane acoustically-significant surround sound and sound effect acoustic correction options that may also be quickly and easily position-noted to a nearby quick-reference positioning symbol or line for future listener reference if desired.

It should be noted that, as detailed and illustrated in FIGS. 1B through 1H, substantially more acoustic enhancement is achievable from stereo speaker output using one of the embodiments presented here alone, even without quick-reference positioning symbols between all acoustic components, than can be otherwise achieved by the listener utilizing the same electronic equipment without the use of the embodiment system as part of the overall stereo audio sound reproduction system.

The substantial historic observed and recorded advantage of equipment properly-aligned and symmetrically setup is the common reality of total acoustic immersion without distraction and a substantially-heightened balanced perceptual acoustic experience for the listener. However, even when using any of the presented embodiments without a precision symmetrical alignment, many listeners report a greater sense of emotional involvement and intimacy with the acoustic presentation that does not detract from the listener's enjoyment of the presented acoustic experience. That is, even if the embodiment system is setup skewed, off-balanced or symmetrically wrong, the result of capturing and utilizing substantially-useful acoustically-pure indirect sound energy before it becomes corrupted that otherwise would be inefficiently-wasted, not heard, and substantially damaging is substantial. The result of the effective cancellation of stereo speaker crosstalk the result of the effective elimination of out-of-sync room reflections, and the plurality of spatial surround sound cues provided by the presented embodiments, as detailed throughout this document, has been found, in virtually all instances, to be acoustically positive, emotionally additive, more enjoyable, aesthetically more interesting, and substantially more sonically riveting to the listeners than conventionally achieved by the listeners utilizing the same digital or analog electronic audio equipment, set at the same system amplitude level, and at the same speaker-to-listener distance than without the acoustic utilization of one of the presented embodiment system.

In fact, as a testing and instructional suggestion, for new users of any of the presented embodiments, it is highly suggested that the beginning listener temporarily and intentionally off-set and off-adjust acoustic components of the employed embodiment system so that they are purposely setup asymmetrically or with substantial non-precise symmetrical misalignment in different ways in order to reveal to the listener the quantity, quality, and character of the adjustable acoustically significant power available to the listener in that off-set condition, and to give the listener a better feel for the expanse of correctional options available to them with their selected embodiment system.

Therefore, it needs to be emphasized that standardized part-alignment positioning systems such as those presented herein and other similar part-alignment positioning systems that are helpful supplemental add-on setup and symmetrical part adjusting devices are not at all required for this embodiment system to acoustically-function most excellently and to the satisfaction of the listener. With this in mind, a substantial aspect of all of the presented embodiments is that they are designed to be very forgiving and substantially devoid of major acoustic artifacts almost regardless of a particular embodiment system's size, slight off-shaping or whether the acoustic components are perfectly symmetrically aligned or not. That is, all of the presented embodiments, even with slightly off setting acoustic components, are substantially devoid of significant or unwanted acoustic artifacts, including phase shifts, ringing or resonance, acoustic frequency cancellations, and wave shape distortions.

This acoustically ideal embodiment system component placement and positioning advantage with its forgiving use over a wide latitude of exemplary adjustable positioning parameters allows it to maintain a highly-controlled linear coupling coefficient and the continuity of sound wave pressure with a plurality of different placement and positioning arrangements through the sound wave's exponential expansion and along the wave's acoustical expansion path. This wide latitude of utilization especially in the substantial expanse of space between the speaker's propagation output point and the listener's position, thus allows the signal's encoded surround sound information and its encoded energy patterns to proportionately time-line develop and present themselves to the listener as a plurality of different but coherent, believable, and mathematically appropriate three-dimensional acoustic pictures of real-world acoustic experiences.

It is also noteworthy that the setup variations available with any one embodiment system, as long as they are somewhat, even though not perfectly symmetrically aligned, provide a substantial acoustically-satisfying sound advantage to the listener. This wide latitude of forgiving setup for the presented embodiments was found to such a degree that, with each new setup adjustment variation provided to the listeners, many listeners reported that the new setup arrangement appeared to them to be the best standard for the most perfect surround sound enhancement system setup selection. What was surprising was that there seemed to be many very different "perfect" acoustic component setup variations using the same embodiment system and many that can be equally, if not more, acoustically satisfying to the listener, even with the same sound signals played back by the same electronic equipment where, for example, the only variation is a seemingly minor setup variation in the embodiment system acoustic component arrangement.

In this regard, it has been conservatively estimated that there are no less than 500, and up to a significantly unknown number, of slightly-different but individual, user-adjustable, potential incremental standardized setup variations are possible. This can be understood when one considers the adjustable parameters of each part and the adjustability of the total combined assembly of all adjustable parts setup in all potential variable incremental angles, directions and placement options utilizing only the illustrated parts shown in FIG. 20, and that is even without including other parts shown or described with other embodiments.

It is hereby important to note that, substantially, any one of these individual, no less than 500, standardized setup variations with the embodiment system, and the other embodiments revealed herein can be separate, standalone, fully-satisfying, and fully-functional systems on their own. That is, any one of these more than 500 individual setup variations, if statically-locked into position as-is, can be used alone as a standardized, stand-alone, fully-functional, and fully-pleasing embodiment system capable of providing high-performance three-dimensional surround sound from universally-available stereo signal sources.

Figure 33:
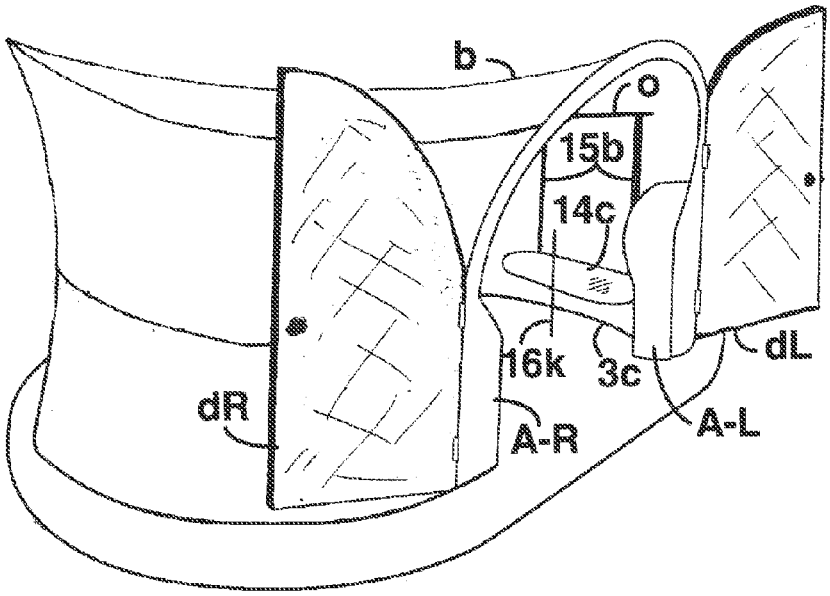
FIG. 33 shows a perspective view of an adjustable-size, interior, or exterior embodiment system that can be a dedicated listening/audio-visual room, with or without a built-in sitting device, and with or without an audio-visual device.

This high number of fully-functional standard embodiment system setup arrangements do not diminish, and only substantially increase, by utilizing different embodiment system components and arrangements such as different sizes of sound-controlling panel components as well as utilizing options for different specular sound-controlling materials, for example, including static, portable or adjustable parts, including sound shapers, detailed elsewhere in this document. Even more permanently-shaped and structured embodiments such as illustrated in FIGS. 33 and 34, which can be fabricated or structured from an assortment of more rigid permanent-shaped materials such as more expensive, heavier, thicker specular reflective materials and room construction materials, deliver to the listener a substantial plurality of optional listener-adjustable acoustic setup options and arrangements that can perform with the same acoustic advantages as the various more portable embodiments. Other embodiments more fully illustrate an even higher number of substantially high-performance standardized embodiment system setup variations than the presently detailed embodiment system.

As illustrated in FIGS. 1B through 1D, 1H, and 1I through 19 and as detailed throughout this document, the presented embodiments generally conform to an oblong, elliptical, or oval, generally non-cornered shaped assembly of one or more sound-controlling components that can create a type of sound enclosure at least between the speakers and listener that can capture, control, and utilize a substantial portion and substantial quantity of otherwise normally inefficiently-wasted and normally destructive indirect sound energy emitted from speakers such as conventional speakers. It is helpful to explain that, if the sound-controlling enclosure was a box-shaped affair, as illustrated in FIG. 1A, like a typical square or rectangle-shaped listening room, with straight parallel lines, even though the interior was lined with a first-order specular sound-controlling material to reflect and capture the sound energy, the parallel surfaces of the interior would cause the sound emitted from the speakers to travel destructively back and forth between the parallel reflective surfaces and produce acoustic waves that interfere with each other, neutralize each other, accentuate certain frequencies and return back to the listener out-of-sync with the normally more acoustically-pure direct sound to cause the sound thusly heard by the listener, especially high-performance stereo audio sound, to become adversely and seriously affected for the listener.

On the other hand, when the enclosure is standardized to be symmetrical, oblong, elliptical, or an oval-shaped non-parallel-walled arrangement, the oblong elliptical shell or enclosure has no parallel lines on its interior, no dead-end box corners to trap sound, no hard intersecting borders, no acoustically disruptive surface anomalies. Instead, as illustrated in FIGS. 1B through 1D and 1H, it is a more organic-shaped arrangement, symmetrically-positioned at least between the speakers and the listener, and where all points along its continuously-connected progressively time-line-coordinated surface on the interior cavity of the embodiment structure that receives sound energy directly from the speaker sources can be used by the embodiment system to harmoniously-reflect and symmetrically focus symmetrically-arranged acoustically-pure sound energy to a fusion point at the listener's location. This is the acoustic ideal that also permits many of the embodiment system provided problem solving solutions, acoustic advantages, industry provisions, and positive overall listening experience improvements.

Having a smaller closer-to-source enclosure also reduces or eliminates entirely destructive sound reflections from the floor and ceiling surfaces that normally add harmful sound reflection interference when the listener is conventionally-positioned at a more typically extended listener distance from the speakers. With a symmetrical oblong, elliptical, or oval-shaped non-parallel walled enclosure, the progressively time-line-encoded sound wave emitted from the front speakers radiates off from the embodiment system's extended reflective surfaced panel component arrangement whereby the sound wave has a gradually expanding progressive time-line-oriented surface to develop from, travel upon and radiate from. The extensive sound capturing and precision focusing shape of the embodiment system's sound-controlling panel component arrangement can help perfect the shape of the waves and allow the waves to be synergistically combined with the symmetrical shape of the enclosure, while simultaneously progressively time-line focusing and directing the sound waves toward the listener in such a way that it provides maximum focus and precision progressively time-line replication of the original sound source wave, from a plurality of angles and directions of radiation, and the ideal is thus accomplished as detailed in FIGS. 1C and 1D.

The overall result is that the presented embodiments create an expansive surrounding sound projection screen around the listener, where every point, location, and square centimeter on embodiments' sound-controlling surface within a direct path of the speakers is capable of becoming an independent sound projection site able to receive and transmit real, physical, individual, pinpoint-localized, progressively time-line-decoded, high-performance surround sounds directly to the listener from hundreds to a significant uncountable number of individual real pinpoint-localized physical sound emitting or sound projection sites, locations, angles and directions around the listener.

One of the first significant comparative observations that affect a listener when he or she first experiences the sound from a high-performance sound system with the incorporation of any one of these embodiments, when using the same electronics set at the same amplitude level and with the listener positioned at the same distance from the speakers, is the substantially-enhanced comparative amplification and acoustic nuances of the sound within the embodiment system sound-controlling enclosure structure versus the loss of energy and the significant reduction of amplitude and acoustic nuances associated with the same soundtrack or sound signals when played back without the acoustic utilization of one of the presented embodiment system sound-controlling enclosure structures.

There are a couple of complementary reasons for this substantial experiential difference. One is that all of the embodiments presented here provide an accumulated concentration of precision-controlled, close-to-the-source, mostly first-order acoustically-pure specular sound reflection which has substantially the same amplitude, character and sound signature as the direct-from-the-speaker, non-reflected sound itself. The sounds heard by the listener being reflected off of one or more of the embodiments sound-controlling panel components are acoustically-pure sounds reflected relatively close-to-the-source and are obstacle interference-free sounds that arrive directly to the listener's location after a single precision reflectance along a symmetrically-organized straight path making these close-to-source acoustically-pure sounds, especially first-order, acoustically-pure, specular reflected sounds, acoustically indistinguishable in many ways from the direct non-reflected sound itself, thereby resulting in a substantially-enhanced sound and acoustic experience.

This substantially-enhanced embodiment system sound and acoustic experience of, for example, hearing a live sound event reproduced with one of the presented embodiments, has been expressed by many listeners as being in many ways an even more acoustically, intellectually, and emotionally involving and satisfying acoustic experience than being at the same live acoustic event as an audience member. This is in part because, as further detailed elsewhere in this document, the embodiment system generally places the listener near to the recording microphone positions, directly in the center of the focal point of the acoustic event itself, whether, for example, in the center of a live sports event or actually on stage with and among the recording artists and their instruments. With the presented embodiments, the listener is literally being surrounded and immersed by their performance on multiple levels. Substantially captured embodiment system micro and macro sounds and surround sounds, for example, substantially and cooperatively captured from two common but good quality stereo audio speakers, can be locationally rendered around the listener in a more locationally pleasing and acoustically satisfying presentation than those received by the same listener as an audience member at the same live acoustic event.

Sound is important to humans and has been throughout the our history. The experience and sensation of sound, we are told by the medical profession, is one of the first sensual experiences that is both heard and felt by the human fetus in the womb. We are also told that when a human is dying their sense of hearing and their sensual response to sound is also one of the last sensual experiences the dying person experiences after the other senses have been substantially weakened or diminished.

To humans, the sense of sound not only contains substantial quantities of sound information but also substantial simultaneous quantities of accompanying sound energy power that is, in a sound system, being emitted from audio speakers. Even though these subcomponents are cooperatively, simultaneously and automatically provided together within the sound component, each information and energy subcomponent provides its own separate and unique stimuli derived from the sensation of sound that affects humans differently. This allows the acoustic designer and listener to advantageously use these individual subcomponents for their unique acoustic problem solving and application advantage.

Where the sound or sonic energy subcomponent and its included sensation and visceral emotional experience, with its profound affect on humans, is unarguably the most obvious, recognized and utilized subcomponent within sound, the presented embodiments, which, as detailed within this document, having the ability to utilize and provide this emotional stimuli at an exponential level that is strikingly impactful to the listener(s). At the same time, the presented embodiments seem to also substantially and naturally evoke from the same sound source the informational detail and subcomponent to previously unknown new level of appropriate acoustic recognition and appreciation.

The acoustic informational provided by the embodiment system includes within it a special ingredient, the sensation and the acoustic experience of wonder. According to the dictionary, the experience of wonder is a feeling of surprise mingled with admiration, caused by something beautiful, unexpected, unfamiliar, or inexplicable: he had stood in front of it, observing the intricacy of the ironwork with the wonder of a child. People and listeners using the embodiment system experience sound in a way never before possible, often evoking an appreciable sense of wonder.

Along with substantial quantities of emotional stimuli derived from the sound energy and power within and of sound, the presented embodiments are also capable of capturing, evoking, and providing substantial quantity and quality levels of special intellectual sound stimuli which are derived from the informational subcomponent naturally encoded within the sound source. This intellectual stimuli, sensation, and experience of wonder is normally a profoundly difficult stimuli, sensation and experience to capture in a sound reproduction system and is one of the prime reasons audiophiles listen so intently to music, and why they invest (not pay) so much for the special and unique acoustic equipment that can provide exponential levels, or at least the promise of exponential levels, of this special ingredient. It seems that the closer the listener can get to the subtle nuances within the sensation of controlled sound, the more intellectual stimulation is possible, captured, and evoked from that acoustic sensation, thus one of the key foundation ingredients of the study of music appreciation.

One striking example of the intellectual experience of wonder derived from the use of one of the presented embodiments, in addition to the added profoundly-close personal immersion into the subtle nuances of a well-performed acoustic event, is the never-before realized and intellectual rationalization of the profundity of directional sounds that can be directed and focused at the listener's position simultaneously from a multiplicity of angles and directions. In this regard, the presented embodiment system devices have evoked in many listeners one or more forms of the following intellectual question, for example the personal self-directed question of: "How does the cooperative profundity of sounds coming at me from all directions that I know only originate from the speakers which are located directly in front of me—somehow non-electronically become completely separated from, and repositioned far away from the sound source speakers and placed in totally different locations and directions than the speakers themselves, with no semblance of a sound connection coming from the speakers including some sounds that only arrive from directly in back of me, or that only arrive from directly off to one side of me, or that even only arrive from directly above me—where I know there is no speaker or sound source or electronic equipment of any kind?" "How does this device DO this—especially without using any added electronics to help position all these individual sounds into those vary different locations far from the speakers themselves?" To them, the experience is almost magical and is simple in its elegance.

The addition of an embodiment system interests and engages the listener even further with intellectual curiosity, where surround sounds are amply encoded within the signals, is augmented, combined, and accompanied by the heightened intellectual response from being personally, acoustically, intellectually, and continuously surprised by the multiplicity of new directions and angles of sound and the new heightened sense of directional awareness the acoustic event that now automatically present themselves to the listener, including simultaneously being acoustically reminded of, and acoustically being able to easily follow, the directional complexity of never-before-localized-around-the-listener, for example, individual, widely-separated-apart, pinpoint-localized sounds, vocals, instruments, subtle musical threads, and accompaniments that are normally, and that have always been, acoustically buried and convoluted within the process of acoustically reproducing, for example, live over-the-air or prerecorded acoustic events, music soundtracks, televised sports events, computer video games, home movies, prerecorded concert events and the like.

Individual surround sounds encoded with these acoustic events, as detailed within this document, can now become dramatically, physically, three-dimensionally and holographically widely separated apart from each other, individually repositioned around the listener into their own distinctive space and location and directed toward the listener by the utilized embodiment system from a plurality of natural and separately pleasing, entertaining and intellectually stimulating directions and angles at once.

The presented therapeutic embodiments such as this embodiment system have been developed in response to the problems and needs in the acoustic therapy industry, including stress reduction therapy and/or behavior modification art that have not yet been fully solved by currently available sound environments. Accordingly, the presented therapeutic embodiments have been developed to provide a system, apparatus, and method for creating a totally-balanced therapeutic sound immersion environment. The disclosed presented embodiments and presently-revealed method of application provide a resonant enclosure containing an environment of balanced sound which the user can balance individually with respect to the user substantially contained within the enclosure, as detailed in the following embodiment system sections.

Associated or related feedback devices, methods of application, and operations can be added to this therapeutic embodiment system that can assist acoustic therapy and/or behavior modification including, for example, light therapy devices, methods of application and operations, where one or more light sources can be mounted or otherwise located on or near any number of suitable embodiment system components at suitable positions to provide selectively energized lights directed toward the eyes and head areas of the listener. These associated therapeutic lighting enhancements, such as LED lights of various colors and light intensities from about 400 to about 800 nanometers can be selectively energized for selected durations by an automatic or manual operated actuating switch and can be adjusted by the patient/user/operator.

As a part of the presented therapeutic embodiments, video game display devices and/or widescreen computer monitors, including large flat or newer curved widescreen high-definition visual displays, can be positioned not only conventionally in front of the listener but also positioned on the sides of the listeners in positions on, over the interior surface of, or in place of, the embodiment system sound-controlling sidewalls. Alternately, left and right side embodiment system sound-controlling sidewalls can also be utilized as visual projection screens toward which visual images can be projected from a centralized location. Whether visual display, monitor, or projection screen, embodiment system positioned sidewalls that are made to also show or project visual images, in addition to their being sound-controlling can also be utilized as therapeutic visual displays, for example, showing images including visually calming landscapes or therapy related images along with accompanying suitable three-dimensional embodiment system stress reducing sounds.

In addition, this ultimate simultaneously-complementary emotionally-impactful multi-dimensional experience of both the high-performance three-dimensional pinpoint-localized surround sound audio component together with the multiple widescreen high-definition visual display components provide a synergistically-enhanced, three-dimensional entertainment experience with full-sensory-immersion for the viewer-listener. Using the embodiment system provides the natural ability and advantage of fostering exponentially-enhanced combined a/v applications and experiences, such as exponentially-enhanced video gaming experiences, home theater experiences, substantially-enhanced live over-the-air broadcast sports experiences, live or recorded concert event experiences, and the like.

Above mentioned lights and/or visuals including relaxing therapeutic images can also be controlled and actuated by automatic electronic sensor equipment that automatically respond, for example, to the play back of certain sounds, including certain frequencies of sound, certain sound amplitude levels, beats, or transients, certain voices or instrument sounds, and other musical and/or acoustic parameters which, in turn, actuate, for example, certain colored lights, certain images on the surrounding embodiment system visual monitor or display walls. These sound can even actuate other sounds, sounds at other sound locations, or movements of that or other sounds, and the like.

Hardware and software control switches for example for reading lights, air circulation, sound system, and the like, can also easily be added with this and other similar therapeutic embodiments for therapeutic and comfort use, including aroma fragrance dispensers for releasing pleasant aromatherapy odors. Furthermore, this therapeutic embodiment system can include vibratory energy devices and methods mentioned elsewhere in this document such as hardwood floor/chair devices to help increase the deeper, more relaxing, therapeutic brainwave states.

The following acoustically-significant floor-mounted embodiment system is used here as an example to illustrate a little known added advantage of the presented embodiments that incorporates not only embodiment system quick-reference positioning symbols and one or more symmetrical part-alignment positioning system (fully-explained elsewhere in this document), but also can be used to transmit a maximized full-body vibratory acoustic energy experience to the listener while also retaining maximum acoustic energy within the embodiment system enclosure itself. Included as an example of this highly-maximized acoustic system is an isolated floating wood-based listening station such as a pre-dried hardwood isolated floating wood listening station that can be substantially-comprised of hardwood such as three-quarter inch kiln-dried maple hardwood which is an acoustically-significant vibratory transferring material to consider for a vibration-transmitting and vibration-isolating floating embodiment system listening station such as the following.

The floating maple hardwood, or other suitable material floor, can be functionally-placed over an existing floor as a secondary floor that can act as a vibration-isolation zone and separated from the room's natural floor by such devices or application methods as a thick rug or other vibration damping material including thick fabrics, sound absorbing or sound deadening materials, synthetic viscoelastic urethane polymer liners, etc. The acoustic system's speakers including speaker stands can then be directly and mechanically-connected to this floating vibration-isolated maple hardwood floor along with a suitable listener sitting device such as a non-upholstered sitting device that can be substantially constructed from the same maple hardwood material. This listener sitting device, to more directly connectively-enhance and transfer the acoustic vibration from the speakers to the listener, can also be directly mechanically-attached or otherwise closely acoustically connected to the same floating maple hardwood floor structure along with one of the presented embodiments.

Significantly unlike simply turning up the volume level on a typical stereo system using corrupted sound, all of the acoustically-significant component parts of this vibration-transmitting and vibration-isolating acoustically-pure embodiment system listening station can then be maximally acoustically interconnected together into one solid unit, thereby able to transmit a combined maximized whole-body multi-dimensional acoustic energy experience directly to the physical body of the listener while also retaining maximum acoustic energy within the embodiment system's enclosure itself for maximum total sound control and utilization.

Utilized with or without a secondary non-connected extensive sound absorbing or sound deadening secondary layer, such as outer sound controlling panels 29*b* in FIG. 29 suitably positioned around the outside of the presented embodiment system, this substantial, isolated, vibrationally-connected acoustic transmitting and containment embodiment system listening station, by transmitting substantial vibratory physical acoustic energy emitted by the speakers through the interconnected vibratory structure directly to the listener's body, can substantially add to the embodiment system's enclosure ability to contain a maximized quantity of acoustic energy within the unit itself where it can be mechanically as well as aurally transferred directly to the body and ears of the listener and registered at the whole-body experience level thus involving more of the whole natural body of the listener with a more physical and more visceral way of personally interconnecting with the acoustic performance. This substantially captured and control-transmitted vibratory physical acoustic energy is also successfully added in synchronized tandem to the aural acoustic energy transmitted to the listener's auditory system in the traditional way by the direct sound energy from the speakers to the listener's ears, as well as the substantially-added indirect surround sound energy substantially-captured from the speakers and control-transmitted to the listener by the employed embodiment system from a multiplicity of simultaneous angles and directions surrounding the body of the listener.

This maximized physical and aural composite of multi-dimensionally-transmitted synchronized acoustic energy emitted from the speakers is then directly and substantially transmitted to the whole body of the listener by this powerful combination of acoustic-isolating floating hardwood listening station and the employed embodiment system while, at the same time, substantially-retaining maximized acoustic energy within the structure itself for the overall acoustic advantage of the listener, thereby to be normally and/or therapeutically used, while also noticeably suppressing nuisance noise spillover to the outside of the structure for the considerate acoustic advantage of nearby non-listeners.

Moreover, unlike simple turning up the amplitude level on one's stereo system, the presented embodiments, effectively cancel substantially damaging stereo speaker crosstalk and substantially reduce or totally eliminate interfering and severely damaging out-of-sync sound source room reflections. This successfully provides a massive extra quantity of acoustically-pure indirect sound information and sound energy that can be synergistically, simultaneously, and optionally combined with the direct sound portion of the same sound. The massive quantity of additional high-performance acoustically-pure therapeutic indirect surround sound energy captured by the embodiment system's extended sound-controlling enclosure, and simultaneously macro and micro control focused in real time toward the listener from a plurality of angles and directions, result in the total quantity and quality of sound that is being projected collectively and cooperatively together toward the listener containing substantially more original acoustically-pure and acoustically-significant information than what is otherwise provided to the listener in any room by the speakers direct sound component alone. This massive additional embodiment system quantity of acoustically-pure indirect sound powerfully conveys to the listener a more acoustically-pure whole version of the original sound being emitted by the speakers. This significantly added acoustically-pure sound also conveys a more whole version of the original encoded surround sound field, along with a more whole version of the original acoustically-pure surrounding immersive sound field's reverberatory energy component than the much smaller direct sound portion alone without one of the presented embodiments.

This acoustically-pure more whole version of the original sound is substantially due to the resulting sound envelopment of the embodiments sound-controlling enclosure essentially acoustically surrounding the listener with concentrated sonic energy of the sound in real time. This combined substantially-enhanced naturally-immersive three-dimensional sound enhancement system and whole body acoustic experience, resulting from sound-wrapping the body of the listener with an emotionally-impactful, three-dimensional, surround sound sensory energy experience, successfully provide a plurality of complementary high-performance acoustic-related enhancement applications for the listener. These include audio-only acoustic enhancement applications such as high-performance audio-music reproduction enhancement, substantially-enhanced therapeutic applications, such as music therapy and sound therapy applications for stress relief, relaxation, meditation, and so on.

To explain this maximizing precision-controlled sound-wrapping of the listener's body with embodiment system-provided three-dimensional emotionally-impactful surround sound sensory energy experience component in more empirical terms, the sound-controlling enclosure arrangement of this and other embodiments perform in a similar way as, for example, a soundboard which is utilized on a large number of acoustic instruments such as a grand piano, cello, or a guitar. Using the soundboard on a traditional guitar as an example, it is helpful to understand that the guitar soundboard, which is now taken for granted on all non-electric guitars, critically and significantly causes the strings of the guitar to sound much better with the soundboard than the sound of the strings alone without the benefit of the soundboard. Even though the soundboard itself does not actually create the sound, it nonetheless substantially enhances the sound of the strings by its use. Without the acoustic utilization of the soundboard, the strings alone, that normally and otherwise sound weak, distant, less interesting, and not particularly emotional, acoustically satisfying, or energizing alone, immediately with the addition of the guitar soundboard, sound substantially strengthened, enlarged, substantially more enhanced, more pleasing, more interesting, and provide a more acoustically satisfying sound to the listener than hearing guitar strings alone without the acoustic utilization of the added soundboard.

To the aspect of the resulting enhancement of the acoustic performance with this and the other presented embodiments, the embodiment system provides a soundboard's acoustic function and a resulting acoustic performance enhancement to the sound emitted by the speakers. That is, the resulting acoustic performance enhancement of the embodiment system's soundboard function for the speakers, is similar to that of a musical instrument soundboard function, is similar to a soundboard's useful application resulting in the significant-increase of acoustic performance enhancement, and the acoustically enjoyable advantages gained from the addition of a soundboard on a musical instrument.

The addition of an embodiment system as an embodiment system soundboard can be viewed in light of comparing the embodiment system soundboard's substantially added utility to a significant number of centuries-old sound or music creating instruments including many musical instruments that now universally employ a soundboard, but which had them added at a certain time during the instrument's early history of development. The noteworthy point is that we now take for granted the addition of the soundboard and view these centuries-old sound or music creating instruments as complete sound or music creating instruments in their own right because of the added soundboard. It is also noteworthy here that the natural sound enhancing function of the soundboard to these centuries-old acoustic instruments is now often viewed as a necessary significant acoustic addition and advantage to the acoustic instrument's performance, regardless of how acoustically satisfying or complete the original instrument sounded alone before the addition of the soundboard's added function and enhancement. Furthermore, some would suggest that the addition of the guitar soundboard, including its shape, function, and its resulting performance enhancement of the strings is at least as significant and important to the guitar's overall acoustic function and resulting enjoyable performance as that of the guitar strings alone.

Using the added soundboard on a guitar as a comparative example, the sound source speakers with the presented embodiments acts and functions in a similar fashion as the sound source guitar strings of the guitar. That is, when the sound source speakers are used in any room alone without a surrounding embodiment system acting like a soundboard, (similar to the sound source guitar strings used alone without a guitar soundboard), the speakers alone (as with the strings alone) do not allow the originally-produced acoustically-pure sounds produced by the sound source in any room to bloom, shape, and self-develop as much, or as fully, or as pleasantly for the listener, as they do when experienced with the addition of the surrounding sound capturing, sound-controlling, and sound enhancing qualities of the presented embodiment system acting as a soundboard.

When a suitable soundboard, such as one of the presented embodiment system surrounding soundboard-like structures is added into the sound experience with the sound producing speaker source, the results are not subtle, incremental, or subjective to the listener. That same originally-weak, distant, remote, less interesting, less satisfactory, low energy sound produced by the strings or speakers alone is strengthened, substantially-enlarged and substantially acoustically enhanced, and nuanced, making it more satisfying, more pleasing, and more fundamentally musical to the listener. This is because the soundboard nature of the presented embodiments, and the nature of other soundboards that were historically added onto many sound or music creating instruments such as a guitar, operate on the same principle of precision sound energy encapsulation and control by substantially controlling, shaping, reflecting, and encapsulating reverberatory sound energy whereby the sounds produced by the source are substantially-enhanced, enlarged, and more pleasant to the listener with the addition of the substantially-added precision acoustic soundboard.

It is also helpful to note here that the soundboard on a guitar does not substantially change the nature of the sound produced by the stretched and tightened strings alone. Instead of being substantially altered, the sound produced by the original guitar strings is being non-electronically captured, controlled, utilized, and substantially-enhanced by the guitar's expansive and suitably-shaped soundboard in a very similar way as the speakers' emitted sound is being non-electronically captured, controlled, utilized, and substantially enhanced by the embodiment system's expansive and suitably-shaped soundboard in order to provide a synergistically-enhanced and far better sound to the listener than would otherwise be experienced without the acoustic utilization of the presented embodiment system with it's sound enhancing capabilities. So too, in a similar way with the embodiments, the stereo speakers alone, like the guitar strings alone, produce the sounds but the addition of the much larger appropriately-shaped embodiment system like a soundboard, in much the same way as the soundboard on a guitar, significantly and synergistically enhances the sound produced by the speakers, while at the same time, substantially increasing its sound amplitude to the listener but without altering the essential original reverberant nature of the original sound source, or altering, manipulating, or otherwise corrupting the original sound source signal.

Although the same amount of energy is released from the stereo speakers without the acoustic utilization embodiment system's surrounding sound capturing, sound-controlling, and sound revealing soundboard-like enclosure structure being present, the greatly extended sound-controlling panel component size and it's substantially-large mostly specular sound-controlling surface area readily captures a substantial portion and substantial quantity of the otherwise wasted and harmful indirect energy from the speakers, concentrates this added, extra energy, and seamlessly progressively time-synchronizes this energy in real time with the direct sound from the speakers while progressively time-line focusing it toward the listener from a plurality of substantially-controlled and optionally-listener-adjustable locations, angles, and directions. This is instead of allowing this extra, wasted and harmful indirect sound energy to be randomly dispersed into a substantial plurality of non-controlled locations, angles, and directions into the listening room. In other words, the embodiment system acting like a soundboard function concentrates and force focuses a substantially greater quantity of surrounding acoustically-pure and acoustically-significant sound wave energy toward the listeners than the speakers alone can provide or that occurs without the acoustically significant addition of the presented surrounding embodiment system enhancement. The result of the addition of the embodiment system, as an acoustic structure, is that it is capable of producing not only a more natural surround sound experience for the listener, but also immersing the listener with an acoustically-pure, naturally-enveloping, acoustically-vibrant, audiophile-grade experience that is substantially replicated from the original sound field, the original acoustic event, and that this immersive acoustic experience and original acoustic event can even have been originally encoded into just two original stereo signals.

The basic fundamental sounds produced by the sound radiating system of the speakers alone, need to be examined here along with the addition of one or more of the presented embodiments for comparison to the high number of sound or music creating instruments that utilize soundboards. The basic sound produced by the speakers have been the major prior art measurement benchmark for what constitutes the sound or music creating quality of sound and music encoded into audio sound signals, such as two-channel stereo signals, since speakers were first developed. This was appropriately reasoned, because the speakers, along with the speaker amplifier, and the other supporting electronic equipment, are fundamentally responsible for creating the quality and character of sound and music encoded onto those signals. However, significantly unlike the prior art, and significantly similar to many sound or music creating instruments utilizing soundboards, it has been found that the addition of the sound-controlling enclosures presented by these embodiment system soundboard-like structures substantially enhance the harmonic nature and construct of the sounds produced by the speakers in the same synergistic fundamental way, and with the same advantageous acoustic enhancing results, as the addition of a soundboard to guitar strings.

In this regard, although the embodiment system is not a music or sound creating instrument on its own, the addition of the embodiment system soundboard-like structure has been found to significantly enlarge and substantially enhance the sounds produced by a plurality of musicians, their instruments, including a multiplicity of speakers, especially smaller and lower priced but good quality speakers to such an important degree that one or more of the embodiments should become a standardized integral component part of future high-performance sound radiating systems in the same mutually-synergistic way, and for the same mutually-beneficial functional and sound enhancing reasons, that a soundboard on the guitar is now viewed, not only as an auxiliary or supplemental add-on to the guitar strings, but as an irreplaceable standard component part of what is now conventionally-recognized and respected as a fully-developed standardized guitar structure, commonly, and correctly referred to, in its entirety, as a musical instrument.

In the same complementary way, the substantial synergistic sound shaping and controlling functionality and operation of the presented embodiments synergistically-combined and integrated with the audio speakers can be viewed as substantially similar to the synergistic functionality, operation, and performance enhancement of a sound instrument, including similar to the wholistic functionality and operation of a sound or musical instrument when coupled together with the speakers into one synergistic cooperative unit.

Conventional sound or music creating instruments that employ a soundboard normally expect such requirements as professional instrument tuning, lengthily prior training, practical music abilities, substantial instrument dexterity, and performance effort on the part of the user before the user is provided with the acoustically-significant results of the instrument's high-performance acoustic capabilities. And, as detailed throughout this document, considerable financial resources, expertise, time, and frustration is normally expected and needed to optimize high-end audio equipment. These requirements, however, are not needed with the presented embodiments. Rather, the listener-operator of the presented embodiments, because of the embodiment system advantages and problem solving capabilities is provided with an intelligently-designed, forgiving, stress-free, high-performance, fully-immersive, surround sound experience with a minimum number of clear, straight-forward, non-intimidating, and confusion-free operations and the experience is available after only an approximate 15 minute setup time. The embodiment system listener-operator can then take full and immediate advantage of the embodiment system's extensive acoustic-related audiophile-grade sound experiences and advantages with no performance preconditions, no prior training, no practical skill, with minimal physical effort.

Additionally, fundamentally and substantially unlike sound or music creating instruments employing a soundboard, the sound capturing, sound-controlling, and sound shaping embodiment system soundboard-like structure places the listener-operator physically inside of the sound shaping and sound-controlling instrument itself, locates the listener-operator at the instrument's main control center, positions the listener-operator dead center within the acoustic focal point of the embodiment system sound-controlling instrument, and provides the listener-operator with the option of interacting with and becoming a part of the experience by sound shaping and sound controlling part of the instrument's main sound-controlling and audiophile-grade experience provisions.

That is, when the listener-operator steps into one of the embodiments, he or she is entering into the inside of a new, high-value, and never-before-offered form of sound shaping and sound-controlling three-dimensional sound reproduction system, and, as with other sound or music reproduction systems, is provided with full and immediate control of a plurality of macro and micro instrument tuning and adjustment capabilities allowing the listener-operator to quickly and easily adjust and control embodiment system components. The listener-operator is also provided with control of adjusting and controlling individual localized sounds produced by the speakers but which can be controlled by the listener-operator's adjustable interaction with the embodiment system's sound revealing, sound shaping, and sound-controlling components enabling the listener-operator to adjust and control the high-performance three-dimensional surrounding sound field that he or she is being personally immersed within and is three-dimensionally time-line experiencing in a very emotionally-impactful way.

One of the differences between the acoustic experience of listening to non embodiment system stereo sound reproduction and the acoustic experience of listening to, for example, stereo sound reproduction with the addition of the significant enhancements and listener advantages provided by most of the presented embodiments and its individual component parts, was explained to be similar to the difference between one riding in an automobile versus the experience of one actually driving the automobile itself.

Moreover, the audio-visual experience difference between, for example, watching a large screen high-definition television display or playing a video game or using other acoustic media without the acoustically-significant utilization of one of the embodiments, versus those same audio-visual experiences with the addition of the embodiments' substantial listener advantages and positive overall listening experience improvements provided by the presented embodiments, is similar to the difference between one simply watching a movie presentation versus not only the personal involvement and emotionally-impactful experience of one actually being surrounded by the movie, but of one personally being in the movie experience itself, and personally being a genuine and integral part of that movie's physical three-dimensional experience. The presented embodiments, including this embodiment system, provide the listener-operator with the option of this level of high-performance and high-value-added experiences.

Alternative Embodiment System

Another embodiment system acoustic structure, is presented in FIGS. 32*a*-32*j* as a perspective view with a series of 10 progressive illustrations showing connectively-attached portable, adjustable-size, adjustable number of sound controlling panels that can be unfolded from a compact storage size into a fully-setup, fully-operational, adjustable-size embodiment system. FIGS. 32*a*-32*j* is presented to help detail, explain and illustrate the embodiment system, including its function, materials, construction, methods of use, and a representative apparatus example of one of the structural options incorporated by the embodiment system. The series of ten perspective views in FIGS. 32*a*-32*j* may not be illustrated according to relative scale and may include one or more elements that may be freely listener-adjustable, optional, and/or cooperatively-interconnected in ways other than those specifically detailed or illustrated, including elements that may be expandable or reducible in number, size, and shape. As with other portable embodiments, this acoustic structure follows the performance area detailed in FIGS. 1C and 1D. FIGS. 32*a*-32*j* show one of the progressive systems of assembly and disassembly utilizing the embodiment system's expansive and substantially-extended assembly of complementary interconnected and listener adjustable indirect sound-controlling embodiment system components that make up the basic structure of this portable listening room assembly, including listener adjustable structural elements, symmetrical part-alignment positioning systems and other components to be explained herein.

As illustrated in FIGS. 32*a*-32*j*, any number of sound-controlling panel components, produced from a plurality of sound-controlling materials of various thicknesses and sizes, can be detachably or permanently secured together into the fundamental embodiment system shape and its functioning sound controlling structure. The embodiment system may also be comprised of highly flexible sound-controlling materials, allowing for the utilization of a wide variety of sound-controlling materials such as detailed in previous embodiments. Some excellent sound-controlling materials are highly dimensionally-stable and do not lend themselves to rolling up for easy storage and are therefore highly-suitable for this method of employing the presented embodiment system. In this regard, the embodiment system provides a free-standing, self-supporting, portable, knock-down modular sound-controlling enclosure assembly that is fast and easy to assemble, disassemble, store and transport in a substantially flat position with extensive modular expandability options for added panel components and size adjustment options for substantial enclosure size adjustment.

The embodiments sound controlling panels A, B, C, A-1, 3, 2, and 1 are first attached together by hand using hook-loop hinges "x" and "y" in FIGS. 32*d* and 32*e*, unless they are provided pre-attached together into their pivotal connective arrangement by the same or other suitable permanent or removable method. The width and height of the individual sound controlling panel components A, B, C, A-1, 3, 2, and 1 may vary from approximately 1 m (3 feet) high in smaller sitting device arrangements up to full room height for standing listeners and/or to provide added interior and/or exterior sound control. Also, the width and height of individual sound controlling panels A, B, C, A-1, 3, 2, and 1 can vary according to the number of panel components used and the physical size of each panel component, to create a variety of specific enclosure sizes, or one specific total structure size using a number of different individual panel component sizes. For example, to provide the same total structure size, the width of individual panel component sizes can be decreased as the number of panel components used in the assembly are increased. Conversely, the number of independent panel components utilized in the enclosure can be reduced by using wider width individual panel component sizes to provide the same equivalent total structure size. A five panel component enclosure using wider individual panel components, for example, may have the same total structure size as a seven panel component enclosure using narrower individual panel components.

A 1 m×1.5 m (40×60 inch) individual panel component size for example represented as A-1 in the FIGS. 32*a*-32*j* for the embodiment system may be fabricated with a multiplicity of attached left and right side panel components whereby side or edge panel components such as outer edge side panel components A and 1 can also be fabricated with an edge component "e" similar to the edges 30*a*, 30*b*, and 30*c* shown in FIG. 30. To provide compact flat fold-up and storage capability, each individual progressive side panel component extending on each side of the center panel component can be manufactured slightly narrower than the center panel component it is attached to. For example, side panel components C and 3 which are shown as connected to the center panel component A-1 are slightly narrower than the center panel component A-1, with the next progressively-connected panel components, shown as side panel components B and 2 slightly smaller again, and so on. That is, as the panel components are progressively extended left and right away from the center panel component, each progressive panel component on the left and right sides are made to be slightly narrower again to allow that narrowest end panel components on each end, shown here as end panel components A and 1, to first fold-in flat in back of the next attached panel components, shown here as panel components B and 2, progressively folding in adjacent panel components until all panel components are folded behind the center panel component A-1 without interference, as illustrated in FIGS. 32*b* and 32*a*. In addition to this panel assembly method, there are many other systematic methods for connecting, sizing, and folding up individual panels into a compact portable size and shape, such as an accordion fold method, a "Z" fold method, sliding fan assembly method, and other methods known to those skilled in the art of expanding and contracting planar-oriented individual panels into a compact size for easy storage and handling. Once organized into a continuous line of connected semi-flexible panels, however, they can be assembled as a unit into a coordinated embodiment system structure for acoustic operation as detailed with the other embodiments presented in this document.

If an environmentally-responsible recyclable panel with high dimensional stability of a flexile or semi-flexible sound-controlling material is utilized with the embodiment system that is also environmentally responsibly-produced, it is presently contemplated that this embodiment system employ an environmentally-responsibly-manufactured recyclable plastic such as a recyclable 30 mil polypropylene plastic sheet for its combined high dimensional stability, long-lasting durability, excellent sound-controlling capacity, and it's environmental recycling composition, however, the embodiment system can be produced from one or more other recyclable dimensionally-stable semi-flexible panels with sound-controlling surfaces such as 30-60 mil opaque, translucent, or transparent panels, screens, or room separating dividers of rigid polyvinyl chloride, polycarbonate, high density polyethylene, polyethylene terephthalate, acrylonitrile butadiene styrene, polystyrene, acrylic and other rigid, semirigid, metallized, flexible, or mixed combinations of sound-controlling materials described with other embodiments presented in this document, as well as other suitable sound-controlling substrates including metals, including layered metal composites; paper, including coated and recycled paper; fiberglass and glass-reinforced plastics; composites including carbon fiber composites; wood materials, including portions and combinations thereof; hinged or non-hinged paper, plastic, foil etc. covered or coated metal mesh, panels, room separating dividers, or a combination thereof; rigid plastic composites, composite structures, etc., and other suitable sound-controlling materials known to those skilled in the art that provide different sound-controlling properties to help match the different acoustic characteristics of various sound systems and to provide variable, but optional listener-adjustable sound control options.

Note that some of these rigid, semirigid and flexible sound-controlling panel component materials are produced oriented in one direction, usually in the machine direction or the longer panel size direction, with higher bend resistance and more dimensional stability offered in the oriented direction. If using thinner gauges of oriented panels for the embodiment system, using vertically-oriented panels, for example, in the vertical oriented direction can provide more structural strength, with less weight and cost, and with less bend memory providing more spring-back to the original flat position after use for economy, lighter transport and a flatter storage profile.

Referring to FIGS. 32*a*-32*j*, an edge reinforcement system, such as illustrated on the open outer edges of the left end panel component "A" and the right end panel component "1" at the "e" marked locations can be attached to these two outer end panel components for added panel component stability as shown and detailed with embodiments presented herein.

Panel components can also be interconnected by a fastener system, for example a modular fastener system such as modular fastener system X and Y as shown with FIGS. 32*c* and 32*d*. Fastener system X and Y can be composed of a various connecting, fastening, and/or attachment devices, or application methods of various suitable types including a hook-loop fastener assembly thus creating a hook-loop flexible or pivotal hinge, explained earlier, that not only allows the interchangeable connection of two or more separate panel components, but also provides a user-adjustable flexible or pivotal hinged joint at those locations. This hook-loop flexible or pivotal hinge is also a method for adjusting the size of the final open enclosure simply by adding or subtracting the number of whole panel components in the system including by detaching individual panel components from one panel component location and reattaching them to a different panel component location. This method is shown and detailed in FIG. 20, for main sound controlling panels C, L, and B.

This flexible or pivotal hinge design also allows at least one of the panel components thus connected to pivot at least 180° at this pivoting hinge location while staying adjustably attached to the adjacent connected panel component. Fasteners X and Y can be comprised of a hook-loop fastener strip or pad attached to one panel component by such attachment application method as adhesives, rivets, sewing, or other fastening device or application method accessible to those skilled in the art. An opposite hook-loop fastener can be similarly attached to a connecting panel component at one or more mutually-interlocking locations such as illustrated in FIGS. 32*c* and 32*d*. User can then simply connect panel components together by utilizing the fastener strips such as hook fastener strip X to lineup with and attach to an opposite connecting fastener strip such as loop fastener strip Y attached the other panel component at a similar adjustable location. Speakers 1*a*L and 1*a*R can positioned and arranged as explained in FIGS. 1I through 6.

Note that similar hook-loop flexible hinges are also illustrated in FIG. 20 with corresponding hook-loop X locations at 21*h*, 21*i* and 14*e*, and corresponding hook-loop Y locations at 21*g*; also illustrated in FIG. 13 with corresponding hook-loop X locations at 14*e* and corresponding hook-loop Y locations at 15*a* and 15*b*, as well as detailed and illustrated elsewhere in this document. Instead of hook-loop flexible hinges as above described, a plurality of other panel component connection methods include using pressure sensitive adhesive (PSA) tapes such as fiber-reinforced PSA tapes, to connect two panel components along the panel component edges that abut other panel components, attaching pre-constructed flexible hinges such as Extruded Hinge with or without PSA adhesive such as item number 8202735401 or Clear Display Hinge item number 8209647001 from FFr Inc. of Cleveland Ohio. Additionally, other suitable panel component connecting application methods and devices can include attaching, connecting panel components by more permanent devices or application methods such as riveting or sewing-on male-female fastener attachment devices such as straps, decorative hooks, loops, slide and lock together fasteners, zippers, snaps, magnets, and other suitable panel component connection application methods and devices available to those skilled in the art.

Conventional speaker setup for the embodiment system is approximately the same where speakers, such as speakers 1*a*L and 1*a*R illustrated in FIGS. 1I-19 are placed at the open outer edge "e" locations shown at speaker locations 1*a*R and 1*a*L, FIGS. 32*i* and 32*j*. FIGS. 32*a*-32*j* are full perspective views of the embodiment system, facing the sound-controlling inside portion of a seven folded-up flat-oriented sheets of sound-controlling materials with a plurality of semi-rigid but flexible and adjustable parts. Even though 7 panel components are presented here, one or more panel components may be added or removed depending on the final size of the enclosure.

As illustrated, the embodiment system is an unfolding presentation that may not be illustrated according to relative scale whereby the center panel component A-1 maintains the same orientation to the viewer in all illustrations with the connected right panel components 1-3 and the connected left panel components A-C unfolding from the back of the center panel component A-1 to self develop into the open embodiment system surround sound enclosure. FIG. 32*a* starts out in the folded-up transport and storage position and quickly ends up in the fully-open position illustrated in FIGS. 32*i* and 32*j*, similar to the function and action of self-standing room dividers.

Note that the slight overlap in all of the panel components at the connection point of the panel components forms a resistance point as the entire structure is brought into the fully-open position as illustrated in FIGS. 32*i* and 32*j*, thereby flattening out the panel components and creating one large and extended panel component with nearly seamless edges at the connection points, while putting a tension in the entire structure as the panel components are swung around and placed into the final fully-open position. The entire structure can then be held into that open position by such devices or application methods as: a side-wing panel component support and positioning system that uses the modified end panel components such as end panel components "1" and/or "A"

that are designed similar to the side-wing panel component support and positioning system detailed and illustrated with FIGS. 30 and 31; by physically attaching the end panel components "1" and "A" to the speakers or speaker stands; by the use of part adjusting devices or panel component props such as part adjusting device 16*j*, which can be adaptively interchanged with self-supporting floor-weighted or connected vertical-positioned part adjustment or positioning pole structures, cross-part adjusting devices such as telescoping cross-part adjusting devices 16*f* as detailed and illustrated with FIG. 29 and in FIG. 32*j* of this embodiment system; by the use of an overhead, floor, or wall mounted connective support systems, including ceiling or wall mounted connecting, fastening, and/or attachment devices, or application methods of a suitable type utilizing connective devices such as hooks, rods, or wires, to cooperatively connect, including help hold into position, one or more embodiment system components; as well as a combination of these as well as other suitable part adjusting devices, and methods available to those skilled in the art. Additionally, the use of auxiliary devices explained with other embodiments, such as hook and loop positioning hangers, sound shapers, symmetrical part-alignment positioning systems, and other listener controllable acoustic devices, and panel component structures, can also be utilized with the embodiment system shown in FIG. 32 as illustrated and detailed with other embodiments within this document.

FIGS. 32*e* through 32*i* help detail, explain, and illustrate the function, materials, construction, methods of use, and a representative apparatus example of one of the structural options incorporated by embodiment system listening room structure. As detailed and illustrated, the series of five perspective views in FIGS. 32*e* through 32*i* show one of the progressive presently-revealed methods of assembly, and reversed disassembly, for the embodiment system that may not be illustrated according to relative scale and may include one or more elements that may be freely listener-adjustable, optional, and/or cooperatively-interconnected in ways other than those specifically detailed or illustrated, including elements that may be expandable or reducible in number, size, and shape. As with other portable embodiments, this acoustic structure follows the performance area detailed in FIGS. 1C and 1D. In one perspective view of the embodiment system, FIG. 32*i* shows a series of connectively-attached, adjustable-size, adjustable number, sound controlling panels that can be one continuous panel having an overhead rail and at least one attachment mechanism for securing the rail to the ceiling and the embodiment system to the rail, holding the wall of the embodiment system in a desired vertical and horizontal position. In another version FIG. 32*j* shows a perspective view of the embodiment system showing a series of connectively-attached, adjustable-size, adjustable number, sound controlling panels that can be one continuous panel having an floor rail and at least one attachment mechanism for securing the embodiment system to the rail, holding the wall of the embodiment system in a desired vertical and horizontal position.

Using FIGS. 32*e* through 32*i* as an illustration guide for the embodiment system, it is an rail, track, or glider acoustic embodiment system that may be permanently or adjustably-attached from overhead, from a nearby support structure such as a vertical room wall, from the floor, or a combination thereof made up of an expansive and substantially-extended assembly of complementary interconnected and listener adjustable indirect sound-controlling embodiment system components that make up the basic structure of this portable 2 to 4 minute setup time listening room assembly, including listener adjustable structural elements, symmetrical part-alignment positioning systems and other components to be explained herein.

FIGS. 32*e* through 32*i* show seven sound-controlling panel components that can be connectively attached to each other for the purpose of providing a convenient, low cost, environmentally-responsible ceiling, wall or floor mounted method and apparatus for improving reproduced stereo sound and for reproducing real three-dimensional holographic surround sound from a plurality of stereo audio sources, including two-channel stereo audio sources. The embodiment system can be employed in a wide range of applications, such as residential and institutional applications such as recreational and entertainment centers, nursing homes, extended living facilities, college dorms, hospitals, health clubs, music schools, commercial sound studios, military bases, rehabilitation centers, and the like where a fast, easy, consistent and full-proof method is needed for setting-up and putting-away a sound enhancing or surround sound audio reproduction system while also enabling the room to be utilized for other needed non-listening room purposes when the sound system is not in use.

The floor rail track system 6*y* shown in FIG. 32*j* is shown as a curved track system providing dimensional stability to the entire system in its curved form. As curve 6*z* in the track 6*y* is reduced to a more straight line, the system becomes more topple prone and less stable. Because the sound-controlling panel component or panel components are put into place and supported by a rail, track, or glider support system that also provides a fast, easy, full-proof and non-weight-oriented setup and put-away system, that can also suitably be automatized, where the setup or put-away does not involve or require the careful positioning or lifting of any main sound-controlling structure component or the upright support of that structure before, during and after use.

The rail, track, including glider system, which can be suitably made of an overhead 6*x* (shown in FIG. 32*i*), wall, including floor-based 6*y* (shown in FIG. 32*j*) glider, rail, or track system, hereafter referred to simply as a rail or track system, can be a rail or track such as those used to separate, partition, divide-up including close off and wall-off rooms such as meeting rooms, restaurant rooms, banquet rooms and the like, normally utilized at company offices, hotels, restaurants, etc. Instead of attaching a non-sound-controlling wall partition to the rail or track, however, as is normally arranged, one or more sound-controlling panel components, that can be connectively-associated with each other, which may or may not extend all the way to the floor or all the way from the ceiling, and which may have a vertical height of 1 m (3 feet) or more, are connected to the rail or track system, either directly or by a system of extension devices such as extension rods or cables 6*m*. The rail and/or track can also include simple rail devices such as low-cost window treatment or shower-curtain-like overhead rail systems, or more elaborate or built-into-the-ceiling or floor track and/or rail devices and systems including open slot-hole, pulley system, magnetic and automated track and/or rail systems.

If an environmentally-responsible dimensionally-stable sound-controlling material is utilized to fabricate sound-controlling flexible walls for the embodiment system that is recyclable, 100% biodegradable and responsibly-manufactured, it is presently contemplated that this embodiment system employ, at least optionally, a recyclable plastic such as a 20-40 mil recyclable polycarbonate, acrylonitrile butadiene styrene or rigid polyvinyl chloride specular sound-controlling panel material manufactured from companies due to their rigid yet flexible dimensionally-stable construction; their sound-controlling properties, their availability in long continuous lengths; their ability to be semi rolled-up if needed; their optional transparent, translucent, and opaque availability; their printability and their environmentally conscious composition.

However, the embodiment system can also be produced from one or more other recyclable dimensionally-stable rigid yet flexible sound-controlling materials described with this and other embodiments such as high density polyethylene, polyethylene terephthalate or acrylic substrates. Additionally, because there is no weight restriction with many track or rail systems, the embodiment system can be fabricated with different materials to provide different or variable sound-controlling properties for variable acoustic performance options at the same location simply by switching panels materials or tracks, such as aluminum panel materials; thermoformed plastics or composites; glass including safety glass, fiberglass and glass-reinforced plastic panels; wood-based materials, including composites and combinations thereof; hinged or non-hinged paper, plastic, foil etc. covered or coated screen or mesh panels or a combination thereof; light and visual projection-surfaced composite materials used to reflect projected visual images as well as localized surround sound back to the listener along with arrangements of flat screen visual displays including integrated arrangements of newer high-performance high-definition and widescreen television broadcast visual displays, video game displays or projection monitors that essentially surround the listener simultaneously with both visual-related information and acoustic-related surround sound information, as well as flexibly-cut corrugated materials including recycled coated corrugated paperboard such as an environmentally-sustainable dimensionally-rigid Enviro-Corr 0.3 cm (0.125 inch) tri-wall double-flute corrugated paper board panel made from 100% recycled paper products detailed with other embodiments in this document.

One or more embodiment system panel components can be joined together if needed with flexible joints explained elsewhere in this document, or left as one continuous length of sound-controlling paneling. Holes only need to be fabricated through the top part of the panel or panels approximately every 30 cm (12 inches) or so to connect the panel or panels to the rail or track system or to an auxiliary extension device such as extension rods or cables. Like rail or track systems which need to be securely attached to a plurality of different structural ceiling or floor arrangements, it is presently contemplated that the embodiment system rail or track system also be capable of being attached, at least semi-permanently, to or built into, an existing structural device such as a pre-existing ceiling, wall, or floor structure with the track or rail system and configured into a sound-controlling shape to match one of the pretested symmetrical quick-reference positioning symbols illustrated on FIG. 3. Smaller enclosures illustrated on FIG. 3 can utilize a thinner, more flexible, less expensive sound-controlling panel material, such as above-mentioned 20 mil sound-controlling surface panel material or sound-controlling materials with a lower coefficient of sound reflection. Conversely, it is contemplated that larger sound-controlling enclosures, such as the larger sizes illustrated on FIG. 3, can utilize a heavier, stiffer, sound-controlling panel material or materials, such as a 50 or 60 mil sound-controlling panel material, with a higher coefficient of sound reflection. For appropriate storage, one or more component parts, including the entire rail or track panel system, can be stored inside of an existing, or specially constructed, wall structure, stored adjacent to, or behind, a wall, or be utilized as a room devider or wall structure itself at one or more locations when not in use as a sound reproduction embodiment system.

A pair of properly-placed stereo speakers, an electronic support system providing the signals to these speakers, and an optional visual device are fundamentally the only additional components needed to provide the listener with a high-performance three-dimensional holographic sound enhancing or surround sound system. The speakers themselves, especially for an institutional environment, need not be large or excessively expensive and can be permanently or temporarily wall-mounted or otherwise structurally or mechanically attached to, placed within, or combined with a room structure including movable partitions, secondary doors, ceiling structures and/or other suitable room assemblies.

A fairly simple setup and put-away operation entails only that an operator pull, push or otherwise mechanically or electronically move the panel component or panel components connected to the track or rail system from their storage location, following the track or rail system, to position the sound-controlling panel components into their sound-controlling enclosure position whereby standing, sitting, reclining or lying listener(s) may avail themselves of the wrap around sound-controlling enclosure design such as illustrated and FIGS. 32*i* and 32*j* as well as FIG. 19. The embodiment system may also employ the full or partial use of sound shapers 14*d*, their connecting fasteners, positioning devices and other sound adjusting devices described with many embodiments in this document. Since the panel components are supported and fixed into a pre-set position dictated by the track or rail system, gravity and the weight of the panel components alone will substantially help stabilize the panel component walls into a natural vertical position. One or more other auxiliary components and other associated acoustic devices detailed with other embodiments herein may also be utilized and incorporated with the embodiment system including symmetrical part-alignment positioning systems, integrated visual displays to provide visual information, including integrated or nearby optional and/or modular sound diffusing, sound absorbing, sound barrier, or sound deflecting panel component structures, to help provide adjustable variable sound control for the listener and other nearby non-listeners.

After use, the panel component or panel components can be left in place or, with a two-minute operation, simply retracted back to their storage position such as by a manual or an electrical application method.

Alternative Embodiment System

FIGS. 33 and 34 show perspective views of embodiment system listening room structures, to help detail, explain and illustrate the function, materials, construction, methods of use, and a representative apparatus example of one of the structural options. The purpose of both embodiments is to provide a multitude of standardized prefabricated options, including standardized prefabricated embodiment system size options, and standardized connection options, to allow simplified-duplication, inexpensive, and environmentally-conscious lean production of interchangeable component parts of, or complete, embodiments, or a combination thereof, including turn-key embodiments, and operations for the commercial, professional, and consumer audio, and audio-visual, markets.

FIG. 33 shows a perspective view of an adjustable-size, interior, or exterior embodiment system that can be a dedicated listening room or combined audio-visual room, with or without a built-in sitting device, and with or without an audio-visual device. FIG. 34 shows a perspective view of an adjustable-size, interior or exterior, embodiment system that can be a dedicated listening or combined audio-visual room, with handicap access, that can be a series of separate or connected units, with or without a built-in sitting device, with or without an audio-visual device, and showing a built-in specialized tweeter-in-woofer speaker system. As with portable embodiments, these embodiments follow the performance area detailed in FIGS. 1C and 1D. The perspective views shown in FIGS. 33 and 34 may not be illustrated according to relative scale and may include one or more elements that may be freely listener-adjustable, optional, and/or cooperatively-interconnected in ways other than those specifically detailed or illustrated, including elements that may be expandable or reducible in number, size, and shape. FIGS. 33 and 34 show an expansive and substantially-extended assembly of complementary interconnected and listener adjustable indirect sound-controlling embodiment system components that make up the basic structure of this more permanent type of embodiment system listening room assembly, including symmetrical part-alignment positioning systems, sound shapers, and other components to be explained herein.

As substantially detailed elsewhere in this document, the basic size and shape of embodiments including both embodiments presented here may be based on one or more pre-positioned and pre-tested quick-reference positioning symbols including those on the floor positioned type of standardized symmetrical part-alignment positioning system 3*a* illustrated on FIG. 3 which includes the quick-reference positioning symbol 3*c* as illustrated in FIGS. 33 and 34.

Standardized structural wall shapes, sizes, and positions for these embodiments include a multiplicity of other pre-tested larger, including substantially larger, and smaller wall alignment positions, including embodiment system floor and ceiling alignment positions, that substantially align themselves between the outside portion of the speakers and substantially extend themselves at least to the sides of the listener, that can extend to include the back of the listener, thereby providing substantial capture, substantial control and optional listener-adjustable utilization of significant portions and substantial quantities of normally damaging and wasted but acoustically-valuable progressively time-line-encoded indirect sound energy emitted from the speakers whereby individual sounds are exponentially-enhanced and can be symmetrically-delivered directly to the listener's ears from a plurality of symmetrically-balanced localized progressively time-line-delayed horizontal and vertical locations, directions and angles from all along the large continuously-extended suitably precision-shaped sound-controlling surfaces of the embodiments that capture and form these individual localized sounds and their surrounding acoustic energy pressure reverberations into a substantially-whole physically-real three-dimensional holographic surround sound field that is capable of substantially-enveloping the listener in a very intimate way, complete with original individually-localized progressively time-line-delayed surround sounds including those sounds surrounding the listener that are substantially re-assembled from the originally-encoded surround sound field as it was originally encoded by the original artists, original performers and the original sound engineers.

That is, substantially-appropriate high-performance symmetrical wall positions for the embodiments can include those derived from one or more pre-positioned and pre-tested quick-reference positioning symbols located on pre-tested standardized symmetrical-part-alignment positioning systems such as the floor template type of symmetrical part-alignment positioning system 3*a* in FIG. 3 with the above-mentioned considerations and can also include substantially expanded wall positions such as those modified by benchmark reference to quick-reference positioning symbols such as quick-reference positioning symbols on pre-tested symmetrical part-alignment positioning systems including those illustrated on FIG. 3 with the above-mentioned considerations and with reference to the substantial synergistic performance provided by symmetrical embodiments including soundboards.

Although large, more permanent, full-room-size embodiments can be composed of acoustic components made from a variety of suitable sound-controlling materials, including a variety of high-performance specialized sound-controlling materials, for example, metals such as sheet aluminum, glass such as tempered safety glass, and smooth moulded plastic such as interlocking smooth plastic panels, etc., it is presently contemplated that a basic permanent full-room-size embodiment system be made from, in addition to those sound-controlling materials detailed below, less expensive, but suitable sound-controlling materials, manufactured, if in accordance with local building regulations, with typical room construction materials for walls, floor and ceiling, for example, 2 cm (0.75 inch) drywall walls and ceiling coated before or after installation with a smooth, hard, suitable sound-controlling coating material such as gloss paint, with non-covered hardwood floors. Curved portions of sound-controlling sidewalls, as shown in embodiment system illustrations, prior to installation, can be made with 2 cm (0.75 inch) drywall that has first been straight-line vertical score cut on the back non sound-controlling side of the drywall panels, approximately every 61 cm (2 inch) apart, with the drywall panels bent at the score lines, then attached onto pre-installed studs in a manner to form curved sidewall portions which can be plaster coated into a smooth inner sound reflective surface. Conversely, pre-formed sound reflective panels can be assembled onto the inner sidewalls and connected ceiling of the acoustic structure.

FIG. 33 shows a progressive view of an embodiment system taken from the right front side of exterior "b" which can be constructed as an interior or exterior dedicated listening room with optional surrounding-room sound proofing capabilities built near to or into the structure itself. If low-impact, environmentally-responsible recyclable sound-controlling materials can be utilized, walls, whether permanent, fixed, or movable, can be manufactured from hard, smooth, semi flexible, recyclable sound-controlling materials, for example, recyclable 30 to 60 gauge clear through opaque, or a combination thereof, plastic sheeting material, as detailed below.

If an exterior outdoor-located dedicated listening room is utilized for embodiments that are exposed to outdoor elements, the exterior layer and the support composition of the structure can be fabricated, if in accordance with local building regulations, from a variety of suitable construction materials. Therefore, it is presently contemplated that the exterior building material "b" of this embodiment system be constructed from a modular exoskeleton, such as a modular reinforced thermoformed plastic including a modular thermoformed plastic exoskeleton, or, as a more custom-built option, constructed from a curved wood support structure such as a sustainable bamboo that can be over-layered with recyclable plastic sheet or-coated walls with or without a protective outer covering, such as stucco covered wire mesh, fiberglass, plastic composites including spray plastic coatings, which may need to be over layered with a suitable weatherproofing material such as an second outer shell, waterproof outdoor coatings including weather-resistant paint, shingles or other suitable weatherproofing material known to those skilled in the art.

For the interior of the wall portion, the wall structures that can be of a single or multilayered construction, it is presently contemplated that a sound absorbent material be utilized within the walls, such as sound absorbing or sound deadening foam, fiberglass or other appropriate sound absorbing or sound deadening material. For the inside face side of one or more portions of the interior room walls that can also be of a single or multilayered construction, because the sound-controlling portion of the interior wall surface only needs a hard smooth specular sound-controlling material, it is presently contemplated that a smooth specular sound-controlling material be used that can be manufactured from a mass-produced or modular-manufactured smooth thermo-formed interlocking plastic sound-controlling panels. However, the interior room walls can be suitably manufactured with, or interchanged with, smooth sound-controlling smooth tiles including porcelain tiles, sheets of sound-controlling plastic such as 20 to 60 gauge, clear through opaque plastic sheeting material, or a combination thereof, such as poly carbonate sheeting, which can be reinforced at vertical edges, and which can be suitably-installed selectively at the curved wall locations illustrated with embodiments herein, or alternatively at all sound-controlling wall locations. Also, other suitable sound-controlling materials can be appropriately used on the interior sound-controlling walls of these embodiments, including aircraft and recreation vehicle aluminum, high-density polyethylene terephthalate, spray or traditionally applied coatings including high gloss paint coatings, liquid plastics, and other sound-controlling materials listed with other presented embodiments, and known by those suitably skilled in the art.

Other alternate material and modular fabrication choices, for portions of the exterior-facing or interior-facing walls or for most of the structure itself, include mass-produced and modular-integrated smooth thermo-formed interlocking recycled plastic sound-controlling panels, recycled reinforced polymeric sheets and reinforced concrete including newer easily-shaped thin (as thin as 10 mm-16 mm) highly stable weather-resistant fibre-reinforced concrete formed into pre-manufactured mass-produced modular pieces that can be site assembled and that can include a smooth sound-controlling surface. Smooth sound-controlling interior walls may also be fabricated with a number of smooth, hard and durable sound-controlling materials, for example, recycled hard plastic, combined wood lath overlaid with smooth plaster or plaster sound-controlling interior walls.

As mentioned, many other construction materials may also be used for wall portions or the complete structure itself including common construction materials such as recycled plastic sheeting, poured concrete, reinforced concrete, wood, wood laminates, composites, steel, aluminum and uncommon construction materials including transparent, translucent or opaque 20 to 60 gauge clear through opaque, or a combination thereof, recyclable high density polyethylene, polyethylene terephthalate, acrylic, acrylonitrile butadiene styrene, rigid polyvinyl chloride, thermoformed plastics, glass including safety glass, fiberglass and glass-reinforced plastics such as glass-filled nylon, composites including carbon fiber composites, rigid plastic composites, virgin or recycled coated paperboard, corrugated plastic, waterproof recycled paper, reinforced coated cardboard, corrugated plastic sheets, thermoset plastics and other suitable material options known to those skilled in the art. Depending on whether the listening room is needed as an exterior or interior room, above materials can also be used for portions of the support structure of the room including to be also used to cover one or more portions of the interior sound-controlling wall surface.

One or more interior walls of a combined audio-visual embodiment system can also include high performance light reflective surface coatings that reflect both visual information projected onto it back to the audio-visual user, as well as substantially-reflect audio surround sound information back to the listener. Additionally, for ultra-high-performance combined audio-visual systems, embodiment system interior wall surfaces can be comprised of one or more suitably-arranged substantially-extended embodiment system surfaces comprised of one or more large, or an integrated conglomerate of, flat or curved screen visual display units such as newer high-definition and widescreen television broadcast visual displays, video game display devices or various-sized projection monitors that can be suitably-curved into or onto walls and wall positions such as detailed above. Suitable wall positions include those wall positions that can be derived from embodiments' symmetrical part-alignment positioning (SPAPS) template systems such as the embodiment system SPAPS's floor template system 3*a* illustrated in FIG. 3 with the above-mentioned considerations, and where the surface(s) of such walls and wall positions are simultaneously-capable of not only reflection projecting high-definition surrounding visual information directly to the listener but also fully capable of reflection projecting high performance three-dimensional symmetrical audio surround sound information to the listener from the same surface, for example from the same glass surface of the visual display that is substantially-surrounding the listener.

Stereo speakers A-R and A-L illustrated in FIGS. 33 and 34 can be similar to other speakers and speaker positions illustrated in figures from other embodiments throughout this document and the acoustic-related functions of this position are explained elsewhere with other embodiments herein. Even though the speakers used for any embodiment system presented herein can be of any type of speaker, the difference between the illustrated speakers in this embodiment system versus the illustrated speakers for the other embodiment system is that it illustrates speakers in FIG. 33, whereas the other embodiment system illustrates a more specialty type of speaker in FIG. 34 which can be comprised of a combination speaker tweeter driver and speaker midrange driver being physically combined and located within one physically-combined driver unit.

The embodiments also generally follow the other embodiment system acoustic relationships presented herein by providing an approximate equal relationship between speaker tweeter height above the floor and the approximate height above the floor for the ears of the listener, as explained elsewhere in this document. The embodiments can also employ one or more associated sound control components utilized and better detailed or illustrated with other embodiments such as sound shapers including sound shaper 14*c* illustrated in FIG. 33 and sound shapers "e" and "p" illustrated in FIG. 34, adjustable positioning hangers such as positioning hanger 15*b*, part adjusting devices including part adjusting device 16*k*, etc. Also one or more components not specifically illustrated or detailed with other embodiments can be employed such as wheels to allow the structure to become movable or portable by manual, electronic or other suitable application device or method of mobility; associated devices including symmetrical part-alignment positioning systems; wall attached devices such as a permanent wall-attached positioning hanger attachment device "o"; and embodiment system doors such as doors dR and dL shown in both FIGS. 33 and 34 which, along with the other associated components may or may not include or be overlaid with a soundproofing, sound absorbing or sound deadening material.

Soundproofing, sound absorbing, or sound deadening material can also be positioned at non first-surface sound-controlling locations explained elsewhere in this document for example to help avoid acoustic damaging second and third reflections from occurring within the structure, to help the listener better localize surround sounds, to help eliminate stereo speaker crosstalk including to help suppress embodiment system sound from leaking outside of the structure and becoming intrusive nuisance noise to other nearby non-listeners, as explained elsewhere in this document, as well as other suitable associated components known to those skilled in the art that are not specifically illustrated or detailed with the embodiments.

FIG. 34 shows an embodiment system enclosure in which can be constructed as an interior or exterior dedicated listening room, which can be fabricated with the same construction materials, such as construction materials "f", and which can be fabricated in multiple numbered arrangements such as facing units or two to ten units, for example, attached together to create larger structures or positioned along the walls, in a circular pattern or side-by-side within one or more entertainment, recreational including therapeutically-oriented facilities including consumer home-theater and video-game rooms.

FIG. 34 shows the embodiment system as a bubble type of acoustic containment enclosure whereby, except for sound absorbed by the optional sound absorbing or sound deadening door surfaces and the use of sound shapers such as flexible sound shapers "e", the entire specular sound-controlling smooth interior of the structure itself is an oval shaped concentrating sound-controlling enclosure that symmetrically-captures virtually all of the indirect sound energy from the speakers, optionally progressive time-line combines it with the direct sound from the speakers, and synergistically shapes the total combined speaker energy into a centrally-focused accompanying emotionally-impactful surround sound sensory component substantially directed at the listener with maximum sound energy hyper-focused toward listener's location, especially toward the listener's general head location including the listener's right side "g" and the listener's left side "q" from a plurality of integrated simultaneous progressively time-lined angles and directions at once, which is well-explained elsewhere.

These embodiments utilize many of the substantial embodiment system provided acoustic problem solving solutions and signature advantages, in order to provide the listener with a much closer acoustic connection to the original three-dimensional acoustic presentation including the ability to hear realistically-natural, optionally-adjustable, pin-point-localized surround sounds and a three-dimensional high-performance holographic surround sound field. This can also include pinpoint individual stable localization of the sound fields' original sounds surrounding the original microphone position and encoded into the original signals by the original sound engineers, including horizontal localization and relevant vertical and trajectory localization of sounds, such as the simultaneous reproduction of localized surrounding voice sounds, musical instrument sounds, audience and crowd sounds, natural environmental sounds, etc. that may have been originally encoded within the original sound field. Each individual reproduced sound may be reproduced to be heard clearly, independently-localized in its own separate location around the listener, and retaining the sound's original real-life natural relative amplitude, progressive time-delay, and harmonics, to other encoded sounds, as naturally heard by a listener located within a real life surrounding sound field. Individual sounds heard by the listener may be reproduced in a similar horizontal position around the listener to those recorded by original recording microphones placed within the original sound event, including as encoded by the original sound engineers. The listener can then perceive the surrounding sound field as a whole, interconnected, and complete surrounding sound field that surrounds and envelops the listener from a plurality of individual macro, and micro coordinated hyper-synchronized acoustic energy sources similar to the locations of sounds within the original sound event, thus providing the listener with an exponentially-enhanced listening experience.

Utilizing the speakers' maximum combined direct and indirect sound energy, such as explained throughout this document also advantageously allows a lower overall system amplitude level without reducing the sound amplitude level to the listener while simultaneously providing a lower sound proofing requirement for the structure to thereby reduce exterior noise levels, while providing the listener with substantially-enhanced overall stereo audio sound and a believably-real three-dimensional full-sphere holographic surround sound experience. In addition, this can be accomplished, when compared directly to the energy usage normally required by electronically-produced surround sound, at a reduced overall energy consumption level.

In addition to recreational and entertainment-oriented applications, including high-performance stereophonic audio music applications, audio-visual applications, video game applications, and the like, FIG. 34 illustrates a listener in a wheelchair device to provide additional applications for the complementary utilization of the presented embodiments, their therapeutic stimuli, and application method. These include music therapy, stress reduction, controlled relaxation, meditation, and other therapeutic health and wellness applications such as nursing home applications, assisted living residence applications, mental health applications, substance abuse treatment centers, hospice applications, disability treatment applications, institutional applications, military outpost applications, recovery room applications, and the like.

Note that the listening device, for example listener sitting device such as wheelchair device "h" in FIG. 34 can also be replaced in one or more embodiments presented in this document by either an empty space or an adjustable or permanently-fixed, for example, standing, leaning, sitting, reclining or lying device including an adjustable listener sitting device that can provide restricted positional movements or adjustments to help automatically symmetrically center-align the listener and keep the listener symmetrical and center-aligned during the session, such as floor positioned track that has been aligned with a symmetrical centerline such as symmetrical centerline 3*g* in FIG. 34 thereby providing a fixed non-movement left and a fixed non-movement right restriction for the listener but permit non-restricted forward and backward listener movements including positional adjustments along a symmetrical centerline such as symmetrical centerline 3*g*. The sitting, standing, reclining or lying device, in addition to being usable by persons with restricted abilities, can be made adjustable to accommodate multiple listener body-sizes such as height and weight adjustable, and to accommodate different numbers and positions of persons.

Furthermore, the placement of embodiment system components around the embodiment system can be altered or radically moved to suit the listener, for component standardization purposes or, for example, to adapt to a variety of practical application needs. For example, both the speakers and the listener positions can be reversed completely around 180° within embodiments than as illustrated in FIGS. 33 and 34, whereby, instead of the speakers being located near to the front entrance door end of the embodiments' structure, as they are currently shown in FIGS. 33 and 34, they may instead be reversed and positioned toward the back end of the acoustic enclosure thereby directing their acoustic energy toward the enclosure's front open entrance rather than directing it toward the back end of the enclosures.

With this type of speaker arrangement, instead of a center-located listener facing the front open end of the embodiment system enclosure as now illustrated, the center-located-listener would then also be reversed 180° inside of the enclosure to face the back end of the enclosure and the speakers which have been substantially repositioned and which now are position-located at the back end of the acoustic enclosure. This example of a reversed speaker location to the back end of the enclosure provides an example of the practical advantage of allowing a visual display, such as a 60" high-definition visual display, if a display is added to the embodiment system, to be simultaneously more permanently, more securely and more safely positioned out of harm's way at the back end of the enclosure rather than being positioned much more in harm's way on the front door(s) of the enclosure or near to the front positioned speakers or front entrance of the enclosure, therefore minimizing the chance of the visual display being disturbed by contact with listeners, for example, as they enter and leave through the front entranceway The shape of the oval rounded walls, which can be seamlessly interconnected with the ceiling, is precision-shaped to aggressively-capture the maximum amount of indirect sound energy uniformly propagating outwardly and away from the left and the right stereo speakers and precision reflects this cohesive integrated indirect acoustic energy off from the uniformly-extended sound-controlling surface as the sound waves bloom, develop and expand outwardly from the original speaker driver propagation point in order to maximize the mutually-synergistic acoustic efficiency of the whole working-together combination. By substantially precision-capturing and controlling a substantial portion of this developing indirect sound wave energy by large cohesive mathematically-precise continuous progressively time-line-oriented acoustic reflection along a substantially extended sound-controlling surface, the progressively time-delayed array of original sounds encoded within the original stereo signals being reproduced and emitted by the speakers is forced to become maximally-integrated together and to precision time-line shape itself from a plurality of seamlessly-connected precision-coordinated reflected angles and directions thereby to be simultaneously progressively time-line focused toward the listener's location in a substantially cohesive progressively time-line organized pattern where the listener's brain instantly converts and continuously reconstructs these progressively time-line reflected surround sounds into a dynamic substantially-whole, realistically-natural, listener-oriented progressively time-line and progressively time-delayed reconstructed three-dimensional holographic surround sound field for the enjoyment, therapy and acoustic satisfaction of the listener.

It should now be clearly understood that the addition of the acoustic teachings, presently-revealed method of application, and associated apparatuses of the presented embodiments which have been essentially non-obvious to the stereophonic sound reproduction industry for over 80 years since its inception thereby advantageously permit the capture and reproduction of sounds precision directed toward and around the listener's position of a significantly similar horizontal and vertical surround sound field composition and sound picture as presented toward the recording microphones by the original surround sound field including as the original surround sound field was originally encoded into the original signals by the original creators and sound engineers, which therefore, can be and should be defined as the successful simple, inexpensive, quick, energy efficient, and listener interactant completion of stereophonic sound reproduction for the listener.

The invention claimed is:

1. A system for enhancing sound provided by a pair of speakers relative to a listener, comprising:

a support structure;

a first panel defining a first portion of an oblong enclosure that forms an approximated double ellipse profile, comprising a material having a sound reflective surface, held upright relative to the ground and the listener by the support structure, and extending between a first area proximate a first speaker and a second area proximate the listener, wherein the first portion of the oblong enclosure forms a first part of the approximated double ellipse profile, and wherein the oblong enclosure is elongated and has a width that is longer than a length thereof; and a second panel defining a second portion of the oblong enclosure that forms the approximated double ellipse profile, comprising a material having a sound reflective surface, held upright relative to the ground and the listener by the support structure, and extending between a third area proximate a second speaker and a fourth area proximate the listener, wherein the second portion of the oblong enclosure forms a second part of the approximated double ellipse profile, and wherein the first panel and the second panel are symmetrically arranged about a plane with which the length of the oblong enclosure is aligned, wherein the first panel and the second panel are shaped such that sound waves emitted laterally from the first speaker and the second speaker are reflected and focused toward the listener to convert one or more sound signals into three-dimensional surround sound without electronically manipulating the sound signals and while reflectively reducing the effect of crosstalk.

2. The system of claim 1, wherein the first panel and the second panel are substantially symmetrical in shape and position.

3. The system of claim 1, wherein the sound reflective surface of the first panel substantially prevents sound waves emitted laterally from the first speaker from hitting a side wall of the surrounding room preventing those sound waves from creating out-of-sync room reflections at the listener location.

4. The system of claim 1, wherein the first panel and the second panel are at least one of shaped, sized, and positioned to reduce the effect of crosstalk observed at the listener location.

5. The system of claim 1, wherein the sound reflective surfaces of the first panel and the second panel are substantially specular, and wherein the first panel and the second panel are positioned to provide spatially localized three-dimensional surround sound to the listener location from two-channel output provided by two stereo speakers.

6. The system of claim 1, wherein the first panel is curved to reflect sound waves emitted at a plurality of different lateral angles relative to a sound axis of the first speaker;

wherein the curvature of the first panel directs a plurality of captured sound waves to the listener via the reflection;

wherein the second panel is curved to reflect sound waves emitted at a plurality of different lateral angles relative to a sound axis of the second speaker;

wherein the curvature of the second panel directs a plurality of captured sound waves to the listener via the reflection.

7. The system of claim 6, wherein the reflections from the first panel and the second panel cause sound waves from stereo speakers normally directed away from the listener to be directed toward the listener and observable as spatially localized three-dimensional surround sound.

8. The system of claim 1, wherein the first panel and the second panel are integrally formed and define a single unitary body.

9. The system of claim 1, wherein the first panel and the second panel are joined behind the listener's position such that waves are reflected to the listener from behind the listener.

10. The system of claim 1, wherein the first panel extends vertically from a distance at least 0.2 meters below a tweeter height of the pair of speakers to a distance at least 0.2 meters above the tweeter height of the pair of speakers;

wherein the second panel extends vertically from a distance at least 0.2 meters below the tweeter height of the pair of speakers to a distance at least 0.2 meters above the tweeter height of the pair of speakers;

wherein the system further comprises:

a first sound shaper panel that extends substantially horizontally from a surface of the first panel, the first sound shaper panel positioned to reflect directional or spatial localizing sound frequencies toward the listener that were emitted at vertically offset angles from a tweeter axis of the first speaker;

a second sound shaper panel that extends substantially horizontally from a surface of the second panel, the second sound shaper panel positioned to reflect sound waves toward the listener that were emitted at vertically offset angles from the tweeter axis of the second speaker.

11. The system of claim 10, wherein the support structure comprises at least one pole that holds the first panel relative to the second panel.

12. The system of claim 1, further comprising symbols symmetrically disposed onto the sound reflective surfaces of the first panel and the second panel.

13. A kit, comprising:

a support structure;

a first panel defining a first portion of an oblong enclosure that forms an approximated double ellipse profile, comprising a material having a sound reflective surface, configured to be disposed upright relative to a ground and a listener by the support structure, and configured to extend between a first area proximate a first speaker and a second area proximate the listener, wherein the first portion of the oblong enclosure forms a first part of the approximated double ellipse profile, and wherein the oblong enclosure is elongated and has a width that is longer than a length thereof; and a second panel defining a second portion of the oblong enclosure that forms the approximated double ellipse profile, comprising a material having a sound reflective surface, configured to be disposed upright relative to the ground and the listener by the support structure, and configured to extend between a third area proximate a second speaker and a fourth area proximate the listener, wherein the second portion of the oblong enclosure forms a second part of the approximated double ellipse profile, and wherein the first panel and the second panel are configured to be symmetrically arranged about a plane with which the length of the oblong enclosure is aligned, wherein the first panel and the second panel are configured to be shaped such that sound waves emitted laterally from the first speaker and the second speaker are reflected and focused toward the listener to convert one or more sound signals into three-dimensional surround sound without electronically manipulating the sound signals and while reflectively reducing the effect of crosstalk.

14. The kit of claim 13, wherein the support structure is configured to hold the first panel and the second panel to reduce the effect of crosstalk observed at the listener between the first speaker and the second speaker.

15. The kit of claim 13, further comprising at least one of a sound shaper, an acoustic extender, and an acoustic skin, wherein the first panel and the second panel include a positioning symbol configured to facilitate positioning at least one of the sound shaper, the acoustic extender, and the acoustic skin relative to the first panel and the second panel.

16. The kit of claim 13, further comprising a template having a first side and an opposing second side configured to be disposed along the ground.

17. The kit of claim 16, further comprising a speaker positioning system disposed along the first side of the template, wherein the speaker positioning system includes an array of symbols that correspond to a plurality of speaker locations.

18. The kit of claim 17, further comprising a panel positioning system disposed along the first side of the template, wherein the panel positioning system includes a plurality of lines that define a plurality of positions for the first panel and the second panel.

19. An audio system, comprising:

a first speaker and a second speaker;

a first panel defining a first portion of an oblong enclosure that forms an approximated double ellipse profile, comprising a material having a sound reflective surface, and having a distal end positioned at the first speaker and a proximal end positioned proximate a listener, wherein the first portion of the oblong enclosure forms a first part of the approximated double ellipse profile, and wherein the oblong enclosure is elongated and has a width that is longer than a length thereof;

a second panel defining a second portion of the oblong enclosure that forms the approximated double ellipse profile, comprising a material having a sound reflective surface, and having a distal end positioned at the second speaker and a proximal end coupled to the proximal end of the first panel, wherein the second portion of the oblong enclosure forms a second part of the approximated double ellipse profile, and wherein the first panel and the second panel are symmetrically arranged about a plane with which the length of the oblong enclosure is aligned; and a support structure configured to hold the first panel and the second panel upright relative to the ground and the listener, wherein the first panel and the second panel define a listening area and are shaped such that sound waves emitted laterally from the first speaker and the second speaker are reflected and focused toward the listening area to convert one or more sound signals into three-dimensional surround sound without electronically manipulating the sound signals and while reflectively reducing the effect of crosstalk.

20. The audio system of claim 19, wherein the first panel is curved to reflect sound waves emitted at a plurality of different lateral angles relative to a sound axis of the first speaker;

wherein the curvature of the first panel directs a plurality of captured sound waves to the listener via the reflection;

wherein the second panel is curved to reflect sound waves emitted at a plurality of different lateral angles relative to a sound axis of the second speaker;

wherein the curvature of the second panel directs a plurality of captured sound waves to the listener via the reflection.

* * * * *